US005983863A

United States Patent [19]

Cavanagh et al.

[11] Patent Number: 5,983,863

[45] Date of Patent: Nov. 16, 1999

[54] COMPACT HIGH PERFORMANCE FUEL SYSTEM WITH ACCUMULATOR

[75] Inventors: Mark S. Cavanagh; Bryan W. Swank, both of Columbus; Arpad M. Pataki, Elizabethtown; Bela Doszpoly; John D. Lane, both of Columbus, all of Ind.; Kent V. Shields, Plymouth, Minn.; Richard D. Kraus, Columbus, Ind.; W. Beale Delano, Columbus, Ind.; Julius P. Perr, Columbus, Ind.; Jy-Jen Frank Sah, Columbus, Ind.; Alexander Guluk, El Paso, Tex.; Lester L. Peters, Columbus, Ind.

[73] Assignee: Cummins Engine Company, Inc., Columbus, Ind.

[21] Appl. No.: 08/362,449

[22] PCT Filed: May 6, 1994

[86] PCT No.: PCT/US94/05108

§ 371 Date: Jun. 16, 1995

§ 102(e) Date: Jun. 16, 1995

[87] PCT Pub. No.: WO94/27041

PCT Pub. Date: Nov. 24, 1994

Related U.S. Application Data

[63] Continuation-in-part of application No. 08/057,489, May 6, 1993, abandoned, and application No. 08/117,697, Sep. 8, 1993, Pat. No. 5,353,766.

[51] Int. Cl.[6] ..... F02M 37/04

[52] U.S. Cl. ..... 123/447; 123/456

[58] Field of Search ..... 123/447, 446, 123/456, 508, 509, 506, 467

[56] References Cited

U.S. PATENT DOCUMENTS

| | | |
|---|---|---|
| 2,027,360 | 1/1936 | Alden . |
| 2,146,184 | 2/1939 | High . |

(List continued on next page.)

FOREIGN PATENT DOCUMENTS

| | | | |
|---|---|---|---|
| 0517991 | 12/1992 | European Pat. Off. . | |
| 1389267 | 1/1965 | France . | |
| 439919 | 12/1935 | Germany | 123/496 |
| 3618447 | 12/1987 | Germany . | |
| 05768532 | 4/1982 | Japan . | |
| 59-49365 | 3/1984 | Japan . | |
| 60-132037 | 7/1985 | Japan . | |
| 62-265461 | 11/1987 | Japan . | |
| 2-112643 | 4/1990 | Japan . | |
| 05180117 | 7/1993 | Japan . | |

OTHER PUBLICATIONS

SAE Technical Paper Series No. 911819 Entitled Electronically Controlled High Pressure Unit Injector System for Diesel Engines, Pierre Lauvin, Alf Löffler, Alfred Schmitt, Werner Zimmerman and Walter Fuchs.

SAE Technical Paper No. 910252 Entitled Development of New Electronically Controlled Fuel Injection System ECD–U2 for Diesel Engines, Masahiko Miyaki, Hideya Fujisawa, Yoshihisa Yamamoto.

PLD Fuel System by Bosch, (single sheet) Fig. 41, attachment 2.

Patent Abstracts of Japan, vol. 7, No. 9, Japanese Publication No. JP57168051, Oct. 16, 1982.

*Primary Examiner*—Carl S. Miller

*Attorney, Agent, or Firm*—Sixbey, Friedman, Leedom & Ferguson; Charles M. Leedom, Jr.; Tim L. Brackett, Jr.

[57] ABSTRACT

A unitized fuel supply assembly is disclosed including an in-line reciprocating cam driven pump (14) for supplying fuel to an accumulator (12) from which fuel is directed to a plurality of engine cylinders by means of a distributor (16) mounted on the unitized assembly. Dual pump control valves (20) provide fail safe electronic control over the effective pump displacement. One or more injection control valves mounted on the distributor are provided to control injection timing and quantity. The accumulator (12) contains a labyrinth of interconnected chambers (36) which are shaped and positioned to produce a minimum overall package size while providing for easy manufacture.

192 Claims, 47 Drawing Sheets

U.S. PATENT DOCUMENTS 2,274,224 2/1942 Vickers .
2,391,174 12/1945 Lownsbery .
2,412,316 12/1946 Campbell .
2,446,497 8/1948 Thomas .
2,608,158 8/1952 Beaman et al. .
2,697,401 12/1954 Barberena .
2,828,727 4/1958 Fischer .
2,867,198 6/1959 Peras .
2,910,056 10/1959 Sampietro .
2,914,053 11/1959 Hittell .
3,044,495 7/1962 Alfieri .
3,598,507 8/1971 Voit et al. .
3,680,782 8/1972 Monpetit et al. .
3,759,637 9/1973 Vuaille .
3,783,898 1/1974 Kirkman .
3,918,496 11/1975 Byers, Jr. .
3,927,652 12/1975 O'Neill .
4,132,201 1/1979 Bart .
4,175,587 11/1979 Chadwick et al. .
4,176,822 12/1979 Chadwick .
4,233,002 11/1980 Birenbaum .
4,236,877 12/1980 Curtis .
4,246,876 1/1981 Bouwkamp et al. .
4,331,119 5/1982 Chadwick .
4,336,781 6/1982 Overfield .
4,357,925 11/1982 Woodruff .
4,440,134 4/1984 Nakao et al. .
4,469,068 9/1984 Kuroyanagi et al. ..... 123/447
4,498,442 2/1985 Tissot .
4,502,445 3/1985 Roca-Nierga et al. .
4,531,494 7/1985 Bailey et al. .
4,531,672 7/1985 Smith .
4,541,394 9/1985 Schechter et al. .
4,566,492 1/1986 Bessard .
4,586,480 5/1986 Kobayashi et al. .
4,624,231 11/1986 Fenne .
4,633,837 1/1987 Babitzka et al. .
4,681,513 7/1987 Saito et al. .
4,711,209 12/1987 Henkel .
4,712,528 12/1987 Schaffitz .
4,777,921 10/1988 Miyaki et al. .
4,788,960 12/1988 Oshizawa .
4,792,285 12/1988 Chapman et al. .
4,798,189 1/1989 Thornthwaite et al. .
4,811,715 3/1989 Djordjevic et al. .
4,838,232 6/1989 Wich .
4,838,233 6/1989 Hayashi et al. .
4,884,549 12/1989 Kelly .
4,905,960 3/1990 Barnhard et al. .
4,940,037 7/1990 Eckert .
5,012,785 5/1991 Long et al. .
5,029,568 7/1991 Perr .
5,035,221 7/1991 Martin .
5,038,826 8/1991 Kabai et al. .
5,042,445 8/1991 Peters et al. .
5,044,345 9/1991 Collingborn .
5,054,445 10/1991 Henkel et al. .
5,058,553 10/1991 Kondo et al. .
5,078,113 1/1992 Haag et al. .
5,094,216 3/1992 Miyaki et al. .
5,096,121 3/1992 Grinsteiner .
5,109,822 5/1992 Martin .
5,133,645 7/1992 Crowley et al. .
5,176,122 1/1993 Ito .
5,197,438 3/1993 Yamamoto .
5,199,402 4/1993 Melchior .
5,203,303 4/1993 Collingborn et al. .
5,230,613 7/1993 Hilsbos et al. .
5,257,606 11/1993 Willman et al. .
5,277,156 1/1994 Osuka et al. .
5,287,838 2/1994 Wells .
5,295,469 3/1994 Kariya et al. .
5,327,869 7/1994 Rembold et al. .
5,353,766 10/1994 Peters et al. .
5,363,824 11/1994 Bonse .
5,364,240 11/1994 Salecker .

COMPACT HIGH PERFORMANCE FUEL SYSTEM WITH ACCUMULATOR

This application is a continuation-in-part application of the following U.S. patent applications: Ser. No. 057,489 filed May 6, 1993, now abandoned; and Ser. No. 117,697, filed Sep. 8, 1993, now U.S. Pat. No. 5,353,766.

TECHNICAL FIELD

This invention relates to a fuel system for an internal combustion engine and more particularly to a fuel system for a multi-cylinder compression ignition engine including a high pressure fuel pump and fuel accumulator.

BACKGROUND

For well over 75 years the internal combustion engine has been mankind's primary source of motive power. It would be difficult to overstate its importance or the engineering effort expended in seeking its perfection. So mature and well understood is the art of internal combustion engine design that most so called "new" engine designs are merely designs made up of choices among a variety of known alternatives. For example, an improved output torque curve can easily be achieved by sacrificing engine fuel economy. Emissions abatement or improved reliability can also be achieved with an increase in cost. Still other objectives can be achieved such as increased power and reduced size and/or weight but normally at a sacrifice of both fuel efficiency and low cost.

An engine's fuel system is the component which often has the greatest impact on performance and cost. Accordingly, fuel systems for internal combustion engines have received a significant portion of the total engineering effort expended to date on the development of the internal combustion engine. For this reason, today's engine designer has an extraordinary array of choices and possible permutations of known fuel system concepts. Design effort typically involves extremely complex and subtle compromises among cost, size, reliability, performance, ease of manufacture and backward compatibility with existing engine designs.

The challenge to contemporary designers has been significantly increased by the need to respond to governmentally mandated emissions abatement standards while maintaining or improving fuel efficiency. In view of the mature nature of fuel system designs, it is extremely difficult to extract both improved engine performance and emissions abatement from further innovations in the fuel system art. Yet the need for such innovations has never been greater in view of the series of escalating emissions standards mandated for the future by the United States government. Meeting these standards, especially those for ignition compression engines, will require substantial innovations in fuel systems unless engine manufacturers are prepared to adopt significantly more costly fuel systems and/or engine redesigns. For example, Cummins Engine Company, Inc., assignee of the subject application, presently manufactures a pair of mid-range compression ignition engines identified as the B series and C series (5.9 and 8.3 liters displacement respectively). These engines employ a state of the art pump-line-nozzle (PLN) type of fuel system provided to Cummins by another manufacturer. However, this type of fuel system will not permit the B and C series engines to meet the future emissions abatement standards imposed by the United States government.

Among the universe of known fuel systems are several concepts which would appear initially to provide a possible solution to the requirement for improved emissions abatement and satisfactory engine performance. However, for the various reasons outlined below these systems are inadequate.

One possibility pioneered by the assignee of this invention is disclosed in U.S. Pat. No. 5,042,445 to Peters et al. This patent discloses a cam driven unit injector designed to provide very high injection pressures (30,000 psi or higher) even at low engine speeds. Such high injection pressures promote better fuel vaporization during injection thereby helping to assure complete combustion and thus reduced emissions in the engine exhaust. Implementation of this concept requires a unit injector (defined as a single unit device combining a fuel injection nozzle and high pressure pump) adjacent each engine cylinder wherein the injector is designed to achieve the desired high injection pressure at low engine speeds. The Peters et al injector is equipped with a hydraulic variable length chamber for controlling the timing of each injection event in response to engine conditions. Excessive pressures are avoided in this type of injector at elevated engine speeds by the provision of a pressure relief valve for dumping timing fluid during the injection stroke of the unit fuel injector.

Other types of unit fuel injectors are known which are capable of adequate high pressure injection and sufficiently precise injection to achieve some of the performance objectives discussed above. One example is disclosed in SAE Paper No. 911819 relating to a PDE unit injector developed by Bosch. Still another is disclosed in U.S. Pat. No. 4,531,672 to Smith assigned to the assignee of this application.

While the unit injectors described above are capable in many ways of achieving the desired performance objectives, major cost penalties are associated with adoption of such injectors on pre-existing engine designs. In particular, retrofitting an existing engine such as the Cummins B series or C series engine with one of the above described unit injector designs would require a major overhaul of the engine. In particular, when these types of injectors were considered for the B and C engines, it became clear that a redesigned block, head, front end and all associated parts would be required. In short, a substantially new engine would be required with an attendant retooling investment in excess of several hundred million dollars.

Another approach for achieving the desired high pressure injection and variable timing required to meet the escalating emissions limitation standards is disclosed in a fuel system offered by Bosch under the designation PLD. This design approach is characterized by the provision of a separate high pressure pump unit associated with each engine cylinder and connected through a short line to a nozzle arranged to inject fuel into the associated cylinder. Each pump unit is individually packaged separate from the associated nozzle and from all other pump units associated with the engine. The pump units are mounted on the engine for actuation by the engine cam shaft as close as possible to the associated engine cylinder. Although this approach has fuel system cost and performance advantages resulting from the use of existing engine components and minimal impact on the head design, major changes would be required in the engine block. More particularly, the block would need to be entirely redesigned to accommodate the attachment of the individual pump units along the engine cam shaft. Implementation of this approach on the B and C engines would require an investment estimated to be in the neighborhood of several tens of millions of dollars.

One high performance approach requiring less engine redesign is disclosed in U.S. Pat. No. 5.096,121 to Grinsteiner. This style of unit injector includes a fluid pressure intensifying piston which has the effect of multiplying the pressure of a motive fluid, such as pressurized lubrication oil, by the ratio of the effective cross sectional areas of the intensification piston contacted on its larger, low pressure side by the motive fluid and on the smaller, high pressure side by the engine fuel. Such a design has the potential for achieving many of the desired performance objectives but some significant redesign of the base engine is still required. For example, the system requires an entirely new cylinder head to accommodate not only the injector but also the oil accumulator that provides the intensification. A separate lubrication circuit or a totally redesigned lubrication circuit must be provided to supply the motive fluid through a control valve to the intensification piston. Such an system would require a separate suction tube, oil pump, and filtration system.

The cost for base engine redesign required by a fluid intensification unit injector is likely to be considerably less than the engine redesign costs associated with adoption of any of the other unit injector and unit pump concepts described above. Nevertheless, Cummins estimates that adoption of fluid intensifiers on the B and C series engines would still require an investment in the range of multiple tens of millions of dollars. In addition to the costs associated with redesign of the engine, the fuel system itself including the hydraulic unit injectors, redesigned lubrication circuit, filters and associated equipment would likely be far more expensive than many other known types of fuel systems. U.S. Pat. Reissue No. 33,270 to Beck et al. discloses another type of hydraulic intensifier unit injector which would appear to supply the same benefits but suffer the same drawbacks discussed above.

Yet another approach to meeting the goal of increased fuel system performance would be to provide an accumulator for storing the output of a high pressure pump and to provide a plurality of injection nozzles connected with the accumulator and associated with the engine cylinders wherein each nozzle includes a separate integrated solenoid valve to control the timing and quantity of fuel flow from the accumulator into each cylinder. Examples of this type of system are disclosed in U. S. Pat. No. 5,094,216 to Miyaki et al. and SAE article no. 910252 entitled Development of New Electronically Controlled Fuel Injection System ECD-U2for Diesel Engines by Miyaki et al. This system allows the accumulator pressure (and thus the injection pressure) to be regulated as necessary independent of engine speed. However, solenoids capable of handling the very high pressure and the necessary fast response times are relatively bulky and costly. Such solenoids will require severe head redesign on the C series and some modification on the B-series engines. Also, mounting of the high pressure accumulator on an internal combustion engine is not necessarily simple nor does it yield an uncluttered engine package or appearance. While the total engine redesign costs would be less than the engine redesign costs associated with adoption of the fuel systems noted above, the costs associated with the fuel system components themselves, including the high pressure pump and solenoid controlled injection nozzles, could be prohibitively high.

The above described approaches could potentially achieve many of the desired performance objectives but a major cost penalty is associated with each design either in the form of a costly engine redesign or added fuel system costs or both. Other less costly fuel system concepts are known but these concepts fail to provide the full complement of performance objectives desired.

One approach which would require virtually no engine redesign involves the provision of a high pressure "in-line" pump such as offered by Bosch under the designation P7100. In this type of system injection nozzles located at each engine cylinder are connected through separate lines to corresponding pumping chambers contained within the housing of a single unitized high pressure pump. The chambers are aligned along the axis of a pump drive shaft and contain corresponding plungers mounted to be reciprocated by the pump drive shaft in synchronism with the engine crankshaft. With appropriate design and controls, in-line systems of this type can achieve the necessary pressures and injection accuracy under some engine conditions but can not be relied upon to provide the desired performance objectives over the long term especially at low engine speeds. Further, in-line fuel pumps which are capable of approaching some of the more important pressure and control objectives are enormously more expensive than the present pump line nozzle system used on the Cummins B and C series engines.

Another fuel system which would necessitate little redesign of the basic engine involves the use of a rotary pump design. This type of pump is characterized by a pump housing containing a plurality of radially oriented pump chambers within which are mounted plungers adapted to be reciprocated by a cam surface located at the center of the pump housing. U.S. Pat. Nos. 4,498,442 and 4,798,189 disclose examples of this type of pump. Although engine impact is low and cost is relatively low, rotary pumps lack performance capability at higher engine ratings. In particular, rotary pumps are not capable of providing the desired volume or the desired high pressure over the full operating range of a typical engine.

Still another fuel system concept is disclosed in Japanese Pat. Application Document 57-68532 to Nakao and assigned to Komatsu. This reference discloses an electronically controlled high pressure pump and an accumulator for receiving the pump output for supply of a plurality of injection nozzles through a distributor type valve and corresponding fuel supply lines. The timing and quantity of injection is controlled by means of rotary valve elements combined with the distributor valve. The pressure within the accumulator is regulated by a feedback signal responsive to the accumulator pressure to control the effective displacement of the high pressure pump. While this design has features of interest, it fails to disclose how to achieve the necessary operating pressures in a unitized assembly of sufficiently compact size to allow the resulting system to be mounted in a practical manner on an internal combustion engine. No provision is made for operating the system in a fail safe manner in case one or more of the electronic control mechanisms should fail during operation. Furthermore, the design provides for an entirely separate pump assembly and accumulator components connected by a plurality of separate fluid lines which would multiply the sites of potential leaks.

The Komatsu reference also fails to teach how to manufacture in a practical manner an accumulator so that the very high pressures, i.e. 5,000 to 30,000 psi or higher, could be stored within a compact package having adequate fuel storage capacity with freedom from potential leakage or dangerous failure. The Komatsu reference further fails to suggest how to design and assemble the system to achieve an acceptably low manufacturing cost. The disclosed distributor valve would also not be suitable for handling the very high pressures required for the system without simultaneously giving rise to a high probability of fuel leakage that would cause excessive parasitic loses, that is an excessive amount of mechanical energy would be required to drive the fuel system pump that would otherwise be available as useful output from the engine.

Still other references have disclosed the concept of providing an accumulator in a fuel system wherein fuel from the accumulator can alternatively be controlled for injection into the respective engine cylinders either by a distributor valve or a plurality of solenoids associated with each of the individual injector nozzles. German Printed Pat. Application No. DE 3618447 Al assigned to Bosch discloses an example of this type of system. The highly schematic disclosure of this teaching, however, causes this reference to fail to teach how to solve the problems referred to with respect to the Komatsu reference.

Attempts have been made to design a high pressure common rail or accumulator for storing the output of a high pressure pump for delivery to injection nozzles. For example, U.S. Pat. No. 5,109,822 to Martin discloses a high pressure common rail fuel injection system including a common rail formed from a one-piece metal housing having a series of elongated bores formed therein for temporarily storing the high pressure fuel delivered by a high pressure pump. However, Martin fails to teach how to determine the optimum arrangement of elongated chambers or bores for producing a compact common rail with minimum outer dimensions which fit within existing available mounting envelopes required by existing engines while ensuring that the common rail housing walls are sufficiently strong to withstand the forces generated by the very high operating pressure of the fuel in the chambers. In addition, Martin does not disclose how to ascertain the minimum required fuel storage volume for the common rail which is a primary factor in designing a compact common rail. Also, the common rail disclosed in Martin is not integrated with the high pressure pump unit and/or other components, such as a fuel pump control valve, to form a compact fuel delivery assembly which is capable of efficiently controlling the pressure in the common rail. U.S. Pat. No. 2,446,497 to Thomas discloses a high pressure pump, a common high pressure chamber or accumulator, a distributor and fuel injection control governors mounted adjacent one another to form a combined fuel injection assembly. However, Thomas fails to disclose a fuel assembly which is highly compact and integrated, and also capable of efficiently and effectively controlling both the pressure in the accumulator and injection timing and quantity.

Attempts have also been made to design high pressure, high speed solenoid operated valves for use in fuel systems for compression ignition internal combustion engines. For example, U. S. Pat. No. 3,680,782 to Monpetit et al discloses an electronically controlled fuel injector employing a force balanced three-way valve having a nearly force balanced "pin-in-sleeve" valve member design. In valves of this type, the movable valve member is movable between first and second positions to alternatively connect an output valve passage to one of two alternative valve passages, typically a high pressure source and a drain. The movable valve member contains a cavity opening at one end to telescopingly receive a floating pin. A first valve seat is formed between the sleeve and the surrounding valve housing and a second valve seat is formed between the sleeve and pin. The valve element is movable between a first position in which the injector nozzle is connected with a source of fuel under high injection pressure and a second position in which the valve element isolates the source of fuel from the injection orifices of the nozzle and connects the passage leading to the injection orifices to a drain to insure near instantaneous termination of each injection event.

Other examples of three-way high speed, high pressure fuel system valves are disclosed in U.S. Pat. No. 5,038,826 to Kabai et al (Nippondenso). While capable of handling high pressure and operating at high speed, the "pin-in-sleeve" arrangements of the Monpetit et al. and Nippondenso references do not permit the effective valve seats of each disclosed design to be substantially unequal in size while maintaining the valve member substantially force balanced.

Another important feature of an effective fuel delivery system is the ability to regulate the injection pressure as necessary independent of engine speed. U.S. Pat. No. 5,094,216 to Miyaki et al. and U.S. Pat. No. 4,502,445 to Roca-Nierga et al. both disclose a plural chamber "in-line" fuel pump assembly having an output control device which varies the effective displacement of one or more pump plungers by providing a separate pump control valve for each pump chamber which operates to vary the beginning of injection with a constant end of injection occurring when the pumping plunger reaches its top dead center position. Specifically, fuel is supplied to the pumping chamber during the retraction stroke and then pumped out of the pumping chamber during the advancing or pumping stroke until the control valve is closed blocking the discharge of fuel from the chamber thereby commencing injection or delivery. The delivery or discharge from the pumping chamber is finished only at the end of the pumping stroke of the plunger.

Yet another important feature of an effective fuel delivery system capable of meeting the ever increasing requirements of emissions abatement is the ability to control the rate of fuel delivery during each injection event. It has been shown that the level of emissions generated by the diesel fuel combustion process can be reduced by decreasing the volume of fuel injected during the initial stage of the injection event. One method of reducing the initial volume of fuel injected during each injection event is to reduce the pressure of the fuel delivered to the nozzle assemblies during the initial stage of injection. Various devices have been developed to control or shape the rate of fuel delivery during the initial phase of fuel injection so as to reduce the fuel pressure delivered to the nozzle assemblies. For example, U.S. Pat. Nos. 3,718,283, 3,747,857, 4,811,715 and 5,029,568 disclose devices associated with each injector nozzle assembly for creating an initial period of restricted fuel flow and a subsequent period of substantially unrestricted fuel flow through the nozzle orifice into the combustion chamber. However, these rate control devices require modifications to each of the fuel injector assemblies in a multi-injector system thus adding costs and complexity to the injection system. U.S. Pat. No. 4,469,068 to Kuroyanagi et al. discloses a distributor-type fuel injection apparatus including an variable volume accumulator to vary the rate of fuel injection to achieve effective combustion. However, this device uses a complex accumulator control system to vary the rate of injection which is specifically designed to be used with a distributor having a reciprocating plunger.

Distributor-type fuel injection systems are also subject to another undesirable phenomena known as secondary injection. When the nozzle element of the nozzle assembly closes at the end of each injection event, reverse pressure waves or pulses are generated which travel back upstream in the fuel delivery lines to the distributor or delivery valves. Under certain operating conditions, these pressure waves may be reflected back toward the nozzle assembly by the distributor or delivery valve creating a secondary nozzle operating pulse of sufficient magnitude to cause the nozzle valve to lift from its seat causing an undesired secondary injection. U.S.

Pat. No. 4,246,876 to Bouwkamp et al. discloses a conventional "snubber valve" used to dampen or diffuse the pressure wave energy traveling from the nozzle valve thereby preventing secondary injection by minimizing the intensity of any resultant reflected pressure wave. However, this design requires a separate snubber valve to be used in each fuel injection line thus adding cost to the system. U.S. Pat. Nos. 4,336,781, 4,624,231 and 5,012,785 all disclose rotary distributor fuel delivery systems using a single snubber-type valve positioned in the rotary shaft of the distributor to dampen pressure waves in each injection line.

In order to achieve accurate and predictable injection quantities of fuel during each injection event, it is important to ensure that the fuel transfer circuit connecting the fuel supply to the nozzle assemblies is continuously full of fuel. It has been found that vapor pockets or voids (called cavitation) in the transfer circuit result in insufficient injection pressure and variations in both fuel quantity and timing of injection. Vapor pockets or voids are especially prone to be formed in high pressure lines of fuel systems where such lines are connected to a low pressure drain. When the fuel transfer circuit, and thus an injection line, is connected to drain at the end of the injection event, fuel at one end of the injection line exits out of the nozzle while fuel at the other end of the circuit exits to drain thus rapidly drawing fuel away from, and reducing the pressure in, intermediate portions of the circuit and injection line. This effect can result in the formation of a vapor pocket or void in the fuel transfer circuit and injection line between the drain and nozzle. Snubber valves, mentioned hereinabove with respect to the prevention of secondary injections, are also used to prevent excessive cavitation by allowing substantially full flow through an injection line to an injector while restricting the return flow of fuel from the injector thereby maintaining fuel in the fuel delivery lines. For example, Japanese Pat. Publication 05-180117 discloses a damping valve positioned downstream of a delivery valve for preventing cavitation erosion. The damping valve includes a spring-biased valve element having an orifice and a pressure regulation valve positioned in a bypass channel. This device appears to regulate the fuel pressure in the fuel injection line between the damping valve and a fuel injection valve to below a preset maximum.

In short, the prior art does not provide a practical, low cost fuel system which satisfies the conflicting demands of emissions control and improved engine performance especially in situations where it is desired to retrofit a pre-existing engine design. Moreover, there does not exist those fuel system components (such as accumulators, solenoid valves, and injection control valves) having all the characteristics necessary for providing fuel under extremely high pressure in precise quantities at precise times as determined by controls that are responsive to a wide range of engine conditions.

SUMMARY OF THE INVENTION

It is a general object of the subject invention to overcome the deficiencies of the prior art and in particular to provide a practical, low cost fuel system which satisfies the conflicting demands of emissions control and improved engine performance. In particular, the subject invention provides superior emissions control and improved engine performance while requiring minimal modification of pre-existing engines designs.

It is another object of the subject invention to provide an electronically controllable, high pressure fuel pump assembly including a pump, accumulator and distributor combined with an electrically operated pump control valve and a injection control valve mounted on the unitized assembly. By this arrangement, a highly integrated fuel system may be designed, built and installed either for an original or pre-existing engine design.

Still another object of the subject invention is to provide a fuel system for an internal combustion engine of the compression ignition type which is capable of achieving very high injection pressures, i.e., 5000–30,000 psi and preferably in the range of 16,000–22,000 psi with precise control over quantity and timing in response to varying engine conditions.

Still another object of the subject invention is to provide a high performance, high pressure fuel system designed for retrofitting on existing engine designs of the compression ignition type without requiring substantial and costly engine redesign. In particular, the subject invention provides a fuel system having the above characteristics while also improving engine efficiency by minimizing the parasitic losses even though fuel pressure is raised to a very high level.

It is a further object of the subject invention to provide a highly integrated fuel system characterized by high pressure injection, minimal impact on pre-existing engine designs, precise control over injection quantity and timing, redundant fail safe electronic components, and improved engine efficiency at overall reduced costs with respect to competing prior art systems.

It is yet another object of the subject invention to provide a fuel pump assembly characterized by the combination of a pump, distributor and accumulator wherein the accumulator includes a housing containing a fluidically interconnected labyrinth of accumulator chambers sized and relatively positioned to create an ideal integrated package.

Another object of the subject invention is to provide an improved fuel system capable of providing sufficiently high operating injection pressures to achieve significant emissions abatement wherein the system includes a unitized assembly of sufficiently compact size to allow the resulting system to be mounted in a practical manner on existing internal combustion engines without creating a cluttered, unsightly engine appearance.

Another object of the subject invention is to provide a fuel system having the above characteristics wherein the number of fuel leakage sites is minimized by the reduction of system components and the provision of fail safe redundant low pressure fuel drains throughout the system to catch and return to the fuel system any fuel which may leak through primary seal areas.

A still further object of the subject invention is to provide a fuel pump assembly including a pump housing having a pump cavity oriented in a radial direction, and an accumulator mounted on the pump housing having an overhang in either the lateral and/or axial direction and a pump control valve mounted on the overhang portion of the accumulator housing adjacent the pump housing to create a highly compact, integrated fuel pump assembly.

Yet another object of the subject invention is to provide a fuel pump assembly including a fuel pump supplying high pressure fuel, i.e., 5,000 to 30,000 psi and preferably 16,000 to 22,000 psi with a pump cavity opening into a head engaging surface and an accumulator adapted to receive the output of the pump and store temporarily the fuel at the high operating pressure for subsequent injection into the internal combustion engine wherein the accumulator is mounted in contact with a head engaging surface of the fuel pump to form an end wall for the pump cavity.

Still another object of the subject invention is to provide a fuel pump assembly including a pump housing containing a radially oriented pump cavity, and an accumulator housing mounted adjacent one end of the pump housing having at least one chamber and a lateral extent to cause the accumulator to form an overhang in either the lateral or axial direction perpendicular to the radially oriented cavity in further combination with an injection valve for directing high pressure fuel in timed synchronism with engine operation to various engine cylinders wherein the distributor is cantilever mounted on the pump housing in spaced apart relationship with the accumulator overhang.

Still another object of the subject invention is to provide a fuel pump assembly including a pump housing having a cavity oriented in a radial direction, and an accumulator housing mounted on the pump housing at one end of the pump housing to form a cantilevered lateral overhang such that the overhang forms an offset transverse profile for the fuel pump assembly to complement the irregular transverse profile of the internal combustion engine on which the fuel assembly is designed to be mounted.

Still another object of the subject invention is to provide a fuel pump assembly including a pump housing containing a pump cavity, a drive shaft adapted to be mounted in the pump housing, a pump head mounted on the housing opposite the drive shaft and a pump unit retained in the pump head by means of a retainer which causes the pump unit to extend into the pump cavity of the pump housing in spaced apart non-contacting relationship with the pump housing, whereby the pump unit may be relatively easily removed and replaced to provide inexpensive overhaul of the pump assembly and/or the ability to switch pump units to adjust the effective displacement of the fuel pump assembly.

It is yet another object of the subject invention to provide an accumulator for a fuel pump system in which the accumulator is formed by a housing containing a fluidically interconnected labyrinth of chambers wherein the housing is formed of an integral one piece block.

It is a more specific object of the subject invention to provide a unitized fuel pump assembly for periodic injection of fuel through plural fuel injection lines into corresponding engine cylinders of a plural cylinder internal combustion engine. The assembly includes a pump for pressurizing fuel, an accumulator for accumulating and temporarily storing fuel under pressure received from the pump. The accumulator is mounted on the pump housing opposite the drive shaft of the pump with a plurality of pump cavities positioned intermediate the drive shaft and accumulator. The fuel pump assembly further includes a fuel distributor for providing periodic fluidic communication between the accumulator and each of the engine cylinders through the corresponding fuel injection lines. The fuel distributor is mounted on the pump housing adjacent one end of the drive shaft and includes a injection control valve for controlling the timing and quantity of fuel injected into each cylinder in response to engine operating conditions. The control valve includes a solenoid operator mounted on the distributor housing and is oriented generally in the same radial direction as the pump cavities relative to the rotation axis of the drive shaft. By this arrangement, an extremely compact, highly integrated fuel pump assembly is formed which maximizes low cost, reduced size, and high performance in a fuel system adapted to be provided on new or existing engine designs.

Still another object of the subject invention is to provide a unitized, single piece fuel pump housing containing plural outwardly opening pump cavities, a radially enclosed drive shaft, a pump head engaging surface and plural tappet guiding surfaces within corresponding pump cavities wherein the tappet guiding surfaces, head engaging surface and drive shaft mounting surfaces are the only surfaces requiring close machining to create adequate alignment between the drive shaft and the cooperating fuel pumping elements of the pump.

It is yet another object of the subject invention to provide a fuel pump including an accumulator, a distributor feeding fuel to plural engine cylinders, and a pair of associated pump control valves for controlling displacement of the pump elements to cause the pump elements to share the load necessary to maintain desired fuel pressure. A first injection control valve is provided to control a pre-injection portion of the injection for each cylinder and a second injection control valve associated with the first injection control valve is provided to control a main injection portion of the injection for each cylinder. An electronic control means is further provided for causing an associated valve to take over if one of the control valves (pump or injection) should become disabled.

It is yet another object of the subject invention to provide a pump assembly including a pump housing containing a pump plunger reciprocating along a first pump axis, a drive shaft rotating about a drive axis perpendicular to the pump axis and an accumulator having at least one elongated chamber mounted on the pump housing with the central axis of the chamber being parallel with the drive shaft axis of the pump. By this arrangement, an ideally compact arrangement of an unitized accumulator type pump assembly may be formed within a minimum package size while providing an adequate total volume of high pressure fuel.

Another object of the subject invention is to provide a fuel pump assembly providing one or more of the above objects and further providing a pump housing having plural pump chambers and plural solenoid operated pump control valves corresponding in number to the pump chambers for controlling the effective displacement of associated pump plungers operating within each pump chamber. By this arrangement, a pressure signal representative of the pressure of the fuel in the fuel pump accumulator may be used to control the solenoid operated pump control valves to adjust thereby the effective displacement of the plungers to cause the pressure of fuel in the accumulator to equal a predetermined pressure level.

It is an object of the subject invention to provide dual injection control valves for use on a distributor in combination with a fuel pump system designed in accordance with the subject invention wherein an electronic control is provided to allow at least "limp-home" operation of the engine should one of the injection control valves become disabled.

Another object of the subject invention is to provide a distributor including an injection control valve for controlling the timing and quantity of fuel injected into each cylinder in response to engine operating conditions wherein the injection control valve includes a three-way valve operable when energized to connect an axial supply passage in the distributor rotor with a high pressure fuel accumulator and operable when de-energized to connect the axial supply passage in the distributor rotor with a low pressure drain.

Yet another object of the subject invention is to provide a distributor housing arranged to control the flow of fuel through a fuel feed line from an accumulator to each one of a plurality of engine cylinders by means of a pair of three-way valves located in a supply plane transverse to the rotational axis of a distributor rotor wherein the three-way valves are received within first and second valve cavities located on opposite sides of the distributor rotor and are interconnected by supply and drain passages. The valve cavities are further connected by a rotor feed bore for supplying high pressure fuel to the distributor rotor. The injection valve is further characterized by a two way check valve located within the rotor feed bore to prevent fuel supplied from one valve cavity from flowing into the other valve cavity.

Yet another object of the subject invention is to provide a fuel pump assembly including cam driven reciprocating plungers driven by corresponding cams having at least one lobe for causing an associated pump plunger to undergo an advancing stroke and a return stroke for each revolution of the camshaft wherein the total number of lobes are selected to produce a pumping event for each injection event.

Yet another object of the subject invention is to provide a replaceable pump unit for each of the respective pump cavities in the pump housing designed in accordance with the subject invention wherein each pump unit includes a barrel containing a pump chamber and a barrel retainer for mounting the pump unit in a recess of the fuel pump assembly accumulator. A check valve is provided to allow one way fuel flow from the pump chamber into the accumulator. The check valve is associated with a disk positioned at one end of the barrel to form an end wall of the pump chamber. The disk contains both inlet and outlet passages and the retainer is formed to provide a clearance with the barrel and disk to provide a pathway for return of fuel leakage to a fuel supply passage contained in the accumulator.

It is yet another object of the subject invention to provide a high pressure fuel pump assembly including an accumulator for storing fuel prior to distribution to corresponding cylinders in an internal combustion engine by means of an injection valve wherein the accumulator has a total volume sufficient to prevent fuel pressure from dropping more than approximately 5–15 percent, and preferably 5–10 percent, during any injection event depending upon such factors as the compressibility of the fuel, the operating pressure of the fuel, the maximum potential required injection volumes, timing range and injection duration selected for the engine, the maximum effective displacement of each pump unit, the fuel leakage of the system, the compression of the fuel in the fuel lines, and the fuel lost to drain during valve member travel between fully opened and fully closed positions.

It is yet another object of the subject invention to provide an accumulator for the fuel system designed in accordance with the subject invention wherein the accumulator contains a labyrinth of interconnecting chambers wherein the chambers are elongated and cylindrical in shape and are positioned in generally parallel relationship. The accumulator chambers are ideally positioned to intersect a vertical plane through the accumulator housing in a two dimensional array.

Still yet another object of the subject invention is to provide a rotatable pump and a distributor integrated with a single drive shaft assembly to form a compact fuel system assembly capable of accurately and reliably delivering precise quantities of fuel to an engine while minimizing the size and weight of the assembly.

Yet another object of the present invention is to provide a high pressure fuel pump assembly including a fuel distributor having axially slidable spool valves in combination with a separate injection control valve.

A further object of the present invention is to provide a fuel pump assembly including an ultra-compact pump head and integral pump chamber which minimizes high pressure fuel leakage while reducing the size and weight of the assembly.

Another object of the present invention is to provide a variety of pump head/accumulator designs for accommodating pump control valves and check valves in various orientations to minimize unwanted fuel leakage, trapped volume and the size and weight of the assembly.

A still further object of the present invention is to provide a fuel pump assembly having a transversely oriented pump control valve for reducing to an absolute minimum the trapped volume within the pump head/accumulator.

A further object of the present invention is to provide a fuel pump assembly having a pump unit and a transverse pump control valve mounted in the barrel of the pump unit.

Yet another object of the present invention is to provide various accumulator designs for simplifying the formation and manufacture of the accumulator while minimizing the possibility of undesired fuel leakage from the accumulator chambers.

It is yet another object of the present invention to provide a high pressure fuel system having a separately mounted accumulator for permitting placement of the accumulator in possibly more appropriate/advantageous locations around the engine while also reducing the size of the pump head thereby creating a more compact assembly which may more appropriately fit with the packaging constraints of certain engines or vehicle designs.

It is yet another object of the present invention to provide various edge filter mounting concepts for positioning an edge filter within the disclosed system for preventing damage to the system's components by small, foreign particles.

Yet another object of the present invention is to provide rate-shaping capability for controlling the amount of fuel injected during the initial portion of the injection event by controlling the increase in pressure at the nozzle assembly.

Another object of the present invention is to provide various cavitation control devices to minimize the formation of vapor pockets or voids within the fuel passages of fuel systems thereby minimizing cavitation-induced anomalies in fuel injection metering and timing.

Still another object of the present invention is to provide a novel high pressure fuel system including rate shaping and cavitation control devices capable of maximizing the rate shaping capability of the system while minimizing cavitation.

A further object of the present invention is to provide a single device for permitting rate shaping while also effectively minimizing cavitation in the fuel passages of the system.

A still further object of the present invention is to provide cavitation control devices which are both inexpensive to manufacture and simply and easily mounted on a fuel pump assembly.

It is a further object of the present invention to provide a cavitation control device capable of refilling the fuel injection lines to each nozzle assembly after an injection event.

Yet another object of the present invention is to provide an a cavitation control device capable of regulating the fuel pressure in the fuel transfer passages during the draining event to above a predetermined minimum thereby preventing excessive cavitation.

Yet another object of the present invention is to provide a cavitation control device capable of both regulating the pressure in the fuel transfer passages during the draining event while also refilling the passages between injection events.

A still further object of the present invention is to provide a high pressure coupling having a plurality of integrally formed delivery portions for connection to high pressure fuel lines and an orifice for controlling the flow through at least one of the delivery portions.

It is another object of the present invention to provide a high pressure coupling for effectively connecting high pressure lines of a fuel system while providing a convenient housing for a filter.

Another object of the present invention is to provide a high pressure coupling which permits simple and inexpensive implementation of a rate shaping device.

Still other detailed objects of the invention may be understood by considering the following Summary of the Drawings and Detailed Description of the Preferred Embodiments.

SUMMARY OF THE DRAWINGS

FIGS. 14–15are cross sectional views of the fuel pump housing of FIGS. 11–13 taken along lines 14—14, 15—15 and 16—16.

FIG. 17*a* is an end elevational view of a distributor housing used in the fuel system assembly of FIGS. 2–6.

FIG. 17*b* is a side elevational view of the fuel system assembly of the present invention showing an alternative mounting arrangement with the distributor shaft oriented perpendicular to the pump drive shaft.

FIG. 18 is a second end elevational view of the distributor housing of FIG. 17*a*.

FIG. 19 is a side elevational view of the distributor housing of FIGS. 17*a and 18*.

FIG. 20 is a top elevational view of the distributor housing of FIGS. 17*a*–19.

DESCRIPTION OF THE PREFERRED EMBODIMENTS

Figure 1:
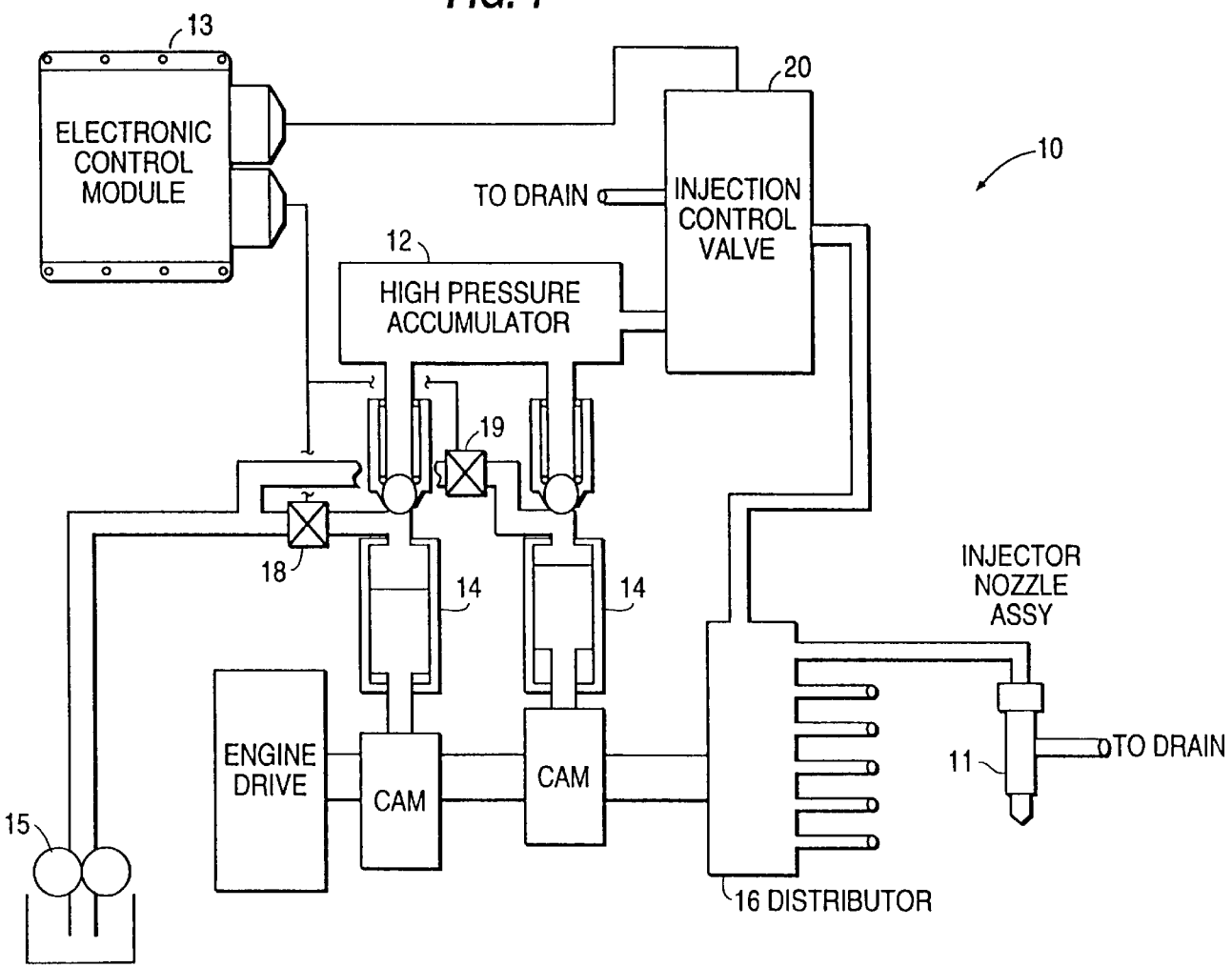
FIG. 1 is a schematic diagram of a fuel system assembly designed in accordance with the subject invention.

Referring to FIG. 1, the unitized fuel delivery assembly of the present invention is shown and may be referred to generally as the Cummins Accumulator Pump System (CAPS). As shown in schematic form and indicated generally at 10, the invention includes a high pressure accumulator 12 for receiving high pressure fuel for delivery to fuel injectors of an associated engine, a high pressure pump 14 for receiving low pressure fuel from a low pressure supply pump 15 and delivering high pressure fuel to accumulator 12 and a fuel distributor 16 for providing periodic fluidic communication between accumulator 12 and each injector nozzle 11 associated with a respective engine cylinder (not shown). The assembly also includes at least one pump control valve 18, 19 positioned along the fuel supply line to pump 14 for controlling the amount of fuel delivered to accumulator 12 so as to maintain a desired fuel pressure in accumulator 12. Also, one or more injection control valves 20 positioned along the fuel supply line from the accumulator 12 to the distributor 16 is provided for controlling the timing and quantity of fuel injected into each engine cylinder in response to engine operating conditions. An electronic control module (ECU) 13 controls the operation of the pump control valves 18, 19 and the injection control valve 20 based on various engine operating conditions to accurately control the amount of fuel delivered by the distributor 16 to the injector nozzle 11 thereby effectively controlling fuel timing and metering.

The injection rate shape can be modified by a device located between the accumulator and the distributor.

Figure 2:
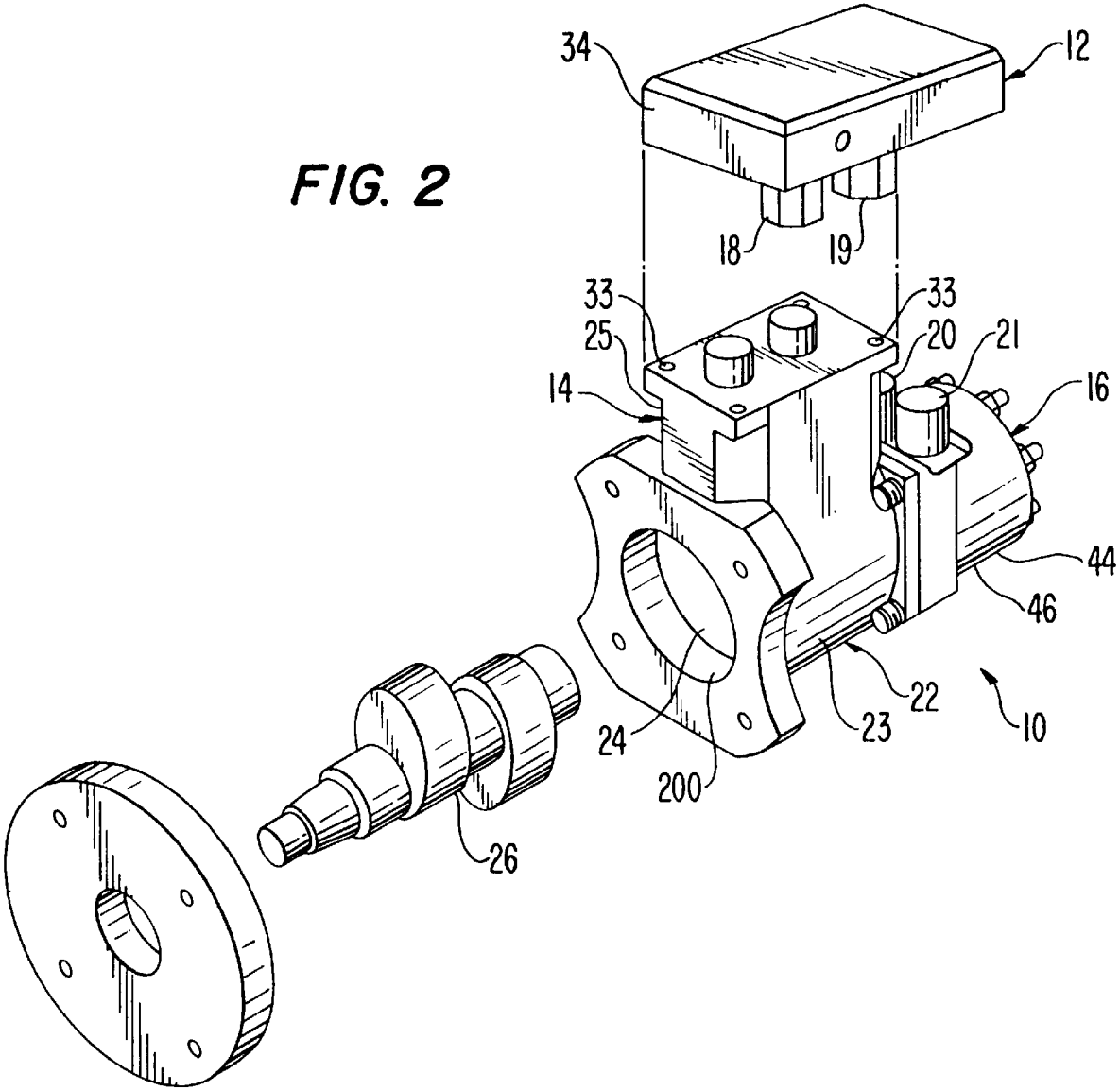
FIG. 2 is an exploded perspective view of a fuel system assembly designed in accordance with the subject invention
Figure 3:
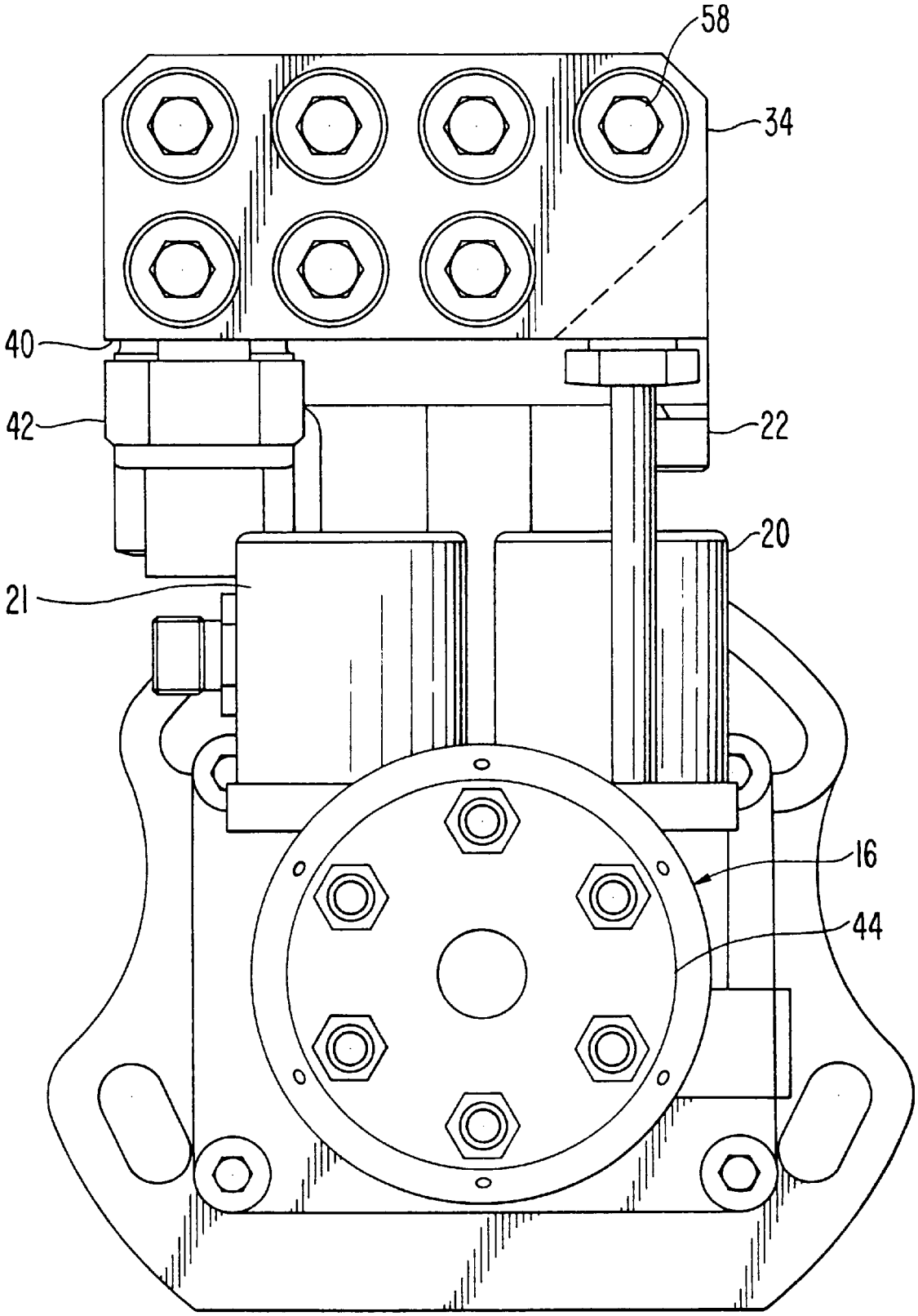
FIG. 3 is an end elevational view of a fuel system assembly designed in accordance with the subject invention.
Figure 4:
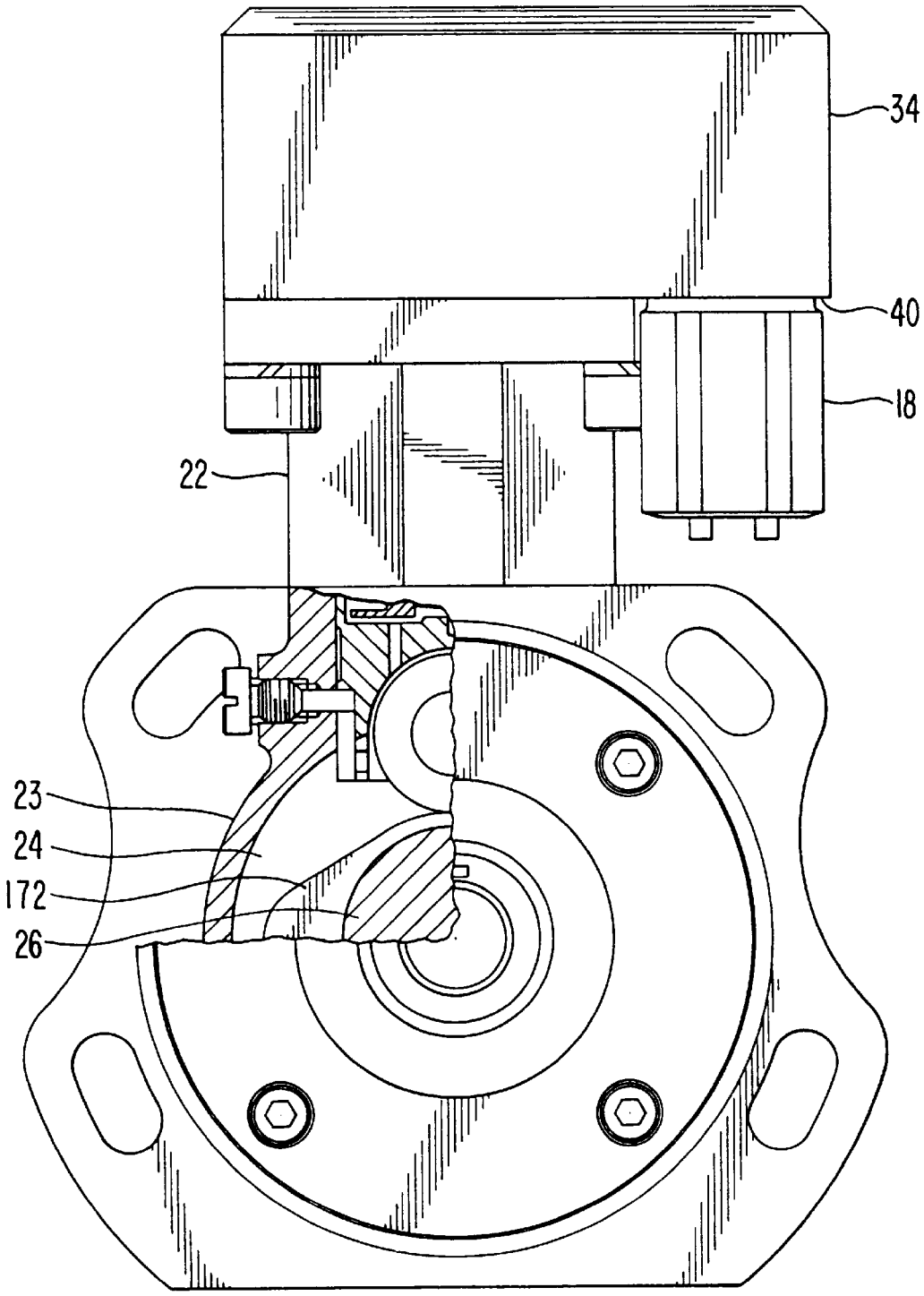
FIG. 4 is an end elevational view of the opposite end of the fuel system assembly of FIG. 3.

FIGS. 2–4 illustrate the preferred embodiment of the fuel delivery assembly 10 in its practical form in a unitized, compact assembly including an accumulator housing 34 of accumulator 12 and a distributor housing 44 of distributor 16 both mounted on a pump housing 22 associated with pump 14. As shown in FIGS. 11–16, pump housing 22 includes a lower portion 23 which forms a drive shaft receiving cavity 24 for radially enclosing a drive or cam shaft 26. Pump housing 22 also includes an upper portion 25 integrally formed with lower portion 23 by, for example, metal casting procedures. A pair of generally cylindrical pump cavities 28 and 30 formed in upper portion 25 extend radially from the longitudinal axis of camshaft 26. Pump cavities 28 and 30 have generally parallel central axes to form an "in-line" pump configuration. Upper portion 25 of pump housing 22 includes a dividing wall 31 for separating pump cavities 28 and 30, and a head engaging surface 32 for engaging the accumulator 12 to form an end wall for pump cavities 28 and 30. Four apertures 33 are formed in upper portion 25 for receiving bolts (not shown) for securing accumulator housing 34 to pump housing 22.

Accumulator housing 34 is generally rectangularly shaped in both lateral and vertical cross-section and includes a lower surface mounted against head engaging surface 32 of pump housing 22. Referring to FIGS. 5–10*a*, four recesses 35 formed in the lower surface of accumulator housing 34 opposite respective apertures 33 include internal threads for engaging complimentary threads formed on bolts (not illustrated) extending upwardly from apertures 33 of pump housing 22 to connect accumulator housing 34 to pump housing 22. Accumulator housing 34 includes elongated accumulator chambers 36 extending along the axial extent of housing 34 for receiving and temporarily storing high pressure fuel delivered by pump 14. Accumulator housing 34 extends axially outwardly from pump housing 22 parallel to the longitudinal axis of camshaft 26 to form a cantilevered axial overhang 38 relative to pump housing 22. Preferably, the central axis of each accumulator chamber 36 is generally parallel to the drive axis of camshaft 26 and perpendicular to the pump axis extending in the radial direction through pump cavities 28 and 30. Accumulator housing 34 also extends laterally outwardly from pump housing 22 to form a cantilevered lateral overhang 40. A first pump control valve 18 and a second pump control valve 19 are mounted on cantilevered lateral overhang 40 of accumulator housing 34 adjacent pump housing 22. As illustrated in FIGS. 2, 3 and 6, pump control valves 18 and 19 are received in downwardly opening recesses formed on the underside of accumulator housing 34. In addition, a pressure sensor 42 for determining the fuel pressure within accumulator chambers 36 is mounted in a recess formed on the underside of accumulator cantilevered axial overhang 38.

Figure 5:
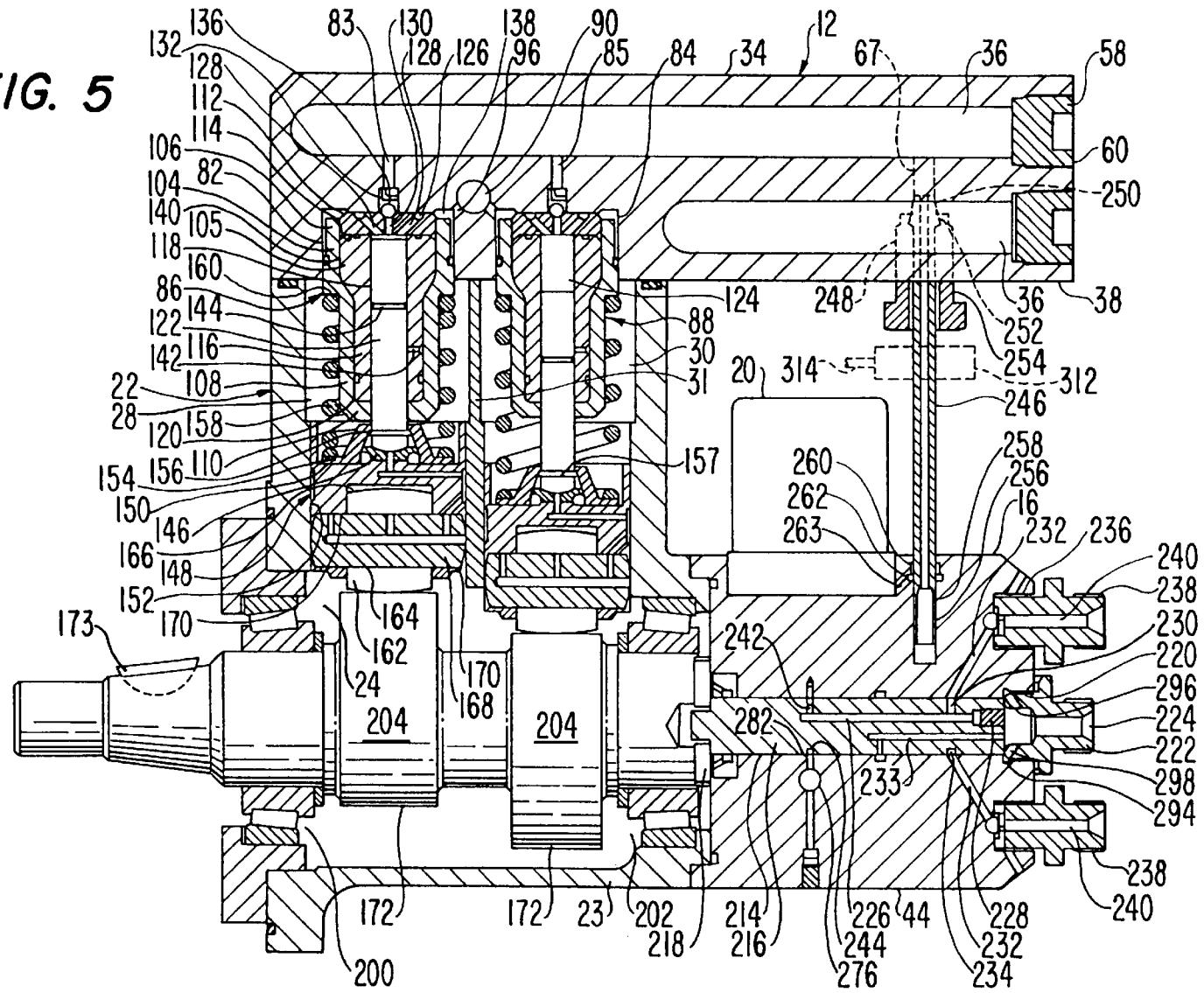
FIG. 5 is a cross sectional view of the fuel system of FIGS. 2–4.
Figure 6:
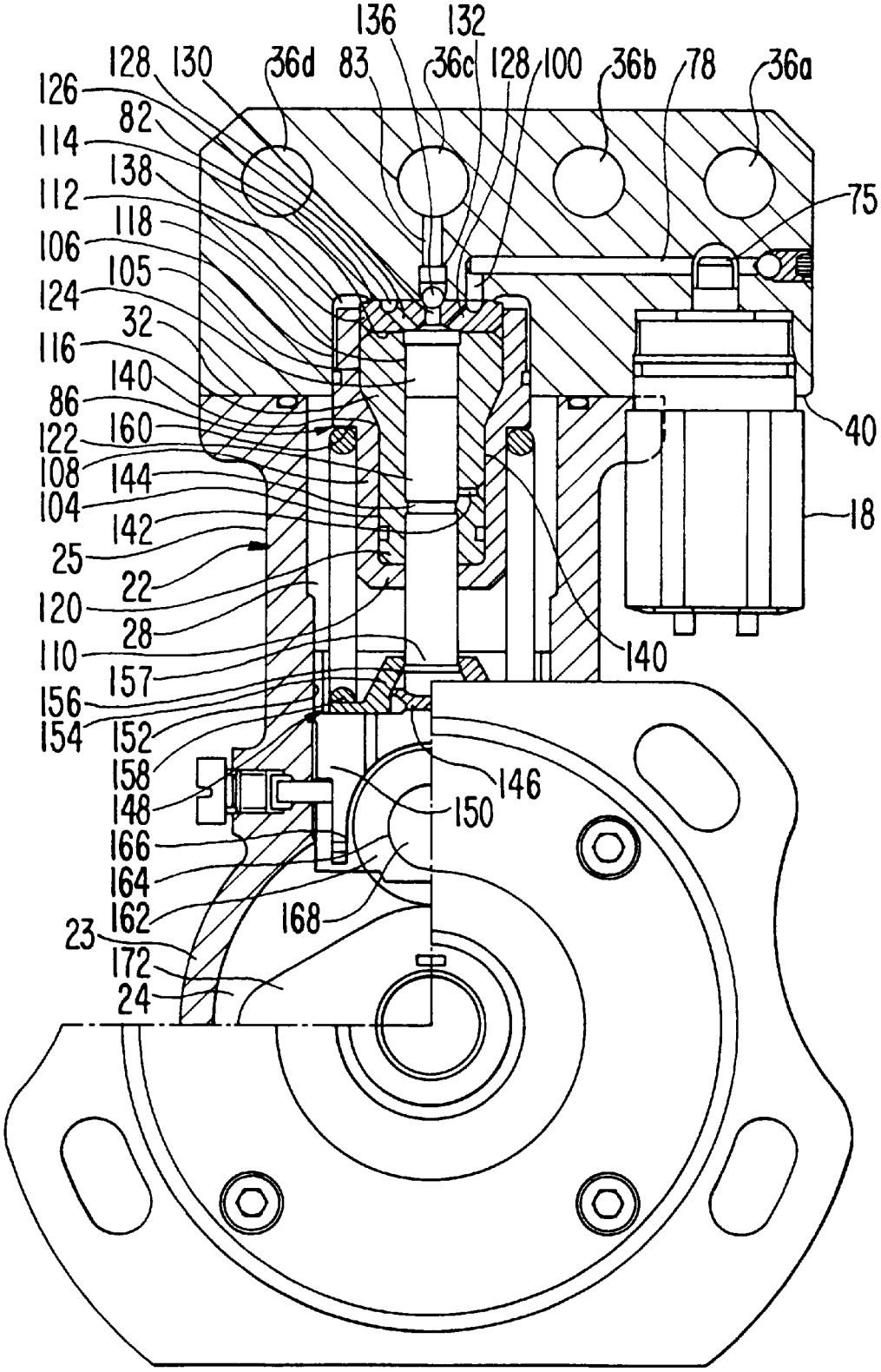
FIG. 6 is a partial cross sectional view of the fuel system assembly of FIGS. 2–5.
Figure 7:
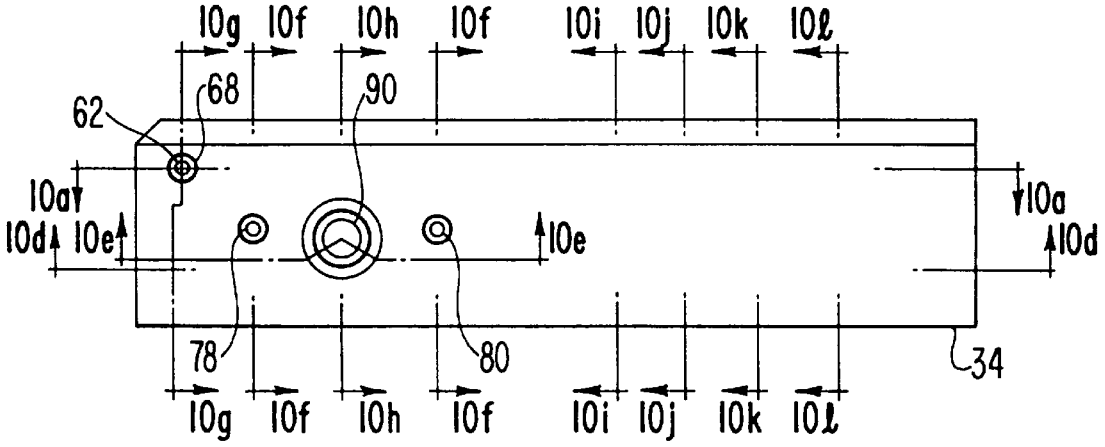
FIG. 7 is a side elevational view of an accumulator used in the fuel system assembly of FIGS. 2–6.
Figure 8:
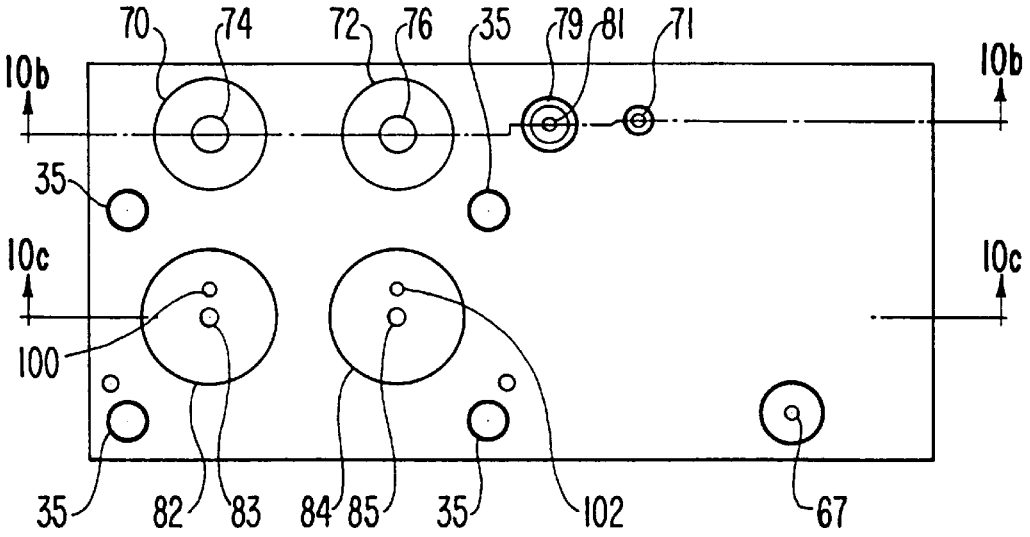
FIG. 8 is a bottom elevational view of the accumulator of FIG. 7.

Referring to FIGS. 2, 3 and 5, distributor housing 44 of fuel distributor 16 is mounted in cantilevered fashion on pump housing 22 adjacent drive shaft cavity 24 and extends outwardly from pump housing 22 in a spaced apart, generally parallel relationship with axial overhang 38 of accumulator housing 34. A first injection control valve 20 and second injection control valve 21 are mounted on distributor housing 44 in the space between the distributor housing and cantilevered axial overhang 38 of accumulator housing 34.

As described hereinabove, the various components of the unitized fuel delivery assembly 10 are oriented in a specific arrangement relative to one another so that subsequent connection of the respective housings 22, 34, and 44 forms a compact, unitized assembly having outer axial, radial and lateral extents within which other components, such as pressure sensor 42, injection control valves 20 and 21, pump control valves 18 and 19 and various fuel passages, can be simply and effectively integrated into the assembly while maintaining the functionality of each component and the compact nature of the assembly.

Figure 9:
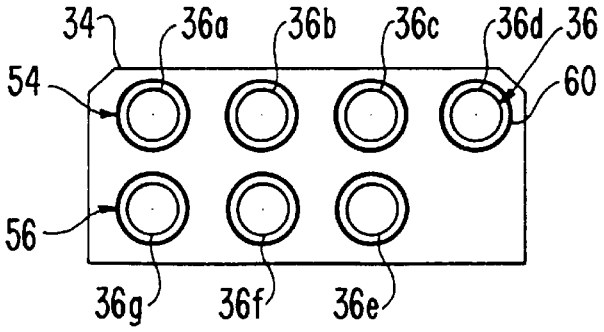
FIG. 9 is an end elevational view of the accumulator of FIGS. 7 and 8.

Referring to FIGS. 7–9 and 10*a*–10*l*, accumulator housing 34 is formed of an integral one piece block formed of high strength material such as SAE 4340, VIMVAR quality, tempered at 700 F.; SAE 4140, VIMVAR quality, tempered to HRc 37 and gas nitrided; Maraging 18Ni(250), aged at 900 F.; Customer 455 stainless steel, aged at 950 F.; and Aermet-100, aged at 900 F. Accumulator chambers 36 are formed in accumulator housing 34 by boring axial drillings in the one piece block starting at one end surface of the block. Accumulator chambers 36 are positioned to intersect a vertical plane extending through the accumulator housing 34 in a two dimensional array including an upper row 54 (FIG. 9) of four accumulator chambers 36*a*, 36*b*, 36*c* and 36*d*, and a lower row 56 (FIG. 9) of three accumulator chambers 36*e*, 36*f* and 36*g* as shown in FIG. 9. Each accumulator chamber 36 is elongated and cylindrical in shape and positioned adjacent, and in generally parallel relationship with, another chamber. Also, the open end of each chamber 36 is fluidically sealed with a plug 58 positioned in a recess 60 formed in the open end. The opposite end of each chamber 36 terminates in the block at a point short of the axial extent of housing 34.

Referring again to the details of the accumulator design as illustrated in FIGS. 7–9 and 10*a*–10*l*, upper row 54 of chambers 36*a*–*d* are fluidically interconnected by a first cross passage 62 and an axial passage 64. First cross passage 62 extends laterally through housing 34 perpendicular to the central axis of chambers 36 to intersect chambers 36*b*–*d* of upper row 54. Axial passage 64 extends perpendicularly from first cross passage 62 axially along housing 34 to communicate with chamber 36*a* which is shorter than the remaining chambers of upper row 54. First cross passage 62 is formed by drilling laterally through one side of the block to intersect chambers 36*b*–*d* of housing 34. The open end of first cross passage 62 is fluidically sealed by a plug (not shown) positioned in a recess 68 similar to plug 58 and recess 60 of accumulator chambers 36. Chamber 36*a* has been foreshortened to accommodate recess 68. Axial passage 64 is formed by drilling from the open end of accumulator chamber 36*a* prior to inserting plug 58. Likewise, accumulator chambers 36*e*, 36*f* and 36*g* of lower row 56 are interconnected by a second cross passage 69 drilled from one side of housing 34 laterally through housing 34 terminating at chamber 36*g*. A plug (not shown) is threaded into a recess 69*a* formed in the open end of second cross passage 69 to fluidically seal passage 69. Upper row 54 and lower row 56 are connected by a vertical passage 71 and an axial passage 73. Vertical passage 71 (FIG. 10*b*) extends upwardly from the lower surface of cantilevered axial overhang 38 to communicate with accumulator chamber 36*a*. The open end of passage 71 is fluidically sealed by a plug (not shown) positioned in a recess formed in the open end. Axial passage 73 communicates at one end with accumulator chamber 36*g* and at the opposite end with vertical passage 71. In this manner, first and second cross passages 62 and 69, and axial passages 64 and 73 connect accumulator chambers 36*a*–*g* together to form a fluidically interconnected labyrinth of chambers for temporarily storing fuel delivered from pump 14. A fuel feed passage 67 extending from the lower surface of axial overhang 38 communicates with accumulator chamber 36*d*. A recess formed in the open end of fuel feed passage 67 is adapted to receive a fuel feed tube for supplying the temporarily stored fuel to fuel injection control valves 20 and 21.

Referring to FIGS. 7, 8, 10*b* and 10*d*–10*f*, accumulator housing 34 also includes a first pump control valve recess 70 and second pump control valve recess 72 formed in the lower surface of housing 34 for receiving first and second pump control valves 18 and 19, respectively. First and second pump control valves 18 and 19 are each preferably a solenoid-operated valve assembly of the type disclosed in commonly assigned U.S. Pat. No. 4,905,960 to Barnhart incorporated herein by reference. A respective valve cavity 74,76 extends upwardly from each pump control valve recess 70,72 respectively, but terminates below accumulator chamber 36*a* for receiving a control valve element 75 (FIG. 6) of first pump control valve 18. A pair of fuel feed branches 78 and 80 are formed by drilling laterally inwardly from the vertical side of axial overhang 38 adjacent first and second pump control valves 18 and 19, respectively. The open ends of fuel feed branches 78 and 80 are each fluidically sealed with plug (not shown) secured in a respective recess formed in the open ends. Each fuel feed branch 78, 80 communicates with a respective valve cavity 74, 76 and extends laterally through housing 34 terminating at a position above the respective pump cavities 28, 30 when accumulator housing 34 is mounted on pump housing 22. In addition, accumulator housing 34 is provided with a stepped recess 79 (FIG. 10*i*) formed in the lower surface of axial overhang 38 adjacent second pump control valve recess 72 for receiving pressure sensor 42. A passage 81 connects recess 79 to accumulator chamber 36*a*.

Accumulator 12 also includes a first pump unit recess 82 and a second pump unit recess 84 formed in the lower surface of housing 34 in alignment with corresponding pump cavities 28 and 30 of the pump housing. Pump recesses 82 and 84 communicate and align with pump cavities 28 and 30, respectively, such that respective pump units 86 and 88 may be mounted within corresponding pump cavities 28 and 30 and recesses 82 and 84 as shown in FIGS. 5 and 6. In this manner, accumulator housing 34 and respective recesses 82 and 84 form a pump head for closing and sealing cavities 28 and 30. First and second pump unit outlet passages 83 and 85 extend vertically through accumulator housing 34 connecting first and second pump unit recesses 82 and 84, respectively, to accumulator chamber 36*c*.

Figure 10A:
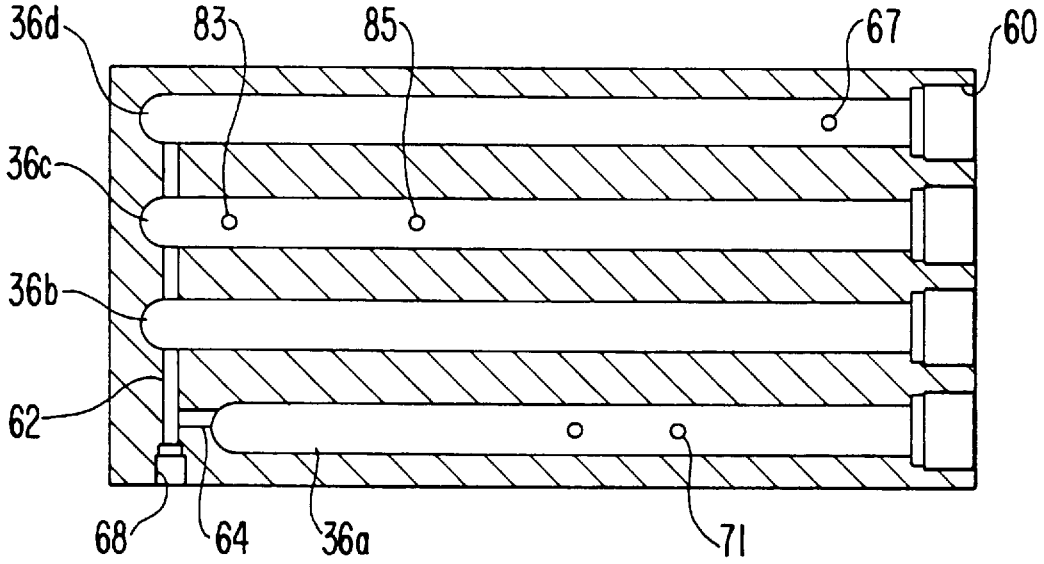
FIGS. 10*a*–10*l* are cross sectional views of the accumulator of FIGS. 7 and 8 taken along lines 10*a*–10*l*.
Figure 10B:
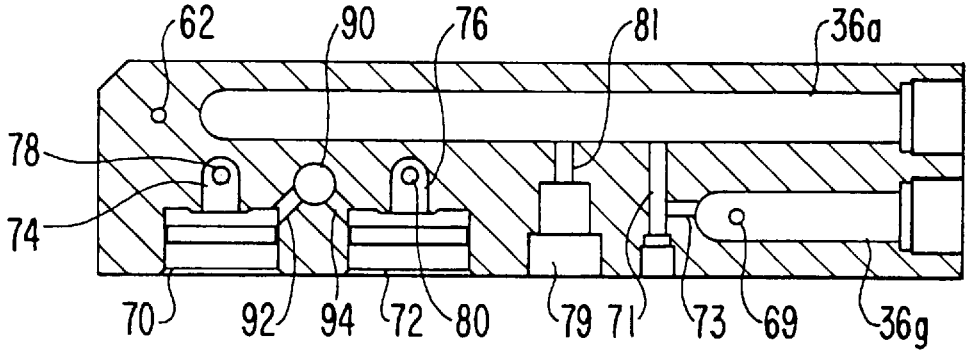
Figure 10C:
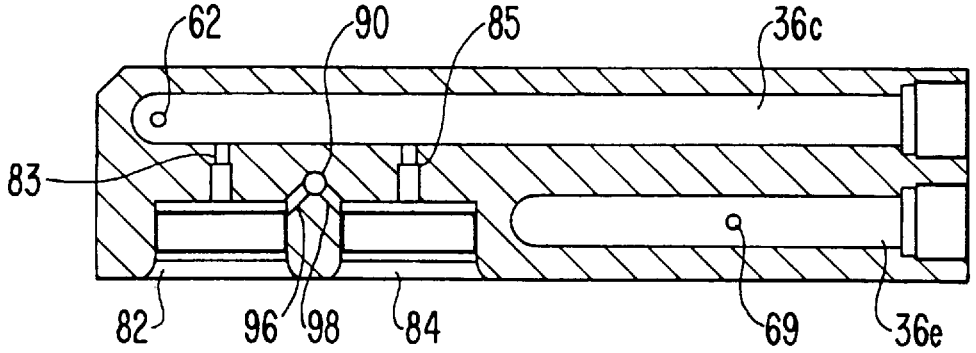
Figure 10D:
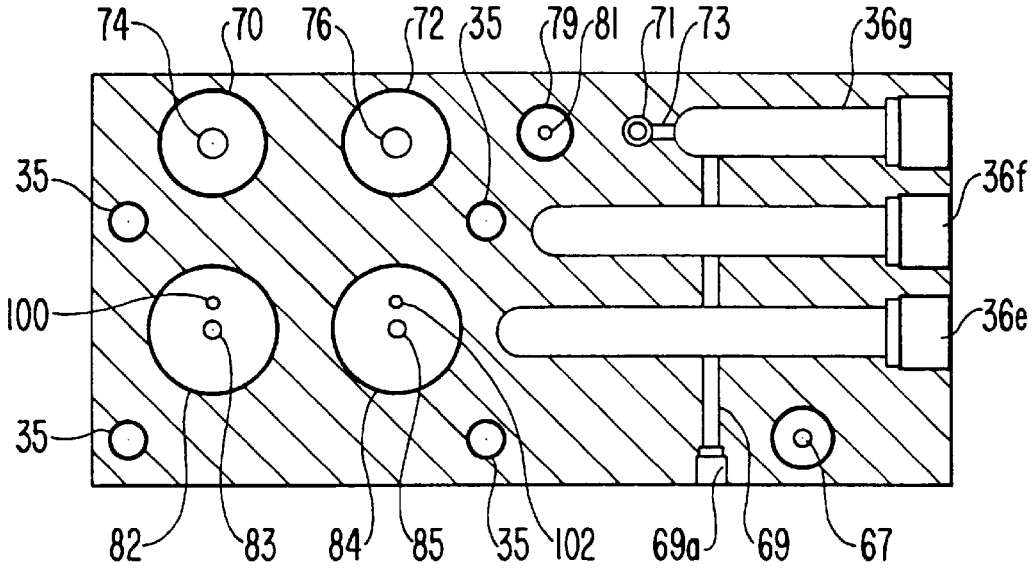
Figure 10E:
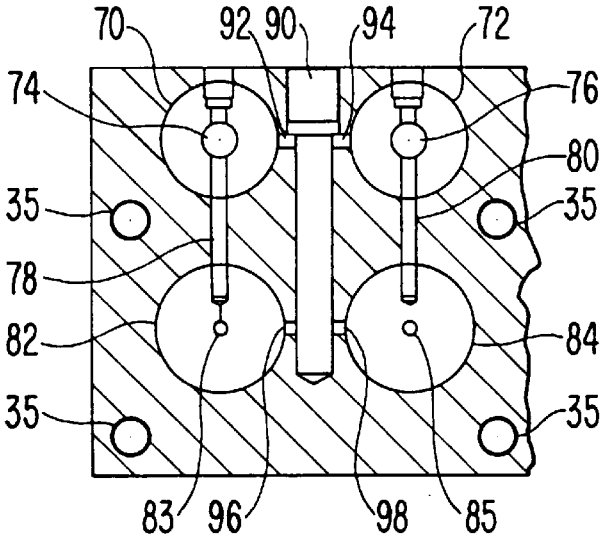
Figure 10F:
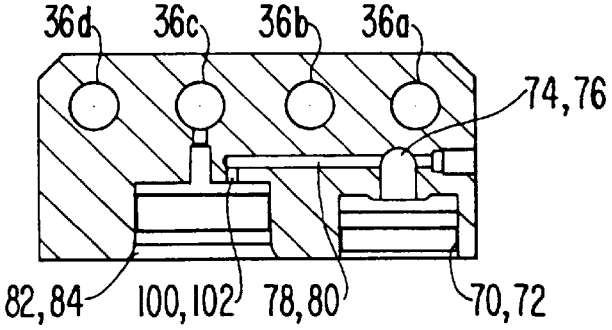
Figure 10G:
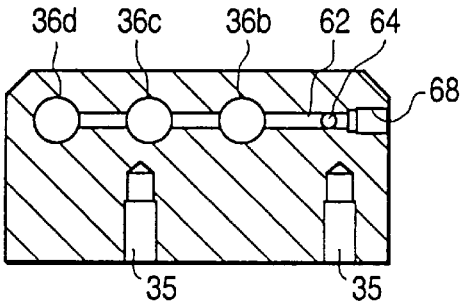
Figure 10H:
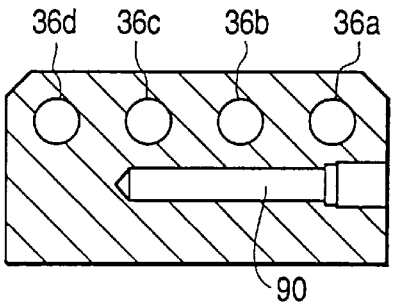
Figure 10I:
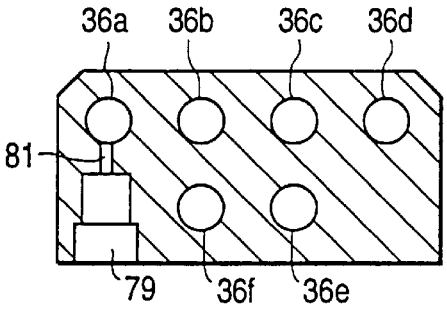
Figure 10J:
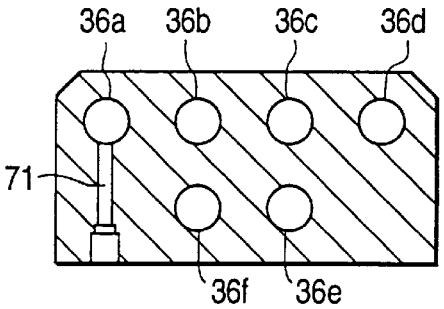
Figure 10K:
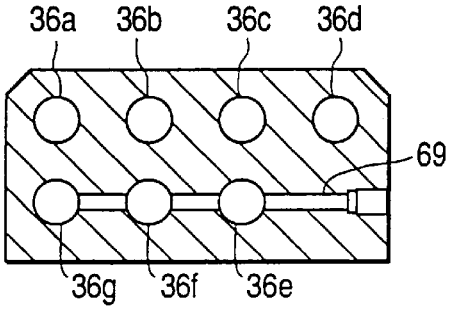
Figure 10L:
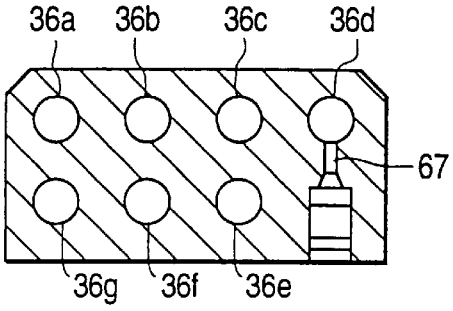
Figure 11:
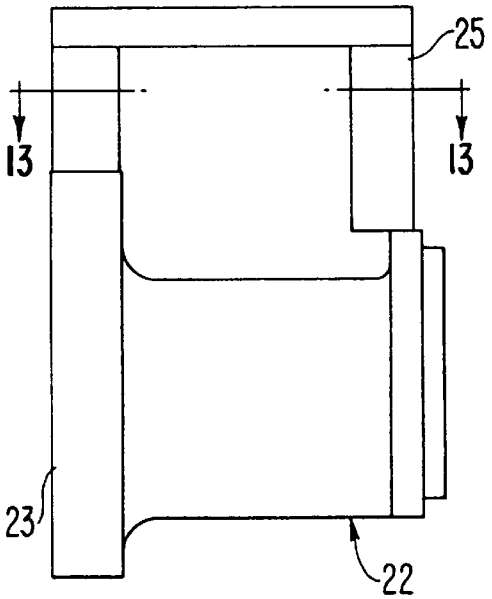
FIG. 11 is a side elevational view of a fuel pump housing used in the fuel system assembly of FIGS. 2–6.
Figure 12:
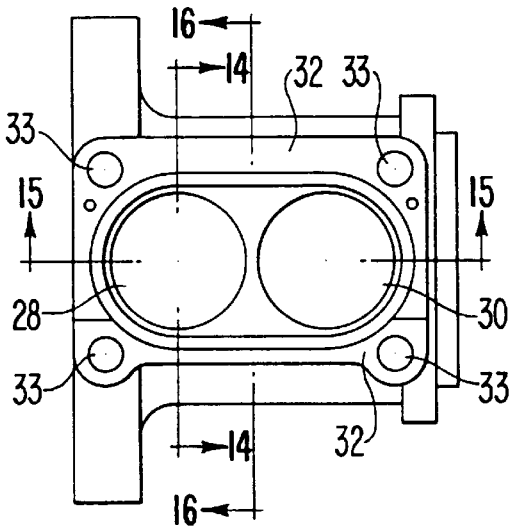
FIG. 12 is a top elevational view of the fuel pump housing of FIG. 11.
Figure 13:
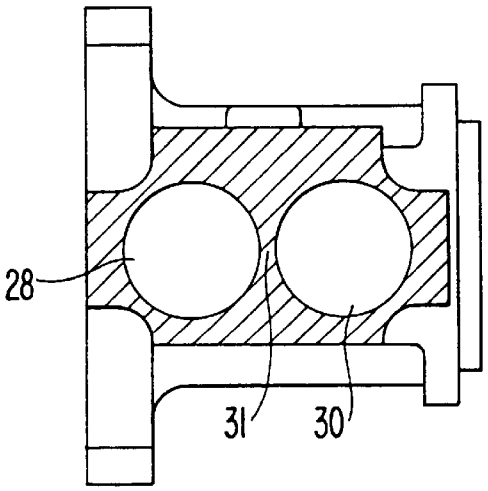
FIG. 13 is a cross sectional view of the fuel pump housing of FIG. 11 taken along line 13—13.
Figure 14:
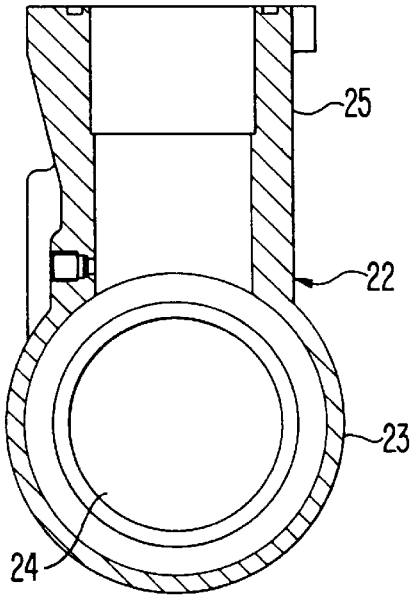
Figure 15:
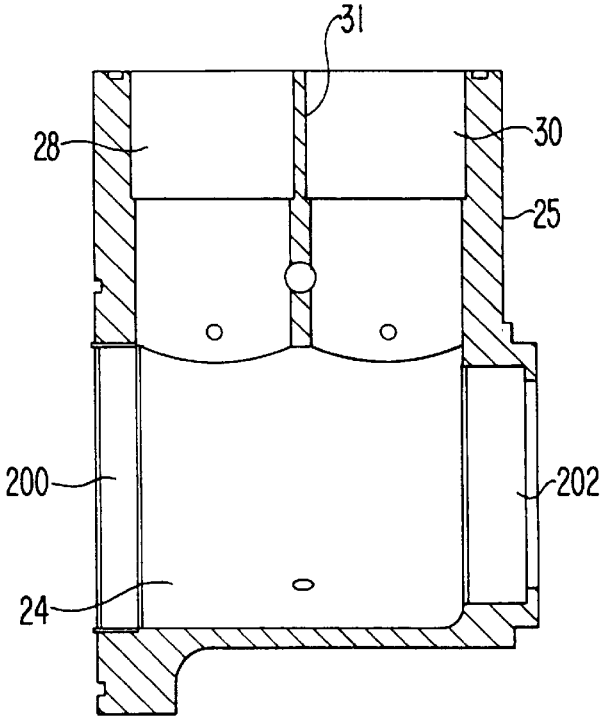
Figure 16:
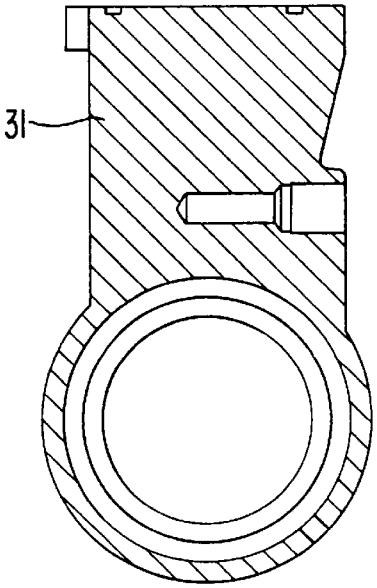

A common fuel feed passage 90 (FIGS. 5, 10*b* and 10*e*) extends laterally inwardly from the vertical side of lateral overhang 40 between and parallel to fuel feed branches 78 and 80. A pair of connector passages 92 and 94 connect common fuel feed passage 90 to pump control valve recesses 70 and 72, respectively. The opposite end of common fuel feed passage 90 is connected to pump recesses 82 and 84 via recess drain passages 96 and 98 (FIG. 10*e*) respectively for draining leak-by fuel from recesses 82 and 84 as further described hereinbelow. The most inward end of each fuel feed branch 78 and 80 is connected to the respective pump unit recesses 82 and 84 by fuel passages 100 and 102, respectively (FIG. 10*f*). In this manner, fuel entering common fuel feed passage 90 flows through connector passages 92 and 94 and valve recesses 70 and 72 into respective fuel feed branches 78 and 80 for delivery to pump units 86 and 88 via fuel passages 100 and 102 depending on the position of the respective pump control valves 18 and 19.

Accumulator chambers 36 are specifically dimensioned to create an aggregate volume sufficient to allow a controlled quantity of fuel at a predetermined operating pressure to be delivered to each engine cylinder at appropriate times throughout the entire operating range of the engine while also minimizing the physical dimensions of the accumulator housing 34 and ensuring that the accumulator housing walls are sufficiently strong to withstand the forces generated by the very high operating pressure, e.g., 5000 psi to 30,000 psi and preferably 16,000–22,000 psi, of the fuel in accumulator chambers 36. Determining the minimum required fuel storage volume for an accumulator designed is important in applying the subject invention to a particular engine. The accumulator volume is related to other component size choices as well. For example, the fuel quantity, timing range, injection pressure and duration required by an engine are the primary factors involved in arriving at the proper sizing of components used in designing a fuel system in accordance with the present invention which may be referred to as the Cummins Accumulator Pump System (CAPS). As an example, the sizing process for designing a fuel system in accordance with the subject invention for the Cummins B and C engine applications is described below.

The peak nozzle pressure for this application was selected to be 21,000 psi with rated duration of 30 degrees crank. The accumulator size was established based on the further constraint that the maximum fuel pressure drop during an injection event should not exceed five percent. The pumping element diameter and stroke were determined by calculating the fuel replacement requirements in the accumulator due to fuel injection, plus losses due to valve transition and leakage, distributor leakage, pumping element leakage, and injection line volume dumped to drain at the end of injection. Since there is one replacement pumping event for each injection event (the total number of cam lobes equal the number of engine cylinders), the total fuel loss from the various sources during one injection should be replaced by the one pumping event.

Figure 1A:
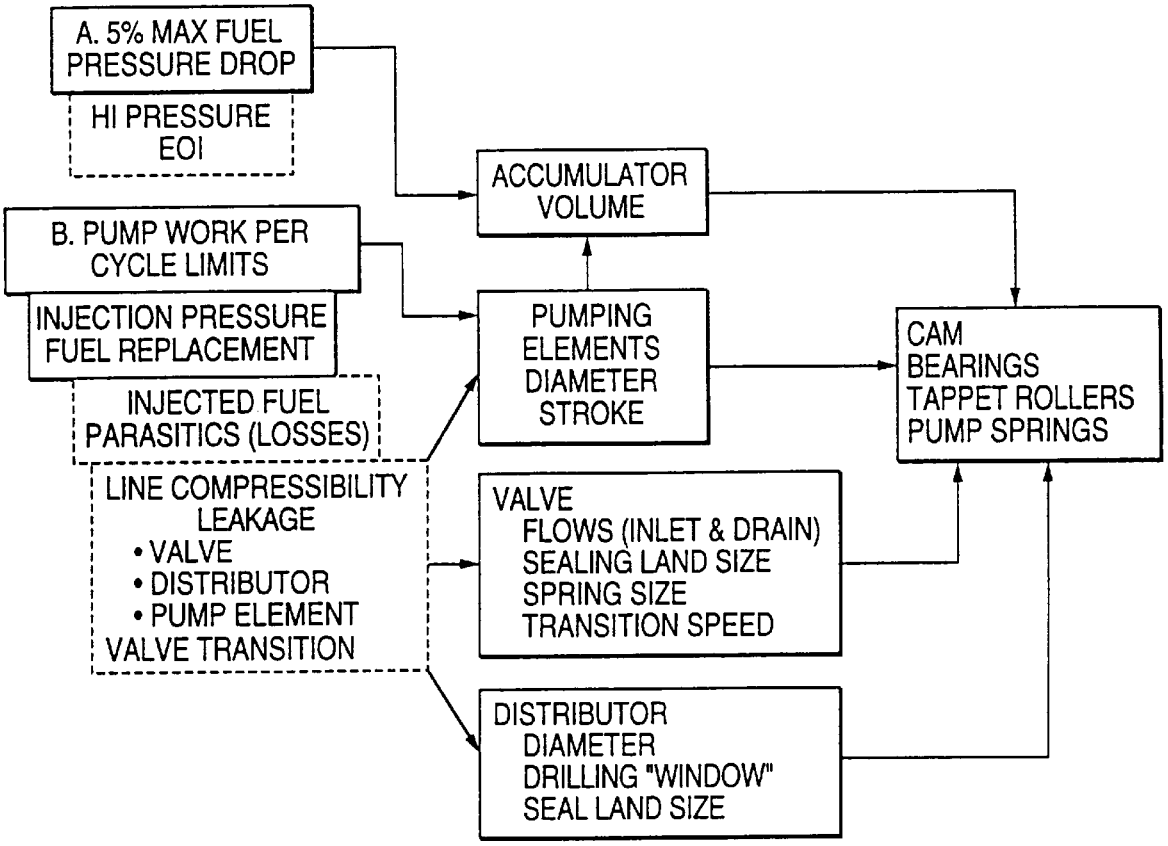
FIG. 1*a* is a schematic illustration of a method for designing a specific fuel system assembly in accordance with the subject invention.

A still further constraint was placed on the maximum acceptable power loss due to leakage and other causes, based on the requirement that CAPS parasitic horsepower should not exceed that of conventional types of prior art in-line pump designs, when operating at the same injection pressures. Other constraints were adopted such as limiting the pumping stroke, leakage and valve transition losses etc., limiting the size of sealing lands for the injection control valve and distributor, and valve transition speeds, (to avoid excessive accumulator leakage to drain). As sizing of the distributor, valve, accumulator volume, and pumping element stroke was determined, adequate information was available to design the cam, bearings, tappet rollers, and pumping element springs. Finally, to determine the final CAPS hardware design, the combination of these elements were oriented, rearranged, examined for vehicle and engine interference and analyzed for acceptable operating stress levels. FIG. 1*a* schematically summarizes the design process.

With respect to the accumulator, the following information summarizes the analytical procedure which was followed to determine the minimum required volume for the accumulator as applied to a fuel system designed in accordance with the subject invention for the B and C Cummins engines:

Step 1. Calculation to determine maximum flow allowable for CAPS pumping elements. Note: Power to support flow through the CAPS system should not significantly exceed conventional PLN fuel systems of the high pressure, high performance type.

Current PLN fuel systems operating at 1200 bar pump pressure require 5.65 Kw drive power at 2400 rpm. Thus the drive power should not be significantly greater for CAPS. Since the pump pressure with CAPS is nearly constant, the maximum allowable pump delivery can be calculated from the following relationship for a 6 cylinder engine.

$$\frac{Pwr*60}{\mathrm{Np}*6} = P*V$$

where:

Pwr=power requirement (w)

Np=pump speed (rpm)

P=pump delivery pressure (Pa)

V=pump delivery volume (m**3)

With the design constraint that CAPS's power requirement is not to exceed 5.65 kW, this equation can be used to solve for the maximum pump delivery. At 1100 bar and 2400 rpm, this calculation indicates that the pump delivery should not exceed 428 mm 3/stk.

Step 2. Calculation to determine that the CAPS components do not exceed allowable flow and drive power requirements.

The pump delivery volume is the sum of the fuel volumes required for combustion, line pressurization, and leakage.

Reducing the leakage is thus critical to successful implementation of the present invention. The leakage volumes were analyzed and reduced by design optimization. The following Table 1 lists the volume contributions to the total pump delivery for a Cummins C series engine.

TABLE 1

C Engine Pump Delivery Breakdown in mm**3 for CAPS

| operating condition | low torque 800 rpm | torque peak 1300 rpm | rated pwr 2400 rpm |
|---|---|---|---|
| maximum fueling | 150 mm3 | 190 mm3 | 155 mm3 |
| line pressure | 91 mm3 | 91 mm3 | 91 mm3 |
| solenoid leak* | 80 mm3 | 49 mm3 | 27 mm3 |
| distributor leak* | 150 mm3 | 92 mm3 | 50 mm3 |
| pump leakage* | 30 mm3 | 22 mm3 | 17 mm3 |
| total | 501 mm3 | 444 mm3 | 340 mm3 |

*note:
see leakage calculation approach below.

This analysis shows that the CAPS should not exceed PLN systems at torque peak through rated speeds of the same injection pressure. At lower speeds, the pump delivery increases due to the increased time available for leakage. This volume must be used for design, since high pressure capability at low speed is critical to the CAPS concept. Pumping power required at low speeds could be expected to be higher than conventional PLN systems, when CAPS is operated at high pressure at low speed.

Step 3. Calculation to determine accumulator volume required to assure accumulator pressure does not drop more than 5% between pumping events.

Determination of Accumulator Volume Requirement

Figure 1B:
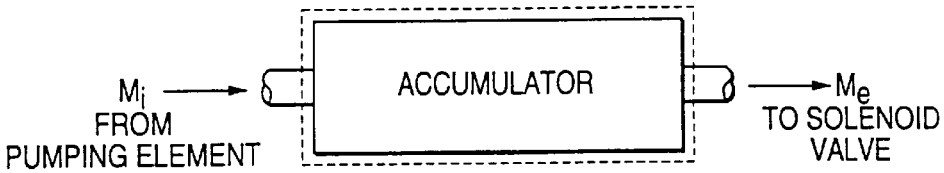
FIGS. 1*b*–1*i* are schematic illustrations of techniques for applying the method of FIG. 1*a*.

Calculation of the accumulator volume required for a given pressure level and pressure drop during pumping was calculated as follows. Assume uniform state, uniform flow during pumping process for one pumping event as illustrated in FIG. 1*b*.

Also, it is assumed that pumping element and fuel delivery (injected +leaked) do not occur concurrently (exit mass flux is zero), adiabatic and no work done on control volume. Therefore energy equation reduces to the following relationship for a control volume with one inlet.

$$m_i h_i = m_2 u_2 - m_1 u_1$$

From conservation of mass $$m_2 = m_1 + m_i$$

and thermodynamic relation $$h = u + \frac{p}{\rho}$$

substitute $$m_i\left(u_i + \frac{P_i}{\rho_i}\right) = (m_1 + m_i)u_2 - m_1 u_1$$

For a small pressure drop assume density is constant, energy content of inlet mass negligible compared to energy stored in accumulator and negligible temperature rise due to inlet fuel mass.

Therefore $$m_i \frac{P_i}{\rho_i} = m_1(u_2 - u_1)$$

convert to volume $$m = \rho V \text{ and } m_i = m_2 - m_i = \Delta m$$

$$V_{acm} = \frac{\rho_0 \Delta V P_1}{\rho_1^2 (u_2 - u_1)}$$

where:

P=initial pressure

ΔV=pump volume delivery per stroke $\rho_1$=density at pressure $u_2-u_1$=internal energy for fuel The internal energy of diesel fuel is calculated from the relationship for bulk modulus as a function of pressure.

$$B = a + bP = \rho \frac{dP}{d\rho}$$

$$u_2 - u_1 = \frac{1}{\rho_0 b}\left[a(C-1) + \frac{1}{1-b}(B_0 + BC)\right]$$

where:

$$C = \left(\frac{B_0}{B}\right)^{\frac{1}{b}}$$

$B_0$=bulk modulus at atmospheric

B=bulk modulus at actual pressure

P=pressure a=constant b=constant $\rho_0$=density at atmospheric conditions the final result follows:

$$V_{acm} = \frac{\rho_0 \Delta V P_1}{\frac{\rho_1^2}{\rho_0 b}\left[a(C_2 - C_1) + \frac{1}{1-b}(B_1 C_1 - B_2 C_2)\right]} \quad \text{Eq. A}$$

For a given volume change, pressure and pressure drop, the volume required can be readily calculated. As the pump delivery increases the accumulator volume increases, therefore the highest pump delivery must be used to size the accumulator. As shown, the highest pump delivery occurs at low speed due to leakage. Using the low speed 501 mm3 pump delivery and a 5% pressure drop design constraint, the required accumulator volume is calculated to be about 130,000 mm3.

As previously indicated, the pump delivery per stroke is the sum of the combustion, line volume pressurization and leakage fuel quantity.

$$\Delta V = V_{injected} + \Delta V_{line} + \Delta V_{slndleak} + \Delta V_{distleak} + \Delta V_{pumpleak}$$

Figure 1C:
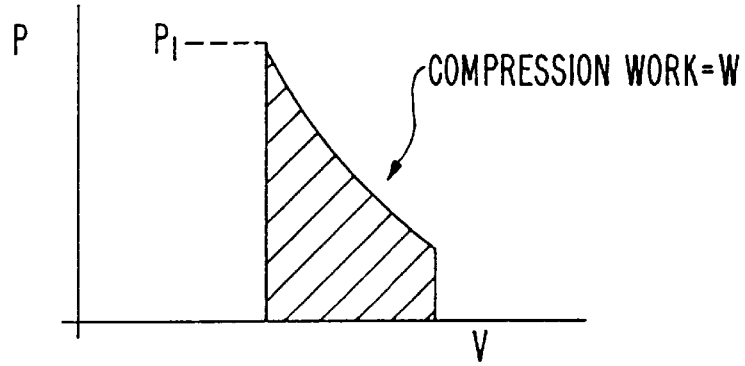
Figure 1D:
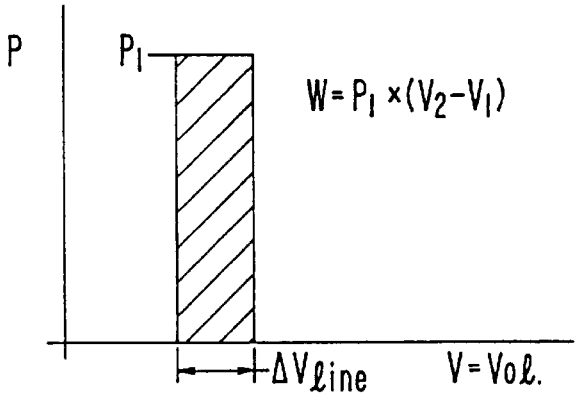

The line volume loss was calculated from the specific energy relationship previously shown. Once the compression energy required to raise the total line volume to injection pressure was known, an effective fuel volume was calculated for a constant pressure as illustrated in FIG. 1*c* and FIG. 1*d*.

Leakage for the solenoid, distributor and pumping element were calculated using energy conservation, pressure vessel expansion formulas and diesel fuel thermodynamic properties. The clearance leakage flow can be calculated from the following equation.

$$Q = \frac{\pi D h^3 \Delta P}{12 \mu L}$$

where:

D=shaft diameter h=clearance

ΔP=pressure drop $\mu$=viscosity at temperature and pressure

L=seal length

Figure 1E:
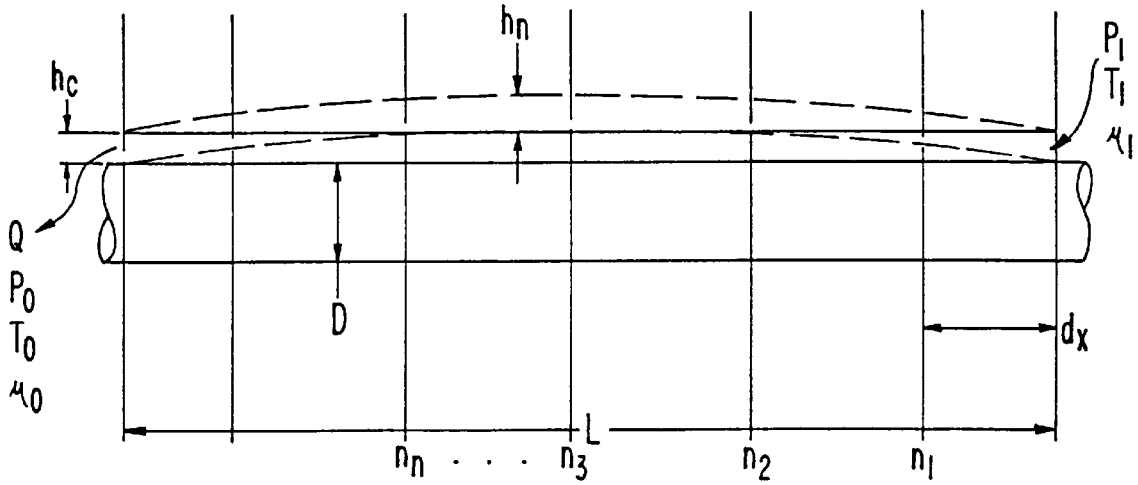

Since the temperature profile, viscosity, pressure profile and clearance are unknown and dependent on each other, the flow is solved iteratively at dx intervals along the seal length assuming that the enthalpy is constant. See FIG. 1*e*.

The solenoid valve is more complex due to the parallel flow that must be iterated. Also, the valve dynamics are calculated using a multi-degree of freedom spring, mass and damper model.

Once the pump volume delivery was known, the pumping element stroke was calculated knowing the plunger diameter. The selection of the plunger diameter and stroke involved several iterations on hydraulic force, contact stress, bearing load, instantaneous torque, cam diameter, roller diameter and no follow (component inertia). All of these parameters are dependent on the plunger diameter and stroke combination. Optimization of one parameter will most likely adversely affect other parameters. A spreadsheet program can be used to analyze the various design options.

Determination of Accumulator Size and Shape for 130,000 $mm^3$ Accumulator Volume (Part I)

The CAPS package size is determined by envelope constraints of engine and vehicle components. The same gear train system in the current engine was assumed to be suitable for driving the CAPS fuel pump. The camshaft, which transmits power from the gear train to the CAPS fuel pump, was determined to be one of the constraints to locating the CAPS assembly. FIG. 1*f* shows the boundary constraints for the CAPS assembly as applied to a Cummins engine.

In FIG. 1*f*, the right hand and bottom surfaces are limited by the engine block. The engine size and other vehicle components constrain the left hand and top surfaces. (These two surfaces are drawn based on the gear train housing boundary in FIG. 1*f*.) The envelope length constraint is determined by the distance between the gear train housing and the engine fuel filter.

Figure 1G:
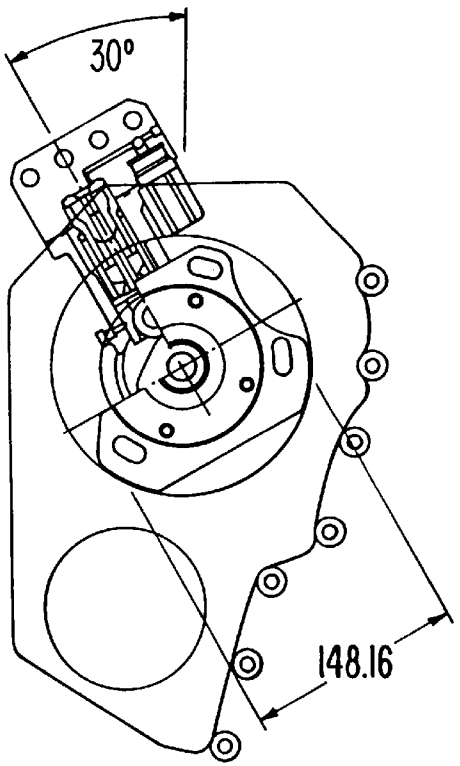
Figure 1F:
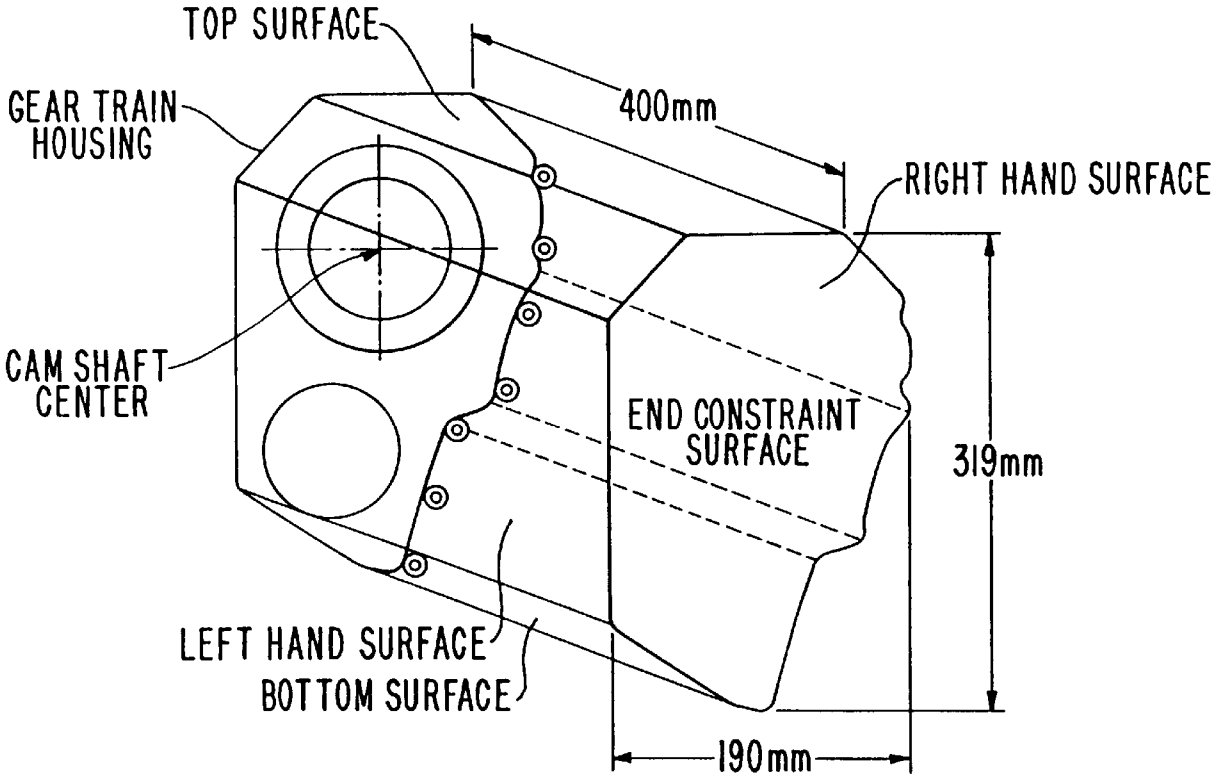

FIG. 1*g* shows how the CAPS assembly fits into the constraint envelope. In order to prevent contact with the engine block at the top corner, the entire assembly is rotated by 30° degrees when it is installed in the engine. Both side constraints and the top boundary are tight in the CAPS design planned for the Cummins C series engine. However, space is available in the longitudinal and bottom directions.

Figure 1H:
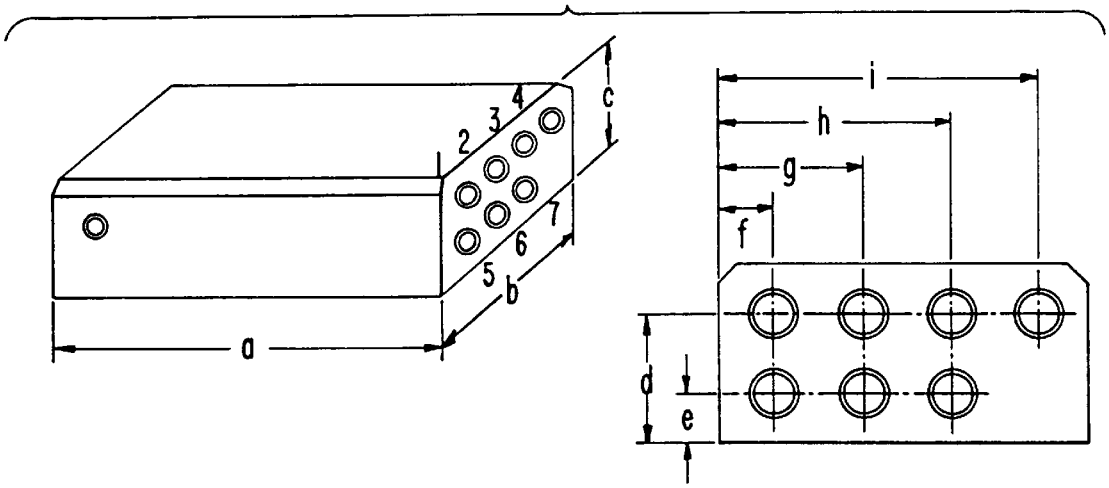

The design shown in FIG. 1*g* and FIG. 1*h* was arrived at by examining numerous accumulator designs. The accumulator dimensions required for a sufficiently strong accumulator consisting of a single internal chamber was determined. It was found that the length of the accumulator did not meet the envelope requirements. The next step involved examining designs with multiple chambers with some designs involving stacked chambers. The multiple chambers increased the width and shortened the length. Adding stacked chambers reduced the width with some height increase. The combination of strength, width, and length requirements were best met by the multiple stacked chamber accumulator shown in FIG. 1*h*. The dimensions identified in FIG. 1*h* are set forth in the following Table 2.

TABLE 2

| Dimension | Size (mm ± .05) |
|---|---|
| a | 212 |
| b | 106 |
| c | 54 |
| d | 41 |
| e | 15 |
| f | 15 |
| g | 41 |
| h | 67 |
| i | 93 |

The layout design of cylindrical drilling holes was based on: (1) the amount of fuel (130,000 $mm^3$) contained inside the accumulator as calculated using Eq. A and (2) prevention of fatigue failure during testing and field operation. Two rows of cylindrical drillings are designed to avoid the long and large holes. Hole No. 1 is shorter than holes No. 2, 3, and 4 to ensure enough wall thickness away from the 4 mm cross hole plug seat. Bottom holes are shorter due to constraints on the pressure sensor and the fuel pump inlet. All drilling holes are designed to have a 13 mm diameter, and they are interconnected by a 4 mm cross hole or vertical side hole. The hole dimensions as shown in Table 3 below are sized to have the desired fuel volume within the accumulator.

TABLE 3

Accumulator Drilling Hole Size

| Hole No. | Diameter (mm) | Length (mm) | Volume (mm**3) |
|---|---|---|---|
| 1 | 13 | 164 | 21856.6 |
| 2 | 13 | 182.63 | 24329.4 |
| 3 | 13 | 182.63 | 24329.4 |
| 4 | 13 | 182.63 | 24329.4 |
| 5 | 13 | 45.5 | 6127.8 |
| 6 | 13 | 80.5 | 10773.4 |
| 7 | 13 | 89.5 | 11968 |
| Total | | | 123713.9 |
| Accumulator approx. total weight (lbs): | | | 18.82 |

The wall thickness around holes is determined so that the stresses at stress concentrations are less than the allowable material strength to prevent fatigue failure. The pressure vessel formula as well as detailed finite element analysis are used to estimate the stress levels. Since the stress concentration at drilling hole intersections is a major concern in the accumulator design, the detail finite element analysis would provide adequate local stress results. It is known that the stress concentration factor for closed end cylinders with side holes or cross holes is typically from 3.0 to 4.0. For example, the stress concentration factor in Peterson's book is 3.42 for the holes size given in Table 4.

The analytical pressure vessel formula for the maximum tensile stress $\sigma_t$ in the circumferential direction is $$\sigma_t = p(b^2+a^2)/(b^2-a^2) \quad (1)$$

where p is the internal radial pressure, a is the cylinder inner radius, and b is the cylinder outer radius. The cylinder wall thickness t is calculated by t=b−a. Note that Eq. (1) is accurate for cylindrical thick vessels without intersecting drillings. Also, the effect of closed end cap is not considered.

The objective is to find out the minimum wall thickness for a given operating pressure, drilling hole diameter, and material properties. Five materials were considered for prototype accumulator fabrication. They were:

1. SAE 4340, VIMVAR quality, tempered at 700 F.
2. SAE 4140, VIMVAR quality, tempered to HRc 37 & gas nitrided.
3. Maraging 18Ni(250), aged at 900 F.
4. Customer 455 stainless steel, aged at 950 F.
5. Aermet-100, aged at 900 F.

Table 4 below shows the wall thickness requirement for various materials and stress intensification factors (SIF) at the drilling intersection. In Table 4, the material allowable tensile stress is calculated from the Goodman diagram for R=O. The stress intensification factor at the drilling hole intersection depends on the hole diameter, intersection angle, hole offset, radius at intersection corner, etc., and the SIF is given as a design input data in Table 4. The allowable maximum tensile stress inside the pressure vessel is the material allowable tensile stress divided by the stress intensification factor. The accumulator drawing shown in FIG. 4B has a 6.5 mm minimum wall thickness. With results calculated in Table 4, it is concluded that the wall thickness around the holes is adequate for the selected material in the accumulator design.

TABLE 4

Sizing the Accumulator Wall Thickness

| Drilling Hole Radius (mm) | Operation Pressure* (ksi) | Acm. Material | Material Strength Ult. Str. Su (ksi) | Material Strength Edn Str. Se** (ksi) | Allow. Tensile Str. from GDM R = 0 Sa (ksi) | Estimated SIF @ drill intersec. | Allow. Max. Cylind. Tensile Str. [Sa/SIF] (ksi) | Min. Wall Thickness (mm) |
|---|---|---|---|---|---|---|---|---|
| 6.5 | 19.575 | SAE 4340 | 270 | 80.64 | 124.189 | 2.5 | 49.676 | 3.359 |
| 6.5 | 19.575 | SAE 4340 | 270 | 80.64 | 124.189 | 3 | 41.396 | 4.365 |
| 6.5 | 19.575 | SAE 4340 | 270 | 80.64 | 124.189 | 3.42 | 36.313 | 5.377 |
| 6.5 | 19.575 | SAE 4340 | 270 | 80.64 | 124.189 | 4 | 31.047 | 7.154 |
| 6.5 | 19.575 | AM-100 | 280 | 115.2 | 163.239 | 2.5 | 65.296 | 2.356 |
| 6.5 | 19.575 | AM-100 | 280 | 115.2 | 163.239 | 3 | 54.413 | 2.973 |
| 6.5 | 19.575 | AM-100 | 280 | 115.2 | 163.239 | 3.42 | 47.731 | 3.55 |
| 6.5 | 19.575 | AM-100 | 280 | 115.2 | 163.239 | 4 | 40.81 | 4.461 |

Note: *Operation pressure 1350 bar = 19.575 ksi.
**A 0.72 surface finish factor is included in the endurance strength.

In the study of stresses at the drilling hole intersection, the following two types of loadings are considered.

Condition 1: A significant number of engine start-up/shut down cycles occur throughout the accumulator life. This results in an estimated 25,000 pressure cycles in the accumulator from 0 to 1100 bar.

Condition 2: Small pressure fluctuations occur in the accumulator cylinders during operation. A maximum pressure drop of 15% from the maximum pressure level (1100 bar) is assumed. These pressure fluctuations from 935 to 1100 bar are anticipated to occur $10^8$–$10^9$ cycles.

Figure 1I:
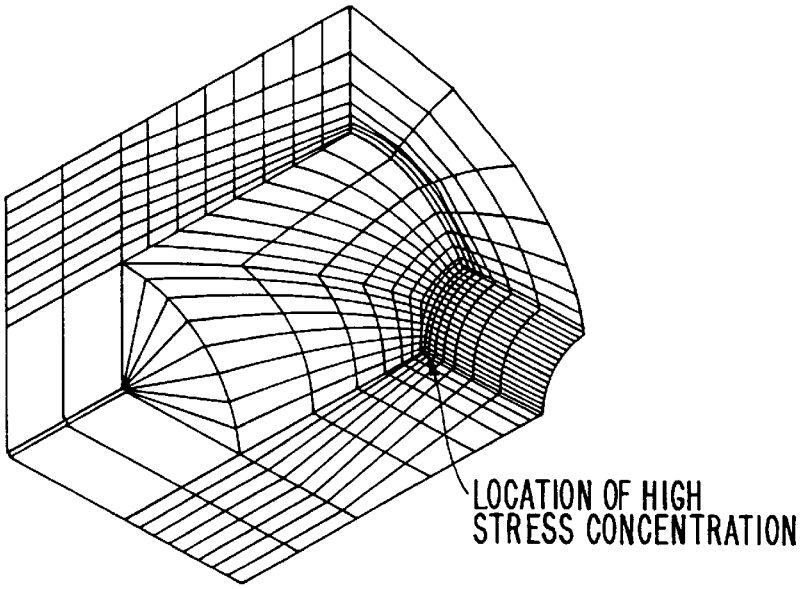

A 3-D finite element model is shown in FIG. 1*i*. The model has 1168 elements and 1566 nodes. The analysis results are summarized in Table 5. The stress intensification factor ranging from 3.0 to 4.4. is estimated for various hole size. The Aermet-100 material properties are used to calculate the fatigue margin in Table 5. The analysis results in Table 5 show the accumulator has excellent structural integrity if the operating pressure condition does not exceed 1100 bar. Also, abrasive flow machining is recommended to improve intersection geometry and keep stress concentrations to a minimum, thereby preventing fatigue failures.

TABLE 5

Stress Analysis Results of Accumulator Drilling Hole Intersections

| Cylnd. Hole Diam. (mm) | Cross Hole Diam. (mm) | Operation Pressure (ksi) | Intersec. Radius (mm) | Closed End Cap | Nominal Stress (ksi) | Max. Tens. Str (ksi) | Stress Intens. Fact. Smax/Snom | Fatigue Margin** Cond. 1 | Fatigue Margin** Cond. 2 |
|---|---|---|---|---|---|---|---|---|---|
| 13 | 3 | 15.95 | Square | no | 17.744 | 78 | 4.4 | 54% | 82% |
| 13 | 4 | 15.95 | Square | no | 19.286 | 81 | 4.2 | 53% | 81% |
| 13 | 4 | 15.95 | Square | yes | 19.286 | 82 | 4.25 | 52% | 81% |
| 13 | 4 | 15.95 | 0.5 | yes | 19.286 | 78 | 4.04 | 54% | 82% |
| 13 | 8 | 15.95 | Square | no | 35.394 | 107 | 3.02 | 33% | 71% |

Note: *1100 bar = 15.95 ksi.
**The material Aermet - 100 is used to estimate the fatigue margin.

Reference will now be made to the details of the pump assembly. In particular, the pump units 86 and 88 will now be described in detail with reference to FIGS. 5 and 6. Pump units 86 and 88 of pump 14 are structurally the same and, therefore, only pump unit 86 will be described hereinbelow. Pump unit 86 includes a pump retainer 104 positioned in pump unit recess 82 and extending outwardly toward camshaft cavity 24. Pump retainer 104 is generally cylindrical in shape to form a cavity 105 and includes an upper portion 106 having external threads for engaging complementary threads formed on the inner surface of pump unit recess 82. Retainer 104 also includes a smaller diameter lower portion 108 extending into pump cavity 28 and terminating to form a lower wall 110. Pump unit 86 also includes a disk 112 positioned within cavity 105 and pump unit recess 82 and a pump barrel 116 mounted adjacent disk 112 in cavity 105 of retainer 104. Retainer 104 holds barrel 116 and disk 112 in a compressive abutting relationship with disk 112 forced against accumulator housing 34 when retainer 104 is fully threaded into recess 82. A center bore 118 extending throughout the entire length of pump barrel 116 is aligned with a central opening 120 in lower wall 110 of retainer 104. A pump plunger 122 is mounted for reciprocal movement in central bore 118 and central opening 120 to form a pump chamber 124 between the upper end of plunger 122 and disk 112 which forms an end wall 114 for pump chamber 124. Thus, retainer 104 permits pump units 86 to be mounted in pump unit recess 82 of accumulator housing 34 and extend into pump cavity 28 of pump housing 22 without directly contacting pump housing 22. This arrangement limits the high pressure sealing surfaces to the contact areas between the disk 112 and recess 82, and disk 112 and barrel 116, thereby avoiding the need for sealing surfaces on pump housing 22. Also, retainer 104 can be inexpensively and easily machined as a replacement part with the appropriate dimensions to correspond to the dimensions of recess 82 of accumulator housing 34.

An annular disk groove 126 formed in the upper surface of disk 112 adjacent housing 34 communicates with respective fuel passage 100. A pair of axial disk inlet passages 128 extend from annular disk groove 126 on opposite sides to connect with pump chamber 124. A disk outlet passage 130 extending through the center of disk 112 is aligned with a check valve recess 132 formed in accumulator housing 34 adjacent disk 112. Pump unit outlet passage 83 extends from check valve recess 132 through accumulator housing 34 to connect with accumulator chamber 36*c*. A pump unit check valve 136 is positioned in check valve recess 132 and adapted to sealingly engage the upper annular surface of disk 112 surrounding outlet passage 130 to prevent the flow of high pressure fuel from chamber 36*c* when the pressure of the fuel in chamber 36*c* is greater than the pressure of the fuel in pump chamber 124 while permitting fuel flow from chamber 124 into accumulator 36*c* when the pressure in pump chamber 124 exceeds the fuel pressure in accumulator chamber 36*c*.

Respective recess drain passage 96 extending from common fuel passage 90 communicates with an annular recess clearance 138 formed between the annular top surface of pump retainer 104 and accumulator housing 34. A pump unit clearance 140 formed between both pump disk 112 and retainer 104, and barrel 116 and retainer 104, communicates at all times with recess clearance 138. A retainer drain passage 142 formed in barrel 116 extends radially outwardly from central bore 118 to communicate with pump unit clearance 140 adjacent lower portion 108 of retainer 104. An annular drain groove 144 formed in pump plunger 122 intermittently communicates with drain passage 142 during reciprocation of pump plunger 122. Fuel leaked from pump chamber 124 between barrel 116 and plunger 122 collects in drain groove 144 and intermittently drains into drain passage 142. Fuel from drain passage 142 is continuously drained through pump unit clearance 140, recess clearance 138 and recess drain passage 96 into common fuel feed passage 90.

As shown in FIGS. 5 and 6, the lower end of pump plunger 122 extends through lower wall 110 of retainer 104 to engage a button 146 of a tappet assembly 148. Button 146 includes an upper semi-spherical seating surface for engaging a complementary semi-spherical surface formed on the lower end of pump plunger 122. Tappet assembly 148 also includes a tappet housing 150 having a cylindrical outer surface mounted for reciprocable movement against corresponding cylindrical tappet guiding surfaces 152 formed on a portion of the vertical interior walls of pump housing 22. Tappet guiding surfaces 152 are machined to ensure smooth sliding contact between tappet housing 150 and pump housing 22 as housing 150 reciprocates. A lower spring seat 154 positioned around button 146 and the lower end of plunger 122 engages both button 146 and a retaining ring 156 positioned in an annular groove 157 formed on plunger 122. A bias spring 158 positioned around lower portion 108 of retainer 104 engages, at one end, a step 160 formed between upper portion 106 and lower portion 108 of retainer 104. The opposite end of bias spring 158 extends through pump cavity 28 to engage lower spring seat 154 thereby biasing tappet assembly 148 and plunger 122 toward camshaft 26. A roller 162 including a central bore 164 is positioned in an interior cavity 166 formed in tappet housing 150. Roller 162 is rotatably secured to housing 150 by a pin 168 extending through bore 164 into apertures 170 formed in tappet housing 150 on opposite sides of cavity 166. Therefore, each roller 162 associated with each tappet housing 150 is biased by spring 158 against a respective cam 172 formed on camshaft 26.

Cams 172 are positioned in camshaft cavity 24 between a first opening 200 and a second opening 202 formed in lower portion 23 of pump housing 22. Camshaft 26 is secured to an engine shaft (not shown) by a woodruff key 173 or any other conventional means for securing two rotating shafts together. Camshaft 26 rotates at a speed half of the engine speed to rotate each cam 172 360 degrees for every 720 degrees rotation of the engine crankshaft. Each cam 172 includes at least one lobe 204 for causing the associated pump plunger 122 to undergo one advancing or pumping stroke and one return stroke for each revolution of the camshaft. However, in order to supply, maintain and control the high fuel pressure in accumulator chambers 36, it is advantageous to replenish fuel in the accumulator chambers 36 in synchronism with the removal of fuel from accumulator chambers 36. To accomplish this sequential operation, the number of advancing strokes must equal the numbers of engine cylinders. In the six-cylinder engine of the preferred embodiment, two pump units 86 and 88 are each driven by a respective cam 172 provided with three lobes 204 so that the total number of lobes and, therefore, the total number of advancing strokes equals the number of engine cylinders, i.e. six. In this manner, each advancing stroke of pump plungers 122 corresponds directly in time to a delivery period associated with fuel distributor 16 and, therefore, an injection period of an injector (not shown). Therefore, lobes 204 are positioned around each cam 172 to permit a fuel pulse to be supplied to accumulator chambers 36 by pump units 86 and 88 during the same period in which a fuel pulse is removed from accumulator chambers 36 for delivery to the injectors by distributor 16.

During the operation of pump 14, pump control valves 18 and 19 are normally de-energized in an open position. Thus, during the retraction stroke of each pump plunger 122, fuel flows from common fuel feed passage 90 through respective fuel feed branches 78 and 80 into respective pump chambers 124. Also, during the pumping or advancing stroke, each pump plunger 122 forces fuel out of its respective pump chamber 124 back through fuel feed branches 78 and 80 and respective pump control valves 18 and 19. However, when the fuel pressure in accumulator chambers 36 falls below a predetermined minimum, ECU 13 will energize pump control valves 18 and 19 as needed at a predetermined point during the a respective pumping stroke of pump plungers 122 thus closing the respective pump control valve 18, 19 blocking the flow of fuel from the respective pump chamber 124. Further advancement of pump plunger 122 pressurizes the fuel in pump chamber 124 until the fuel pressure in chamber 124 exceeds the fuel pressure in accumulator chambers 36 causing pump unit check valve 136 to lift off its seat allowing fuel from pump chamber 124 to flow into accumulator chambers 36 thereby maintaining the fuel pressure in accumulator 12 within a desired pressure range. The discharge of fuel from chamber 124 into accumulator 12 ends when pump plunger 122 finishes its advancing or pumping stroke. In this manner, the pump 14 and associated pump control valves 18 and 19 are operated to control the effective displacement of each pump chamber 124 by providing a variable beginning of injection upon closure of a respective pump control valve 18, 19 while a constant end of injection occurs when the pumping plunger 122 reaches its top dead center or most advanced position. However, other forms of variable displacement high pressure pumps may be used to control accumulator pressure. Examples of such other variable displacement pumps are disclosed in U.S. Pat. No. 4,502,445 to Roca-Nierga et al. and in a co-pending patent application filed on the same date as the present application and entitled Variable Displacement High Pressure Pump for Common Rail Fuel Injection Systems in the name of Yen et al. and assigned to the assignee of this invention. The entire disclosure of that application is incorporated herein by reference.

Figure 21:
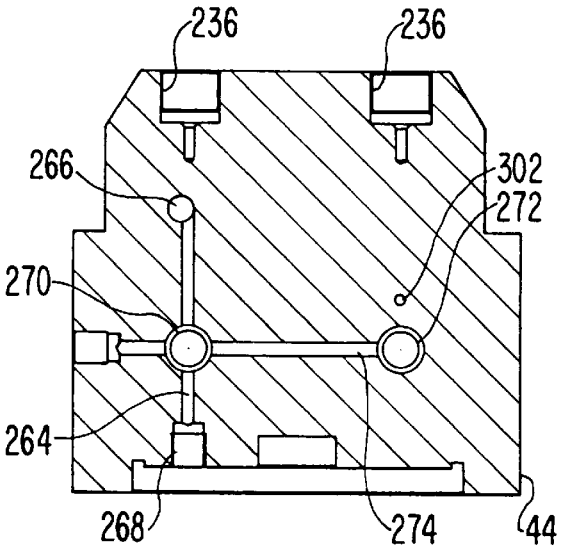
FIGS. 21 and 22 are cross sectional views of the distributor body taken along lines 21—21and 22—22 of FIG. 17*a*.
Figure 22:
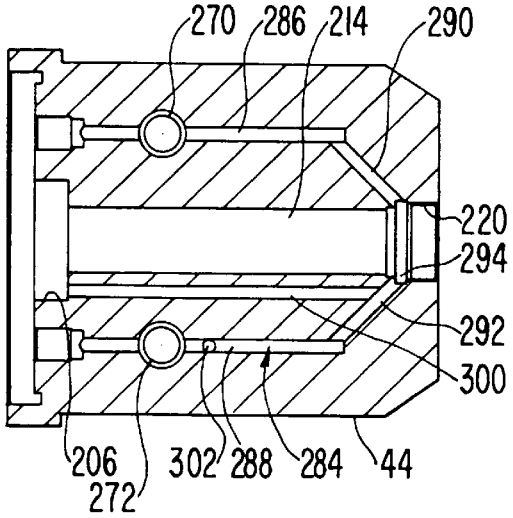

Referring to FIGS. 5 and 17*a*–27, fuel distributor housing 44 of distributor 16 is mounted on lower portion 23 of pump housing 22 adjacent second opening 202. Fuel distributor housing 44 includes a rotor bore 214 extending axially through housing 44 in axial alignment with second opening 202 of pump housing 22. An annular seal recess 206 is formed in distributor housing 44 at one end of rotor bore 214 for receiving shaft seals 208 which prevent fuel leaking form around rotor 216 from entering camshaft cavity 24. A rotor 216 is rotatably mounted in rotor bore 214 and connected at a first end to camshaft 26 by a coupling 218. A second end of rotor 216 terminates adjacent the inner surface of a recess 220 formed in the end of distributor housing 44 adjacent rotor bore 214 (FIGS. 5, 22 and 25). Recess 220 includes internal threads for engaging the external threads of a drain fitting 222 having a drain port 224 extending axially therethrough. Although distributor housing 44 preferably extends axially from pump housing 22, housing 44 may be mounted on pump housing 22 so that rotor 216 extends perpendicular to the axis of camshaft 26 as shown in schematic form in FIG. 17*b*. In this arrangement, rotor 216 may be operatively connected to camshaft 26 by gears 217.

Figure 27:
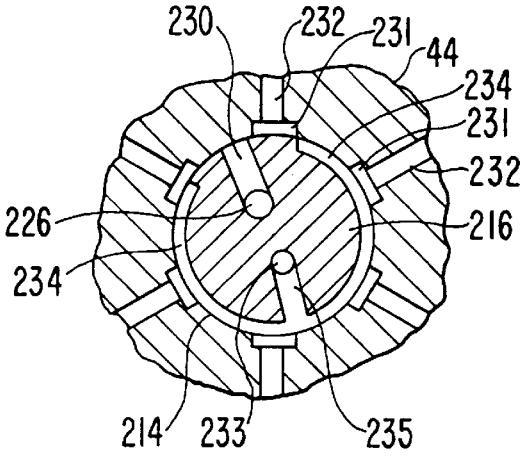
FIG. 27 is a cutaway cross sectional view of the distributor rotor and surrounding housing taken along a plane transverse to the rotational axis of the rotor.

Rotor 216 includes an axial supply passage 226 extending axially along, but radially spaced from, the central axis of rotation of rotor 216 from the second end of rotor 216 inwardly terminating at a point prior to the first end (FIGS. 5 and 27). A plug 228 is threadably secured in the open end of axial supply passage 226 adjacent recess 220 to fluidically seal passage 226 from drain port 224. A radial supply passage 230 extends radially from axial supply passage 226 to communicate with rotor bore 214. Six fuel receiving ports 231 and six corresponding fuel receiving passages 232 are formed in distributor housing 44 and equally spaced around the circumference of rotor bore 214 for successive communication with radial supply passage 230 during rotation of rotor 216. A semi-annular balance groove 234 formed in rotor 216 extends around approximately 75% or 272° of the circumference of rotor 216. Balance groove 234 terminates on either side of radial supply passage 230 such that when supply passage 230 registers with one of the receiving passages 232, the remaining receiving passages 232 communicate with balance groove 234. Therefore, the fuel pressure in the receiving passages 232 communicating with balance groove 234 will be equalized before the start of each injection period. This balancing or equalization of the initial fuel pressure in receiving passages 232 and corresponding downstream passages insures controllable and predictable fuel metering from one injection period or engine cycle to the next. Moreover, an axial drain passage 233 formed in rotor 216 extends inwardly from the end of the rotor 216 adjacent drain fitting 222 to communicate with a radial passage 235 extending radially inward from balance groove 234. In this manner, the fuel in balance groove 234 and, therefore, the receiving passages 232 not communicating with radial supply passage 230, is continuously connected to the fuel drain which is maintained at a relatively constant low pressure. As a result, each receiving passage 232 is maintained at a relatively predictable, constant pressure so that the pressurization of each receiving passage 232 begins at approximately the same pressure thus improving controllability and predictability of fuel metering. The opposite end of each receiving passage 232 communicates with a recess 236 formed in the end of distributor housing 210. Each recess 236 has internal threads for engaging complementary external threads on an outlet fitting 238. An axial injection bore 240 extends axially through each outlet fitting 238 to communicate with a respective receiving passage 232. Receiving passages 232 are formed by drilling inwardly through distributor housing 44 from each recess 236 at an acute angle to the rotor axis. In this manner, each outlet fitting 238 fluidically seals the portion of the drilling radially outward of fitting 238 thereby providing a fluidically sealed connection between each receiving passage 232 and each injection bore 240. A radial receiving passage 242 formed in rotor 216 and axially spaced from radial supply passage 230 extends radially outwardly from axial supply passage 226 to communicate with an annular supply groove 244.

The portion of the present fuel delivery system for delivering fuel from accumulator chambers 36 to supply groove 244 will now be described in detail. As shown in FIG. 5, fuel is delivered from accumulator chamber 36*a* to distributor housing 44 via fuel feed passage 67 and a fuel feed tube 246. A feed supply recess 248 formed in the open end of feed passage 67 includes a feed tube seat 250 for engaging a feed tube head 252 formed on the end of feed tube 246. Supply recess 248 includes internal threads for engaging complementary external threads formed on a generally cylindrical feed tube fitting 254. Feed tube 246 extends through tube fitting 254 so that one end of tube fitting 254 abuts tube head 252. Rotation of tube fitting 254 relative to supply recess 248 and fuel feed tube 246 forces feed tube head 252 inwardly into sealing engagement with tube seat 250 thereby creating a fluidically sealed connection between feed passage 67 and feed tube 246. Feed tube 246 extends downwardly in the space between distributor housing 44 and cantilevered axial overhang 38 of accumulator housing 34 into a feed tube receiving recess 256 formed in the upper surface of distributor housing 44. A cylindrical seal 258 formed on the end of feed tube 246 is forced radially outwardly against the surface of receiving recess 256 to prevent fuel from leaking between feed tube 246 and receiving recess 256. An annular seal groove 260 formed in recess 256 is adapted to receive a seal for preventing leakage of fuel out of recess 256 between feed tube 246 and housing 44. An annular feed tube drain groove 262 formed in recess 256 between seal groove 260 and cylindrical seal 258 collects any fuel leaking upwardly in recess 256 between feed tube 246 and housing 44. A drain passage 263 extends from drain groove 262 to connect with the drain system from first injection control valve 20.

Figure 24:
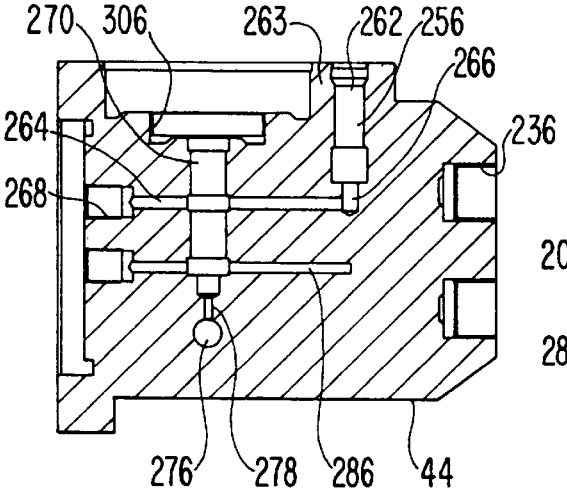
FIGS. 24–26 are cross sectional views of the distributor housing taken along lines 24—24, 25—25 and 26—26 of FIGS. 20, 18 and 23 respectively.
Figure 25:
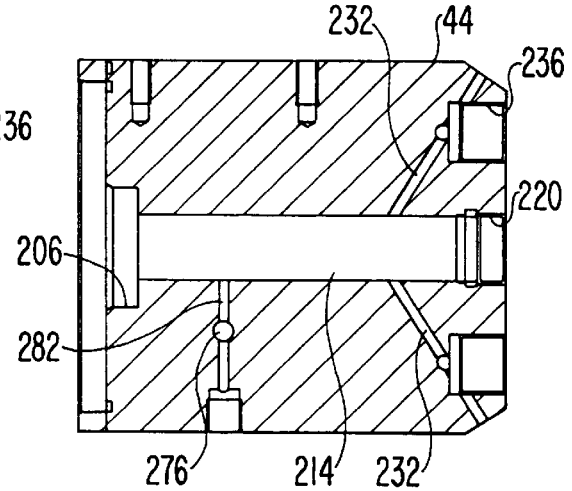
Figure 26:
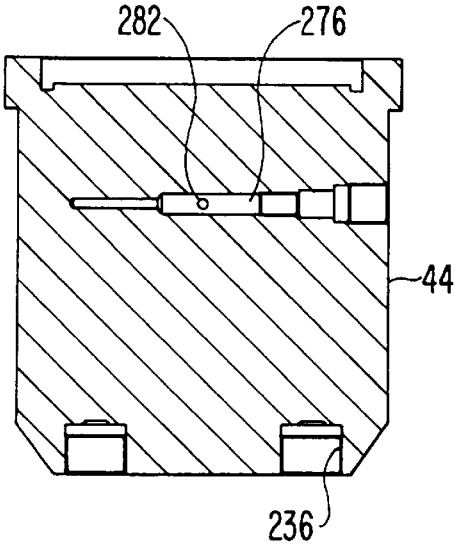
Figure 23:
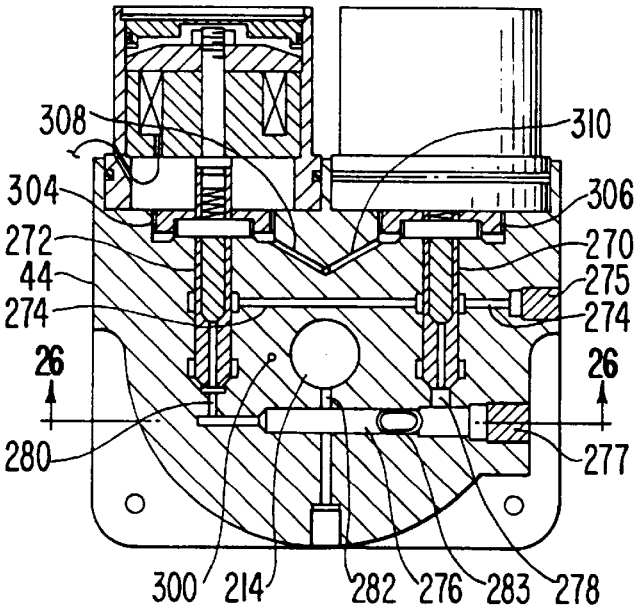
FIG. 23 is a cross sectional view of the distributor including the solenoid operated injection control valves associated therewith taken along line 23—23 of FIG. 20.
Figure 24:
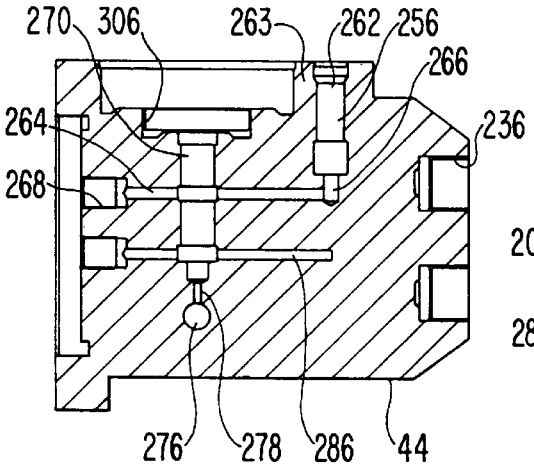
Figure 25:
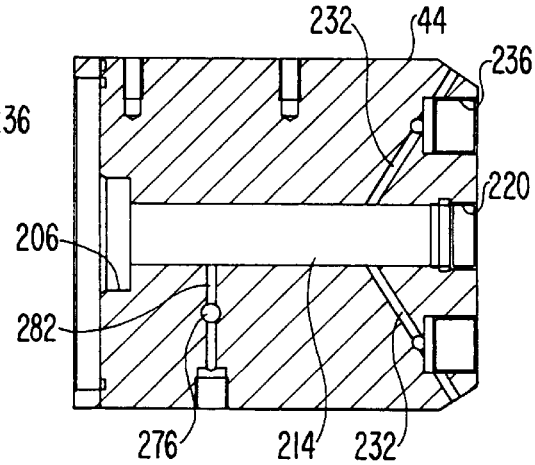
Figure 26:
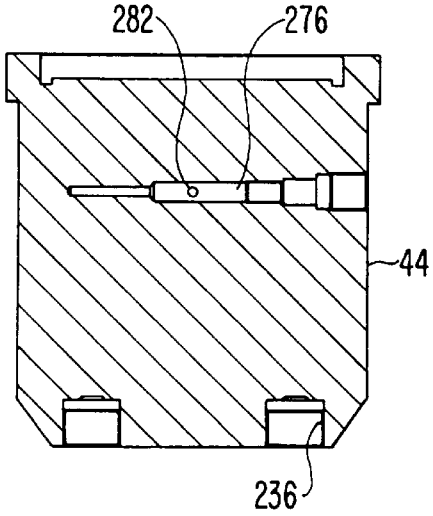
Figure 27:
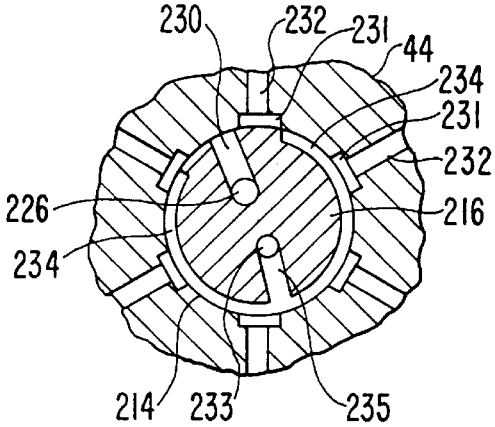

An axial feed bore 264 extends from the transverse face of distributor housing 44 adjacent second opening 202 of pump housing 22 axially outwardly to communicate with a first injection control valve cavity 270 formed in distributor housing 44 for receiving first injection control valve 20 (FIG. 24). Axial feed bore 264 continues from first injection control valve cavity 270 axially outwardly to communicate a passage 266 extending from recess 256. The open end of transverse bore 264 includes a recess 268 fluidically sealed with a plug (not shown). A second injection control valve cavity 272 is formed in distributor housing 44 adjacent first injection control valve cavity 270 so that first and second injection control valve cavities 270 and 272, respectively, are located on opposite transverse sides of rotor 216. A transverse feed bore 274 extending from one side of distributor housing 44 above rotor 216 fluidically connects first injection control valve cavity 270 with second injection control valve cavity 272 (FIGS. 21 and 23). Transverse feed bore 274 and axial feed bore 264 are formed in the same horizontal plane so as to intersect first injection control valve cavity 270 at adjacent points around the circumference of cavity 270. The open end of transverse feed bore 274 is fluidically sealed with a plug 275 (FIG. 23). A rotor feed bore 276 formed in distributor housing 44 extends from one side of housing 44 below rotor 216 to communicate with a first outlet passage 278 and second outlet passage 280 extending from first and second injection control valve cavities 270 and 272, respectively (FIGS. 19, 23–26). The open end of rotor feed bore 276 is fluidically sealed with an appropriately sized plug similar to plug 277. A rotor port 282 extends vertically upward from rotor feed bore 276 to communicate with rotor bore 214. Feed port 282 is formed by drilling upwardly through the bottom of distributor housing 44. Therefore, the open end of the drilling associated with feed port 282 is fluidically sealed with a plug (not shown).

Feed port 282 and rotor feed bore 276 are formed in a common vertical transverse plane with radial receiving passage 242 and supply groove 244 so that feed port 282 continuously communicates with supply groove 244 and radial receiving passage 242 as rotor 216 rotates. As a result, fuel delivery to axial supply passage 226 via radial receiving passage 242, supply groove 244, feed port 282, rotor feed bore 276 and first and second outlet passages 278 and 280 from transverse bore 274 is dependent only on the position of the respective injection control valves 20 and 21. However, a two way check valve is positioned in rotor feed bore 276 to prevent fuel supplied from one of the injection control valve cavities 270 and 272 to flow into the other injection control valve cavity. First and second injection control valves 20 and 21, which are each operable to connect axial supply passage 226 with accumulator chamber 36*a*, may be of the three way type illustrated in FIG. 23 and described in detail in a co-pending patent application filed on Mar. 19, 1993 entitled Force Balanced Three-Way Solenoid Valve in the name of Pataki et al. and assigned to the assignee of this invention. The entire disclosure of that application is incorporated herein by reference.

First and second injection control valves 20 and 21 are also operable to fluidically connect axial supply passage 226 with a low pressure fuel drain circuit indicated generally at 284 (FIG. 22). Drain circuit 284 includes a first and a second axial drain passage 286 and 288, respectively, extending axially from the transverse face of distributor housing 44 adjacent pump housing 22 to communicate with first and second injection valve cavities 270 and 272, respectively. Axial drain passages 286 and 288 also extend axially from respective cavities 270 and 272 to communicate with drain passageways 290 and 292, respectively (FIG. 22). Drain passageways 290 and 292 each extend inwardly at an angle toward the axis of rotor 216 to communicate with an annular drain collection groove 294 formed in recess 220. A pair of drain apertures 296 and 298 formed in the innermost end of each drain fitting 222 extend from drain collection groove 294 to drain port 224 to direct fuel from drain collection groove 294 to a low pressure fuel drain connected to the opposite end of drain fitting 222 (FIG. 5).

Drain circuit 284 further includes an axially extending drain passage 300 formed in distributor housing 44 to communicate with seal recess 206 at one end and drain passageway 292 at an opposite end (FIG. 17*a*, 22 and 23). Therefore, any fuel leaking into seal recess 206 from the clearance between rotor 216 and distributor housing 44 is directed to drain. A vertical drain passage 302 communicates at one end with a second valve recess 304 formed at the upper end of valve cavity 272 and at a second end with axial drain passage 288. A first valve recess 306 is fluidically connected to second valve recess 304 by a pair of drain passages 308 and 310, each extending inwardly from respective recesses 306 and 304 (FIG. 20 and 23). As a result, any fuel leaking from valve cavities 270 and 272 is collected in recess 306 and 304, respectively, and directed to drain by vertical drain passage 302, axial drain passage 288, drain passageway 292, drain aperture 298 and drain port 224.

Referring to FIG. 5, a safety valve 312, shown in schematic form, is positioned along the fuel transfer circuit in feed tube 246 between the accumulator 12 and injection control valve 20. During operation of the fuel pump system, injection control valve 20 may become unintentionally jammed or lodged in the open position continuously fluidically connecting accumulator 12 to distributor 16. As a result, high pressure fuel from accumulator 12 will be permitted to flow through distributor 16 to the engine cylinders during the entire time of each injection period. Thus, regardless of the engine throttle position, fuel is undesirably continuously supplied to the engine resulting, possibly, in an engine run-away condition. Safety valve 312 prevents such a run-away condition by blocking fuel flow to distributor 16 when injection control valve 20 improperly remains in the open position. Safety valve 312 may be a pressure balanced two-way, two-position solenoid-operated valve which completely blocks fuel flow through feed tube 246. Alternatively, safety valve 312 may be a pressure balanced three-way valve, similar to injection control valve 20, movable from an open position permitting flow from accumulator 12 to distributor 16 under normal operating conditions into a drain position blocking flow to distributor 16 while connecting accumulator 12 via feed tube 246 to a drain passage 314. Safety valve 312 may be controlled by a signal from an ECU (not shown) indicating that injection control valve 20, upon receiving a closing signal, failed to reach the closed position. In addition, safety control valve 312 may alternatively be positioned within the fuel transfer circuit between injection control valve 20 and distributor 16.

Figure 28:
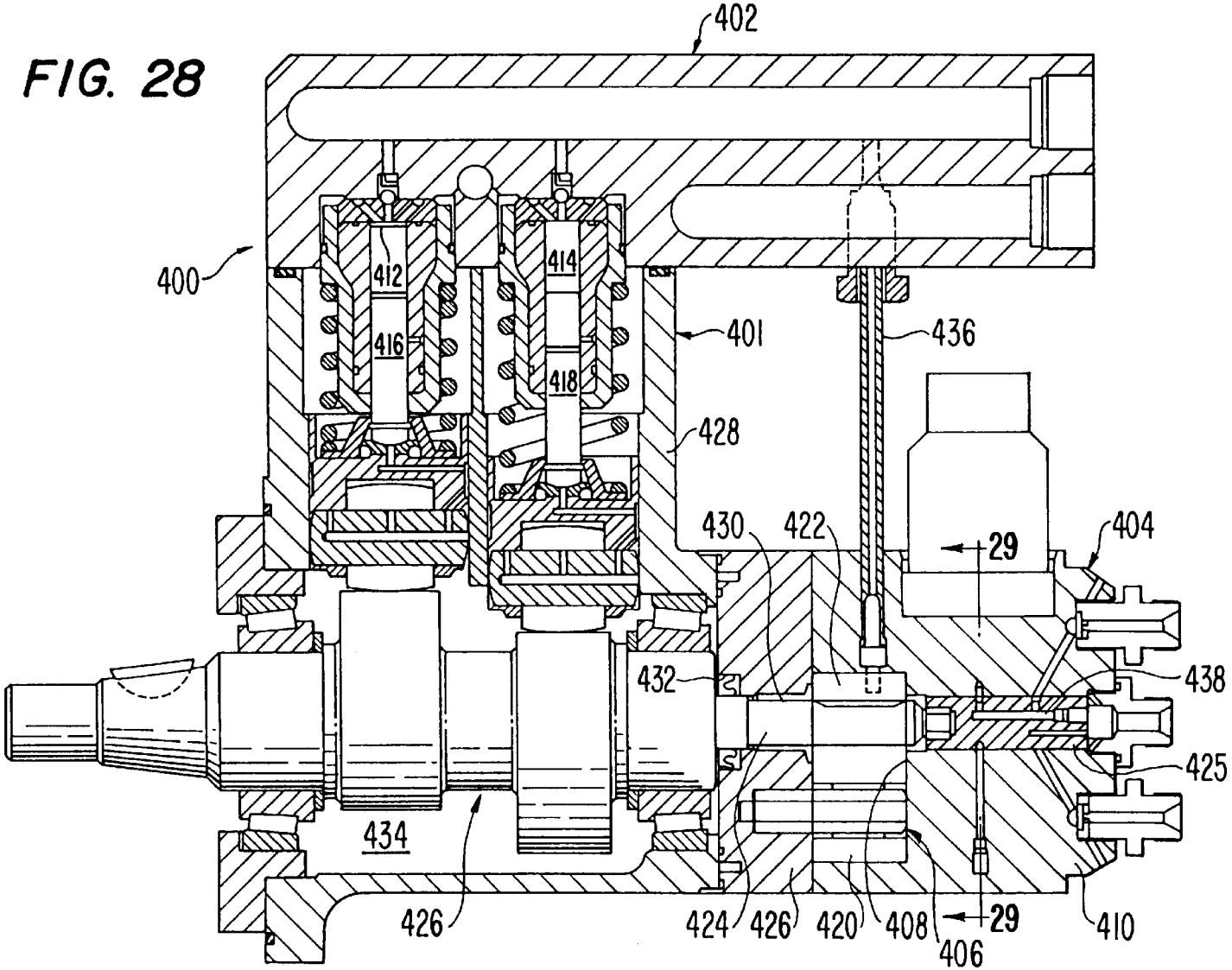
FIG. 28 is a cross sectional view of another embodiment of a fuel system assembly designed in accordance with the subject invention.

Reference is now made to an alternative embodiment of the subject invention as illustrated in FIG. 28. In this embodiment, the same basic components referred to with respect to the first embodiment of FIGS. 2–6 are illustrated, namely, a pump 401, accumulator 402 and distributor 404. Unlike the previous embodiment, however, the fuel pump assembly 400 of FIG. 28 includes a gear type boost pump 406 located in a complementary cavity 408 contained in the distributor housing 410. The purpose of boost pump 406 is to insure that the pump chambers 412 and 414 are filled with fuel during the downward stroke of the respective pump plungers 416 and 418. During certain operating conditions, such as high engine speeds, the downward stroke of pump plunger 416 and 418 will occur at a rate that exceeds the capacity of the normal engine "lift" pump to cause fuel to fill the respective pump chambers 412 and 414.

To remedy the problem associated with the pump chambers failing to be fully charged at all times, boost pump 406 is provided to raise significantly the pressure of the fuel supplied to chambers 412 and 414. For example, boost pump 406 may raise the supply pressure of the fuel supplied to the pump chambers from a low level, for example 5 psi, to significantly higher level, for example 200–300 psi. This significantly higher pressure will generally assure that chambers 412 and 414 will be fully charged with fuel even during periods of maximum downward velocity of the corresponding pump plungers 416 and 418.

Pump 406 includes a pair of intermeshing gears 420 and 422 received in cavity 408. Gear 422 is mounted on a shaft 424 which is co-axial with and connected for driving rotation with the drive shaft of the pump 401. The other end of shaft 424 is connected to a distributor rotor 425 which functions similarly to rotor 216 of the FIG. 5 embodiment. A spacer housing 426 is positioned between pump housing 428 and distributor housing 410 to facilitate assembly of the distributor and boost pump on the pump housing 428. A bearing journal 430 is provided in spacer housing 426 for one end of shaft 424. A fluid seal ring 432 may be provided surrounding one end of driving shaft to maintain the separation of fuel in the boost pump and the lubrication fluid in the drive shaft cavity 434 of the high pressure pump 401.

The high pressure fuel is stored in accumulator 402 for supply to the distributor 404 through a feed tube 436. Although not shown in FIG. 28, passages internal to distributor housing 410 are provided to provide high pressure fuel to the axial supply passage 438 in rotor 425 for sequential communication to the individual engine cylinders in the manner previously described. A pair of solenoid operated injection control valves 440 (only one of which is visible in FIG. 28) are provided to control the timing and quantity of fuel injection into each engine cylinder by controlling the flow of fuel from feed tube 436 into the axial supply passage 438. Injection control valves 440 may also be of the three way type illustrated in FIG. 23 and described in detail in a co-pending patent application filed on Mar. 19, 1993 entitled Force Balanced Three-Way Solenoid Valve in the name of Pataki et al. and assigned to the assignee of this invention.

Figure 29:
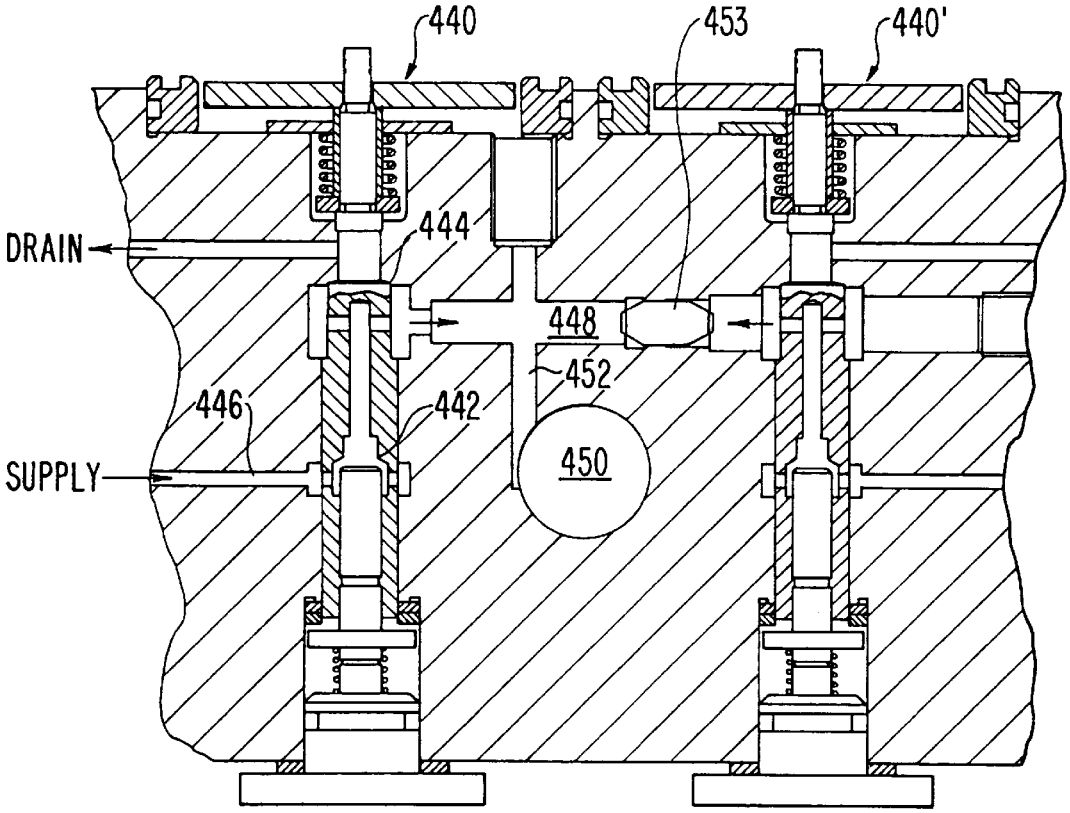
FIG. 29 is a cross sectional view of the distributor employed in the fuel system assembly of FIG. 28 taken along line 29—29.

An alternative type of solenoid operated, injection control valve 440 is illustrated in FIG. 29. A pair of such valves 440 and 440' is illustrated in FIG. 29 as they would appear in a transverse cross section of the distributor 404 taken along lines 29—29 of FIG. 28. This type of valve is characterized by the provision of a "pin-in-sleeve" valve member which is force balanced but which includes a high pressure valve seat 442 which is considerably smaller in effective seal area than is the drain valve seat 444. When valve 440 is actuated, supply passage 446 is connected through valve seat 442 of the three way valve with a feed bore 448 which in turn communicates with the rotor receiving bore 450 through a connecting passage 452. The advantage of this type of valve is that the flow characteristics of the valve upon opening can be made considerably different than the flow characteristics upon closing. Also, a two way check valve 453 is positioned in feed bore 448 to prevent fuel supplied from one of the injection control valve cavities to flow into the other injection control valve cavity. This style of three way control valve is also described in greater detail in the co-pending patent application filed on Mar. 19, 1993 entitled Force Balanced Three-Way Solenoid Valve in the name of Pataki et al. and assigned to the assignee of this invention.

Figure 30:
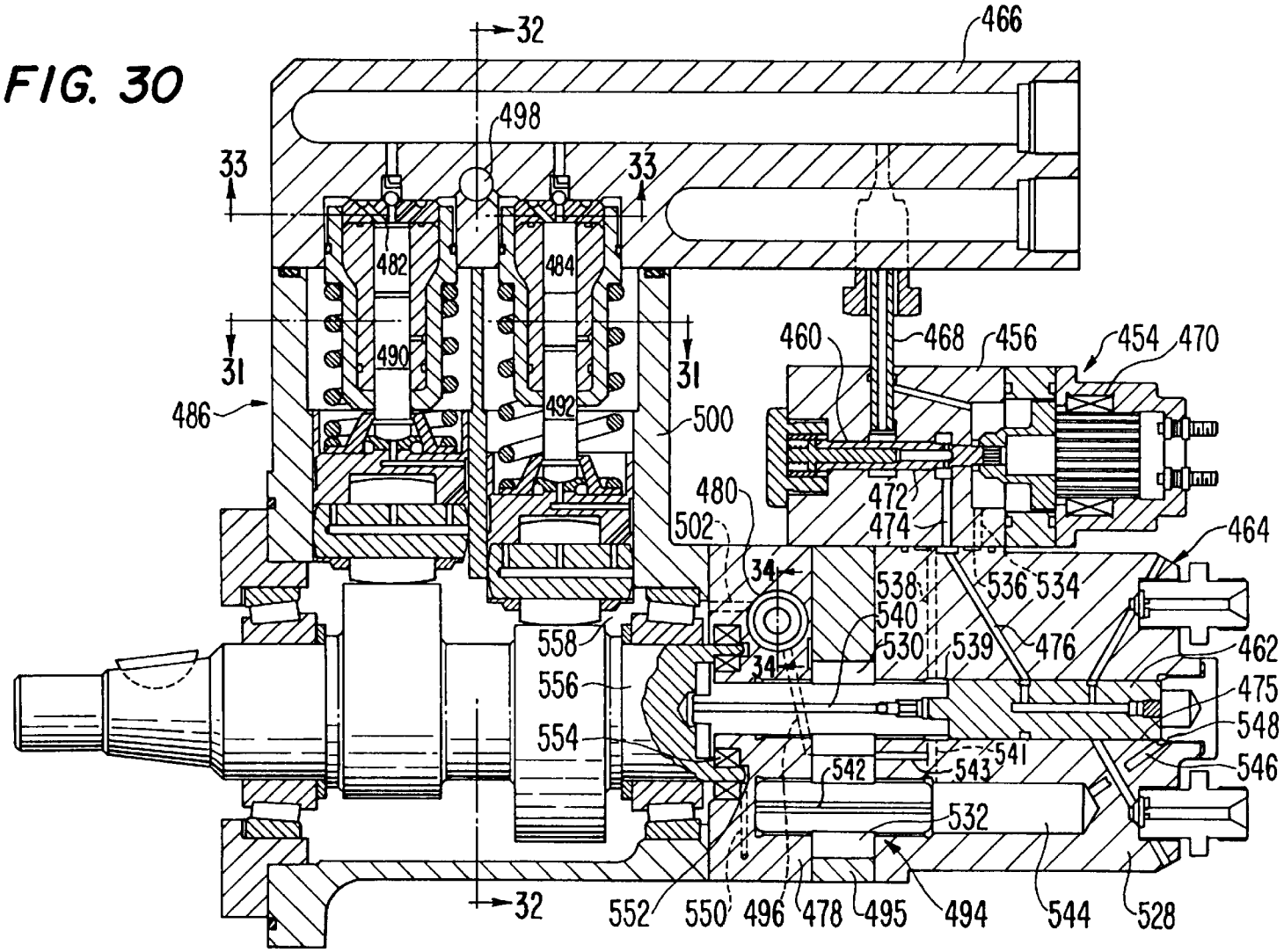
FIG. 30 is a cross sectional view of yet another embodiment of a fuel system assembly designed in accordance with the subject invention.

Reference is now made to FIG. 30 which discloses yet another embodiment of the subject invention. In this embodiment, a single solenoid operated, three way injection control valve 454 is provided in place of the dual three way valves of FIG. 23 or FIG. 29. In particular, injection control valve 454 includes its own valve housing 456 containing a valve cavity 460 in which is received a three way valve of the type illustrated in FIG. 29. Unlike the injection control valves of FIGS. 23 and 29, however, injection control valve 454 is oriented with the central axis of valve cavity 460 parallel to the rotational axis of the distributor rotor 462 of the distributor 464. High pressure fuel from the accumulator 466 is supplied through a feed tube 468 to the valve cavity 460. When the solenoid 470 is actuated, the valve member 472 moves to the right in FIG. 30 to connect feed tube 468 to passage 474 which in turn supplies the high pressure fuel to the distributor bore 475 through passage 476.

FIG. 30 also discloses a spacer housing 478 which differs from the spacer housing illustrated in FIG. 28 by provision of a low pressure accumulator 480. The purpose of this additional accumulator is to permit an adequate volume of fuel to be available for supply to the pump chambers 482 and 484 of the high pressure pump 486 even during the time of highest retraction velocity of pump plungers 490 and 492. Without low pressure accumulator 480, the size of the gear pump would need to be greater to handle the high flow rate required during the period of greatest downward retraction velocity of plungers 490 and 492. Fuel flow proceeds through the fuel pump assembly as follows: Fuel is supplied to the assembly from a fuel source, such as a fuel tank (not shown), to the gear pump 494 contained in a separate gear pump housing 495. From the gear pump the fuel is provided to the low pressure accumulator 480 through a first transfer passage 496 (shown schematically in dashed lines) and from low pressure accumulator to a supply passage 498 contained in the high pressure accumulator 466 through a series of passages contained in the spacer housing 478, pump housing 500 and accumulator 466. More particularly, the outflow of fuel from the low pressure accumulator 480 is supplied to the pump housing 500 through a second transfer passage 502.

Figure 32:
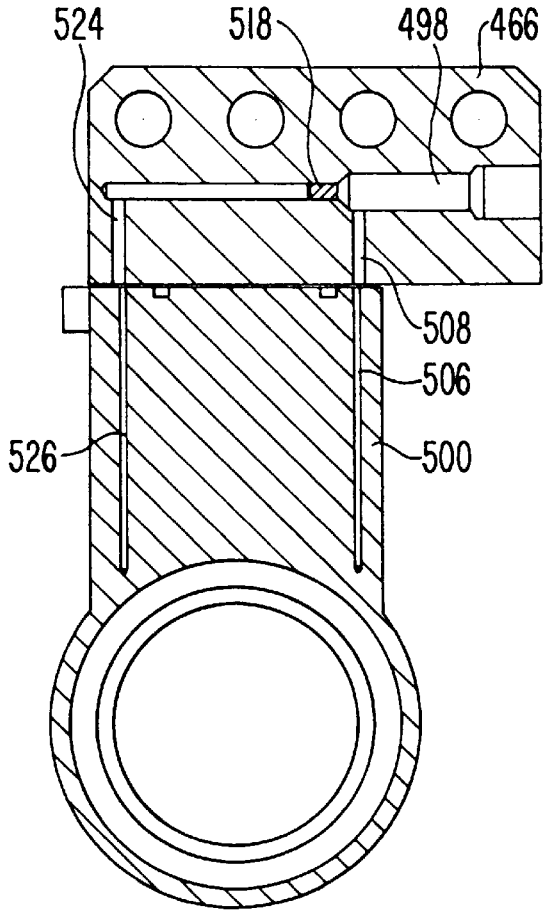
FIG. 32 is a cross sectional view of the pump housing and accumulator employed in the fuel system assembly of FIG. 30 taken along line 32—32.
Figure 33:
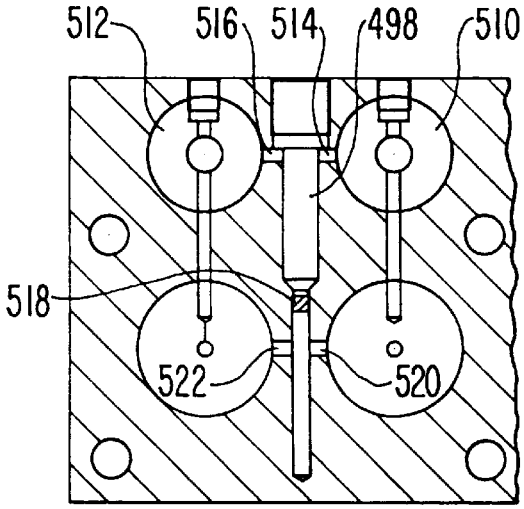
FIG. 33 is a partially cutaway cross sectional view of the accumulator employed in the fuel system assembly of FIG. 30 take along lines 33—33.
Figure 31:
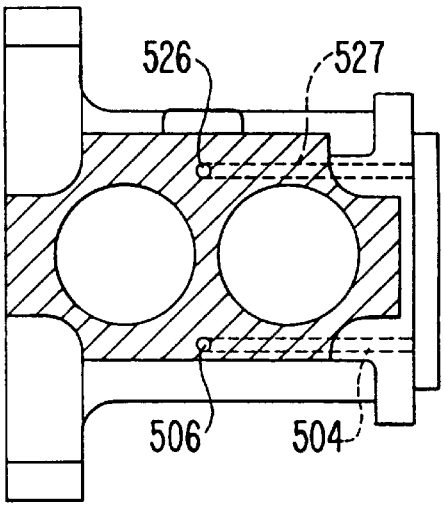
FIG. 31 is a cross sectional view of pump housing employed in the fuel system assembly of FIG. 30 taken along line 31—31.

Reference is now made to FIG. 31 which is a cross-sectional view of the pump housing 500 taken along lines 31—31 of FIG. 30. Fuel from second transfer passage 502 is received in a horizontal passage 504 and transferred up through vertical passage 506 for communication with supply passage of accumulator 466 through an accumulator transfer passage 508 as illustrated in FIG. 32 which is a cross section of the pump housing 500 and accumulator 466 taken along lines 32—32 of FIG. 30. From supply passage 498, fuel flows to the pump control valve recesses 510 and 512 through passages 514 and 516, respectively, as illustrated in FIG. 33 which is a broken away cross sectional view of the accumulator 466 taken along lines 33—33 of FIG. 30. Unlike the passages shown in FIG. 10*e*, supply passage 498 is blocked at 518 (FIGS. 32 and 33) so that fuel leakage returned to the supply passage 498 through passages 520 and 522 from pump units illustrated in FIG. 30, does not mix with the fuel supplied to the pump control valves. Instead, as illustrated in FIGS. 31, 32 and 33, fuel is returned to the low pressure intake of gear pump 494 in pump housing 495 through a series of passages labeled 524, 526, 527 and passages not illustrated formed in spacer housing 478 and 495.

A series of drain passages are also provided in the injection control valve housing 456, the distributor housing 528, and the gear pump shafts 530 and 532. Namely these passages include a drain passage 534 extending radially through valve housing 456 to direct fuel drains from injection control valve 454 to an annular drain passage 536 formed in the top surface of distributor 464 which also collects leakage from the high pressure connection of passages 474 and 476. A drain passage 538 extends inwardly from passage 536 to connect with an annular cavity 539 formed around one end of distributor rotor 462 which also receives fuel leakage from between rotor 462 and distributor housing 528. Annular cavity 539 is connected to the intake of gear pump 494 by drain passages 541 and 543. Passage 541 also communicates with a drain cavity 544 which collects fuel leakage from between rotor 462 and housing 528 via drain passages 546 and 548. Also, a drain passage 550 extends from an annular cavity 552 formed between lip seals 554 positioned around one end of crankshaft 556 to drain fuel collecting in cavity 552 to a drain not shown. In addition, a pair of drain passages 540 and 542 extending axially through gear pump shafts 530 and 532, respectively, collect fuel leaking between gear pump shafts 530 and 532 and spacer housing 478. Passage 542 directs fuel leakage to cavity 544 while passage 540 directs fuel leakage to cavity 539. A check valve 545 positioned in passage 540 is biased to prevent the flow of leakage fuel to the right in FIG. 30 until a low fluid pressure, e.g. 5 psi, is reached in passage 540. This arrangement prevents gear pump 494 from drawing air into its intake from passage 550 and camshaft cavity 558.

Figure 34A:
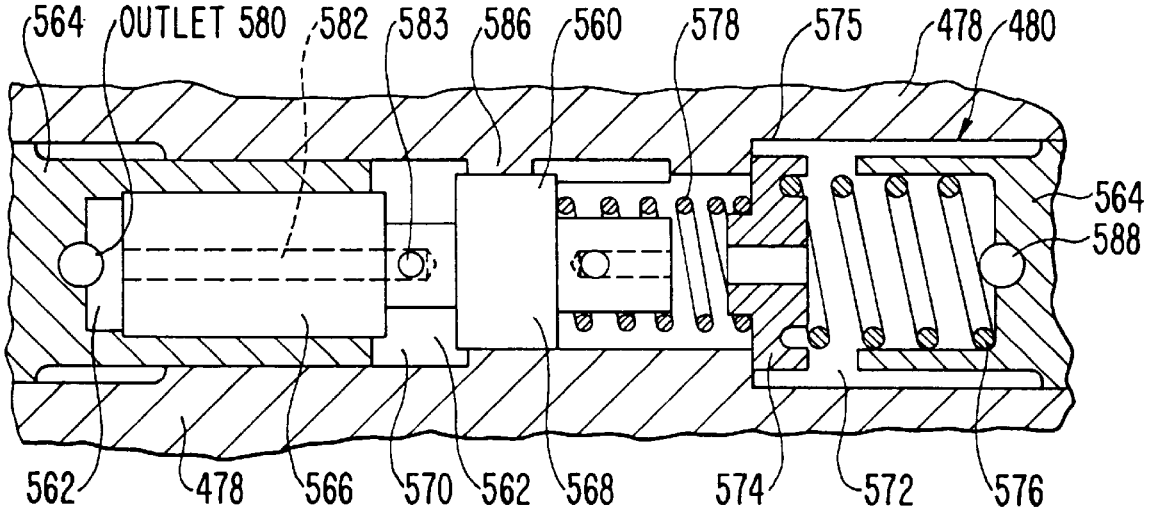
FIG. 34*a* is a cross sectional view of a low pressure accumulator employed in the fuel system assembly of FIG. 30 taken along line 34—34.
Figure 34B:
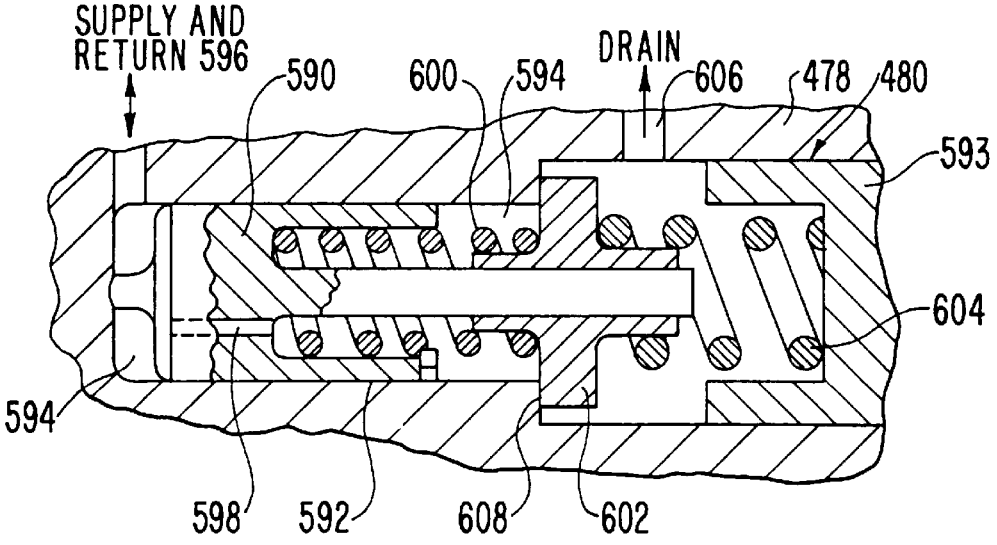
FIG. 34*b* is a cross sectional view of a second embodiment of the low pressure accumulator employed in the fuel system assembly of FIG. 30 taken along line 34—34.

Reference is now made to FIG. 34*a* and FIG. 34*b*, which disclose two embodiments of the low pressure accumulator 480. Referring to FIG. 34*a*, low pressure accumulator 480 includes a movable piston 560 slidably positioned in a cavity 562 extending through spacer housing 478. Seal plugs 564 are threadably secured in each end of cavity 562 on opposite sides of piston 560 to fluidically seal cavity 562. Piston 560 includes a first portion 566 slidably received in one of the seal plugs 564 and a second portion 568 slidably and sealingly engaging an inner wall of housing 478 to divide cavity 562 into a supply section 570 and a drain section 572. A pressure regulator disc 574 positioned in drain section 572 is biased to the left in FIG. 34*a* against an annular step 575 by a high pressure spring 576. A low pressure spring 578, seated at one end against pressure regulator disc 574 and at a second end against piston 560, biases piston 560 to the left in FIG. 34*a*. Fuel from gear pump 494 (FIG. 30) enters supply section 570 via a supply port (not shown) formed opposite an outlet port 580 connected with the passages 502, 504, 506 and 508 supplying fuel to the high pressure fuel pump. Fuel passes through passages 582 and 583 extending through first portion 566 to act on both sides of first portion 566 and on one end face of second portion 568. As the pressure in cavity 562 increases, the fuel pressure acts on piston 560 to move piston 560 to the right in FIG. 34*a* against the force of low pressure spring 578 to create a reservoir of fuel in cavity 562. As the need for fuel by the high pressure pump exceeds the capacity of the gear pump, spring 578 will force piston 560 to the left to supplement the fuel available from the gear pump. The assemblies of FIGS. 34*a* and 34*b* also function to regulate the pressure within the pressure accumulator cavity 562. As the output of the gear pump increases, higher fuel pressure will force piston 560 against pressure regulator disc 574 forcing disc 574 to the right in FIG. 34*a* against the bias pressure of high pressure spring 576 until a left edge 584 of second portion 568 moves to the right of a land 586 thereby allowing fuel to flow from supply section 570 to drain section 572. Fuel in drain section 572 is returned to the intake of gear pump 494 via a drain port 588 and return passages (not shown). Once the fuel pressure in supply section 570 decreases to a predetermined level, high pressure spring 576 forces piston 560 to the left fluidically sealing supply section 570 from drain section 572. In this manner, accumulator 484 maintains a sufficient supply of fuel to the pump chambers 482 and 484 of the high pressure pump 486 even during the time of highest retraction velocity of pump plungers 490 and 492 (FIG. 30).

FIG. 34*b* illustrates a second embodiment of low pressure accumulator 484 having a movable piston 590 positioned in a cavity 592 formed in one side of spacer housing 478 and fluidically sealed by a seal plug 593. Supply fuel enters and exits the supply section 594 via passages 596 and 598. As the pressure in cavity 592 increases, piston 590 is moved to the right in FIG. 34*b* against the bias pressure of a low pressure spring 600. When fuel pressure increases to a predetermined level piston 590 contacts pressure regulator disc 602 moving disc 602 to the right against the bias pressure of a high pressure spring 604 thereby allowing supply fuel to drain through passage 606. As supply fuel pressure decreases, spring 604 returns disc 602 to its seated position against a step 608.

Figure 35:
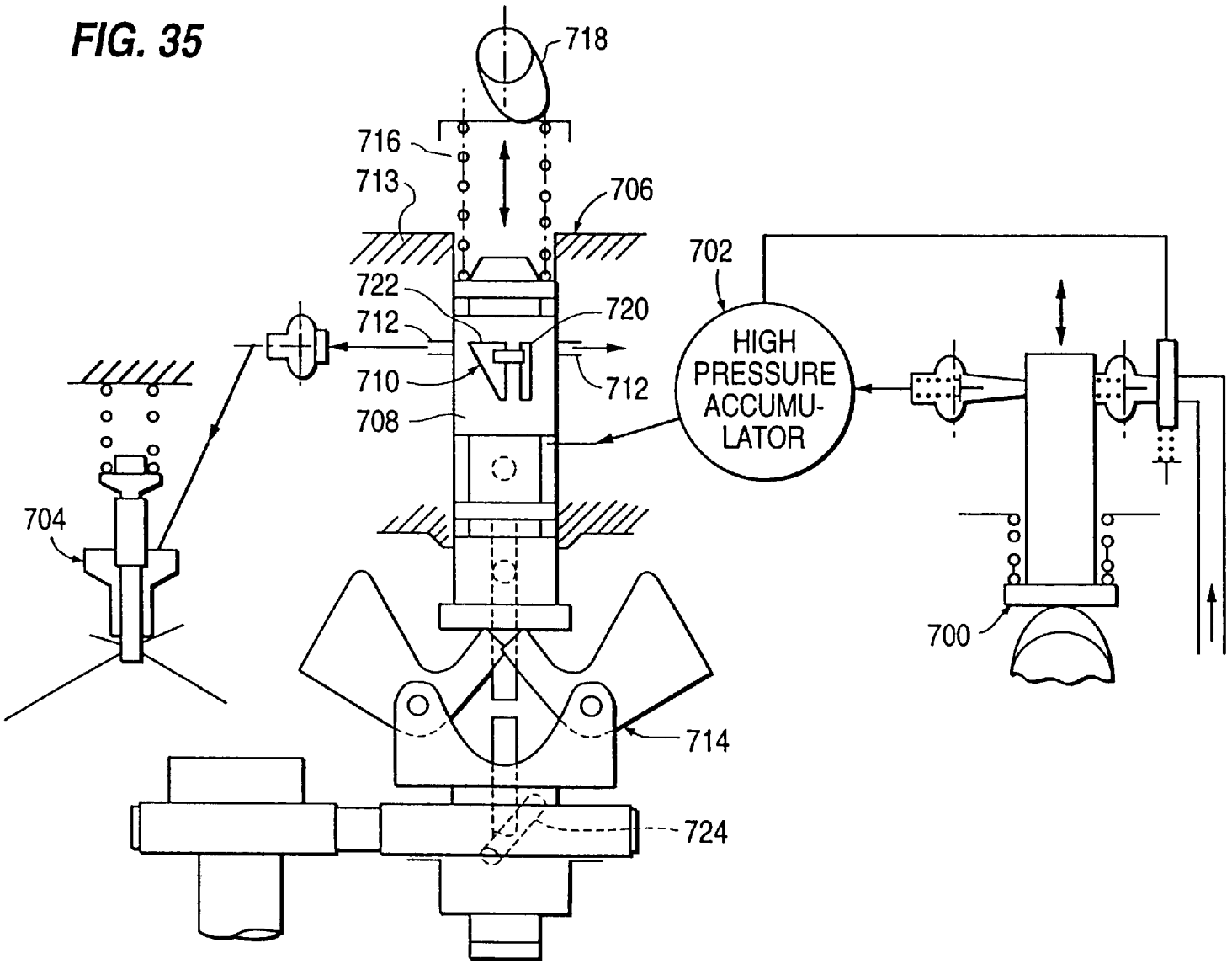
FIG. 35 is a schematic diagram of a hydro-mechanical embodiment of the subject invention.

Referring now to FIG. 35, an alternative hydromechanical embodiment of the present invention is disclosed which is similar to the previously discussed embodiments in that a high pressure pump unit 700 supplies high pressure fuel to an accumulator 702 for sequential delivery to a plurality of injector nozzles, one of which is illustrated at 704, via a fuel distributor 706 which includes a rotor 708 which rotates to sequentially deliver fuel from supply ports 710 formed in rotor 708 to receiving passages 712 formed in a distributor housing 713. However, unlike the previous embodiments, rotor 708 is mounted for axial displacement under the influence, at one end, of an engine speed sensing flyweight device 714 and, at the other end, by a spring element 716 having a bias force which is adjustable in response to the rotation of a cam 718 which may be controlled by throttle position and/or an all speed governor. Supply ports 710 include a pilot port 720 which leads the supply ports 710 to provide a pilot or pre-injection and a generally triangularly-shaped main injection port 722. The shape of port 722, which registers with receiving passages 712 after further rotation of rotor 708, is varied in the axial direction of the rotor 708 to cause the amount of fuel injected by the corresponding fuel injector to be varied in accordance with the axial position of the rotor 708. To vary the timing of each injection event performed by the system, a "phaser" mechanism 724 can be provided to advance or retard rotor 708 relative to the instantaneous position of the cam shaft. Such a mechanism may respond to a mechanical, electrical or fluidic signal to adjust the angular position of rotor 708 relative to the engine cam shaft.

Figure 36:
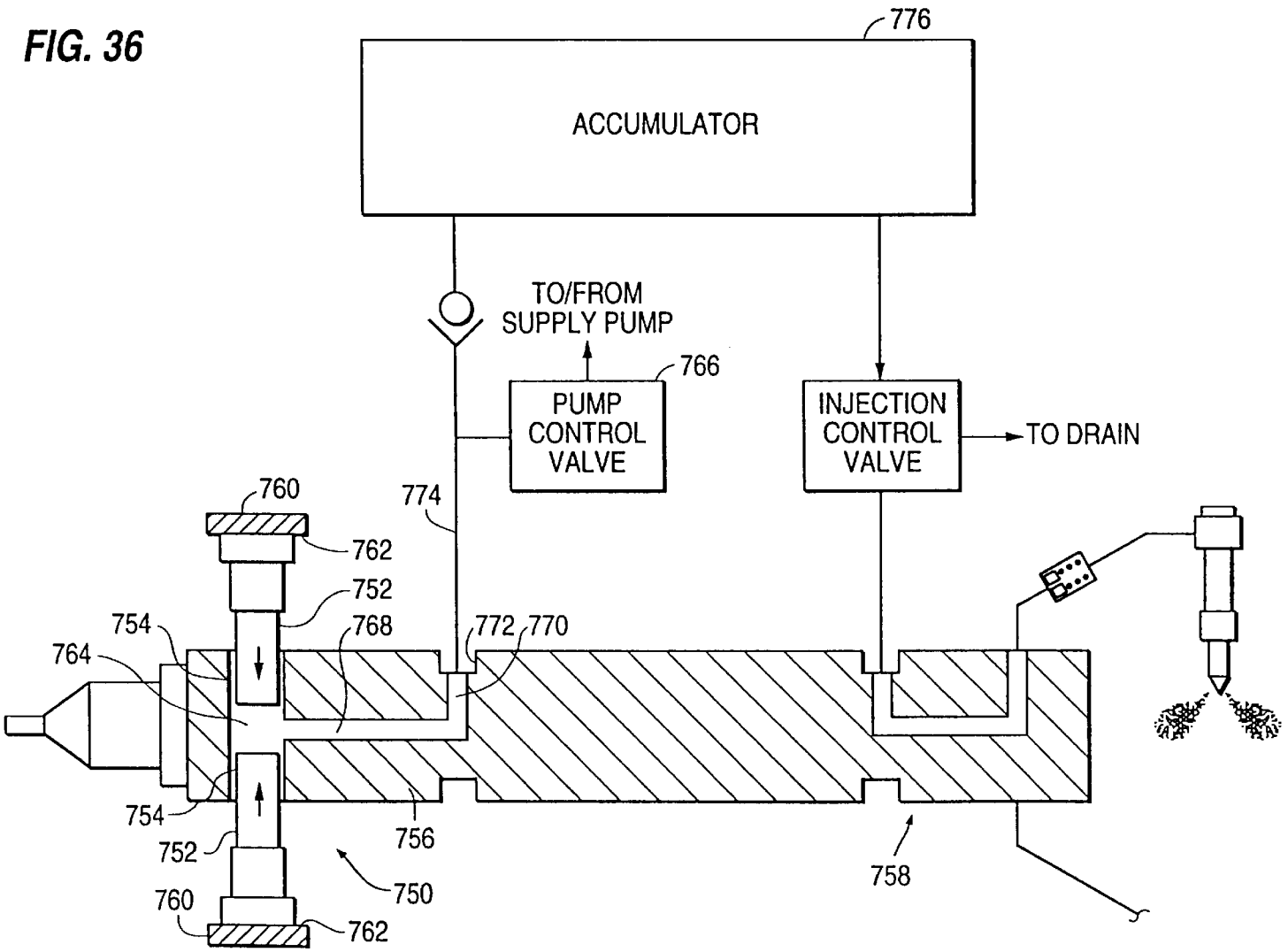
FIG. 36 is a schematic diagram of yet another embodiment of a fuel system assembly designed in accordance with the subject invention having a rotary pump.

Now referring to FIG. 36, another embodiment of the present invention is illustrated which is similar to the embodiment shown in FIG. 1 except that a rotary pump 750 is used instead of the in-line high pressure pump 14 disclosed in FIG. 1. Rotary pump 750 includes pump plungers 752 reciprocally mounted in pump chambers 754 formed in a portion of the drive shaft 756 which constitutes a rotatable pump housing. Alternatively, the pump chambers may be formed in a rotatable pump housing which is separate from drive shaft 756 but is adapted to rotate with it. Preferably, drive shaft 756 is also used to drive distributor 758 which may be formed in drive shaft 756 or may be formed as a separate rotatable assembly driven by shaft 756. Distributor 758 operates in the same manner as distributor 16 of FIG. 5.

A cam ring 760 through which drive shaft 756 extends includes an inner annular cam surface 762 against which pump plungers 752 are biased by, for example, biasing springs (not shown). In this manner, as drive shaft 756 rotates, pump plungers 752 are rotated relative to cam surface 762 which alternatively forces plungers 752 inwardly and permits plungers 752 to move outwardly as dictated by the contour of cam surface 762. Pump chambers 754 communicate with a common central cavity 764 which is continuously connected to pump control valve 766 by, for example, axial passage 768, radial passage 770, annular groove 772 and connecting passage 774 formed in a pump housing (not illustrated).

Although not illustrated, the pump housing may be stationary and the cam ring 760 may be arranged to rotate with drive shaft 756. The radially oriented pump chamber may be placed radially inside the cam ring as in FIG. 36 or the pump chambers may be positioned radially outside of the cam surface. Regardless of the cam ring embodiment used, the rotary pump of FIG. 36 may be integrated in the unitized pump assemblies of the present invention as disclosed in FIGS. 5, 28 and 30.

The operation of the embodiment disclosed in FIG. 36 is fundamentally the same as the embodiment of FIG. 1 except that rotary pump 750 operates to move pump plungers 752, in unison, radially inwardly and outwardly during the rotation of drive shaft 756. When the pump valve 766 is open, fuel is allowed to flow from a fuel supply (not illustrated) through pump control valve 766 into pump chambers 754 on the outward stroke of pump plunger 752. Fuel is forced back out through pump control valve 766 to the supply upon inward movement of pump plungers 752 so long as pump control valve 766 is in the open position. When fuel delivery to the accumulator is desired, pump control valve 766 is moved to the closed position during the inward stroke of pump plunger 752 blocking the flow of fuel to the supply, thus allowing high pressure fuel to the delivered from common central cavity 764 to accumulator 776. This embodiment of the present invention is particularly advantageous in providing an extremely compact, low cost fuel pumping system readily adaptable for use with small engines subject to strict size, weight and price requirements. Moreover, it should be noted that only one pump control valve is needed for a plurality of pump plungers, thereby simplifying the assembly and the control system.

Figures 37, 38:
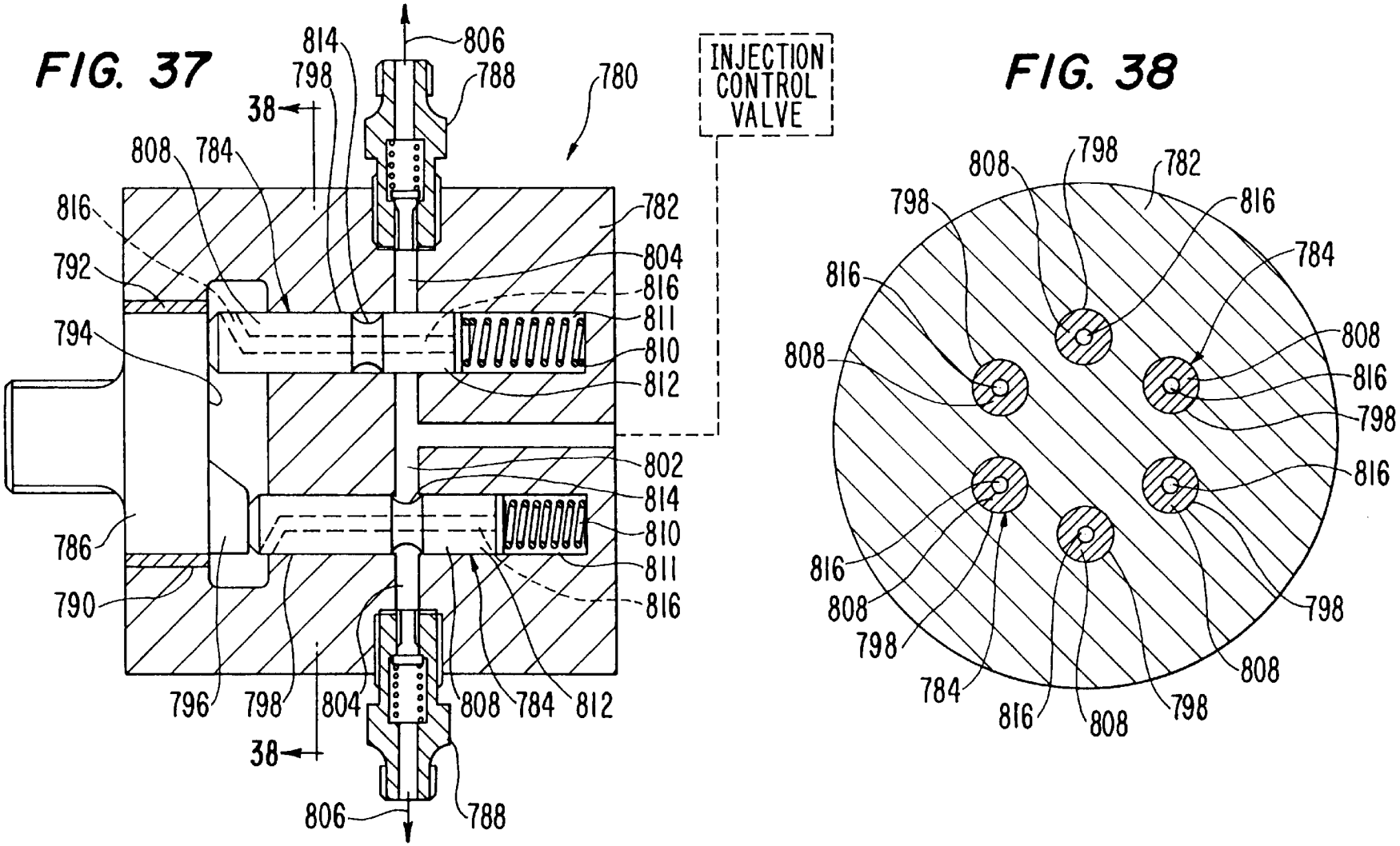
FIG. 37 is a cross-sectional view of another embodiment of the distributor of the present invention using slidable spool valves.
FIG. 38 is a cross-sectional view of the spool valve distributor of FIG. 37 taken along Line 38—38.

Referring now to FIGS. 37 and 38, an alternative embodiment of the fuel distributor used in the fuel system of the present invention is disclosed. Specifically, distributor 780 includes a distributor housing 782 containing distributor or injection line valves 784 which are operated by a rotating camshaft 786 to deliver pressurized fuel through respective delivery valves 788 to corresponding engine cylinders (not shown). Distributor housing 782 includes a large cylindrical recess 790 in one end of housing 782 for receiving rotating camshaft 786. A seal 792 is provided between the outer annular surface of camshaft 786 and distributor housing 782 to prevent fuel from leaking between camshaft 786 and housing 782 while permitting camshaft 786 to rotate. Camshaft 786 includes an end face 794 having a cam 796 formed thereon for operating injection line valves 784 during rotation of camshaft 786. Cam 796 is positioned on the outer radial portion of end face 794 for sequentially contacting injection line valves 784.

Distributor housing 782 further includes a plurality of valve cavities 798 extending axially along the rotational axis of camshaft 786 perpendicular to end face 794. Valve cavities 798 are equally spaced in a circular formation, as shown in FIG. 38, and extend from the inner end of cylindrical recess 790. A supply inlet passage 800 is formed in distributor housing 782 and fluidically connected at one end to the injection control valve 20 of FIG. 1. The opposite end of supply inlet passage 800 is connected to a common supply chamber 802 which is fluidically connected to each of the valve cavities 798. A respective fuel injection outlet passage 804 extends radially outward from each valve cavity 798 through housing 782 for delivering high pressure fuel to respective fuel injection lines 806 leading to corresponding engine cylinders. The respective spring biased delivery valve 788 is positioned in each fuel injection line 806 to prevent the flow of fuel from each fuel injection line 806 back through distributor 780.

Injection line valves 784 are each of the spool-type including a slide valve element 808 positioned for reciprocal movement in a respective valve cavity 798. Each slide valve element 808 extends, at one end, into the inner end of recess 790 adjacent end face 794 of camshaft 786 so as to be positioned for engagement by cam 796 during rotation of camshaft 786. The opposite end of each slide valve element 808 extends into its corresponding valve cavity 798 beyond the connections of fuel injection outlet passages 804 and supply chamber 802 to the valve cavity 798. A bias spring 810 is positioned in a cavity 811 formed by the opposite end of slide valve element 808 and a closed end of each valve cavity 798 to bias slide valve element 808 toward camshaft 786 and into abutment with end face 794.

Each slide valve element 808 also includes a cylindrical land 812 sized to form a close sliding fit with the inside surface of valve cavity 798 creating a fluid seal between the adjacent surfaces to prevent fuel from leaking from outlet passage 804 and supply inlet passage 800 when land 812 covers or blocks these passages. Supply valve element 808 also includes an annular groove 814 formed in its outer surface so as to form land 812 on one end of element 808. Annular groove 814 is formed along valve element 808 so as to be positioned in communication with common supply chamber 802 and fuel injection outlet passage 804 when the respective slide valve element is moved inward by cam 796 against the bias force of spring 810.

Operation of the fuel distributor of FIG. 37 will now be discussed in accordance with its use in the fuel pump system of the present invention. As camshaft 786 rotates, cam 796 sequentially engages slide valve elements 808 of injection line valves 784 moving a respective slide valve element 808 to the right as shown in FIG. 37 against the bias force of spring 810. In this manner, annular groove 814 moves into communication with common supply chamber 802 and fuel injection outlet passage 804, placing injection line valve 784 in an open position fluidically connecting supply inlet passage 800 with a respective injection line 806. As camshaft 786 continues to rotate, cam 796 passes by the end of slide valve element 808 allowing slide valve element 808 to return to a closed position under the force of bias spring 810, wherein land 812 blocks the flow between common supply chamber 802 and fuel injection outlet passage 804. The opening and closing of each injection line valve 784 defines a respective potential injection period or window of opportunity during which injection may occur as determined by the operation of injection control valve 20 shown in FIG. 1. However, at any given time during the rotation of camshaft 786, only one injection line valve 784 is in an open position defining the injection period. Injection control valve 20 opens and subsequently closes during each injection period to define an injection event during which high pressure fuel from high pressure accumulator 12 is delivered via supply inlet passage 800, common supply chamber 802 through a respective injection line valve 784 into outlet passage 804 and a respective injection line 806 for delivery to a respective injector nozzle assembly 11 and associated engine cylinder (not shown). Injection line valve 784 also includes an equalizing passage 816 extending from one end of slide valve element 808 to the opposite end so as to communicate recess 790 with spring cavity 811. In this manner, any pressure developing in recess 790 and spring cavity 811 due to fuel leaking between slide valve element 808 and distributor housing 782 can be equalized to permit movement of slide valve element 808. Also, although not shown, a drain passage may be used to connect spring cavity 811 and/or recess 790 to a low pressure fuel drain. Alternatively, spring cavity 811 and recess 790 may be filled with lube oil via a passage (not shown) communicating with recess 790. In addition, other forms of distributors may be used in the present fuel system including the distributors discloses in commonly assigned U.S. patent application Ser. No. 117,697 entitled Distributor for High Pressure Fuel Injection System which is hereby incorporated by reference.

Figure 39:
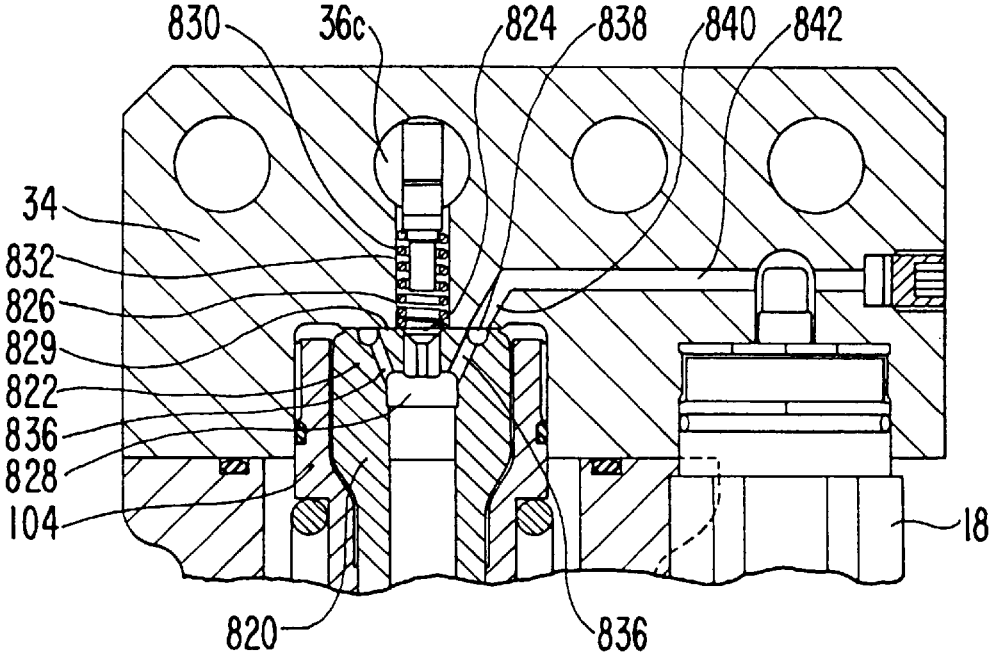
FIG. 39 is a partial cross-sectional view of an alternative embodiment of the fuel system assembly of the present invention.
Figure 40:
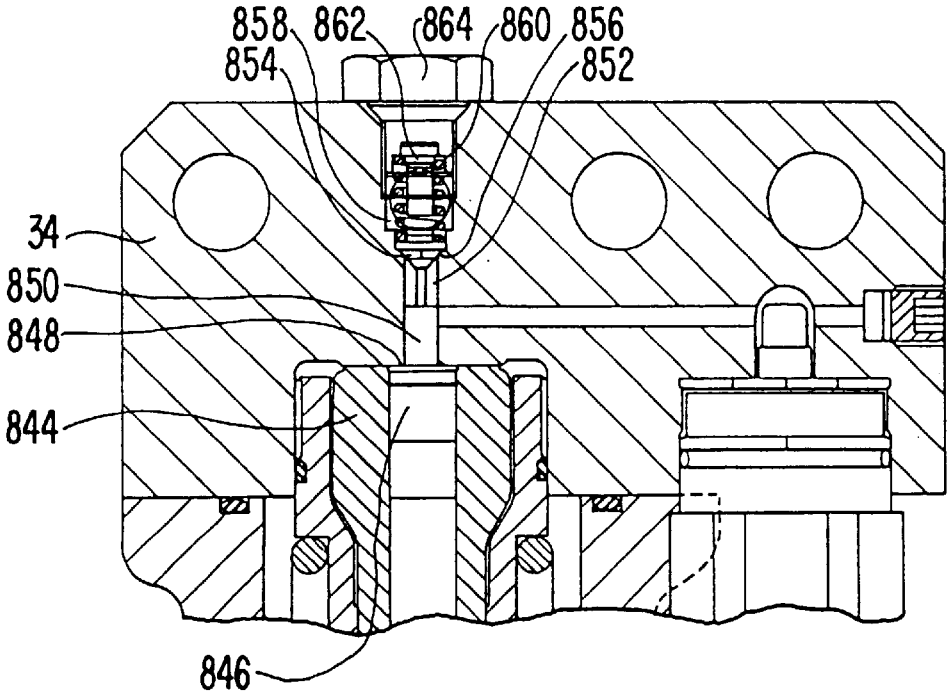
FIG. 40 is a partial cross-sectional view of yet another embodiment of the fuel system assembly of the present invention.

FIGS. 39 and 40 represent two further embodiments of the high pressure pump assembly of the present invention as shown in FIG. 6. Components of these embodiments which are the same as components disclosed in FIG. 6 will be referred to with like reference numerals. Both the embodiments of FIGS. 39 and 40 advantageously reduce the number of components of the assembly and the complexity of the manufacturing process, thereby advantageously reducing the costs of the entire system. Moreover, these embodiments reduce the potential for fuel leakage from the pump chamber by reducing the number of sealed joints subject to high fuel pressure.

As shown in FIGS. 39 and 40, these embodiments achieve the above-noted advantages by avoiding the use of sealing disk 112 of the embodiment shown in FIG. 6. The embodiment of FIG. 39 includes a one-piece pump barrel 820 having an inner end 822 positioned in compressive abutment with accumulator housing or pump head 34 under the force of retainer 104. The pump unit check valve 824 extends into a pump outlet passage 826 extending through inner end 822 along the central axis of the pump chamber 828. Pump unit check valve 824 is adapted to sealingly engage a check valve seat 829 formed on the upper annular surface of pump barrel 820 surrounding pump outlet passage 826 to prevent the flow of high pressure fuel from accumulator chamber 36*c* when the pressure of the fuel in chamber 36*c* is greater than the pressure of the fuel in pump chamber 828 while permitting fuel from chamber 828 into accumulator chamber 36*c* when the pressure in pump chamber 828 exceeds the fuel pressure in accumulator chamber 36*c*. Check valve 824 is biased into the closed position against check valve seat 829 by a bias spring 830 positioned in a delivery passage 832. A spring guide pin 834 extends from accumulator chamber 36*c* into delivery passage 832 for guiding spring 830 while providing a seating surface for spring 830. Pump barrel 820 also includes a pair of pump inlet passages 836 extending from pump chamber 828 to connect with an annular groove 838 formed in the top surface of pump barrel 820. As described more fully hereinabove with respect to FIG. 6, annular groove 838 is fluidically connected to pump control valve 18, 19 by a respective fuel passage 840 and fuel feed branch passage 842. The operation of this embodiment is substantially the same as that described in relation to FIG. 6 hereinabove.

Referring now to FIG. 40, another embodiment of the pump assembly includes a pump barrel 844 positioned in abutment with pump head 34 so as to position pumping chamber 846 immediately adjacent pump head 34. Pump head 34 extends across pump chamber 846 to form at least a partial end wall 848 of pump chamber 846. In this embodiment, no pump inlet and outlet passages are formed in pump barrel 844 since pump inlet and outlet passages 850 and 852 respectively are formed completely in pump head 34. A check valve 854 is positioned in outlet passage 852 for abutment against a check valve seat 856 formed annularly around outlet passage 852. A check valve assembly cavity 858 extends from the upper surface of pump head 34 downwardly to communicate with pump outlet passage 852 to permit easy installation of check valve 854 and its associated spring 860 and guide pin 862. A sealing plug 864 is threadably engaged in check valve assembly cavity 858 to seal cavity 858 while providing support for spring 860 and guide pin 862. Both the embodiments shown in FIGS. 39 and 40 advantageously create only one high pressure joint between the inner end of each pump barrel and the abutting pump head. This design minimizes the amount of fuel leakage and reduces the time and expense involved in forming metal to metal sealing surfaces, thereby ensuring effective high pressure operation of the pump at reduced cost.

Figure 41:
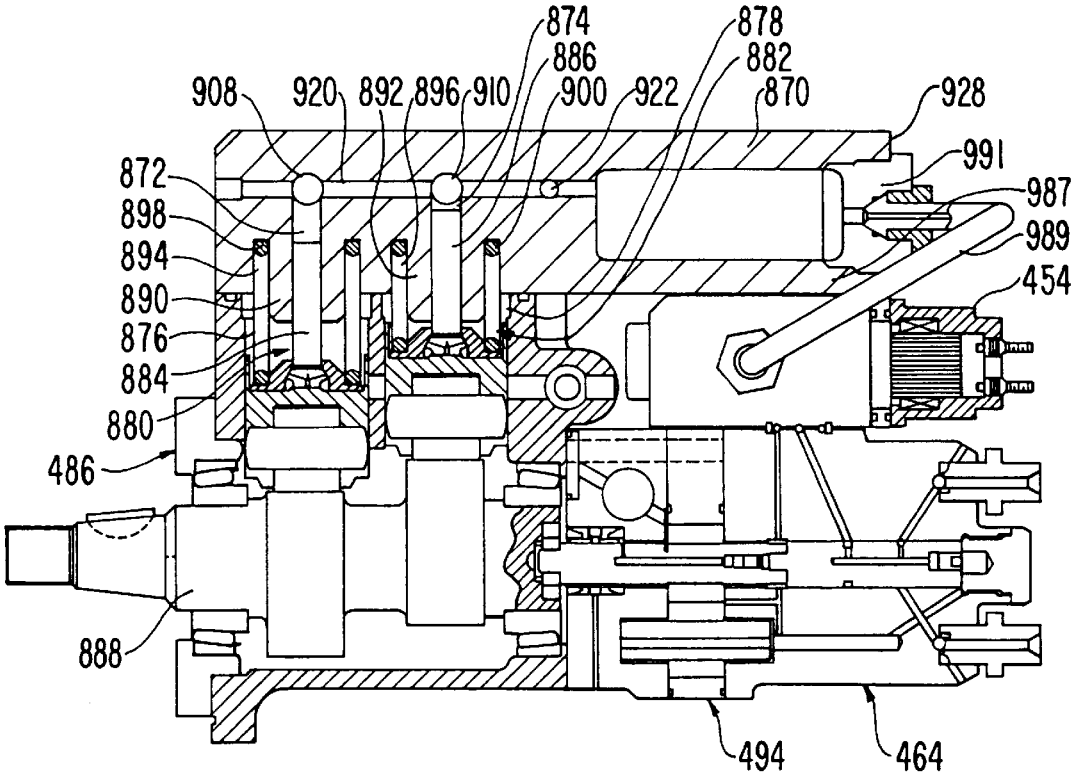
FIG. 41 is a cross-sectional view of yet another embodiment of a fuel system assembly designed in accordance with the subject invention.
Figure 42:
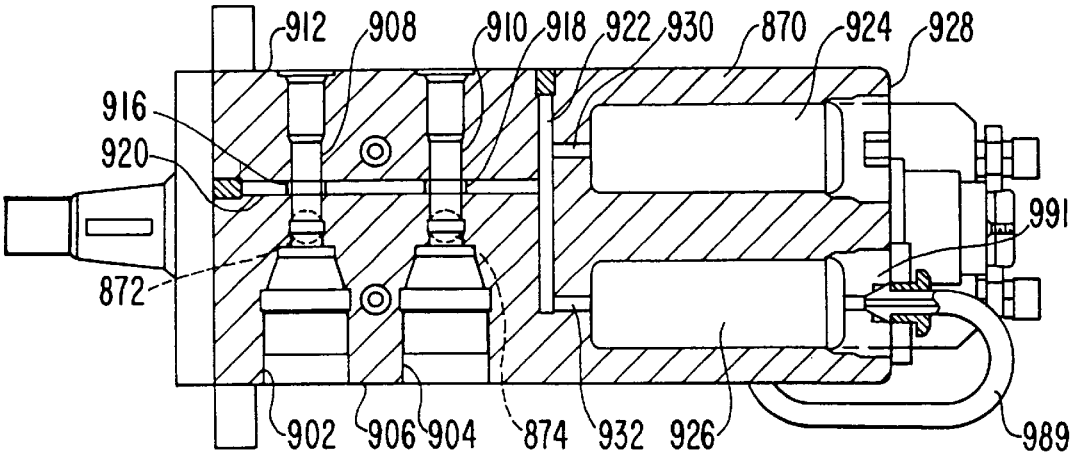
FIG. 42 is a cross-sectional view of the fuel system assembly of FIG. 41 taken generally along line 42—42.
Figure 43:
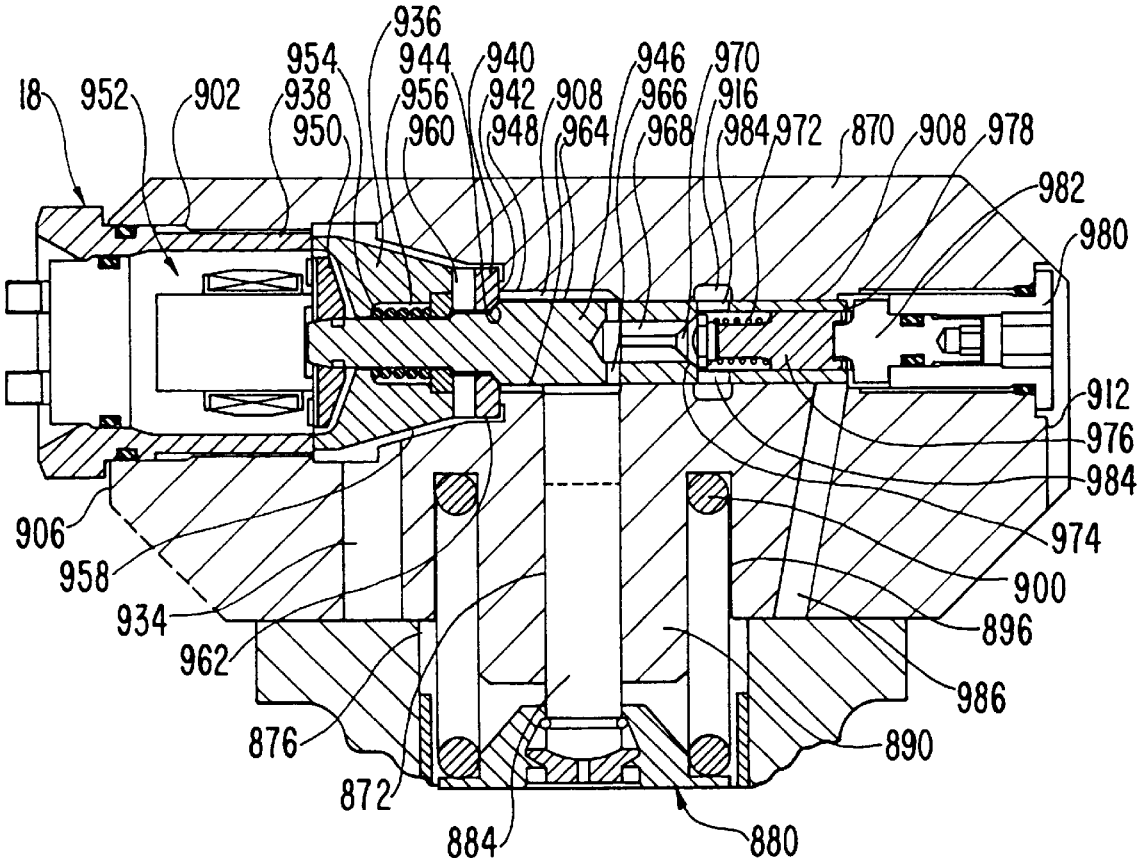
FIG. 43 is a partial cross-sectional view of the fuel system assembly of FIG. 42 taken generally along line 43—43.

Reference is now made to FIGS. 41 through 43 which disclose yet another embodiment of the subject invention. This embodiment is substantially the same as the embodiment shown in FIG. 30 discussed hereinabove with regards to the single solenoid operated three-way injection control valve 454, the distributor 464, gear pump 494 and the lower portion of high pressure pump assembly 486. However, in this embodiment, an accumulator housing or pump head 870 is integrated with the upper portion of high pressure pump assembly 486 so as to minimize the overall height of the fuel pump assembly. In particular, pump chambers 872 and 874 are formed directly in the accumulator housing 870. The pump chambers 872 and 874 are formed along a respective radial pump axis extending through outwardly opening pump cavities 876, 878 housing pump units 880 and 882. Pump plungers 884, 886 extend into the respective pump chambers 872 and 874 for reciprocal movement during the rotation of the drive shaft 888. Pump chambers 872 and 874 are formed by respective pump barrels 890 and 892 formed integrally with accumulator housing/pump head 870. Pump barrels 890 and 892, formed integrally with accumulator housing 870, each extend inwardly into respective pump cavities 876, 878 to support pump plungers 884, 886.

Respective annular spring recesses 894 and 896 are formed around respective pump barrels 890, 892 for receiving and supporting one end of respective bias springs 898 and 900. Accumulator housing/pump head 870 also includes a pair of pump valve recesses 902 and 904 formed in a sidewall 906 and extending transversely into the housing for receiving pump control valves 18, 19. A respective cavity 908, 910 extends laterally through housing 870 from each pump valve recess 902, 904 respectively, to an opposite side wall 912 for receiving a respective control valve element 914 (FIG. 43) of a respective pump control valve 18, 19. Each valve cavity 908, 910 is positioned axially along housing 870 directly above respective pump chambers 872, 874 so that pump chambers 872, 874 open directly into respective valve cavities 908, 910.

As shown in FIGS. 41 and 42, annular grooves 916, 918 are formed in respective valve cavities 908, 910 transversely between respective pump chambers 872, 874 and side wall 912. A common axial transfer passage 920 extends axially through housing 870 so as to connect annular grooves 916 and 918. Common axial transfer passage 920 extends from valve cavity 910 axially to intersect a cross passage 922 extending transversely through a portion of accumulator housing 870 from side wall 912. The open ends of transfer passage 920 and cross passage 922 are fluidically sealed by plugs 920 a and 922 a positioned in a recess formed in the open end. Accumulator housing 870 also includes two accumulator chambers 924 and 926 extending axially into the housing from an end wall 928. A respective axial passage 930, 932 connects each accumulator chamber 924, 926 to cross passage 922. As shown in FIG. 43, accumulator housing 870 also includes a respective supply passage 934 associated with each pump control valve 18, 19. Generally, pump control valves 18 and 19 are each preferably a solenoid-operated valve assembly similar to the type disclosed in commonly assigned U.S. Pat. No. 4,905,960 to Barnhart. The mounting arrangement of pump control valves 18 and 19 in pump head 870 is structurally the same. Only the differences in pump control valve 18 will be described hereinbelow. In this particular application, pump control valve 18 includes a spring housing 936 positioned between a solenoid casing 938 and a valve seat member 940. Valve seat member 940 is positioned in a compressive fluid sealing abutting relationship between spring housing 936 and an annular abutment surface 942 formed on accumulator housing 870 around valve cavity 908. Valve seat member 940 extends radially inward around valve cavity 908 to form an annular valve seat 944. Pump control valve 18 also includes a valve member 946 reciprocally mounted in valve cavity 908 for controlling the flow of fuel to and from pumping chamber 872. Valve member 946 includes an annular conical surface 948 for engaging valve seat 944 when valve member 946 is moved into a closed position. An armature 950 is connected to one end of valve member 946 adjacent solenoid coil assembly 952 to be pulled toward the solenoid coil assembly 952 when the coil assembly is energized. A valve biasing spring 954 is positioned in an annular cavity 956 formed in spring housing 936 for biasing conical surface 948 of valve member 946 away from valve seat 944 into an open position. Spring housing 936 is positioned relative to the inner surface of pump valve recess 902 to form an annular gap 958 in communication with supply passage 934. Valve seat member 940 includes radial passages 960 in communication with annular gap 958. Valve member 946 is positioned relative to valve seat member 940 to form a first annular passage 962 in communication with radial passages 960 on one side of valve seat 944. On the opposite side of valve seat 944, valve member 946 is positioned relative to the inner annular surface of valve cavity 908 to form a second annular passage 964 which communicates at one end with first annular passage 962 when valve member 946 is in the open position, and with pumping chamber 872 at an opposite end.

As shown in FIG. 43, valve member 946 of pump control valve 18 also includes a pump outlet passage 966 connecting pumping chamber 872 with a check valve cavity 968 formed centrally in valve member 946. A spring biased check valve 970 is positioned in check valve cavity 968 and biased by a check valve spring 972 against a check valve seat 974 formed on the inner annular surface of valve member 946 in cavity 968. A spring guide pin 976 is also positioned in check valve cavity 968 and secured to valve member 946 by an inner snap ring 978. Therefore, the check valve assembly including check valve 970, check valve spring 972 and spring guide pin 976 reciprocate with valve member 946 during operation of pump control valve 18. The open end of each valve cavity 908, 910 is fluidically sealed by a plug 980 threaded into a recess formed in the open end. A valve stop 982 is threadedly engaged with the plug 980 to form an abutment for the outer annular end of valve member 946 when valve member 946 is moved into the open position by biasing spring 954. Valve stop 982 includes an inner extension 983 for abutment by guide pin 976. By rotating valve stop 982 relative to plug 980, the transverse position of valve stop 982 relative to valve member 946 and, thus, the valve stroke of valve member 946 may be adjusted.

Valve member 946 further includes radial passages 984 arranged to allow fluid communication between check valve cavity 968 and annular groove 916. Check valve seat 974 is positioned along check valve cavity 968 between pump outlet passage 966 and radial passage 984 to allow check valve 970 to prevent the back flow of high pressure fuel from accumulator chambers 924, 926 when in the closed position while permitting high pressure fuel from pumping chambers 872, 874 to flow to the accumulator chambers 924, 926 when valve member 946 moves to the closed position. Accumulator housing 870 also includes a drain passage 986 extending from valve cavity 908 adjacent valve stop 982 to a low pressure drain (not shown).

The pump assembly of FIGS. 41–43 is particularly advantageous in several respects. First, by forming the pump barrels 890, 892 integral with pumphead/accumulator housing 870 and mounting the pump control valves 18, 19 in the side of the accumulator so as to extend transversely through the accumulator housing 870. The accumulator housing 870 can be moved closer to the drive shaft 888 resulting in a more integrated, compact and lightweight pump assembly. As shown in FIG. 41, this compact assembly permits contiguous positioning of injection control valve 454 between an axial overhang 987 of accumulator housing 870 and distributor 464. Instead of a vertical feed tube connecting the accumulator to the injection control valve as shown in the previous embodiments, a feed tube 989 is connected at one end to a plug 991 positioned in the open end of accumulator chamber 926 and loops around to connect with the side wall of the housing containing injection control valve 454. Secondly, this integrated assembly reduces the volume of high pressure fuel trapped in the high pressure passages during a pump delivery stroke since the pumping chambers are moved immediately adjacent the valve cavities and valve seats. This reduction in trapped volume translates into increased pumping efficiency for each stroke of the high pressure pump since a greater portion of the total volume of fuel subjected to very high pressure is actually transferred into the accumulator. As a result, the horsepower of the engine may be increased for a given size fuel pump assembly since less power is consumed by the high pressure pump in pumping the same amount of fuel into the accumulator as compared to a similar system without this feature. Third, because the pump chamber is moved into the accumulator housing, this design minimizes the number of high pressure joints between the pump chamber and the accumulator chambers.

Figure 44:
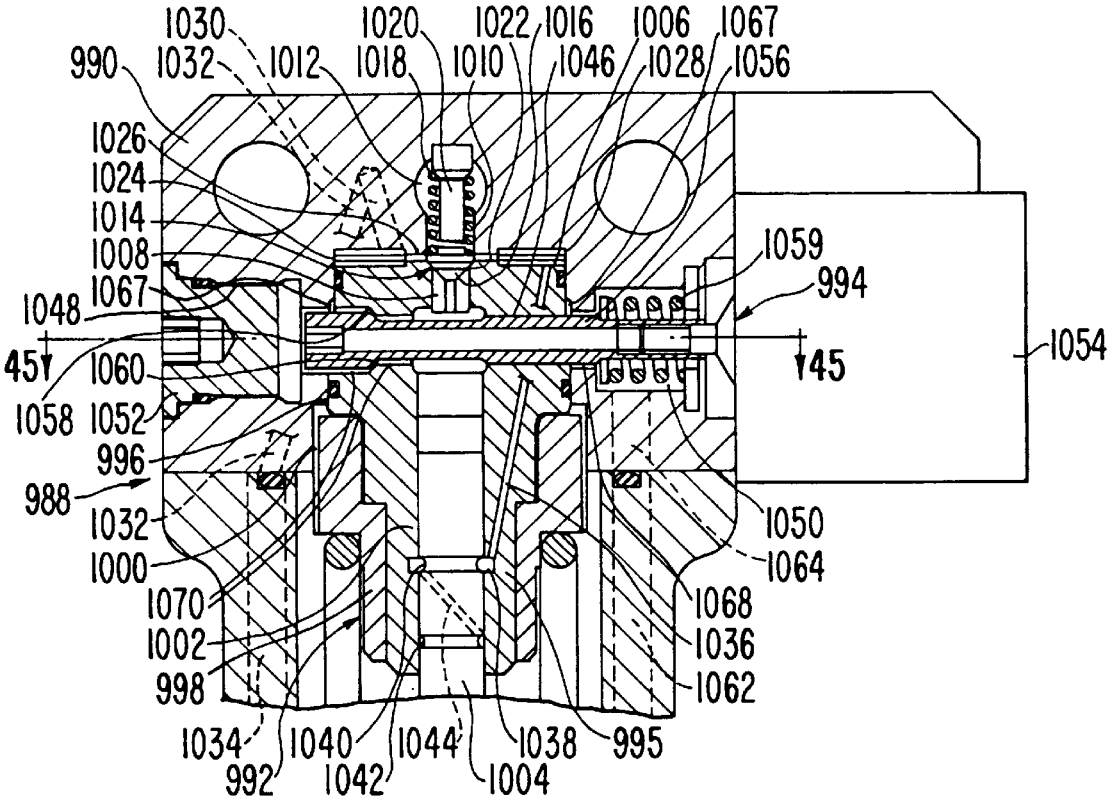
FIG. 44 is a partial cross-sectional view of another embodiment of an accumulator/pump housing assembly designed in accordance with the subject invention taken along line 44—44 of FIG. 45.
Figure 45:
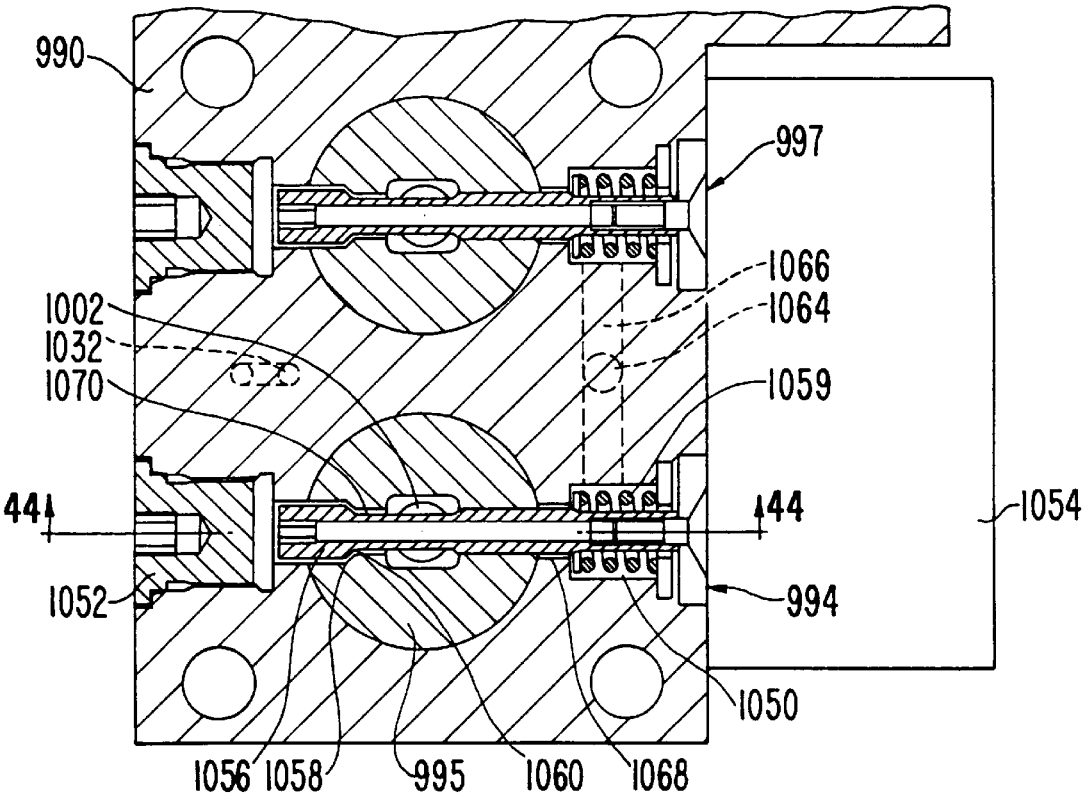
FIG. 45 is a partial cross-sectional view of the accumulator/pump housing of FIG. 44 taken along line 45—45.

Referring now to FIGS. 44 and 45, another embodiment of the present invention is illustrated. Generally, this embodiment discloses a novel pump assembly including a pump head 990, a pair of pump units 992 and 993, and corresponding pressure balanced pump control valves 994 and 997. The pump units 992 and 993, and associated pump control valves 994 and 997 are structurally the same and, therefore, only pump unit 992 and pump control valve 994 will be discussed hereinbelow. Although not shown, fuel pump assembly 988 may be used with, or mounted on, the same components of the fuel pumping systems disclosed in FIGS. 5, 28 and 30, including the solenoid operated three-way injection control valve(s), the distributor, and the lower portion of the high pressure pump assembly. As shown in FIG. 44, pump unit 992 includes a pump barrel 995 held in a pump recess 996 by a pump retainer 998 having external threads for engaging complementary threads formed on the inner annular surface of a counter bore 1000 formed in the outer end of recess 996. Pump unit 992 also includes a pump chamber 1002 formed in barrel 995 and a pump plunger 1004 positioned for reciprocal movement within pump chamber 1002 in response to the rotation of the drive shaft (not shown). Pump barrel 995 includes an inner end 1006 positioned in abutment with the pump head 990. A pump unit outlet passage 1008 extends through inner end 1006 from pump chamber 1002. A discharge passage 1010 is formed in pump head 990 to connect outlet passage 1008 to an accumulator chamber 1012. A pump unit check valve assembly 1014 is positioned in accumulator chamber 1012, discharge passage 1010 and pump unit outlet passage 1008. Check valve assembly 1014 includes a check valve element 1016, biasing spring 1018 and guide pin 1020. Check valve element 1016 is biased by spring 1018 into abutment with an annular valve seat 1022 formed on pump barrel 995 around outlet passage 1008 so as to prevent fuel flow from accumulator chamber 1012 into pump chamber 1002 while permitting fuel flow from pump chamber 1002 into accumulator chamber 1012 when the fuel pressure in chamber 1002 is greater than the fuel pressure in chamber 1012. A facer plate 1024 and sealing ring 1026 are positioned around annular seat 1022 between pump barrel 995 and pump head 990 to prevent high pressure fuel from leaking between these components. Alternatively, facer plate 1024 and sealing ring 1026 may be omitted to form a metal to metal joint between pump barrel 995 and pump head 990. An outer annular groove 1028 is formed between the pump barrel 995 and pump head 990 to receive any high pressure fuel that leaks through the sealed connection provided by either facer plate 1024 and sealing ring 1026 or a metal to metal interface. A drain connector passage 1030 extends from annular groove 1028 to connect with a combined drain passage 1032 for directing leak-by fuel from annular groove 1028 to drain via a main drain passage 1034 formed in the pump housing. A similar drain connector passage (not shown) associated with pump unit 993 connects to main passage 1034.

A lubrication flow passage 1036 extends through pump barrel 995 from annular groove 1028 to connect with an annular lubrication channel 1038 formed in barrel 995 around chamber 1002. First and second annular lubrication grooves 1040 and 1042, respectively, are formed in plunger 1004 and connected by cross passage 1044. During the reciprocal movement of plunger 1004 in chamber 1002, first and second annular lubrication grooves 1040, 1042 are intermittently connected to annular lubrication channel 1038. In this manner, low pressure fuel from annular groove 1028 is used to lubricate plunger 1004 thereby minimizing friction between plunger 1004 and the inner surface of pump barrel 995 thus minimizing wear, scuffing and scoring of the contacting surfaces.

A valve cavity 1046 extends diametrically through pump barrel 995 so as to intersect the inner end of pumping chamber 1002 and the outer end of outlet passage 1008. Valve cavity 1046 also extends through pump head 990 to connect with a plug recess 1048 at one end and a spring chamber 1050 at the opposite end. The open end of valve cavity 1046 adjacent recess 1048 is fluidically sealed by a plug 1052 threadably engaging pump head 990 in recess 1048. Pressure balanced pump control valve 994 includes a valve operator 1054 mounted on one side of pump head 990 and a control valve element 1056 mounted for reciprocal movement in valve cavity 1046. Control valve element 1056 includes an annular valve surface 1058 for abutment against an annular valve seat 1060 formed on pump barrel 995 around valve cavity 1046 when pressure balanced pump control valve 994 is in a closed position. A biasing spring 1059 is positioned in spring chamber 1050 for biasing control valve element 1056 into an open position. Fuel is delivered to pump chamber 1002 via a main supply passage 1062 formed in the pump housing, a connector passage 1064 formed in a lower portion of pump head 990 and a cross feed passage 1066 which extends longitudinally through pump head 990 to fluidically connect spring chamber 1050 of one pump control valve 994 to an adjacent pump control valve as shown in FIG. 45. An annular channel 1067 is formed in pump head 990 around pump recess 996 adjacent valve cavity 1046. An annular gap 1068 formed between control valve element 1056 and the inner surface of valve cavity 1046 connects spring chamber 1050 to annular channel 1067. On the opposite end of valve cavity 1046, annular channel 1067 is connected to chamber 1002 by an annular gap 1070 formed between control valve element 1056 and the inner surface of valve cavity 1046. Annular valve seat 1060 is formed along annular gap 1070 between annular channel 1067 and chamber 1002. In this manner, annular valve surface 1058 can be moved into and out of engagement with annular valve seat 1060 to control the flow of fuel into and out of pump chamber 1002.

Pressure balanced pump control valve 994 may be any conventional solenoid operated, pressure balanced two-way valve adaptable for use in this design. The control valve element 1056 of pressure balanced pump control valve 994 is pressure balanced in the closed position because the fluid pressure forces resulting from high pressure fluid acting on control valve element 1056 in one direction, i.e., to the right in FIG. 44, equal the fluid pressure forces resulting from high pressure fluid acting on control valve element 1056 in the opposite direction, i.e., to the left in FIG. 44, since the effective cross sectional area of valve seat 1060 which remains exposed to the fluid pressure found in the pump chamber is equal to the effective cross-sectional area defined in the portion of valve element 1056 received in the pump barrel on the right side of pump chamber 1002, control valve element 1056 causing the rightward forces equals the surface area of the control valve element 1056 causing the leftward forces.

During operation, fuel is delivered by a supply pump (not shown) through main supply passage 1062, connector passage 1064 and cross feed passage 1066 into spring chamber 1050. Fuel flows from spring chamber 1050 through annular gap 1068 surrounding control valve element 1056, annular channel 1067 surrounding barrel 995 into annular gap 1070 adjacent annular valve seat 1060. When pressure balanced pump control valve 994 is in the de-energized open position, fuel flows between annular valve seat 1060 and annular valve surface 1058 into pump chamber 1002. As pump plunger 1004 reciprocates, fuel flows into, and is pumped out of, pump chamber 1002 via these supply passages. Upon the need for fuel delivery to accumulator chamber 1012, valve operator 1054 of pump control valve 994 will be energized during the advancing movement of the pump plunger 1004 to move control valve element 1056 to the right in FIG. 44, thus causing annular valve surface 1058 to engage annular valve seat 1060. As a result, fuel flow through annular gap 1070 is blocked allowing pump plunger 1004 to compress and pressurize any fuel remaining in pump chamber 1002. Upon reaching a pressure level greater than the fuel pressure level in accumulator chamber 1012, fuel in pump chamber 1002 will open check valve element 1016 and flow through outlet passage 1008 and discharge passage 1010 into accumulator chamber 1012. Depending on the control scheme used, at some point in time during the advancing or retracting movement of pump plunger 1004, pressure balance pump control valve 994 will be de-energized to permit check valve element 1016 to move into an open position under the force of biasing spring 1059. The advantage of using a pressure balanced valve is that greater latitude exists for opening and closing the pump control valve. In particular, it becomes readily possible to terminate the effective pumping stroke of pump plunger 1004 during any point in the advancing stroke without resulting in very high spring or solenoid forces that would be required if an unbalanced valve structure were used.

Figure 46:
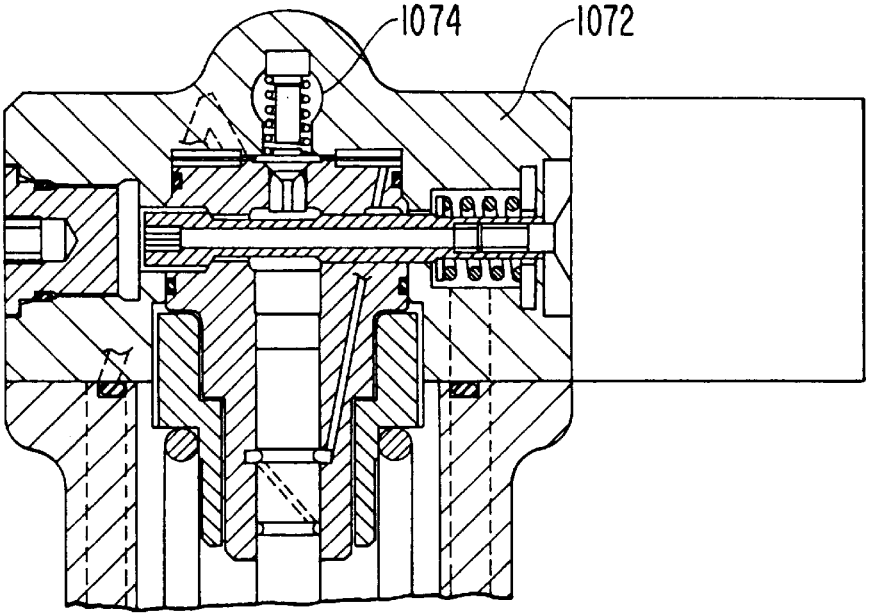
FIG. 46 is a partial cross-sectional view of another embodiment of a pump head/pump housing assembly used in the fuel system assembly of the subject invention.
Figures 52, 53A:
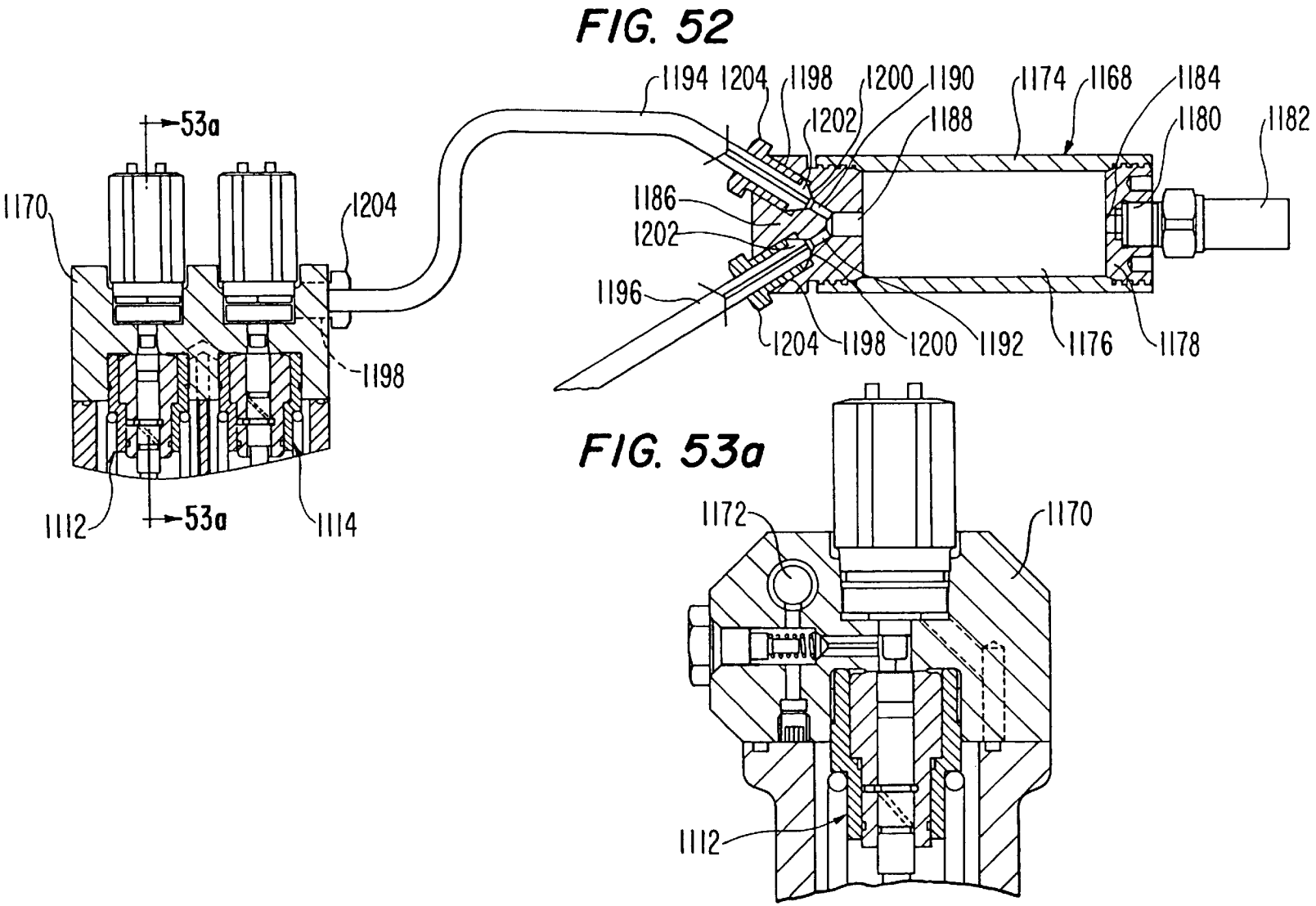
FIG. 52 is a partial cross-sectional view of another embodiment of a fuel system assembly designed in accordance with the subject invention showing an off-mounted accumulator.
FIG. 53*a* is a partial cross-sectional view of the fuel system assembly of FIG. 52 taken along line 53*a*—53*a*.

Reference is now made to FIG. 46 disclosing another embodiment of the present invention which is the same as the embodiment of FIGS. 44 and 45 except that a pump head 1072 does not include any accumulator chambers for accumulating a quantity of fuel. As will be explained more fully hereinbelow in relation to the embodiment of FIGS. 52 and 53, pump head 1072 merely includes a single common transfer passage 1074 for receiving fuel from the one or more pumping chambers 1002. One end of common transfer passage 1074 is connected to an off-mounted accumulator positioned a spaced distance from the fuel pump assembly as shown in FIG. 52. This arrangement results in a more compact fuel pump assembly while permitting mounting of the high pressure accumulator in a more appropriate and advantageous location on the engine.

Figure 47:
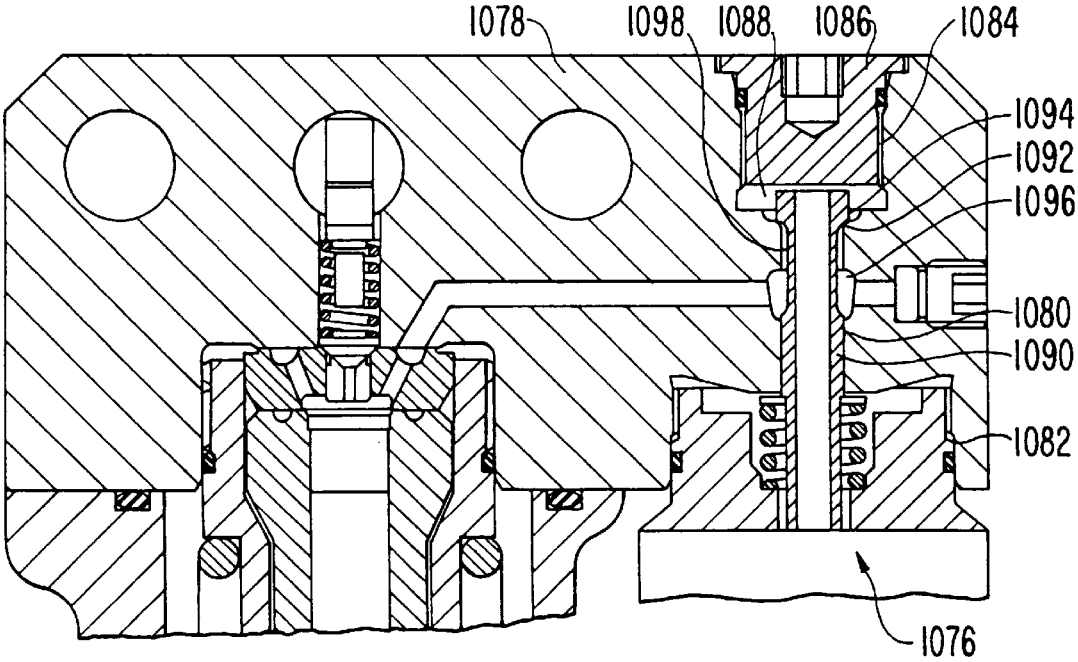
FIG. 47 is a partial cross-sectional view of yet another embodiment of an accumulator/pump housing assembly used in the fuel system assembly designed in accordance with the subject invention.

FIG. 47 represents yet another embodiment of the fuel pump assembly of the present invention which is the same as the embodiments disclosed in FIGS. 5, 28 and 30 except that a pressure balanced pump control valve 1076 is used. Pressure balanced pump control valve 1076 may be any conventional two-way pressure balanced solenoid-operated valve. A pump control valve cavity 1080 extends upwardly from a valve recess 1082 formed in a lower surface of accumulator housing 1078. Valve cavity 1080 opens into a plug recess 1084 which is fluidically sealed by a plug 1086. Plug 1086 terminates prior to the end wall of recess 1084 to form a chamber 1088. Pump control valve 1076 includes a control valve element 1090 which extends through valve cavity 1080 and terminates at one end in chamber 1088. An annular valve seat 1092 formed around valve cavity 1080 adjacent chamber 1088 is positioned for abutment by an annular valve surface 1094 formed on control valve element 1090. An annular recess 1096 may be formed in valve cavity 1080 adjacent control valve element 1090 between valve seat 1092 and valve recess 1082. An annular channel 1098 formed between control valve element 1090 and the inner wall of valve cavity 1080 fluidically connects chamber 1088 to annular recess 1096 when control valve 1076 is in the open position.

The fuel feed passages formed in accumulator housing 1078 are substantially the same as those disclosed in FIGS. 5–10L, with the exception of the following modifications. First, connector passages 92 and 94 shown in FIG. 1O*e* which supply fuel from common fuel feed passage 90 to both pump control valves, would extend from each chamber 1088 downwardly to communicate with passage 90 instead of extending upwardly from pump control valve recess 1082 as suggested by the embodiment of FIGS. 5 and 10*e*. Also, accumulator chamber 36*a* will necessarily be shorter in length so as to terminate prior to plug recess 1084. Operation of the embodiment of FIG. 47 is substantially the same as that of the embodiment shown in FIG. 6 except that pump control valve 1076 is pressure balanced when in the closed position blocking fuel flow between the fuel supply and the pump chamber thus permitting the control scheme flexibility discussed with respect to the embodiment disclosed in FIGS. 44–45.

Figure 48:
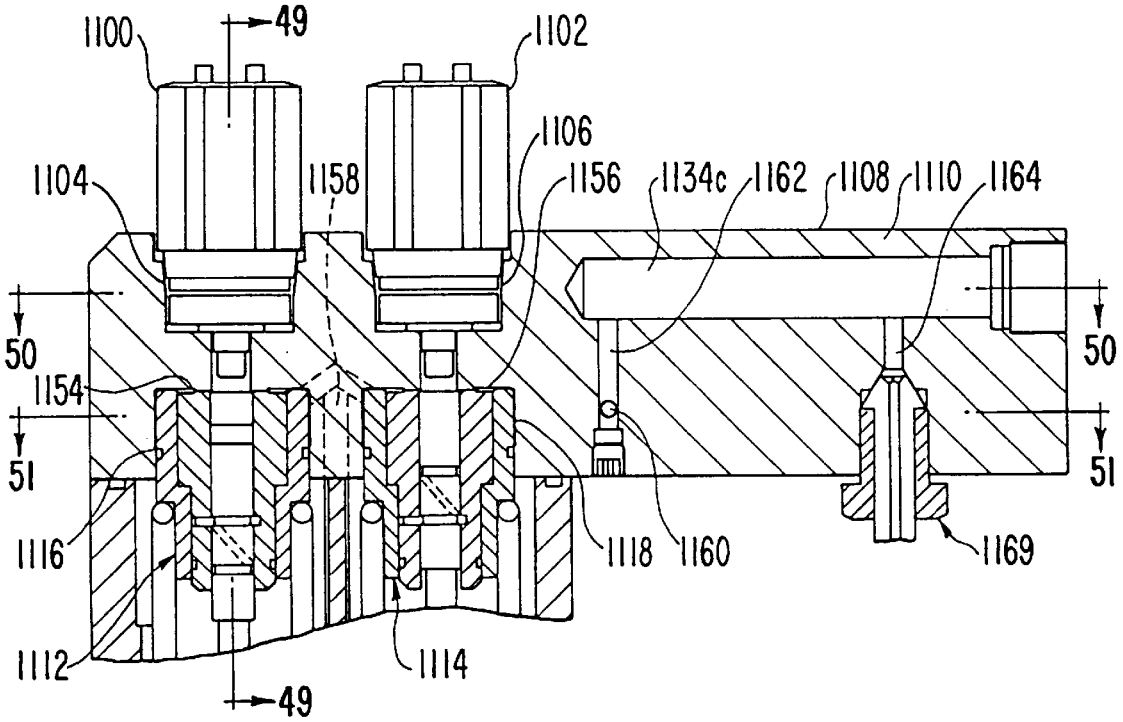
FIG. 48 is a partial cross-sectional view of yet another embodiment of a fuel system assembly designed in accordance with the subject invention having vertically mounted pump control valves.

Referring now to FIGS. 48–51, another embodiment of the present invention is disclosed. Referring to FIG. 48, pump control valves 1100 and 1102 are vertically mounted in respective valve recesses 1104 and 1106 formed in the top surface 1108 of accumulator housing 1110. Pump control valves 1100 and 1102 are each preferably a solenoid-operated valve assembly of the type disclosed in commonly assigned U.S. Pat. No. 4,905,960 to Barnhart. Pump units 1112 and 1114 are mounted in corresponding pump unit recesses 1116 and 1118 formed in the lower surface of accumulator housing 1110 directly below corresponding valve recesses 1104 and 1106. The formation of the fuel passages in accumulator housing 1110 associated with each pump control valve 1100 and 1102 are structurally the same and, therefore, only one set of passages and components will be described herein below.

Figure 49:
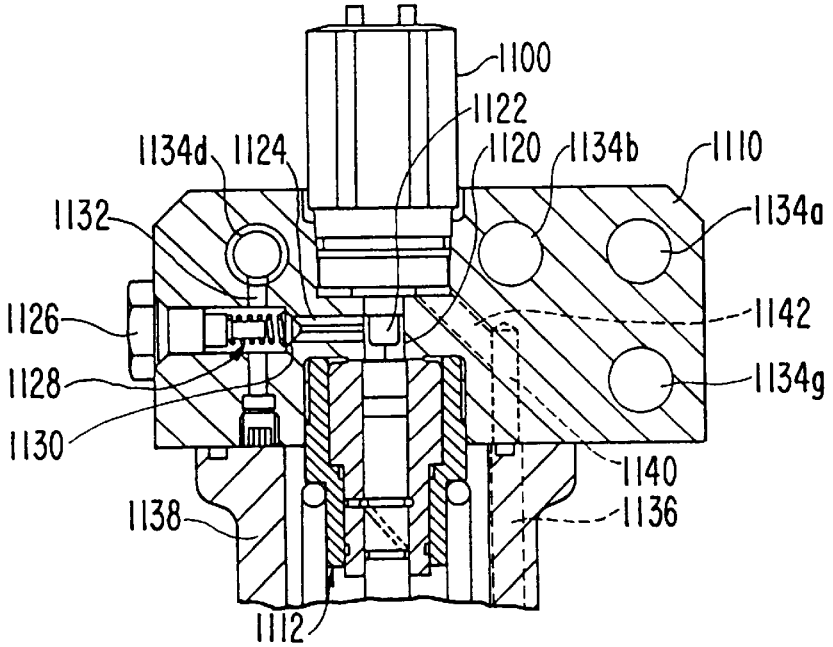
FIG. 49 is a cross-sectional view of the fuel system assembly of FIG. 48 taken along line 49—49.

Referring to FIG. 49, a pump outlet passage 1120 extends from valve recess 1104 to the pumping chamber of pump unit 1112 to form a valve cavity for receiving a valve element 1122 of pump control valve 1100. A discharge passage 1124 extends from one side of accumulator housing 1110 transversely inwardly to connect with pump outlet passage 1120. The open end of discharge passage 1124 is fluidically sealed with a plug 1126. A pump unit check valve 1128 is positioned in discharge passage 1124 and adapted to sealingly engage an annular valve seat surrounding discharge passage 1124. A vertical passage 1132 extends upwardly from the lower surface of accumulator housing 1110 through discharge passage 1124 to connect with an accumulator chamber 1134*d* formed in accumulator housing 1110. A similar vertical passage 1133 associated with pump unit 1114 connects a respective discharge passage (not shown) with accumulator chamber 1134*d*. A main supply passage 1136 formed in pump housing 1138 supplies low pressure fuel to pump control valve 1100 via a connector passage 1140 and a branch passage 1142. A similar branch passage 1143 extends from connector passage 1142 to supply fuel to the other pump control valve 1102. It should be noted that although pump units 1112 and 1114 are illustrated as being similar to the embodiment disclosed in FIG. 40 and described hereinabove, the pump units may take the form of a different embodiment.

Figure 50:
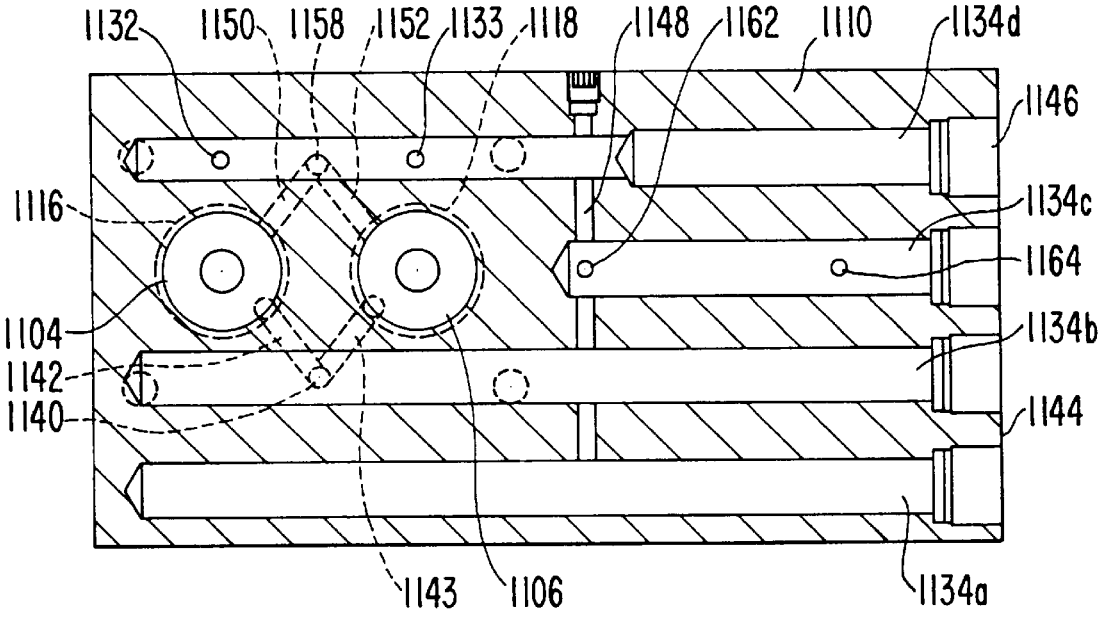
FIG. 50 is a cross-sectional view of the accumulator of the fuel system assembly shown in FIG. 48 taken along line 50—50.
Figure 51:
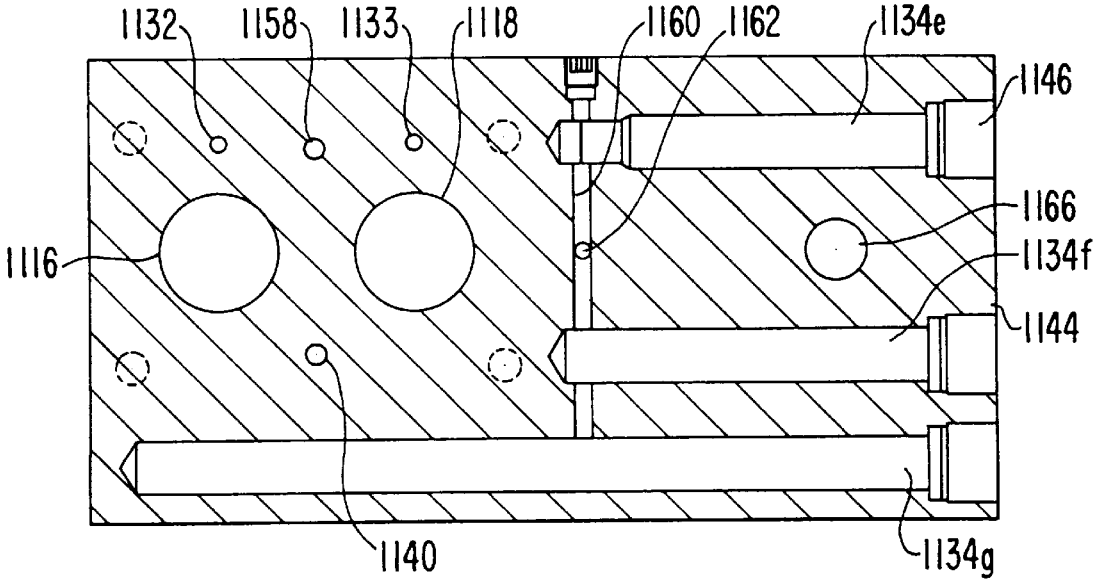
FIG. 51 is a cross-sectional view of the accumulator of the fuel system assembly of FIG. 48 taken along line 51—51.

Referring now to FIGS. 50 and 51, the accumulator housing 1110 of the embodiment illustrated in FIGS. 48–49 includes an upper row of elongated accumulator chambers 1134*a–d* (FIG. 50) and a lower row of elongated accumulator chambers 1134*e–g*. Each of the accumulator chambers are formed by drilling longitudinally through accumulator housing 1110 from an end wall 1144. The open end of each accumulator chamber is fluidically sealed with the respective plug 1146. The upper row of accumulator chambers are connected by a first cross passage 1148 extending transversely from one side of accumulator housing 1110 through each of the accumulator chambers 1134*a–d*. Accumulator housing 1110 further includes a pair of recess drain passages 1150 and 1152 extending from respective pump unit recesses 1116 and 1118 for directing fuel leakage collecting in respective recess clearances 1154 and 1156 to a main drain passage 1158. As shown in FIG. 50, accumulator chamber 1134*c* terminates about midway through accumulator housing 1110 adjacent first cross passage 1148. Accumulator chambers 1134*e–g* are also interconnected by a second cross passage 1160 (FIG. 51) extending transversely through accumulator housing 1110 in the same vertical plane as the first cross passage 1148. The upper and lower rows of accumulator chambers are connected by a vertical passage 1162 extending upwardly from second cross passage 1160 to connect with accumulator chamber 1134*c*. A fuel feed passage 1164 extending from the lower surface of accumulator housing 1110 also communicates with accumulator chamber 1134*c*. A recess 1166 formed in the open end of fuel feed passage 1164 is adapted to receive a fuel feed tube 1169 (FIG. 48) for supplying the temporarily stored fuel in the accumulator chambers to the fuel injection control valve(s) (not shown) for delivery to the engine via a distributor (not shown) as described hereinabove in relation to various other embodiments.

Referring now to FIGS. 52 and 53*a*, another embodiment of the present invention is shown which is the same as the previous embodiment of FIGS. 48 and 49 except that an accumulator 1168 is positioned a spaced distance from a pump head 1170. Pump head 1170 does not include any accumulator chambers but merely one elongated common transfer passage 1172 connected to vertical passages 1132, 1133 for receiving high pressure fluid from each pump unit 1112, 1114. The accumulator 1168 includes an accumulator housing 1174 forming a generally cylindrical accumulator chamber 1176. However, accumulator 1168 may include multiple interconnected accumulator chambers similar to the embodiments of FIGS. 7 and 50. One end of accumulator chamber 1176 is fluidically sealed with a plug having a stepped recess 1180 for receiving a pressure sensor 1182. A center passage 1184 connects stepped recess 1180 to accumulator chamber 1176 thereby permitting pressure sensor 1182 to monitor the fuel pressure in accumulator chamber 1176. The opposite end of accumulator chamber 1176 is fluidically sealed with an adapter 1186 having an inner recess 1188. Adapter 1186 also includes an inlet passage 1190 and an outlet passage 1192 extending from the inner end of inner recess 1188. A fuel transfer tube 1194 is connected at one end to common transfer passage 1172 and at an opposite end to inlet passage 1190 for delivering fuel from common transfer passage 1172 to accumulator chamber 1176. A fuel feed tube 1196 is connected at one end to outlet passage 1192 for delivering high pressure fuel from accumulator chamber 1176 to the injection control valve (not shown). The open ends of common transfer passage 1172, inlet passage 1190 and outlet passage 1192 include respective recesses 1198 having a tube seat 1200 for engaging a tube head 1202 formed on the end of the respective tube 1194, 1196. Each recess 1198 includes internal threads for engaging complementary external threads formed on a generally cylindrical tube fitting 1204. Each tube 1194, 1196 extends through the respective tube fitting 1204 so that one end of tube fitting 1204 abuts tube head 1202. Rotation of tube fitting 1204 relative to recess 1198 and the respective tube 1194, 1196 forces tube head 1202 inwardly into sealing engagement with tube seat 1200 thereby creating a fluidically sealed connection between the respective passage 1172, 1190, 1192 and the respective tube 1194, 1196.

The off-mounted accumulator design of FIGS. 52 and 53*a* permits the accumulator 1168 to be mounted in possibly more appropriate/advantageous locations around the engine. Moreover, the pump head 1170 is reduced in size in both the axial direction as shown in FIG. 52 and in the transverse direction as shown in FIG. 53*a*. This reduction in pump head size creates a more compact assembly which may more appropriately fit within the packaging constraints of certain engine or vehicle designs.

Figure 53B:
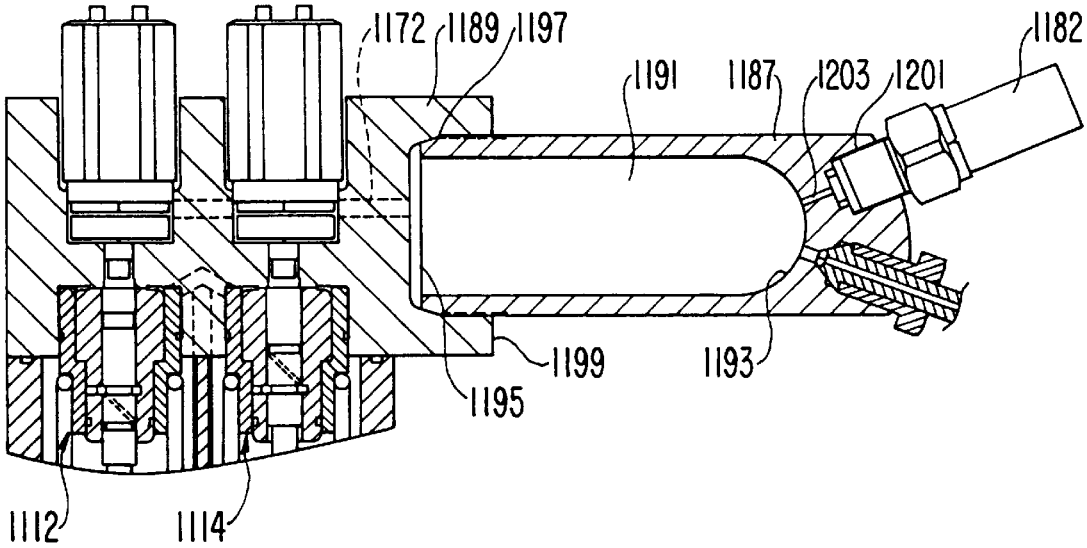
FIG. 53*b* is a partial cross-sectional view of another embodiment of the fuel system assembly of the present invention.

Reference is now made to FIG. 53*b* disclosing yet another embodiment of the present invention which is the same as the previous embodiment of FIGS. 52 and 53*a* and, therefore, like components will be referenced to with the same reference numerals. In this embodiment, a separately formed accumulator housing 1187 is connected to a pump head 1189. Accumulator housing 1187 is generally cylindrical in shape and includes an accumulator chamber 1191 having a closed end 1193 and an open end 1195. Open end 1195 is threadably secured in a recess 1197 formed in an end wall 1199 of pump head 1189 to form a fluidically sealed connection between accumulator housing 1187 and pump head 1189. Common transfer passage 1172 extends through pump head 1189 to connect with recess 1197 and accumulator chamber 1191 for delivering high pressure fuel from pump units 1112, 1114 to chamber 1191. Pressure sensor 1182 is positioned in a recess 1201 formed in closed end 1193 and connected to accumulator chamber 1191 by a passage 1203. The assembly of FIG. 53*b* is especially advantageous in providing a compact, unitized high pressure fuel pump assembly having an accumulator which is inexpensive to manufacture and easily mountable on the assembly.

Figure 54A:
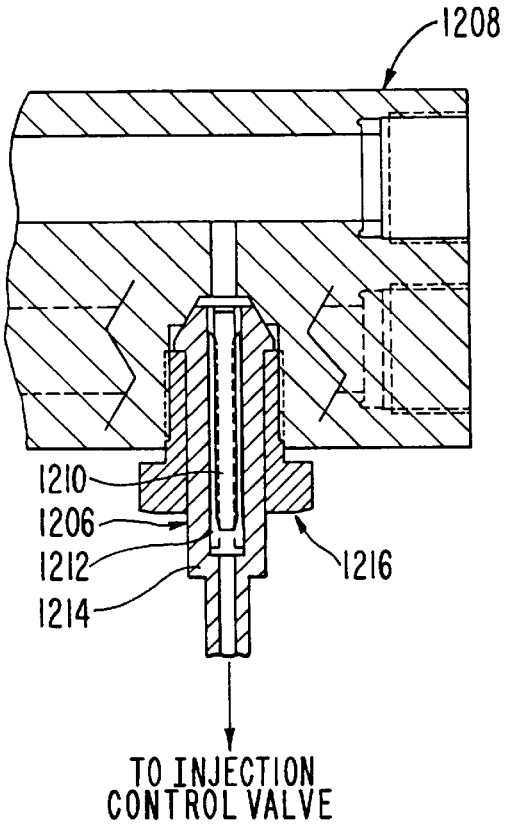
FIG. 54*a* is a partially cut away cross-sectional view of a feed tube housing an edge filter connected to the accumulator of the fuel system of the present invention.
Figure 54B:
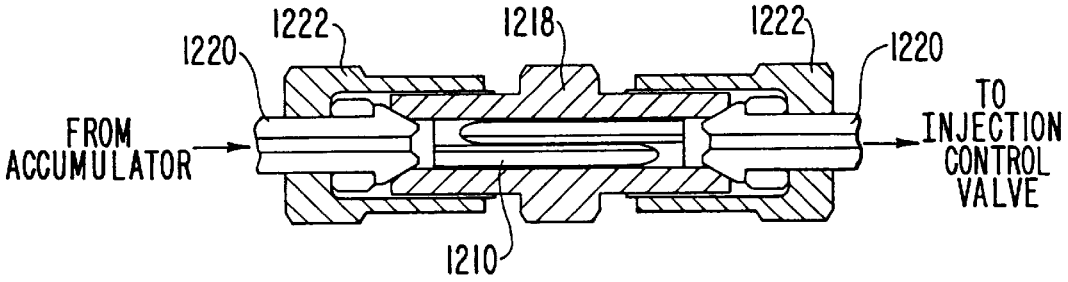
FIG. 54*b* is yet another embodiment of a filter housing for mounting the filter in the fuel system assembly of the present invention.

Reference is now made to FIGS. 54*a* and 54*b* which disclose edge filter assemblies used to capture small foreign particles in the fuel flowing from the accumulator to the injection control valve (not shown). It is known that the intermeshing gears of a gear pump, such as boost pumps 406 and 494 shown in FIGS. 28 and 30 respectively, often contact each other as they mesh during normal operation to form small metal particles. If not captured by the boost pump's filter, these metal particles will be carried by the fuel through the fuel pumping system. However, it has been found that these particles interfere with the successful operation of the injection control valve and distributor of the present invention. Both the injection control valve and distributor rely on extremely small clearances between components thereof to allow one or more of the components to move relative to the other while creating a fluidic seal at the clearance. Foreign particles in the fuel become lodged between the components in these clearances resulting in excessive wear or even binding of the moving part and possibly the gradual loss of the fluidic seal. As a result, it is desirable to position a filter in the fuel path upstream of the injection control valve which is capable of removing small particles from the fuel.

FIG. 54*a* discloses an edge filter assembly 1206 positioned along the fuel flow path between the accumulator 1208 and the injection control valve (not shown). Edge filter assembly 1206 includes an edge filter 1210 positioned in a filter cavity 1212 formed in one end of a fuel feed tube 1214 of a feed tube attachment assembly 1216. Tube attachment assembly 1216 is the same as the tube fitting connections described hereinabove in relation to the embodiments shown in FIGS. 5 and 52 except that the end of feed tube 1214 includes the filter cavity 1212 sized to house edge filter 1210. As shown in FIG. 54*b*, the edge filter may also be positioned in a filter housing 1218 positioned along a fuel feed tube 1220. In this instance, conventional high pressure tube attachment assemblies 1222 are used to attach each end of feed tube 1220 to a respective end of filter housing 1218. In both the embodiments of FIGS. 54*a* and 54*b*, edge filter 1210 functions to advantageously prevent small particles from flowing through the fuel system downstream of accumulator 1208 thereby preventing foreign particle induced wear and/or damage to the injection control valve and distributor.

Figure 55A:
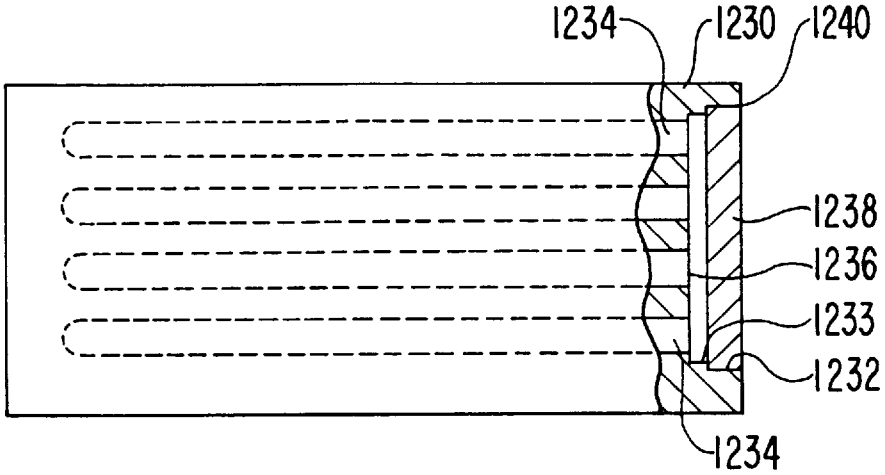
FIG. 55*a* is a partial cross-sectional view of another embodiment of the high pressure accumulator employed in the fuel system assembly of the present invention having a single end plate.
Figure 55B:
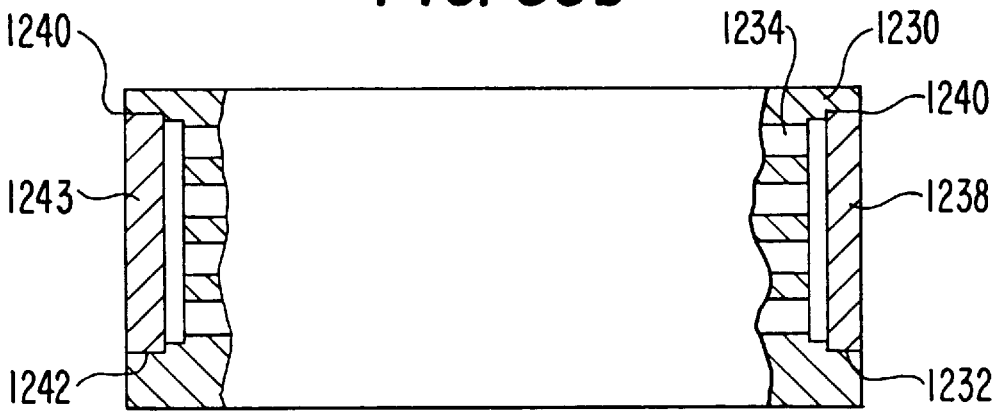
FIG. 55*b* is a partial cross-sectional view of yet another embodiment of the high pressure accumulator employed in the fuel system of the present invention showing two end plates.
Figure 55C:
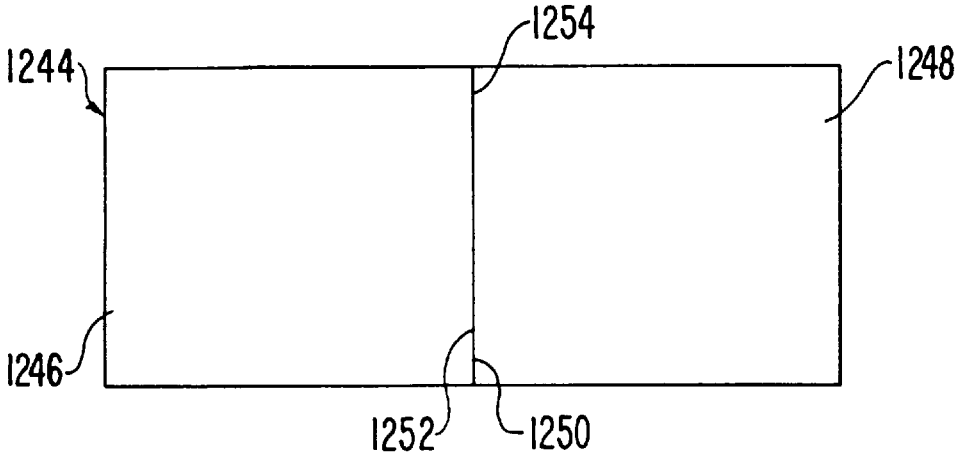
FIG. 55*c* is a plan view of yet another embodiment of the high pressure accumulator employed in the fuel system of the present invention.

Reference is now made to FIGS. 55*a*–55*c* disclosing various other embodiments of the accumulator of the present invention. The accumulators discussed hereinabove with respect to the previous embodiments of the present invention have all included an accumulator housing having an accumulator chamber with an open end fluidically sealed by a plug having external threads for engaging complementary internal threads formed on the inner surface of a recess formed in the open end of one or more chambers. Although such threaded connections also include some type of seal, such as an O-ring, at extremely high fuel pressures, such sealed threaded connections may develop a leak permitting fuel to drain from the accumulator chamber causing an undesirable loss of fuel pressure in the accumulator, thus adversely affecting the metering of fuel.

FIGS. 55*a*–55*c* disclose alternative embodiments of the accumulator which prevent fuel leakage from the ends of the accumulator chambers. FIG. 55*a* discloses an accumulator housing 1230 which includes a stepped recess 1232 formed in one end of housing 1230. Accumulator chambers 1234 are formed by drilling through an inner end wall 1236 of stepped recess 1232. An end plate 1238 is then positioned in stepped recess 1232 against a step 1233 formed by stepped recess 1232. End plate 1238 may then be securely and sealingly connected to accumulator housing 1230 by welding along a peripheral joint 1240 formed between the outer peripheral edge of end plate 1238 and the edge of accumulator housing 1230 defining the open end of stepped recess 1232. A common flow cavity is formed between the inner end wall 1236 and the inner surface of end plate 1238 for permitting the flow of fuel between accumulator chambers 1234. The welded peripheral joint 1240 is extremely effective in sealing accumulator chambers 1234. Consequently, this embodiment results in an accumulator housing 1230 having a single welded end plate 1238 which is highly resistant to fuel leakage.

FIG. 55*b* discloses another embodiment of the accumulator of the present invention which is the same as the embodiment disclosed in FIG. 55*a* except that a second stepped recess 1242 is formed at the opposite end of accumulator housing 1230 for receiving a second end plate 1243.

FIG. 55*c* discloses a third embodiment of the accumulator of the present invention which includes an accumulator housing 1244 formed by the welded connection of a first accumulator block 1246 and a second accumulator block 1248. The accumulator chambers and any other longitudinal passages are formed in each block 1246, 1248 from respective end walls 1250, 1252 prior to joining the blocks 1246, 1248. End walls 1250, 1252 are then positioned in abutment to form a peripheral joint 1254 extending around the entire accumulator housing. The peripheral joint is then welded to securely attach blocks 1246 and 1248 while creating a seal for preventing fuel leakage from the accumulator chambers (not shown). The accumulator embodiments disclosed in FIGS. 55*a*–55*c* substantially reduce the likelihood of fuel leakage from those areas of the accumulator housing used to form the accumulator chambers.

Reference is now made to FIGS. 56–62 which disclose several devices which may be incorporated into the fuel system of the present invention to provide rate shaping capability. By reducing the rate at which fuel pressure increases at the nozzle assembly during the initial phase of injection and, therefore, reducing the initial fuel quantity injected into the combustion chamber, the various embodiments of the present invention are better able to achieve various objectives such as more efficient and complete fuel combustion with reduced emissions. The rate shaping devices discussed hereafter are designed to better enable the subject fuel system to meet the ever increasing requirements for decreasing emissions.

Figure 56:
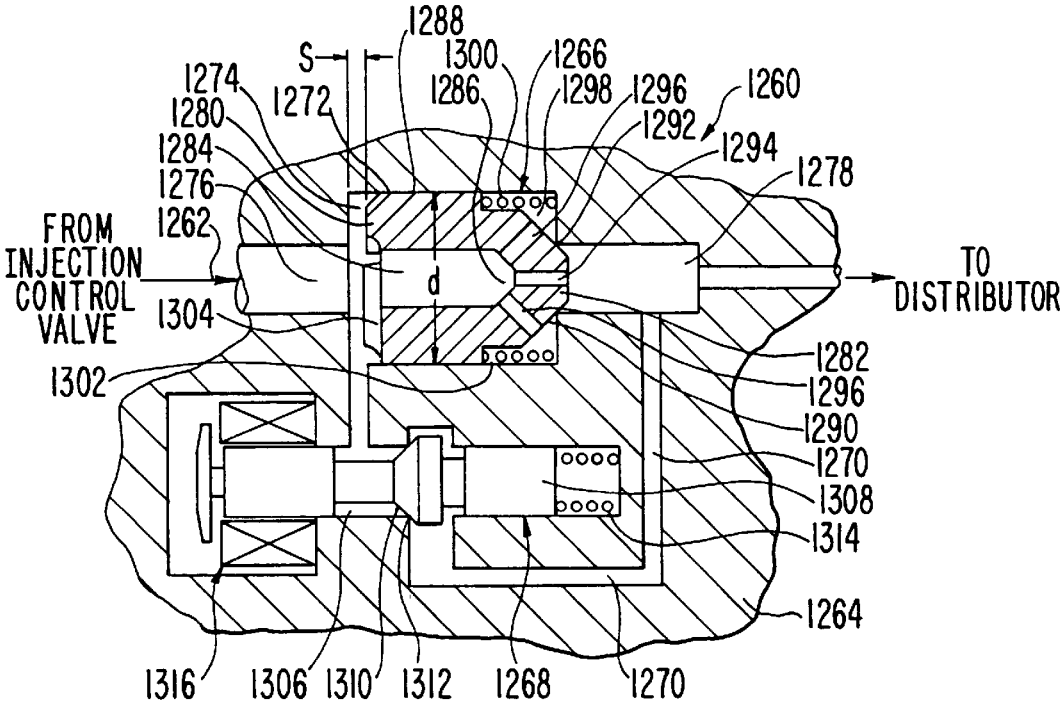
FIG. 56 is a cut away cross-sectional view of a rate shaping device of the present invention.

Referring initially to the embodiment shown in FIG. 56, a rate shaping device indicated generally at 1260 is positioned along the fuel transfer circuit 1262 between the fuel injection control valve 20 and the distributor 16 of FIG. 1. However, rate shaping device 1260 could be utilized in any of the embodiments of the present fuel delivery system disclosed hereinabove. Also, for purposes of illustration, rate shaping device 1260 is shown in FIG. 56 positioned in a distributor housing 1264. However, device 1260 may be integrated into fuel transfer circuit 1262 anywhere between injection control valve 20 and distributor 16.

As shown in FIG. 56, rate shaping device 1260 includes a flow limiting valve 1266 positioned within fuel transfer circuit 1262 and a rate shaping by-pass valve 1268 positioned in a by-pass passage 1270. Flow limiting valve 1266 includes a slidable piston 1272 mounted for sliding movement within a piston chamber 1274 formed in fuel transfer circuit 1262 so as to create a fuel inlet 1276 and a fuel outlet 1278. Slidable piston 1272 includes a first end 1280 positioned adjacent fuel inlet 1276, a second end 1282 positioned adjacent fuel outlet 1278 and a central bore 1284 extending from first end 1280 inwardly to terminate at an inner end 1286. Slidable piston 1272 also includes an outer cylindrical surface 1288 which may have a sufficiently close sliding fit with the inside surface of piston chamber 1274 to form a fluid seal between surface 1288 and the inside surface of piston chamber 1274. Second end 1282 of slidable piston 1272 includes a conical surface 1290 for engaging an annular valve seat 1292 formed on distributor housing 1264 at fuel outlet 1278 when slidable piston 1272 is moved to the right as shown in FIG. 56.

Slidable piston 1272 also includes a central orifice 1294 extending through second end 1282 to fluidically connect central bore 1284 with fluid outlet 1018 regardless of the position of slidable piston 1272. A plurality of first stage orifices 1296 extend through second end 1282 from central bore 1284. First stage orifices 1296 are oriented in relation to valve seat 1292 so that when flow limiting valve 1266 is in the position shown in FIG. 56, hereinafter called the second stage position, fuel flow from first stage orifices 1296 to fuel outlet 1278 is blocked by the abutment of conical surface 1290 and valve seat 1292. Flow limiting valve 1266 includes a spring cavity 1298 formed between piston 1272 and distributor housing 1264 for housing a biasing spring 1300. An annular step 1302 formed on piston 1272 functions to provide a spring seat for spring 1300 which biases piston 1272 leftward as illustrated in FIG. 56 into a first stage position.

Bypass passage 1270 communicates at one end with fuel inlet 1276 via piston chamber 1274 and at an opposite end with fuel outlet 1278. Slidable piston 1272 includes radial grooves 1304 in the end surface of first end 1280 for permitting fuel to flow between fuel inlet 1276 and bypass passage 1270 when flow limiting valve 1266 is in the first stage position. Rate shaping bypass valve 1268 is positioned along bypass passage 1270 in a rate shaping valve cavity 1306. Rate shaping bypass valve 1268 includes an elongated valve element 1308 having a conical valve surface 1310 for engaging an annular valve seat 1312 formed in distributor housing 1264. Rate shaping bypass valve 1268 is preferably a two-position, two-way pressure balanced solenoid-operated valve which includes a bias spring 1314 positioned to bias valve element 1308 into the closed position against valve seat 1312. A solenoid assembly indicated at 1316 is used to move valve element 1308 to the right in FIG. 56 into a full flow, open position, separating conical valve surface 1310 from annular valve seat 1312, thus establishing flow through bypass passage 1270. Rate shaping bypass valve 1268 may alternatively be hydraulically operated.

Figure 57:
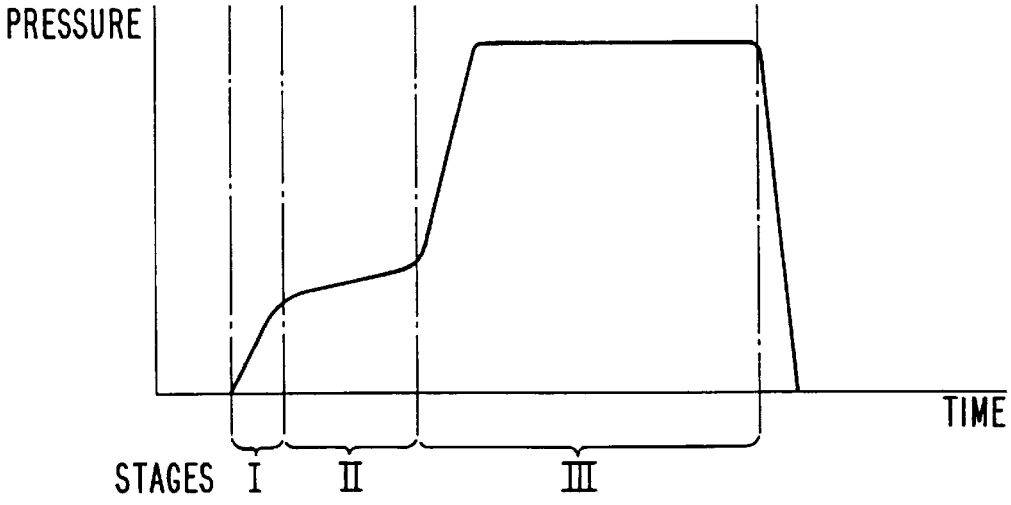
FIG. 57 is a graph showing the pressure rate as a function of time during an injection event using the rate shaping device of FIG. 56.

In general, flow limiting valve 1266 functions to control or shape the pressure rate increase at the nozzle assembly during the initial stages of an injection event, as represented by stages I and II in FIG. 57, while also controlling the return flow of fuel through the transfer circuit at the end of the injection event when the injection control valve 20 is connected to drain thereby minimizing cavitation in the fuel transfer circuit and associated fuel injection lines. Rate shaping bypass valve 1268 functions primarily to allow a rapid increase in the pressure rate when it is desirable to achieve maximum pressure at the nozzle assembly by providing an unrestricted flow path through fuel transfer circuit 1262 after the initial injection period as represented by stage III in FIG. 57.

More specifically, during operation, just before the start of an injection event, injection control valve 19 is in the closed position connecting fuel transfer circuit 1262 to drain. At this time, flow limiting valve 1266 is in its first stage position with first end 1280 in abutment against distributor housing 1264 permitting fluidic communication between fuel inlet 1276 and fuel outlet 1278 via both central orifice 1294 and first stage orifices 1296. Rate shaping bypass valve 1268 is in the closed position under the force of bias spring 1314 blocking flow through bypass passage 1270. Once injection control valve 20 is energized to connect accumulator pressure to fuel transfer circuit 1262, high pressure fuel initially flows through both central orifice 1294 and first stage orifices 1296 creating an initial pressure increase downstream of flow limiting valve 1266 and at the respective nozzle assembly as represented by stage I in FIG. 57. However, accumulator fuel pressure at fuel inlet 1276 acts on the end surface of first end 1280 and on inner end 1286 of central bore 1284 to move slidable piston 1272 to the right in FIG. 56, placing slidable piston 1272 in the second stage position with conical surface 1290 in abutment with valve seat 1292. Thus, fuel flow through first stage orifices 1296 is blocked while a limited amount of fuel passes through central orifice 1294 to fuel outlet 1278 thus decreasing the rate at which fuel pressure at the nozzle assembly is increasing as represented by stage II in FIG. 57. After a predetermined period of time and preferably prior to the middle portion of the injection event, rate shaping bypass valve 1268 is energized to the open position allowing full flow of fuel through bypass passage 1270, causing a sharp increase in the fuel delivery pressure as represented by the upwardly sloping pressure rate of stage III in FIG. 57. The pressure at the nozzle assembly quickly reaches a maximum level until the end of the injection event as determined by the closing of injection control valve 20. Consequently, as shown in FIG. 57, rate shaping device 1260 creates an first stage of fuel injection (stage I) having a high pressure rate increase, a second stage of fuel injection (stage II) having a reduced pressure rate less than stage I and a third stage wherein the pressure rate increase is initially greater than stage II. By reducing the pressure rate increase at the nozzle assembly during the initial stages of injection, i.e. stage II, rate shaping device 1260 also reduces the quantity of fuel delivered to the combustion chamber during the initial stage which, in turn, advantageously reduces the level of emissions generated by the combustion process.

Upon closing, injection control valve 20 blocks fuel from the accumulator while connecting fuel transfer circuit 1262 to drain. After a predetermined period of time, rate shaping bypass valve 1268 is de-energized and moved to the closed position by bias spring 1314. However, note that the pressure relief of fuel transfer circuit 1262 downstream of rate shaping device 1260 can be controlled or shaped in a variety of ways depending on the timing of closing of rate shaping bypass valve 1268 in relation to the closing of injection control valve 20. If the closing of rate shaping bypass valve 1268 is retarded or delayed until a significant amount of time after the closing of fuel injection control valve 20, bypass passage 1270 will function as the primary relief passage allowing an intensive return flow of fuel to drain thus quickly relieving a substantial amount of fluid pressure from the downstream transfer circuit and respective fuel injection line while a secondary relief flow is established through flow limiting valve 1266. However, by closing rate shaping bypass valve 1268 simultaneously with, or immediately after, the closing of injection control valve 20, primary relief occurs through flow limiting valve 1266. In both instances, once rate shaping bypass valve 1268 closes, the fuel pressure at fuel inlet 1276 becomes less than the fuel pressure in fuel outlet 1278. As a result, the fluid forces acting on the end surface of piston 1272 at second end 1282, combined with the biasing force of spring 1300, become greater than the fluid forces acting on piston 1272 which tend to move piston 1272 to the right in FIG. 56. Consequently, slidable piston 1272 of flow limiting valve 1266 will immediately move leftward in FIG. 56 into the first stage position communicating first stage orifices 1296 with fuel outlet 1278, thus permitting fuel flow through flow limiting valve 1266 via orifices 1294 and 1296. Central orifices 1294 and first stage orifices 1296 are large enough in diameter so that their combined cross-sectional flow area creates the necessary return flow during the drain event to insure sufficient fuel pressure relief at the nozzle assembly to prevent secondary injections. On the other hand, central orifice 1294 and first stage orifices 1296 are small enough to provide a combined flow area designed to limit the return flow to a predetermined level necessary to minimize cavitation in the circuit and injection lines between flow limiting valve 1266 and the nozzle assemblies. Therefore, flow limiting valve 1266 functions as a variable flow valve when moved between the first stage and second stage positions to advantageously utilize the flow limiting feature of central orifice 1294 during the injection event to shape the pressure rate increase while advantageously controlling the return flow during the drain event to both prevent secondary injections and minimize cavitation.

It should be noted that a single fixed orifice placed into the main flow will cause a quite significant injection lag. A great portion of this lag is eliminated by the present rate shaping device which incorporates central orifice 1294 in a moving piston 1272. The swept volume of this piston will result in no practical differential in the pressure trace compared with a free line, until a certain pressure level. This level mostly depends on the swept volume of the plunger, and the volume of the system pressurized. If the geometry ("d" diameter and "s" stroke; FIG. 56) of piston 1272 is sized properly, the pressure can be maintained slightly less than the opening pressure of the injector. This means that the invisible part of the injection rate has a "fast response" (no lag) and orifice 1294 starts dominating the event just from this pressure level, in order to shape the rate.

A further advantage of this design is realized by locating rate shaping bypass valve 1268 downstream of the injection control valve. This arrangement minimizes the leakage loss occurring through valve 1268. This leakage is four times less than it would be if valve 1268 were placed upstream of the injection control valve (assuming the duration is 30 degrees crank angle and the engine is a six cylinder four stroke one).

Figure 58:
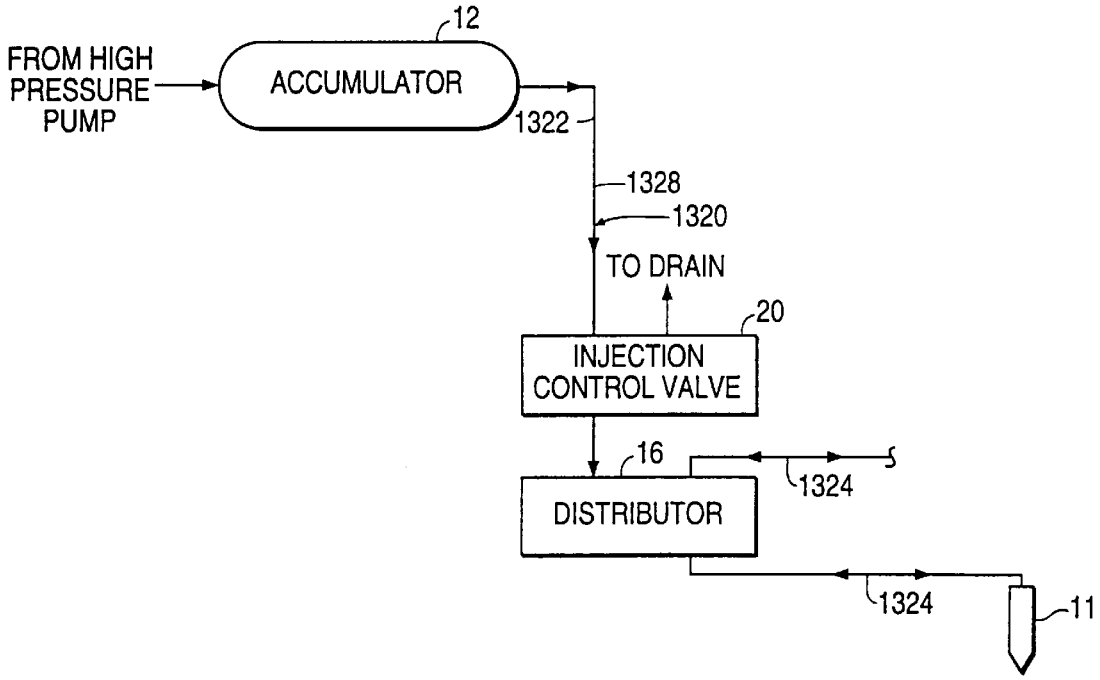
FIG. 58 is a schematic diagram of another embodiment of a rate shaping device of the present invention.
Figure 59:
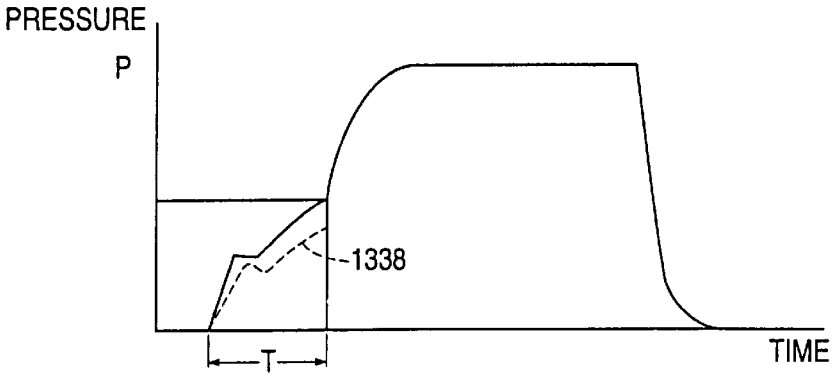
FIG. 59 is a graph showing injection pressure as a function of time as shaped by the devices of FIGS. 58 and 60.

Referring now to FIGS. 58 and 59, another rate shaping device 1320 is disclosed in the context of the subject fuel pump system of the present invention including high pressure accumulator 12, injection control valve 20 and distributor 16 positioned along fuel transfer circuit 1322 for delivering precise quantities of fuel through injection lines 1324 for delivery to the engine cylinders (not shown) via respective nozzle assemblies 11. Rate shaping device 1320 includes high pressure delivery passage 1328 of fuel transfer circuit 1322 connecting accumulator 12 to injection control valve 20. At the beginning of the injection event, when injection control valve 20 moves to an open position fluidically connecting accumulator 12 and high pressure delivery passage 1328 to fuel transfer circuit 1322 downstream of injection control valve 20, an immediate drop in fuel pressure is experienced in high pressure delivery passage 1328 immediately upstream of injection control valve 20 while a high pressure fuel pulse from accumulator 12 quickly travels from the accumulator to this low pressure region and then on to the nozzle assembly 11. Therefore, there is a time delay between the opening of injection control valve 20 and the arrival of the high pressure pulse at injection control valve 20. The greater the distance the fuel pulse must travel from accumulator 12 to injection control valve 20, the greater the time it will take for the fuel pressure at the control valve and, therefore, in the fuel injection line adjacent the nozzle assembly to increase to the pressure rate necessary to achieve optimum high fuel pressure. Therefore, by increasing the distance between the accumulator 12 and injection control valve 20, i.e., by lengthening high pressure delivery passage 1328, rate shaping device 1320 of the present embodiment slows down the rate of pressure increase at the nozzle assembly as represented by the pressure-time curve of FIG. 59.

Figure 60:
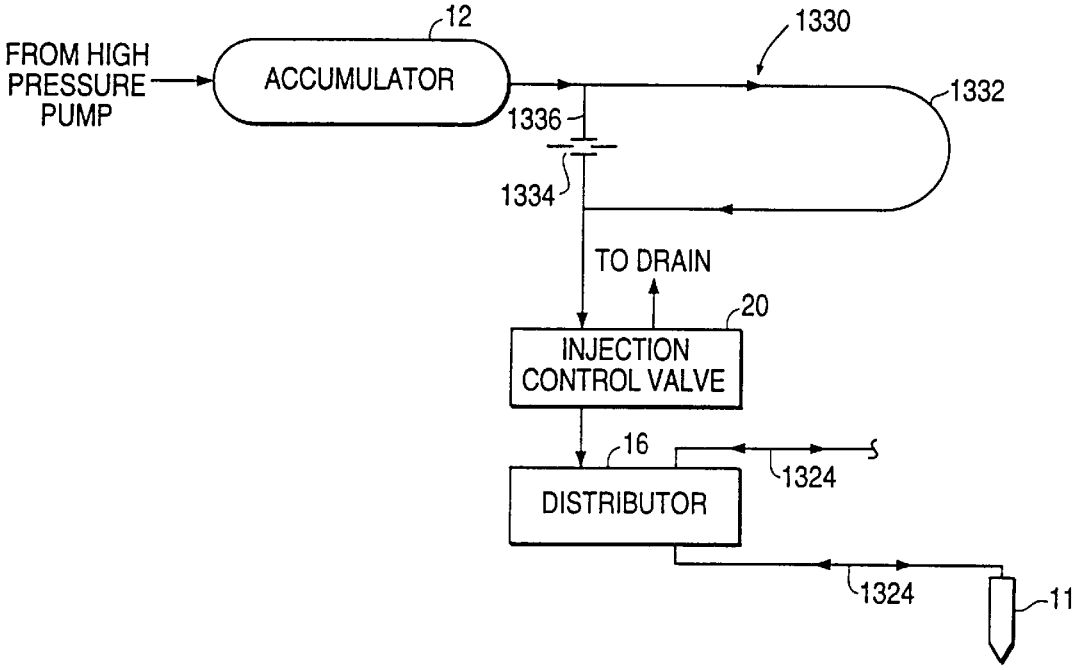
FIG. 60 is a schematic diagram of yet another embodiment of a rate shaping device of the present invention.

Referring now to FIG. 60, another rate shaping device 1330 is disclosed which is similar to the embodiment shown in FIG. 58 in that a high pressure delivery loop 1332 having a length is used to control the time it takes for the full unrestricted accumulator flow and resulting high pressure to reach nozzle assembly 11. However, in this embodiment, an orifice 1334 is positioned in a restricted flow passage 1336 so that high pressure delivery loop 1332 functions as a bypass around restricted flow passage 1336. Again, like the previous embodiment, rate shaping device 1330 utilizes the fact that it takes time for pressure waves to propagate through high pressure delivery loop 1332 which delays the arrival of high pressure at nozzle assembly 11 and creates an initial period of injection having a low rate of pressure increase. However, in addition, orifice 1334 functions to slow the rate of pressurization at the nozzle assembly to the desired pressure rate. Therefore, orifice 1334 can be selected with a predetermined cross-sectional flow area which provides a desired pressure rate during the initial injection period. Moreover, orifice 1334 functions to dampen undesired pressure waves fluctuating in the lines between the accumulator and injection control valve. Referring to FIG. 59, although for a given length of high pressure delivery loop 1332, the time delay (T) would remain constant, the pressure rate could be varied by selecting an appropriately sized orifice 1334 to create a desired pressure rate change as represented by the dashed lines 1338.

Figure 61:
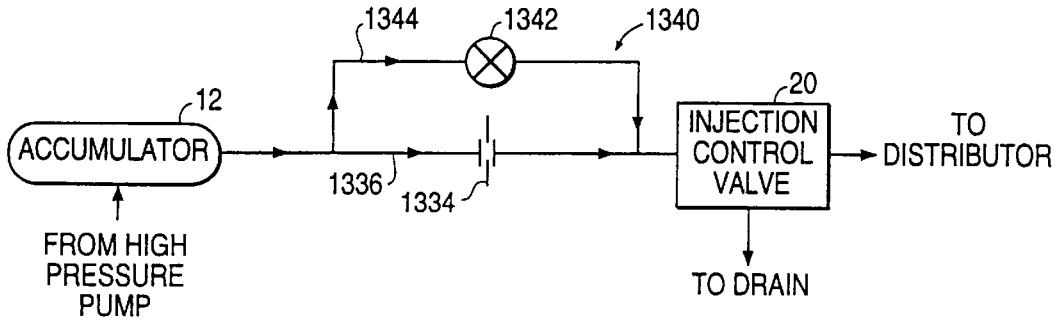
FIG. 61 is a schematic diagram of yet another embodiment of a rate shaping device of the present invention.

Reference is now made to FIG. 61 which discloses a rate shaping device 1340 which is the same as rate shaping device 1330 of FIG. 60 except that a rate-shaping or flow control valve 1342 is positioned in a high pressure bypass passage 1344 for directing flow around orifice 1334. Preferably, rate shaping control valve 1342 is a two-position, two-way pressure-balanced solenoid operated valve capable of being positioned in a closed position blocking flow through high pressure bypass passage 1344 and an open position permitting flow. Rate shaping control valve 1342 permits the time delay (T) shown in FIG. 59 to be accurately controlled and varied by electronically controlling and adjusting the opening and closing of rate control valve 1342.

The rate shaping devices shown in FIGS. 56–62 and discussed hereinabove have the ability to be connected to nozzle assemblies such as the two-spring nozzle assembly produced by Bosch or the piston in the nozzle assembly as conceived by AVL which are intended to reduce the fuel quantity delivered during the first part of injection. When these nozzle assemblies designs are connected to the accumulator rate shaping concepts of the present invention, the coupling of the two produces further reductions in the quantity of fuel injected in the beginning of the injection event.

Figure 62A:
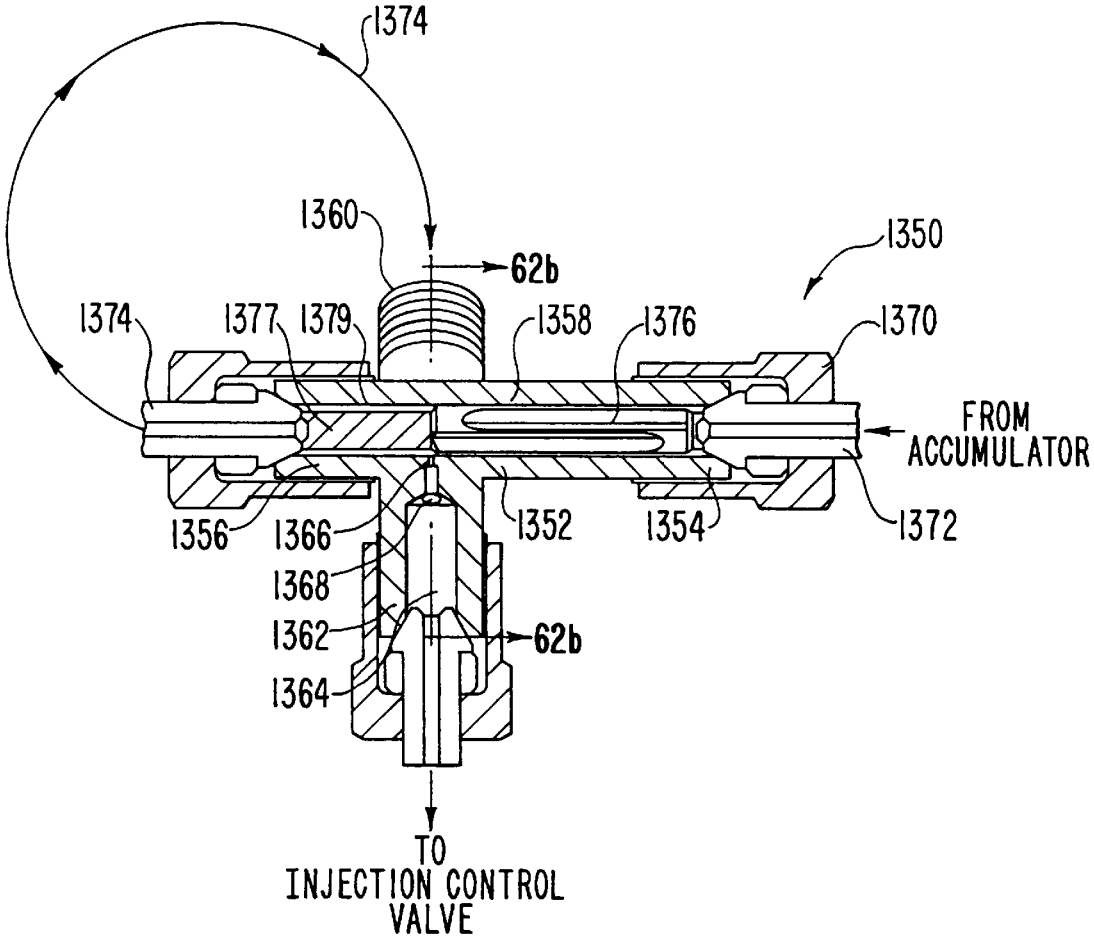
FIG. 62*a* is a cross-sectional view of a high pressure coupling of the present invention incorporating a filter.
Figure 62B:
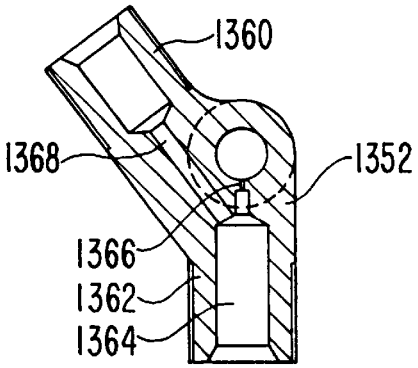
FIG. 62*b* is a cross-sectional view of the high pressure coupling of FIG. 62*a* taken along line 62*b*—62*b*.

Reference is now made to FIGS. 62*a* and 62*b* which disclose a rate shaping coupling 1350 for integrating the rate shaping devices disclosed in FIGS. 60 and 61 into a fuel system while also providing a housing for receiving an edge filter. Rate shaping coupling 1350 includes a generally cylindrical housing 1352 having an inlet portion 1354, an outlet bypass portion 1356, and a central feed bore 1358 extending through both inlet portion 1354 and outlet bypass portion 1356. Housing 1352 further includes a bypass return portion 1360 and a discharge portion 1362 integrally formed with inlet portion 1354 and outlet bypass portion 1356. Discharge portion 1362 includes a feed passage 1364 extending inwardly through portion 1362 toward central feed bore 1358. A flow restricting orifice 1366, equivalent to orifice 1334 of FIGS. 60 and 61, is positioned at the inner end of feed passage 1364 to connect feed passage 1364 to central feed bore 1358. As illustrated in FIG. 62*b*, bypass return portion 1360 includes a return passage 1368 which extends through housing 1352 to connect with feed passage 1364 downstream of orifice 1366. Referring again to FIGS. 62*a* and 62*b*, inlet portion 1354 is connected by a high pressure tube fitting 1370 to a fuel feed tube 1372 which delivers fuel from the accumulator (not shown). Outlet bypass portion 1356 is connected to one end of a bypass loop or tube represented at 1374 while the opposite end of bypass loop 1374 is attached to bypass return portion 1360. Bypass loop 1374 is the equivalent of delivery loop 1332 and bypass passage 1344 disclosed in FIGS. 60 and 61, respectively. Therefore, rate shaping control valve 1342 of FIG. 61 may be positioned along bypass loop 1374. Also, an edge filter 1376 is positioned in central feed bore 1358 of housing 1352 adjacent inlet portion 1354. A support pin 1377 is positioned in central bore 1358 in compressive abutment between edge filter 1376 and one end of feed tube 1372 for securing edge filter 1376 in central feed bore 1358. Support pin 1377 includes axial grooves 1379 for permitting fuel flow through central feed bore 1358 to bypass loop 1374. The edge filter 1376 functions to remove small particles, such as metal shavings, from the fuel to prevent the particles from reaching the injection control valve and distributor positioned downstream. Therefore, rate shaping coupling 1350 provides a compact, effective device for implementing the rate shaping devices of FIGS. 60 and 61 while also providing a easily accessible yet effective housing for an edge filter.

Reference is now made to FIGS. 63*a*–69 which disclose various devices for minimizing cavitation in the fuel transfer circuit and high pressure injection lines while also minimizing the possibility of a secondary injection. Cavitation, i.e. vapor pockets or voids, in the transfer circuit and injection lines leading to the nozzle assemblies results in insufficient injection pressure and unpredictable, uncontrollable variations in both fuel quantity and timing of injection. Cavitation is especially prone to occur in high pressure lines of fuel systems where such lines are connected to a low pressure drain on a cycle by cycle basis such as in the fuel pumping system of the present invention. The following devices advantageously control cavitation by 1) minimizing the occurrence of cavitation by restricting the return or reverse fuel flow during the draining event and/or 2) refilling the injection lines with fuel after each draining event and prior to the succeeding injection event. Specifically, the cavitation control devices disclosed in the embodiments shown in FIGS. 64*a*–64*e* minimize cavitation by restricting the return fuel flow during the drain event while the devices disclosed in FIGS. 63*a*, 63*b* and 69 minimize the effects of cavitation by primarily refilling the downstream lines with fuel.

Figures 63A, 63B:
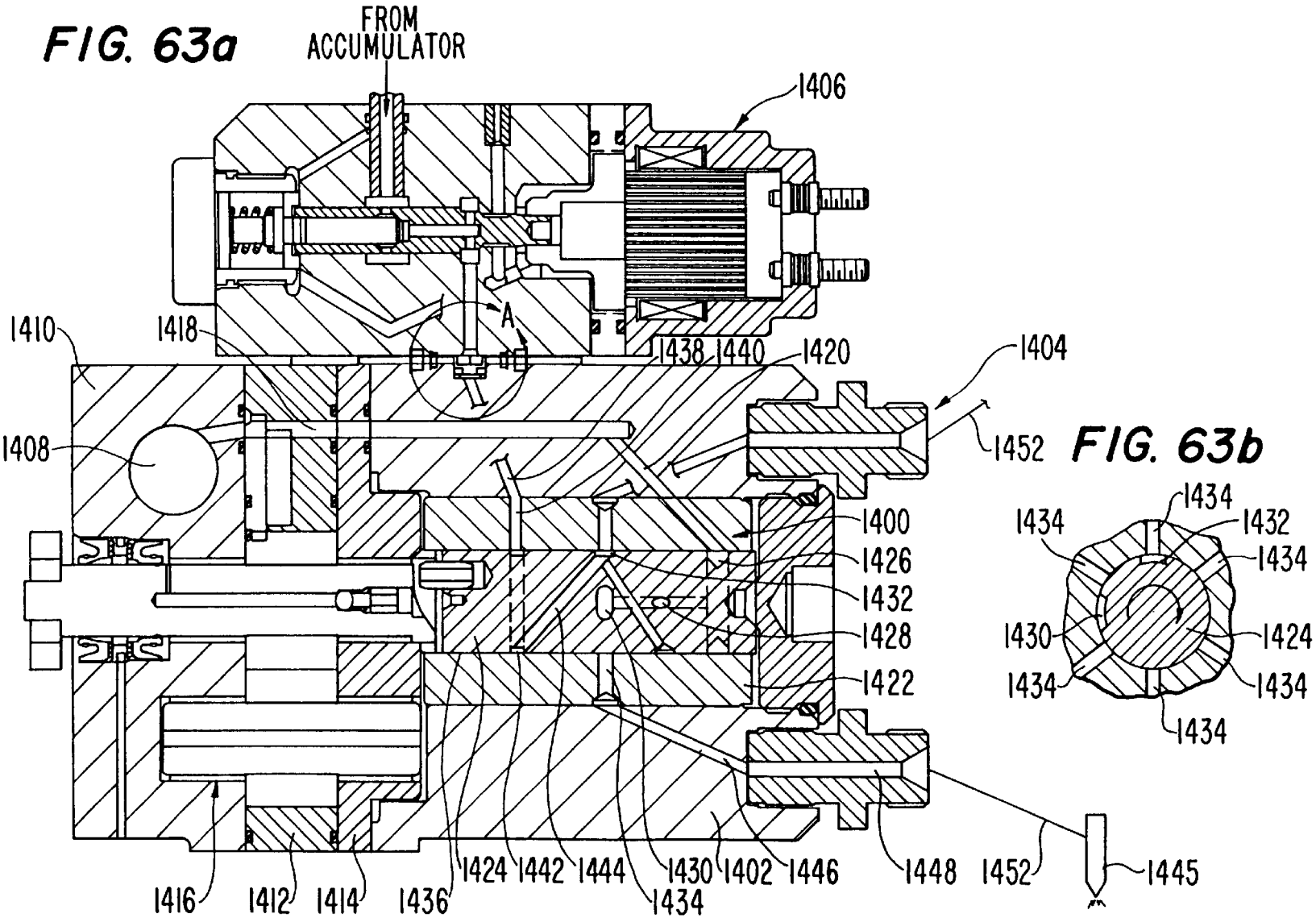
FIG. 63*a* is a cross-sectional view of the injection control valve, boost pump and distributor used in the fuel system assembly of the present invention showing cavitation control devices.
FIG. 63*b* is a cut away cross-sectional view of the distributor of the assembly shown in FIG. 63*a* taken along line 63*b*—63*b*.

Referring initially to the embodiment disclosed in FIGS. 63*a* and 63*b*, a cavitation control device indicated generally at 1400 is formed in a distributor housing 1402 of a distributor 1404. FIG. 63*a* also illustrates an injection control valve 1406, a low pressure accumulator 1408 mounted in a spacer housing 1410, a two-piece gear pump housing 1412, 1414 and a boost or gear pump 1416. These various components are substantially the same as the embodiment described hereinabove with regards to FIG. 30 with the exception of the addition of cavitation control device 1400. Cavitation control device 1400 includes an axial passage 1418 extending from the outlet of boost pump 1416 adjacent low pressure accumulator 1408 through spacer housing 1410, two-piece gear pump housing 1412, 1414 and distributor housing 1402. Axial passage 1418 terminates approximately midway through distributor housing 1402 for connection with a delivery passage 1420 extending radially inward at an angle through distributor housing 1402 and a stationary shaft sleeve 1422 surrounding a rotary distributor shaft 1424. The most inward end of delivery passage 1420 continuously communicates with an annular groove 1426 formed in the outer surface of distributor shaft 1424. A cross passage 1428 extends diagonally from annular groove 1426 through the center axis of distributor shaft 1424 to the opposite side of distributor shaft 1424. Cross passage 1428 connects annular groove 1426 to a refill port 1430 formed in the outer surface of distributor shaft 1424. As shown in FIGS. 63*a* and 63*b*, refill port 1430 is positioned in a common vertical plane with an injection port or window 1432 which sequentially communicates with fuel receiving passages 1434 equally spaced around the circumference of rotor bore 1436. As discussed hereinabove in relation to the embodiment of FIG. 5, injection control valve 1406 supplies fuel through a fuel transfer circuit to injection port 1432 during the window of opportunity to create an injection event. The fuel transfer circuit includes passages 1438 and 1440 formed in distributor housing 1402 and shaft sleeve 1422, respectively, an annular supply groove 1442 formed in distributor shaft 1424 and a transfer passage 1444 extending from annular supply groove 1442 diagonally through distributor shaft 1424 to connect with injection port 1432. As shown in FIG. 63*b*, at the end of the injection event, as distributor shaft 1424 rotates in the clockwise direction, injection port 1432 will move out of communication with a given fuel receiving passage 1434. As distributor shaft 1424 continues to rotate, refill port 1430 will be moved into fluidic communication with the receiving passage 1434 through which an injection event previously occurred. As a result, low pressure fuel from the outlet of boost pump 1416 is delivered via passages 1418, 1420, annular groove 1426 and cross passage 1428 to the respective fuel receiving passage 1434. Each fuel receiving passage 1434 is connected to a nozzle assembly 1445 of an associated engine cylinder by a respective injection passage 1446 formed in distributor housing 1402, a respective injection bore 1448 formed in an outlet fitting 1450 and a corresponding injection line 1452 connected at one end to outlet fitting 1450 and at an opposite end to nozzle assembly 1445. In this manner, cavitation control device 1400 ensures that each injection circuit connecting distributor 1404 to a respective nozzle assembly is refilled with low pressure fuel before the next injection event thus minimizing cavitation induced variations in fuel quantity and timing of injection. Moreover, since boost pump fuel pressure is maintained at a relatively constant level, all injection lines are pressurized to approximately the same fuel pressure level for each injection event thus adding to the predictability of fuel metering and timing.

Figure 64A:
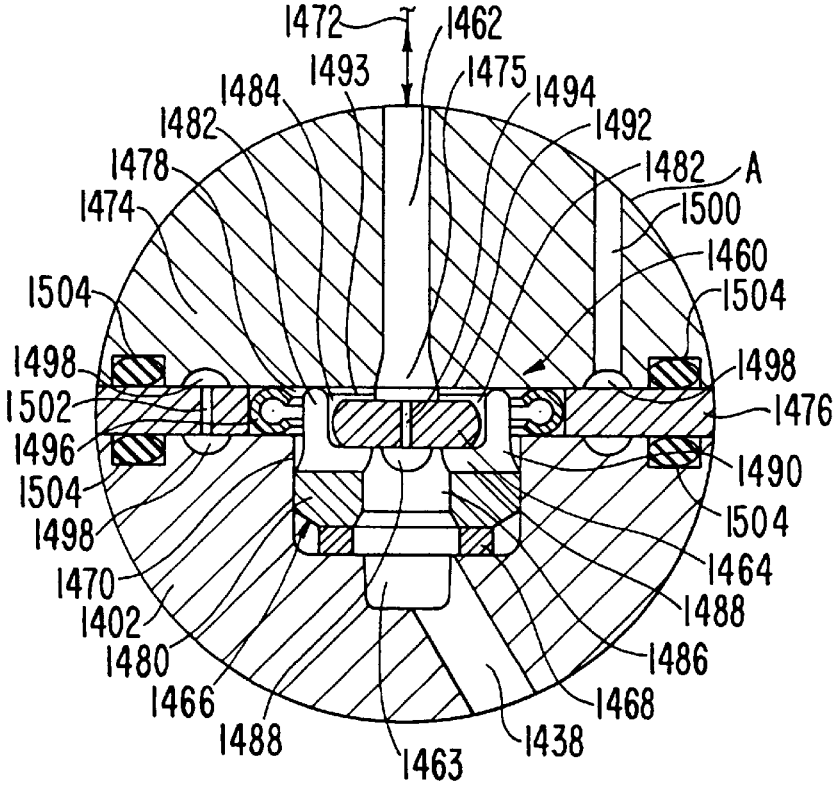
FIG. 64*a* is a cut away cross-sectional view of a cavitation control device of the present invention indicated at A in FIG. 63*a*.

FIGS. 63*a* and 64*a* also illustrate another device for minimizing cavitation indicated generally at A. This embodiment includes a reverse flow restrictor valve 1460 positioned along the fuel transfer circuit 1462 between injection control valve 1406 and distributor 1404. Reverse flow restrictor valve 1460 includes a movable valve member 1464, an insert 1466 and a support ring 1468 supported in a recess 1470 formed in distributor housing 1402. The inner end of recess 1470 communicates with one end of passage 1438 via an outlet 1463 for delivering fuel to distributor 1404. A transfer passage 1472 formed in an injection control valve housing 1474 includes an inlet 1475 positioned to open into recess 1470 when injection control valve housing 1474 is positioned adjacent distributor housing 1402. A spacer plate 1476 is positioned between injection control valve housing 1474 and distributor housing 1402. Spacer plate 1476 includes an opening 1478 through which reverse flow restrictor valve 1460 extends. Support ring 1468 is positioned against the inner end of recess 1470 around outlet 1463 for supporting insert 1466. Insert 1466 is positioned in recess 1470 in compressive abutment with support ring 1468 at one end and injection control valve housing 1474 at an opposite end. Insert 1466 includes an annular base 1480 positioned in abutment with support ring 1468 and wall portions 1482 extending upwardly from base 1480 to abut with housing 1874. Wall portions 1482 form a valve cavity 1484 for receiving valve member 1464. A bore 1486 extending through base 1480 connects outlet 1463 to valve cavity 1484. Radial grooves 1488 formed in the upper portion of base 1480 extend from bore 1486 radially outward to connect with respective slots 1490 separating wall portions 1482.

Movable valve member 1464 is generally doughnut shaped and sized with an appropriate outer diameter to permit movement in valve cavity 1484 along a vertical axis while wall portions 1482 provide lateral support to valve member 1464. A valve seat 1492 formed around inlet opening is adapted for sealing engagement by valve member 1464 when valve member 1464 is moved upwardly into a restricting position. Valve member 1464 may move downward into abutment with the inner surface of cavity 1484 into an open position as shown in FIG. 64. Valve member 1464 is also sized with an appropriate width to create an axial gap 1493 for permitting fuel flow from inlet 1475 to slots 1490 when valve member 1464 is in the open position. Valve member 1464 includes a central orifice 1494 for permitting fluidic communication between inlet 1475 and outlet 1463 when valve member 1464 is in the restricting position.

The high pressure joints formed by the abutment of injection control valve housing 1474, spacer plate 1476 and distributor housing 1402 are sealed using several devices to prevent high pressure fuel leakage. First, an annular sealing ring, i.e., a C-ring, 1496 is positioned in compressive abutment between injection control housing 1474 and distributor housing 1402 within opening 1478. In addition, opposing annular fuel collection grooves 1498 are formed in each housing 1474, 1402 radially outward from sealing ring 1496 for collecting any fuel leaking by sealing ring 1496. A drain passage 1500 extends from one fuel collection groove for draining collected fuel to drain (not shown). An equalizing passage 1502 extends through spacer plate 1476 to connect the opposing fuel collection grooves 1498, thereby permitting fuel collected in both grooves to be directed to drain. Third, a pair of opposing annular O ring grooves 1504 are formed in the housings 1474 and 1402 radially outward from fuel collection grooves 1498 for additional sealing.

During operation, at the beginning of an injection event when injection control valve 1406 moves into an open position supplying high pressure fuel from the accumulator (not shown) to transfer passage 1472, valve member 1464 of reverse flow restrictor valve 1460 moves under the force of the high pressure fuel into abutment against the inner surface of valve cavity 1484 into an open, full flow position. In this open position, fuel flows from transfer passage 1472 through axial gap 1493, slots 1490, and into bore 1486 for delivery to distributor 1404 via outlet 1463 and passage 1438. Fuel from transfer passage 1472 also flows through central orifice 1494 for delivery to the distributor. Valve member 1464 is sized so that the effective flow area of axial gap 1493, in combination with the effective flow area of central orifice 1494, creates substantially unrestricted flow through restrictor valve 1460. At the end of the injection event, when injection control valve 1406 moves into a drain position connecting transfer passage 1472 to drain, the fuel pressure in transfer passage 1472 immediately becomes less than the pressure in passage 1438 and bore 1486. As a result, a return or reverse flow of fuel flows from passage 1438 and other downstream passages including the respective fuel injection line, in a reverse direction through flow restrictor valve 1460 toward injection control valve 1406. As discussed hereinabove, without the use of flow restrictor valve 1460, vapor pockets or voids (cavitation) may form in the transfer passages and injection line between the injection control valve 1406 and the nozzle assemblies. However, reverse flow restrictor valve 1460 helps to minimize cavitation by permitting valve member 1464 to move into a restricting position against valve seat 1492. In the restricting position, valve member 1464 blocks reverse fuel flow through annular gap 1493 while permitting a restricted flow of fuel through central orifice 1494. Central orifice 1494 has an effective cross sectional flow area which permits a reverse flow of fuel sufficient to allow adequate pressure relief of the passages between restrictor valve 1460 and the nozzle assembly to permit the nozzle valve element (not shown) of the nozzle assembly to close resulting in predictable timing and metering of injection while restricting fuel flow to create an optimal back pressure for minimizing cavitation.

Figure 64B:
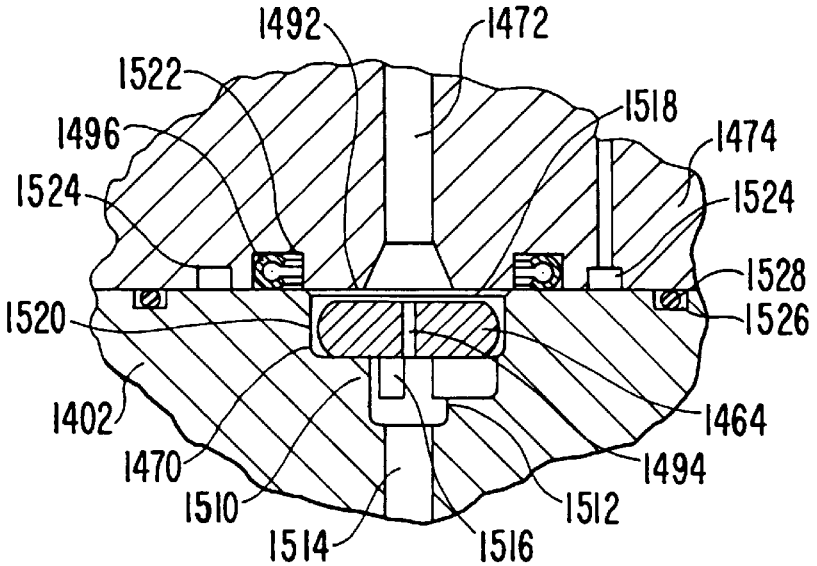
FIGS. 64*b*–64*e* are partial cut away cross-sectional views of various embodiments of cavitation control devices used in the fuel system assembly of the present invention.

Now referring to FIG. 64*b*, another embodiment of the flow restrictor valve is disclosed which is similar to the embodiment of FIG. 64*a* in that valve member 1464 including central orifice 1494 is positioned in a recess 1470 formed in distributor housing 1402. However, in the embodiment shown in FIG. 64*b*, wall portions 1510 are formed integrally with distributor housing 1402 in the inner end of recess 1470. Wall portions 1510 extend radially inward to define a central bore 1512 connected to outlet passage 1514 for directing fuel to distributor 1404. Wall portions 1510 are separated by slots 1516 communicating with central bore 1512. In this embodiment, valve member 1464 is sized to form both an axial gap 1518 between its upper flat surface and annular valve seat 1492, and an annular radial gap 1520 between its outer circumferential surface and the inner surface of recess 1470. When positioned in the open, full flow position as shown in FIG. 64*b*, fuel flows from transfer passage 1472 through axial gap 1518 and radial gap 1520 into central bore 1512 via slots 1516 for delivery to distributor 1404 via outlet passage 1514. Valve member 1464 functions in the same manner as that described with respect to the embodiment of FIG. 64*a* when moved into a restricting position against annular valve seat 1492 to restrict the reverse flow of fuel, thus slowing down the pressure decay in the fuel transfer circuit and injection lines between valve member 1464 and nozzle assembly thereby preventing excessive cavitation. Also, it should be noted that this embodiment does not include a spacer plate 1476. Moreover, sealing ring 1496 is positioned in a single ring groove 1522 formed in injection control valve housing 1474. Also, only a single fuel collection groove 1524 and a single O-ring groove 1526 for housing O-ring 1528, are needed since only one high pressure joint is formed between housings 1474 and 1402.

Figure 64C:
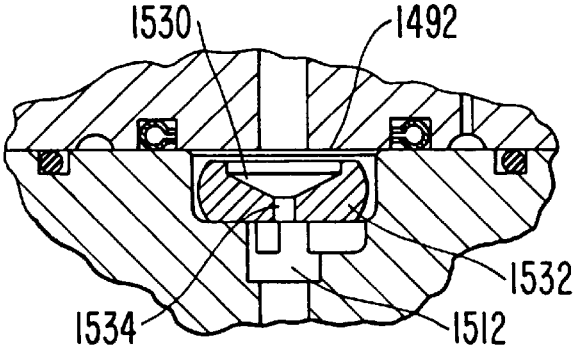

Reference is now made to FIG. 64*c* which illustrates yet another embodiment of a cavitation control device which is the same as the embodiment shown in FIG. 64*b* except that a conical shaped recess 1530 is formed in the upstream side of a movable valve member 1532 adjacent annular valve seat 1492. Central orifice 1534 extends through movable valve member 1532 connecting conical shaped recess 1530 to central bore 1512. Conical shaped recess 1530 functions to decrease the surface area of valve member 1532 contacting valve seat 1492 thereby improving the seating of valve member 1532 against valve seat 1492.

Figure 64D:
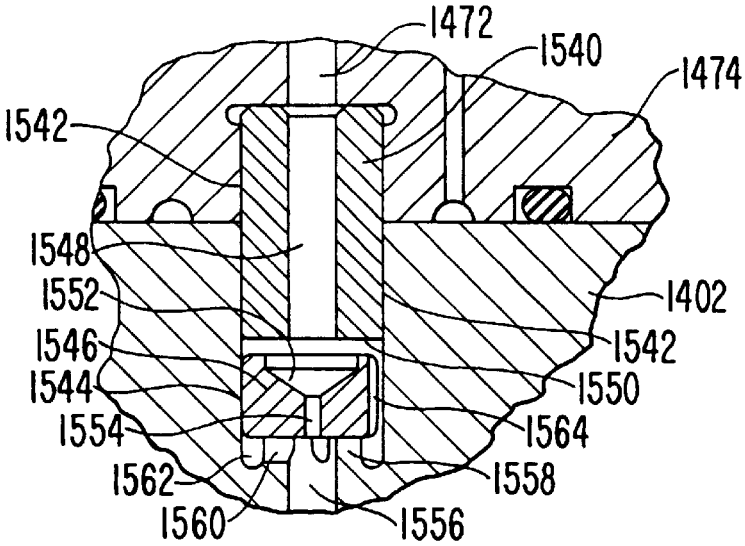

Referring now to FIG. 64*d*, a fourth embodiment of the reverse flow restrictor valve is disclosed which includes a cylindrical jumper tube 1540 positioned in a recess 1542 formed in both distributor housing 1402 and injection control valve housing 1474. Jumper tube 1540 is preferably fixedly attached to the inner wall of recess 1542 by a press fit connection whereby the outer diameter of jumper tube 1540 is slightly larger than the inner diameter of the portion of recess 1542 formed in distributor housing 1402 prior to assembly. The portion of recess 1542 formed in injection control valve housing 1474 has a slightly larger inner diameter than the outer diameter of jumper tube 1540 to create a clearance therebetween for permitting fuel leakage to flow to drain. Jumper tube 1540 abuts the upstream end of recess 1542 and extends into distributor housing 1402 terminating prior to the opposite end of recess 1542 to form a valve cavity 1544 for receiving a movable valve member 1546. Jumper tube 1540 includes a center bore 1548 for permitting fluid flow between transfer passage 1472 and valve cavity 1544. Jumper tube 1540 also includes a valve seat 1550 formed on its end wall adjacent valve cavity 1544 for engagement by movable valve member 1546. Movable valve member 1546 includes a conical shaped recess 1552 formed in one end adjacent valve seat 1550 and a central orifice 1554 extending from conical shaped recess 1552 through valve member 1546 to connect with outlet passage 1556. Inner annual wall portions 1558 formed around outlet passage 1556 extend toward movable valve member 1546. Wall portions 1558 are separated by slots 1560 extending radially outward from outlet passage 1556 to connect with an outer annular groove 1562. Axial grooves 1564 are formed in the outer surface of movable valve member 1546 around its circumference. When movable valve member 1546 is moved by upstream fuel pressure into the open position as shown in FIG. 64*d*, fuel is permitted to flow from center bore 1548 into valve cavity 1544 and through axial grooves 1564 into outlet passage 1556 via annular groove 1562 and slots 1560. The advantages and operation of this embodiment of the reverse flow restrictor valve are the same as the previous embodiments.

Figure 64E:
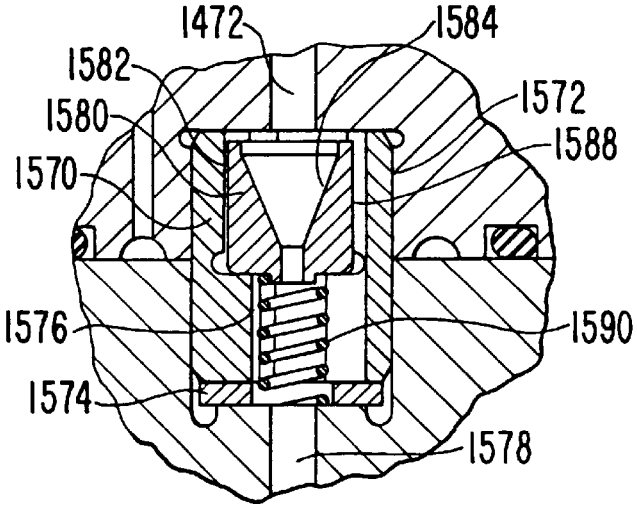

FIG. 64*e* illustrates yet another embodiment of the reverse flow restrictor valve of the present invention which includes a cylindrical jumper tube 1570 positioned in a recess 1572 similar to that of the previous embodiment. However, jumper tube 1570 and a support ring 1574 are held in end to end compressive abutment in recess 1572. Jumper tube 1570 includes a center bore 1576 which communicates at one end with transfer passage 1472 and at an opposite end with an outlet passage 1578. In this embodiment, a movable valve member 1580 is positioned in a recess 1582 formed in the upstream end of center bore 1576. Movable valve member 1580 includes a conical shaped recess 1584 formed in its upstream end and a central orifice 1586 which fluidically connects recess 1584 to center bore 1576. In this embodiment, axial grooves 1588 are formed in the inner surface of jumper tube 1570 along the entire length of tube 1570. In this manner, during the injection event, when movable valve member 1580 is positioned in the full flow open position as shown in FIG. 64*e*, fuel flows from passage 1472 through axial grooves 1588 to outlet passage 1578 via center bore 1576. In addition, movable valve member 1580 is spring biased into the flow restricting position by a bias spring 1590 positioned in center bore 1576. Bias spring 1590 assists in moving the valve member 1580 into the flow restricting position upon the connection of fuel transfer passage 1472 to drain at the end of the injection event.

Figure 65:
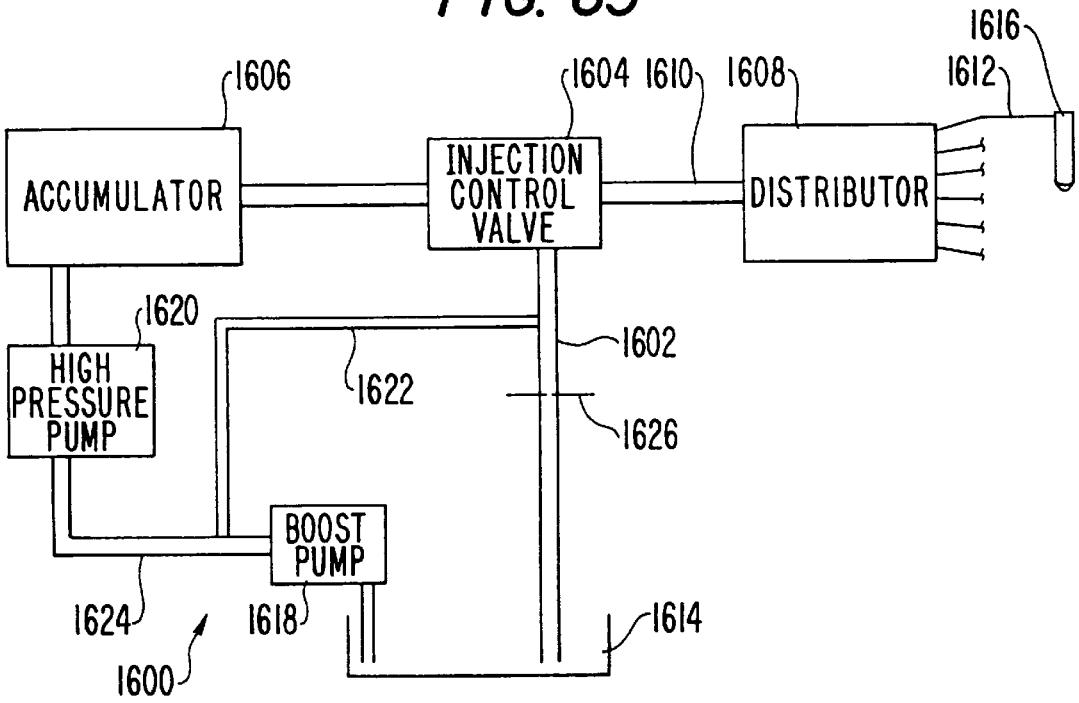
FIG. 65 is a schematic diagram of a cavitation control device incorporated into the fuel system assembly of the present invention.

Referring now to FIG. 65, another embodiment of the cavitation control device of the present invention includes an auxiliary supply of fuel, indicated generally at 1600, delivered to the drain passage 1602 of the injection control valve 1604. As explained hereinabove in relation to the fuel system of the present invention, injection control valve 1604 operates to fluidically connect accumulator 1606 to distributor 1608 to define an injection event. Injection control valve 1604 ends the injection event by connecting fuel transfer passage 1610, and therefore the corresponding injection line connected by distributor 1608, to drain passage 1602 permitting fuel flow from transfer passage 1610 and injection line 1612 to a drain 1614. As noted hereinabove, this draining event may cause cavitation in passage 1610 and the respective downstream passages. The embodiment shown in FIG. 65 minimize the effects of cavitation in passage 1610 and injection line 1612 during the injection cut off event by supplying auxiliary fuel at a relatively low pressure, i.e., 300 psi, to the transfer and injection passages between injection control valve 1604 and nozzle assembly 1616 thereby refilling the passages prior to the next injection event. The auxiliary fuel also minimizes cavitation slowing down the draining of fuel during the draining event thereby preventing excessive pressure decay in the downstream passages. In this embodiment, the auxiliary fuel is supplied by boost pump 1618 which supplies low pressure fuel to high pressure pump 1620 for delivery to accumulator 1606. Auxiliary fuel passage 1622 is connected at one end to the downstream side of boost pump 1618, for example, directly into transfer passage 1624 connecting boost pump 1618 and high pressure pump 1620. The opposite end of auxiliary fuel passage 1622 is connected to drain passage 1602. A restriction orifice 1626 is positioned in drain passage 1602 downstream of the connection of auxiliary fuel passage 1622. Restriction orifice 1626 functions to reduce the quantity of auxiliary fuel returned to drain 1614 thereby minimizing pumping losses.

Figure 66:
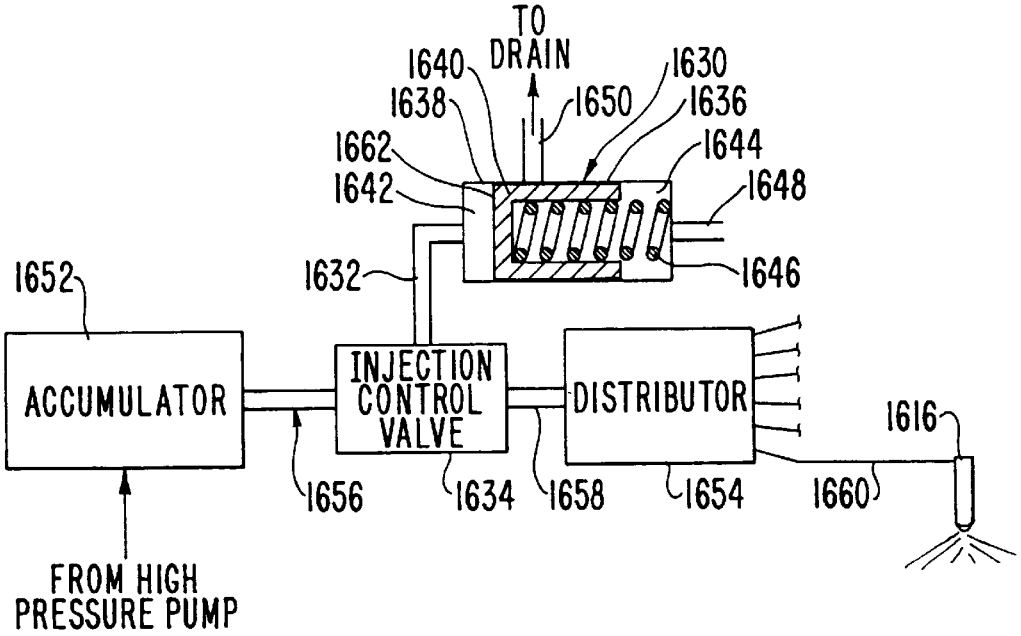
FIG. 66 is yet another embodiment of a cavitation control device incorporated into the fuel system assembly of the present invention.

Reference is now made to FIG. 66 showing another embodiment of the cavitation control device of the present invention which includes a pressure regulator 1630 positioned within the drain passage 1632 extending from injection control valve 1634. Pressure regulator 1630 includes a cylinder 1636 which forms a cavity 1638 connected at one end to drain passage 1632. Pressure regulator 1630 also includes a piston 1640 slidably mounted in cavity 1638 so as to divide cavity 1638 into an inlet chamber 1642 for receiving fuel from drain passage 1632 and a biasing chamber 1644. The outer cylindrical surface of piston 1640 forms a sufficiently close sliding fit with the inside surface of cylinder 1636 to form a fluid seal between the surfaces to substantially prevent fuel leaking from inlet chamber 1642 to biasing chamber 1644. A bias spring 1646 is positioned in biasing chamber 1644 for biasing piston 1640 toward inlet chamber 1642. A leak-by drain passage 1648 is connected to spring chamber 1644 to direct any fuel accumulating in spring chamber 1644 to drain. A high pressure relief passage 1650 is connected to cavity 1638 along the length of cylinder 1636 between inlet chamber 1642 and spring chamber 1644. Bias spring 1646 normally biases piston 1640 to the left in FIG. 66 so that the outer cylindrical surface of piston 1640 covers relief passage 1650 preventing flow from drain passage 1632 to relief passage 1650 via inlet chamber 1642. During an injection event, injection control valve 1634 fluidically connects accumulator 1652 to distributor 1654, while blocking fuel flow between fuel transfer circuit 1656 and drain passage 1632. During this time, piston 1640 will normally block relief passage 1650 since no high pressure fuel exists in inlet chamber 1642. Once the injection event is complete, and the injection control valve 1634 moves into a drain position connecting fuel injection passages 1658 and a respective fuel injection line 1660 to drain passage 1632, high pressure fuel flows through drain passage 1632 into inlet chamber 1642. The high pressure of the fuel in inlet chamber 1642 acts on the end face 1662 of piston 1640 creating a force which tends to move piston 1640 to the right in FIG. 66. However, bias spring 1646 will resist the rightward movement of piston 1640 thereby creating a back pressure in the fuel transfer passages and respective injection line. Once the pressure of the fuel in inlet chamber 1642 rises to a predetermined level sufficient to overcome the bias force of spring 1646, piston 1640 will move to the right in FIG. 66, uncovering high pressure relief passage 1650 thereby allowing fuel from inlet chamber 1642, transfer passage 1658 and other downstream lines including injection line 1660 to flow in the reverse direction through drain passage 1632 and relief passage 1650. Once the fuel pressure in the drain passage decreases to below a predetermined level, piston 1640 will move to the left in FIG. 66, under the force of bias spring 1646, blocking fuel flow through relief passage 1650. Inlet chamber 1642 functions as an accumulator for accumulating fuel for refilling the injection lines to minimize the effects of any cavitation. The force of piston 1640 against the accumulated fuel in inlet chamber 1642 pumps fuel into the fuel transfer passages and injection lines at a predetermined low pressure level thereby refilling any voids or vapor pockets unexpectedly formed in the transfer passages and injection lines during the draining event. Also, the effective cross sectional area of end face 1662 and the bias force of spring 1646 are carefully chosen to create a draining effect corresponding to the optimal rate of pressure decay in the injection lines and passages connected to drain to minimize cavitation. Also, a conventional pressure regulator could be used to maintain a back pressure without the advantages of an accumulated volume of fuel for refilling the injection lines.

In addition, the pressure regulator 1630 of FIG. 66 may be combined with cavitation control device 1400 of FIGS. 63*a* and 63*b* to advantageously minimize cavitation. Drain passage 1632 in FIG. 66 connecting the injection control valve to the pressure regulator 1630 is subject to pressure wave fluctuations due to the repeated relief of relatively high injection pressure into the drain passage caused by the operation of the injection control valve. These pressure wave fluctuations may be transmitted to the injection lines 1660 during refill adversely affecting the refill procedure and subsequent injections. However, by combining the embodiments of FIGS. 63*a* and 66, the relatively constant boost pump fuel pressure 416 of cavitation control device 1400, which is free of pressure wave fluctuations, is used to more effectively refill the injection lines downstream of the distributor without subjecting the injection lines to pressure wave fluctuations and the associated adverse effects.

Figure 67:
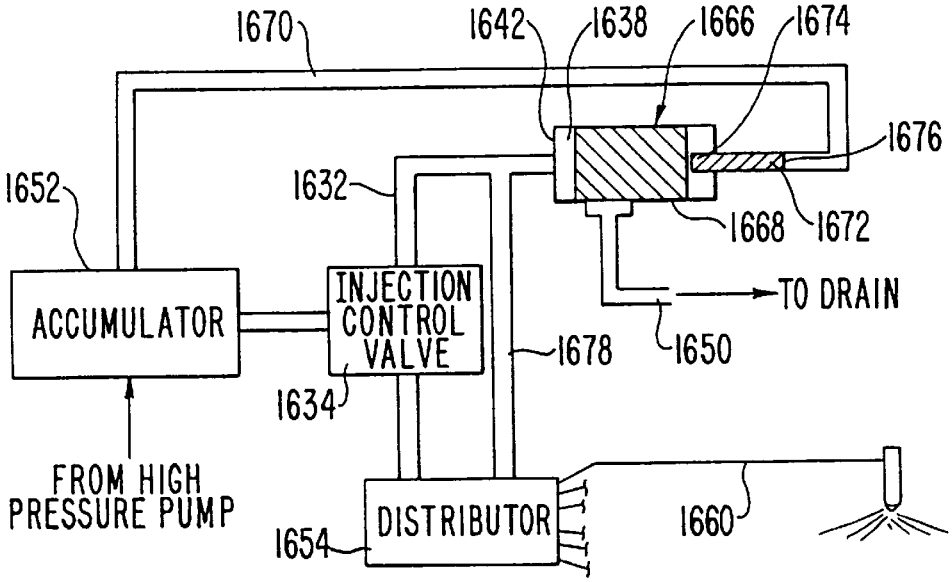
FIG. 67 is yet another embodiment of a cavitation control device used in the fuel system of the present invention.
Figure 68:
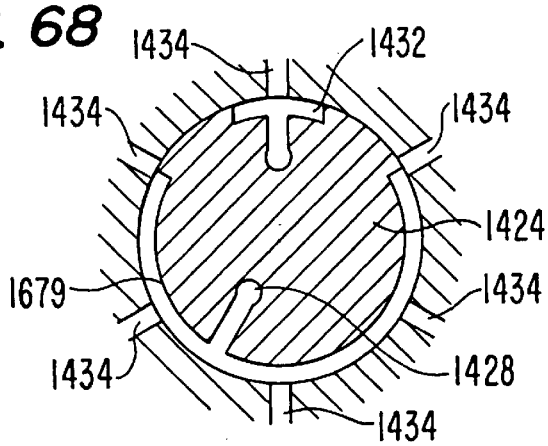
FIG. 68 is a partially cut away cross-sectional view of the distributor similar to FIG. 63*b* showing the application of the cavitation control device of FIG. 67.

Reference is now made to FIG. 67 disclosing another embodiment of the cavitation control device of the present invention which is similar to the previous embodiment and therefore like components will be referred to with the same reference numerals used in FIG. 66. In this embodiment, a pressure regulator 1666 includes a piston 1668 biased toward inlet chamber 1642 by the pressure of fuel supplied from accumulator 1652. A biasing fluid passage 1670 is connected to accumulator 1652 at one end and biasing chamber 1644 at an opposite end. A biasing pin 1672 is slidably mounted in biasing fluid passage 1670 adjacent biasing chamber 1644. An inner end 1674 of biasing pin 1672 extends into biasing chamber 1644 into abutment with one end of piston 1668. An outer end 1676 of biasing pin 1672 is exposed to accumulator fuel at extremely high pressure. By choosing the proper effective cross sectional area of the outer end 1676 of biasing pin 1672, pressure regulator 1666 can be used in the same manner as the embodiment of FIG. 66 to provide sufficient draining of the fuel transfer circuit and injection lines to end injection while both maintaining an optimum back pressure necessary to minimize cavitation and supplying low pressure fuel to the fuel passage and respective injection line during the last portion of the draining event to refill the injection passages and lines. In addition, this embodiment includes a refill passage 1678 connecting drain passage 1632 to each of the fuel injection lines 1660 via distributor 1654 for refilling the injection passages and injection line 1660 between distributor 1664 and nozzle assembly after the draining event prior to the next injection event. Refill passage 1678 is connected to each of the injection lines 1660 via passages (not shown) formed in the distributor housing and rotating shaft similar to the passages disclosed in FIGS. 63*a* and 63*b* with respect to cavitation control device 1400 except that delivery passage 1420 would be connected to refill passage 1678. Thus, subsequent to an injection event, refill port 1430 shown in FIG. 63*a* sequentially connects each injection line to refill passage 1678 permitting fuel in inlet chamber 1642 to flow to the respective injection line. The biased piston 1668 of pressure regulator 1666 maintains a back pressure in refill passage 1678 during the injection event when injection control valve 1634 blocks flow through drain passage 1632. Thus, pressure regulator 1666 functions to pump fuel back into fuel injection lines 1660 via refill passage 1678 to fill the vapor pockets or voids possibly formed during the previous injection cut off event and prior to the next injection, thereby insuring accurate and predictable and timing of the injection. Alternatively, a refill groove 1679 may be formed in distributor shaft 1424. Refill groove extends around the circumference of shaft 1424 a sufficient angular distance to fluidically connect, during a portion of each injection period, the fuel receiving passages 1434 which are not connected to injection port 1432. Thus, refill groove 1679 permits refilling of receiving passages 1434 and corresponding downstream lines between injection events and equalization of the initial fuel pressure in these passages prior to each injection event to insure controllable and predictable fuel metering from one injection period or engine cycle to the next.

Figure 69:
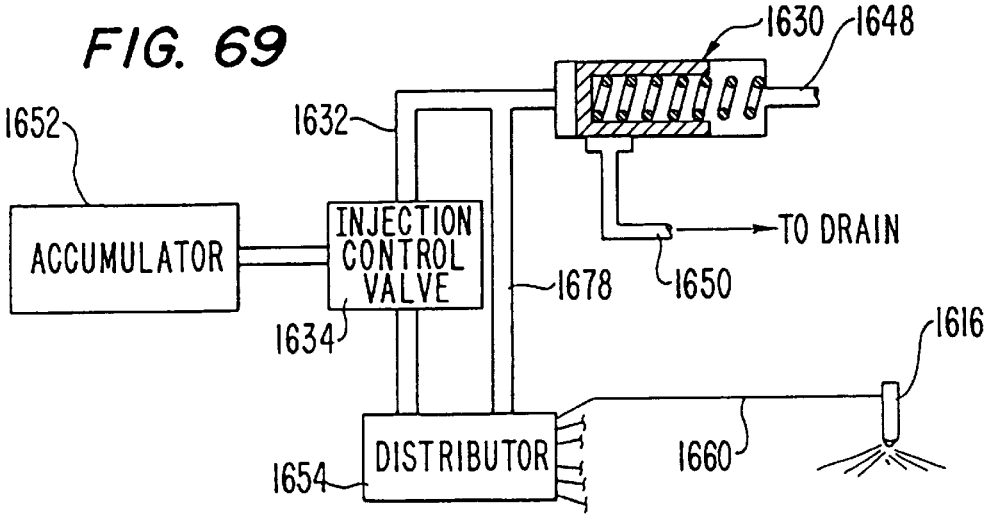
FIG. 69 is a schematic diagram illustrating yet another embodiment of a cavitation control device of the present invention used in the fuel system of the subject invention.

Referring now to FIG. 69, another embodiment of the cavitation control device of the present invention is disclosed. This embodiment combines the spring biased pressure regulator 1630 of FIG. 66 with the refill passage 1678 disclosed in FIG. 67. Therefore, the functioning and advantages of this embodiment are substantially the same as the previous two embodiments.

As can be appreciated from the discussion set forth hereinabove, the present invention advantageously provides a fuel system comprised of an electronically controllable, high pressure fuel pump assembly including a pump, accumulator and distributor combined with an electrically operated pump control valve and an injection control valve mounted on the unitized assembly to form a highly integrated fuel system which provides superior emissions control and improved engine performance and which may be designed, built and installed either for an original or pre-existing engine design with minimal modification of the pre-existing designs. This highly integrated fuel system is capable of achieving very high injection pressures, i.e., 5000–30,000 psi and preferably in the range of 16,000–22,000 psi with precise control over injection quantity and timing in response to varying engine conditions while allowing for the provision of redundant fail safe electronic components, and improved engine efficiency at overall reduced costs with respect to competing prior art systems.

The present fuel system also offers the advantage of a highly compact, integrated fuel pump assembly by providing a pump housing having at least one pump cavity oriented in a radial direction, and an accumulator mounted on the pump housing. Such accumulator may provide an overhang in either the lateral and/or axial direction and a pump control valve mounted on the overhang portion of the accumulator housing adjacent the pump housing. In addition, the accumulator housing is mounted on the pump housing at one end of the pump housing to form a cantilevered lateral overhang such that the overhang forms an offset transverse profile for the fuel pump assembly to complement the irregular transverse profile of the internal combustion engine on which the fuel assembly is designed to be mounted.

The present fuel system also advantageously provides a unitized, single piece fuel pump housing containing plural outwardly opening pump cavities, a radially enclosed drive shaft, a pump head engaging surface and plural tappet guiding surfaces within corresponding pump cavities wherein the tappet guiding surfaces, head engaging surface and drive shaft mounting surfaces are the only surfaces requiring close machining to create adequate alignment between the drive shaft and the cooperating fuel pumping elements of the pump. Moreover, by providing a pump head mounted on the pump housing opposite the drive shaft and a pump unit retained in the pump head by means of a retainer which causes the pump unit to extend into the pump cavity of the pump housing in spaced apart non-contacting relationship with the pump housing, the present invention allows the pump unit to be relatively easily removed and replaced to provide inexpensive overhaul of the pump assembly and/or the ability to switch pump units to adjust the effective displacement of the fuel pump assembly.

Moreover, the fuel system of the present invention minimizes the number of fuel leakage sites by reducing the system components and providing fail safe redundant low pressure fuel drains throughout the system to catch and return to the fuel system any fuel which may leak through primary seal areas. Also, the present fuel system may include both two pump control valves and two injection control valves to allow one respective valve to take over if the other respective valve should become disabled.

The present invention also provides an improved accumulator containing a labyrinth of interconnecting chambers wherein the chambers are elongated, cylindrical in shape and positioned in generally parallel relationship intersecting a vertical plane through the accumulator housing in a two dimensional array. The accumulator chambers are specifically oriented to minimize the physical dimensions of the accumulator housing while being dimensioned to create a minimum total volume sufficient to prevent fuel pressure from dropping more than five percent during any injection event depending upon such factors as the compressibility of the fuel, the operating pressure of the fuel, the maximum potential required injection volumes, timing range and injection duration selected for the engine, the maximum effective displacement of each pump unit, the fuel leakage of the system, the compression of the fuel in the fuel lines, and the fuel lost to drain during valve member travel between fully opened and fully closed positions.

The disclosed invention provides a variety of additional features such as (1) the integration of a rotatable pump and distributor with a single drive shaft assembly; (2) the provision of a distributor including axially slidable spool valves in combination with a separate injection control valve; (3) the provision of a variety of pump head/accumulator designs for accommodating pump control valves and check valves; (4) the provision of ultra-compact pump head and integral pump chamber designs; (5) the provision of a transversely oriented pump control valve for reducing to an absolute minimum the trapped volume within the accumulator; (6) the provision of a pump unit and transverse pump control valve mounted in the barrel of the pump unit; (7) various accumulator designs for simplifying the formation and manufacture of the accumulator; (8) the provision of a separately mounted accumulator; (9) the provision of various edge filter mounting concepts for use within the disclosed fuel system; and (10) the provision of rate shaping and cavitation control devices within the disclosed fuel system.

Industrial Applicability

The compact high performance fuel system of the present invention, and the components thereof, may be used in a variety of combustion engines of any vehicle or industrial equipment requiring accurate and reliable high pressure fuel delivery. However, the high performance fuel system of the present invention is particularly useful with small and medium displacement diesel truck engines and especially adaptable to existing diesel engine designs without major engine modifications.

We claim:

1. An electronically controllable, high pressure fuel pump assembly for supplying fuel at a predetermined pressure through plural fuel injection lines to the corresponding cylinders of a multi-cylinder internal combustion engine, comprising (a) a unitized assembly adapted to be mounted on the engine, said unitized assembly including i. pump means for pressurizing fuel above the predetermined pressure, said pump means including a pump housing having mounting means for mounting said unitized assembly on the engine, ii. an accumulator means for accumulating and temporarily storing fuel at high pressure received from said pump means, said accumulator means including an accumulator housing containing at least one accumulator chamber, said accumulator housing being mounted on said pump housing, and iii. a fuel distributor means for enabling sequential periodic fluidic communication between said accumulator chamber and the engine cylinders, said distributor means including a distributor housing being mounted on said pump housing;

(b) a first solenoid operated pump control valve for controlling said pump means to maintain a desired pressure of fuel in said accumulator chamber, said first solenoid operated pump control valve by being mounted on said unitized assembly; and (c) a first solenoid operated injection control valve for controlling the timing and quantity of fuel injected into each engine cylinder in response to engine operating conditions, said first solenoid operated injection control valve being mounted on said unitized assembly.

2. The electronically controlled, high pressure fuel pump assembly of claim 1, further including a second solenoid operated pump control valve for controlling said pump means to maintain the desired pressure of fuel in said accumulator chamber even if said first solenoid operated pump control valve becomes disabled.

3. The electronically controlled, high pressure fuel pump assembly of claim 1, further including a second solenoid operated injection control valve for controlling the timing and quantity of injection into each engine cylinder even if said first solenoid operated injection control valve becomes disabled.

4. The fuel pump assembly of claim 1, wherein said pump means includes plural pump chambers, plural pump plungers mounted for reciprocal motion within said pump chambers, and wherein said assembly further includes plural solenoid operated pump control valves corresponding in number to said pump chambers, said solenoid operated pump control valves being connected with said pump chambers, respectively, for controlling the effective displacement of each said associated pump plunger.

5. The fuel pump assembly of claim 4, further including means for generating a pressure signal representative of the pressure of the fuel in said accumulator means and control means for controlling said solenoid operated pump control valves to adjust the effective displacement of said pump plungers in response to said pressure signal to cause the pressure of fuel in said accumulator means to equal said predetermined pressure.

6. An electronically controllable, fail safe, high pressure fuel pump assembly for supplying fuel at a predetermined pressure through plural fuel injection lines to the corresponding cylinders of a multi-cylinder internal combustion engine, comprising (a) pump means for pressurizing fuel above the predetermined pressure, said pump means including plural positive displacement pump elements having variable displacement capability, (b) an accumulator means for accumulating and temporarily storing fuel at high pressure received from said pump means, said accumulator including at least one accumulator chamber arranged to receive fuel from all said positive displacement pump elements, (c) a fuel distributor means for enabling sequential periodic fluidic communication between said accumulator chamber and the engine cylinders, (d) at least a pair of associated solenoid operated pump control valves for controlling the effective displacement of said pump elements to cause said pump elements to share the pumping load necessary to maintain a desired pressure of fuel in said accumulator chamber, (e) a first solenoid operated injection control valve for normally controlling the timing of one portion of the quantity of fuel injected into each engine cylinder during each injection event, and (f) electronic control means for controlling the operation of said pump control valves to allow substantially normal engine operation should one of said pump control valves become disabled by causing the associated pump control valve to take over the function of the disabled pump control valve.

7. The fuel pump assembly of claim 6, further including a second solenoid operated injection control valve associated with said first solenoid operated injection control valve for normally controlling the timing of another quantity of fuel injected into each engine cylinder during each injection event wherein said electronic control means operates to control said injection control valves to allow at least "imphome" operation of said engine should one of said injection control valves become disabled by causing the associated injection control valve to take over the function of the disabled injection control valve.

8. A compact, high pressure fuel pump assembly for supplying fuel to a multi-cylinder internal combustion engine, comprising a pump housing having minimal extent in mutually perpendicular lateral, radial and axial directions, said pump housing containing at least one pump cavity having a first pump axis extending in the radial direction and a drive shaft cavity adjacent one end of said pump cavity having a drive axis extending in the axial direction;

a drive shaft mounted within said drive shaft cavity for rotation about said drive axis;

a pump plunger mounted within said pump cavity for reciprocatory motion along said first pump axis in response to rotational movement of said drive shaft; and an accumulator housing containing at least one elongated accumulator chamber for accumulating and temporarily storing fuel at high pressure, said accumulator housing being mounted on said pump housing adjacent the other end of said pump cavity with the central axis of said elongated accumulator chamber being arranged parallel to said drive axis.

9. The fuel pump assembly of claim 8, wherein said accumulator housing has an axial extent which is substantially greater than the axial extent of said pump housing thereby creating an axial overhang of said accumulator housing relative to said pump housing.

10. The fuel pump assembly of claim 9, wherein said pump housing contains at least one additional pump cavity having a second pump axis parallel to said first pump axis and perpendicular to said drive axis and further including a second pump plunger mounted for reciprocatory motion along said second pump axis in response to rotational movement of said drive shaft.

11. The fuel pump assembly of claim 10, further including a fuel distributor means for providing sequential periodic fluidic communication between said accumulator chamber and the engine cylinders, said fuel distributor means including a distributor housing mounted on said pump housing adjacent said drive shaft cavity in spaced apart generally parallel relationship with said axial overhang of said accumulator housing.

12. The fuel pump assembly of claim 11, wherein said distributor housing contains a rotor bore and said distributor means further includes a distributor rotor mounted for rotation within said rotor bore, said rotor being rotationally driven by said drive shaft, said rotor containing an axial supply passage fluidically connected to receive fuel from said accumulator chamber, said rotor also containing a first radial supply passage fluidically connected to said axial supply passage, said distributor housing containing a set of receiving ports adapted to communicate with corresponding engine cylinders through corresponding fuel injection lines, said receiving ports being circumferentially spaced around said rotor, said set of receiving ports being arranged in positions to register successively with said first radial supply passage as said rotor is rotated to define separate distinct periods during each rotation of said rotor in which said corresponding engine cylinders may be fluidically connected to said accumulator chamber.

13. The fuel pump assembly of claim 12, wherein the rotational axis of said rotor is co-axial with the rotational axis of said drive shaft.

14. The fuel pump assembly of claim 12, wherein the rotational axis of said rotor is perpendicular to the rotational axis of said drive shaft.

15. The fuel pump assembly of claim 12, further including a fuel feed line for fluidically connecting said axial supply passage to said accumulator chamber, said feed line including a feed port for supplying fuel from said accumulator to said rotor bore, said feed port being located in a supply plane which is perpendicular to the rotational axis of said rotor and is axially spaced from said set of receiving ports, said rotor containing a radial receiving passage axially positioned within said supply plane.

16. The fuel pump assembly of claim 15, wherein said distributor housing contains a distributor housing drain port located at one end of said rotor bore for communication with a low pressure fuel drain, said rotor contains a first axial drain passage fluidically connected to said distributor housing drain port.

17. The fuel pump assembly of claim 16, wherein said rotor further contains a first radial drain passage communicating with an axial drain passage and to a first drain groove formed in one of said rotor and said rotor bore located axially between said first radial supply passage and said radial receiving passage to receive any fuel which leaks through the close fitting clearance between said rotor and rotor cavity extending between said radial supply passage and said radial receiving passage.

18. The fuel pump assembly of claim 16, further including a boost pump means located between said distributor means and said pump housing for receiving fuel from a fuel source and for supplying fuel to said pump cavity at a pressure sufficient to provide an adequate amount of fuel to said pump cavity throughout the operating range of the engine.

19. The fuel assembly of claim 18, wherein said boost pump means includes a shaft extension coupled to said drive shaft of said fuel pump at one end and to said rotor distributor rotor at the other end, said distributor housing having a seal recess surrounding the end of said distributor rotor adjacent said shaft extension.

20. The fuel pump assembly of claim 12, wherein said rotor contains a pressure equalizing groove extending a sufficient circumferential distance around said rotor at an axial location to connect fluidically all said receiving ports except for the receiving port which is in fluidic communication with said first radial supply passage.

21. The fuel pump assembly of claim 20, wherein said receiving ports are circumferentially spaced equal angularly around said rotor to maximize the space between said receiving ports.

22. The fuel pump assembly of claim 21, wherein said distributor means includes a supply groove contained in one of said rotor and said rotor bore, said supply groove being positioned to communicate at all times with said radial receiving passage of said rotor and said fuel feed line.

23. The fuel pump assembly of claim 15, wherein said distributor means includes an injection control means for controlling the timing and quantity of fuel injected into each engine cylinder in response to engine operating conditions, said injection control means including a first solenoid injection control valve mounted on said distributor housing and arranged to control the flow of fuel through said fuel feed line, said first solenoid injection control valve being a three way valve operable when energized to connect said axial supply passage of said rotor with said accumulator and operable when de-energized to connect said axial supply passage of said rotor bore with a low pressure drain wherein said distributor housing includes an elongated first valve cavity for receiving said first solenoid injection control valve.

24. The fuel pump assembly of claim 23, wherein said injection control means includes a second solenoid injection control valve mounted on said distributor housing and arranged to control the flow of fuel through said fuel feed line in parallel with said first solenoid injection control valve, said second solenoid injection control valve being a three way valve operable when energized to connect said axial supply passage of said rotor with said accumulator and operable when de-energized to connect said axial supply passage of said rotor with a low pressure fuel drain, said distributor housing containing a second valve cavity having a central axis parallel to a central axis of said first valve cavity, said central axes residing within said supply plane containing said radial supply passage supplying fuel to said axial supply passage of said rotor, said first and second cavities being positioned on opposite sides of said rotor.

25. The fuel pump assembly of claim 24, wherein said first and second valve cavities interconnected by a rotor feed bore having a central axis located in said supply plane, said feed port for said rotor cavity being fluidically connected with said rotor feed bore, said distributor means including a two way check valve located within said rotor feed bore to prevent fuel supplied from one said valve cavity to flow into the other said valve cavity.

26. An ultra high pressure fuel pump assembly for supplying fuel through plural fuel injection lines to the corresponding cylinders of a multi-cylinder internal combustion engine having a predetermined operating range and having reciprocating pistons associated with the respective cylinders, comprising:

pump means for supplying fuel at a pressure above a predetermined operating pressure;

a high pressure accumulator means fluidically connected with said pump means for accumulating a predetermined volume of fuel at said predetermined operating pressure;

a fuel distribution means for providing sequential periodic fluidic communication between said accumulator means and the engine cylinders through the fuel injection lines associated with the corresponding engine cylinders for causing periodic injection of fuel into the corresponding engine cylinder in timed synchronism with the movement of the piston in the corresponding engine cylinder;

wherein said high pressure accumulator means includes a high strength, compact accumulator housing containing a fluidically interconnected labyrinth of accumulator chambers having a total volume sufficient to allow controlled quantities of fuel at the said operating pressure to be delivered to each engine cylinder at appropriate times throughout the entire operating range of the engine as determined by said fuel distribution means.

27. The fuel pump assembly of claim 26, wherein said pump means includes at least one pump unit for responding to a control signal to vary the amount of fuel pumped, and further including pressure sensing means for determining the pressure within said accumulator chambers and a pump control means for generating said pump control signal to maintain the pressure of fuel in said accumulator chambers at the predetermined operating pressure.

28. The fuel pump assembly of claim 26, wherein said accumulator chambers are elongated and cylindrical in shape and are connected by connecting passages.

29. The fuel pump assembly of claim 28, wherein said accumulator chambers are positioned adjacent, and oriented in generally parallel relationship, to each other.

30. The fuel pump assembly of claim 28, wherein said accumulator chambers are positioned to intersect a vertical plane through said accumulator housing in a two dimensional array.

31. The fuel pump assembly to claim 30, wherein said two dimensional array includes an upper row of four accumulator chambers and a lower row of three accumulator chambers.

32. The fuel pump assembly of claim 28, wherein said accumulator housing is formed from an integral one piece block and wherein said accumulator means includes a plurality of plugs located at the ends of respective accumulator chambers to seal fluidically the ends of said accumulator chambers.

33. The fuel pump assembly of claim 32, wherein said pump means includes a pump housing containing plural pump cavities and said accumulator housing is mounted on said pump housing and includes plural pump unit recesses aligned with and communicating with said pump cavities, respectively, and wherein said pump means includes plural pump units, each said pump unit being mounted within a corresponding pump cavity and associated pump unit recess.

34. The fuel pump assembly of claim 33, wherein each said pump unit includes a pump barrel containing a pump chamber and a pump plunger mounted for reciprocal movement in said pump chamber.

35. The fuel pump assembly of claim 34, wherein said pump means includes a camshaft rotationally mounted within said pump housing, said camshaft includes plural cams for causing said plungers, respectively, to reciprocate as said camshaft is rotated.

36. The fuel pump assembly of claim 35, wherein said pump means includes a plurality of tappet assemblies associated with said pump units, respectively, each said tappet assembly being mounted for reciprocal movement within the pump cavity in which said corresponding pump unit is mounted and being connected with the pump plunger of the corresponding pump unit, and wherein said pump means includes a tappet bias spring for biasing said tappet assembly into engagement with a corresponding cam on said camshaft to cause said tappet assembly and the connected pump plunger to reciprocate as said camshaft is rotated.

37. The fuel pump assembly of claim 35, wherein each said cam has at least one lobe for causing an associated pump plunger to undergo one advancing stroke and one return stroke for each revolution of said camshaft, the total number of lobes on all said cams being selected to cause one advancing stroke for each of said periodic injections into each of the engine cylinder.

38. The fuel pump assembly of claim 34, wherein each said pump unit includes a pump retainer surrounding said barrel, for supportively mounting the pump unit within the corresponding pump unit recess of said accumulator housing, each said pump unit extending into the corresponding pump cavity without directly contacting said pump housing.

39. The fuel pump assembly of claim 38, wherein each said pump unit contains a pump unit inlet communicating with a source of fuel for feeding fuel into said pump chamber and a pump unit outlet communicating with said labyrinth of accumulator chambers and wherein each said pump unit includes a pump unit check valve for permitting only one way flow of fuel from the pump chamber through said pump unit outlet into said accumulator chambers.

40. The fuel pump assembly of claim 39, wherein each said pump unit check valve includes a check valve recess contained in said accumulator housing to form a fluid communication path between a corresponding disk outlet passage and said accumulator chambers, each said pump unit check valve further including a check valve element adapted to be biased into a closed position by the pressure of fuel within said accumulator chambers until the pressure of fuel within the corresponding pump chamber exceeds the pressure within said accumulator chambers at which time said check valve element is caused to open to allow fuel to flow from the corresponding pump chamber and through said check valve recess into said accumulator chambers.

41. The fuel pump assembly of claim 39, wherein each said pump unit includes a disk positioned within said retainer at one end of said barrel to close off the corresponding pump chamber, said pump unit disk containing said pump unit inlet and said pump unit outlet and wherein said retainer is threadedly received within the corresponding pump unit recess of said accumulator housing to bias said barrel and said disk in axially stacked relationship against said accumulator housing, said pump unit outlet including a disk outlet passage positioned centrally in said disk, said pump unit inlet including an annular disk groove positioned concentrically on one side of said disk and at least one axial disk inlet passage extending from said pump chamber to said annular disk groove.

42. The fuel pump assembly of claim 41, wherein said accumulator housing contains at least one common fuel feed passage for supplying fuel to all of said pump units and a plurality of fuel feed branches extending between said common fuel feed passage and said pump unit recesses respectively, each said fuel feed branch communicating at one end with said annular disk groove contained in the corresponding pump unit recess and communicating at the other end with said common fuel feed passage.

43. The fuel pump assembly of claim 42, further including a plurality of pump unit control valves associated with said fuel feed branches, respectively, to control the flow of fuel through the corresponding fuel feed branches in response to a pump unit control signal to control the amount of fuel pumped into said accumulator chambers by the corresponding pump unit during each reciprocal cycle of the corresponding pump plunger.

44. The fuel pump assembly of claim 43, further including pressure sensing means for determining the pressure within said accumulator chambers and a pump unit valve control means for generating said pump unit control signal for each said pump unit control valve to maintain the pressure of fuel in said accumulator chambers at the predetermined operating pressure.

45. The fuel pump assembly of claim 44, wherein said accumulator housing contains an accumulator drain passage communicating with each said pump unit recess and with said common fuel feed passage, each said pump unit includes a pump unit drain means for directing fuel leaked from said pump unit into said accumulator drain passage, each said pump unit drain means further including a recess clearance formed between the corresponding retainer and the corresponding pump unit recess, each said recess clearance communicating with the corresponding accumulator drain passage.

46. The fuel pump assembly of claim 45, wherein each said drain means further includes a pump unit clearance between the corresponding barrel and retainer, a drain groove located on the surface of the corresponding pump plunger and a retainer drain passage communicating at all times with said pump unit clearance and communicating intermittently with said drain groove during reciprocal movement of the corresponding pump plunger, whereby fuel leaked from the corresponding pump chamber between the corresponding barrel and pump plunger will collect in said drain groove for intermittent drainage through the corresponding drain passage.

47. The fuel pump assembly of claim 46, wherein each said pump unit clearance is fluidically connected to receive fuel leaked from the area of contact between the corresponding disk and retainer and wherein each said recess clearance is fluidically connected to receive fuel leaked from the area of contact between the corresponding disk and accumulator housing to allow fuel leaked from said contact areas to be returned to said common fuel feed passage.

48. The fuel pump assembly of claim 46, wherein each said pump unit check valve includes a check valve recess contained in said accumulator housing to form a fluid communication path between a corresponding disk outlet passage and said accumulator chambers, each said pump unit check valve further including a check valve element adapted to be biased into a closed position by the pressure of fuel within said accumulator chambers until the pressure of fuel within the corresponding pump chamber exceeds the pressure within said accumulator chambers at which time said check valve element is caused to open to allow fuel to flow from the corresponding pump chamber through said corresponding disk outlet passage and said check valve recess into said accumulator chambers.

49. A fuel pump assembly for supplying fuel to a multi-cylinder internal combustion engine above a predetermined high pressure, comprising a compact pump housing having minimal dimensions in mutually perpendicular lateral, radial and axial directions, said pump housing containing at least one pump cavity having a first pump axis extending in the radial direction;

pumping means mounted within said pump cavity for pressurizing fuel above the predetermined high pressure;

an accumulator housing containing at least one accumulator chamber for accumulating and temporarily storing fuel at high pressure, said accumulator housing being mounted on said pump housing adjacent one end of said pump chamber, at least one of said axial extent and said lateral extent of said accumulator housing being greater than the corresponding extent of said pump housing thereby creating a cantilevered overhang of said accumulator housing relative to said pump housing; and pump control valve means connected with said overhang of said accumulator housing adjacent said pump housing for controlling the amount of fuel pumped into said accumulator chamber.

50. The fuel pump assembly of claim 49, wherein said pump housing includes plural pump cavities, said pumping means includes means for pressurizing fuel in all said pumping cavities for delivery to said accumulator chamber.

51. The fuel pump assembly of claim 50, wherein said accumulator housing contains at least one common fuel feed passage for supplying fuel to all of said pump cavities and a plurality of fuel feed branches extending between said common fuel feed passage and said pump cavities, respectively, each said fuel feed branch communicating at one end with a corresponding said pump cavity and communicating at the other end with said common fuel feed passage.

52. The fuel pump assembly of claim 51, wherein said pump control valve means includes a plurality of pump control valves associated with said fuel feed branches, respectively, to control the flow of fuel through the corresponding fuel feed branches in response to a pump control signal to control the amount of fuel pumped into said accumulator chambers by said pump means, said pump control valves being mounted on said cantilevered overhang of said accumulator.

53. The fuel pump assembly of claim 52, wherein said pump control valves are mounted in said cantilevered overhang in a position immediately adjacent said pump housing.

54. The fuel pump assembly of claim 53, wherein cantilevered overhang extends in the lateral direction and said pump control valves are positioned along the lateral side of said pump housing.

55. The fuel pump assembly of claim 54, further including pressure sensing means for determining the pressure within said accumulator chamber and wherein said cantilevered overhang of said accumulator also extends in the axial direction, said pressure sensing means being mounted in said axial portion of said cantilevered overhang.

56. The fuel pump assembly of claim 55, wherein said pressure sensing means is mounted on the same side of said accumulator housing as said pump housing.

57. A high pressure fuel pump assembly for supplying fuel to an internal combustion engine, comprising:

pump means for supplying fuel above approximately 5,000 psi, said pump means including a pump housing containing at least one pump cavity opening into a head engaging surface; and a high pressure accumulator means fluidically connected with said pump means for accumulating a predetermined volume of fuel at a predetermined operating pressure above approximately 5,000 psi, said high pressure accumulator means includes a high strength, compact accumulator housing containing at least one accumulator chamber and mounted in contact with said head engaging surface of said pump housing to form an end wall for said pump cavity, wherein said accumulator housing includes a fluidically interconnected labyrinth of accumulator chambers having a total volume sufficient to allow controlled quantities of fuel at the operating pressure to be delivered to the internal combustion engine at appropriate times throughout the entire operating range of the engine.

58. A high pressure fuel pump assembly as defined in claim 57, wherein said pump means is adapted to supply fuel at a pressure above approximately 16,000 psi and said accumulator means is adapted to contain fuel at a pressure above approximately 16,000 psi.

59. A high pressure fuel pump assembly as defined in claim 57, wherein said pump means is adapted to supply fuel at a pressure above approximately 20,000 psi and said accumulator means is adapted to contain fuel at a pressure above approximately 20,000 psi.

60. A high pressure fuel pump assembly as defined in claim 57, wherein said accumulator housing is formed from material selected from the group consisting of SAE 4340 or Aermet 100.

61. A high pressure fuel pump assembly as defined in claim 57, wherein said accumulator housing is formed of an integral one piece block containing said labyrinth of accumulator chambers shaped and positioned to form surrounding walls sufficiently strong to withstand the forces generated when said accumulator chambers are filled with fuel at the predetermined operating pressure.

62. A high pressure fuel pump assembly as defined in claim 61, wherein said accumulator chambers are formed by boring said one piece block, and wherein said accumulator includes a plurality of separate plugs for sealing said accumulator chambers respectively.

63. A high pressure fuel pump assembly as defined in claim 62, wherein the aggregate volume of said accumulator chambers is sufficient to limit the drop in fuel pressure within said accumulator throughout the entire operating range of the engine to no more than approximately 5%–10% of said predetermined operating pressure.

64. A high pressure fuel pump assembly as defined in claim 63, wherein said accumulator block walls are sufficiently strong to allow said accumulator chambers to hold fuel at a predetermined pressure above 5,000 psi.

65. A high pressure fuel pump assembly as defined in claim 64, wherein said accumulator block walls are sufficiently strong to allow said accumulator chambers to hold fuel at a predetermined pressure above 20,000 psi.

66. A high pressure fuel pump assembly as defined in claim 65, wherein said accumulator chambers are elongated and cylindrical in shape and are connected by connecting passages.

67. A high pressure fuel pump assembly as defined in claim 66, wherein said accumulator chambers are positioned adjacent, and oriented in generally parallel relationship, to each other.

68. A high pressure fuel pump assembly as defined in claim 67, wherein said accumulator chambers are positioned to intersect a vertical plane through said accumulator housing in a two dimensional array.

69. A high pressure fuel pump assembly as defined in claim 68, wherein said accumulator chambers are fluidically interconnected by a first cross passage which intersects an upper row of accumulator chambers and a second cross passage which intersects a lower row of accumulator chambers.

70. A high pressure fuel pump assembly as defined in claim 69, wherein said two dimensional array includes an upper row of four accumulator chambers and a lower row of three accumulator chambers.

71. A high pressure fuel pump assembly as defined in claim 70, wherein accumulator means includes a plurality of plugs located at the ends of respective accumulator chambers to seal fluidically the ends of said accumulator chambers.

72. A high pressure fuel pump assembly for periodic injection of fuel through plural fuel injection lines into corresponding engine cylinders of a plural cylinder internal combustion engine having a predetermined operating range and a plurality of reciprocating pistons associated with the corresponding cylinders, comprising:

a compact pump housing having minimal dimensions in mutually perpendicular lateral, radial and axial directions, said pump housing containing at least one pump cavity having a first central axis extending in the radial direction;

a pump plunger mounted within said pump cavity for reciprocatory motion along said first central axis;

an accumulator housing containing at least one accumulator chamber for accumulating and temporarily storing fuel at high pressure, said accumulator housing being mounted on said pump housing adjacent one end of said pump chamber, at least one of said axial extent and said lateral extent of said accumulator housing being greater than the corresponding extent of said pump housing thereby creating a cantilevered overhang of said accumulator housing relative to said pump housing; and a fuel distributor means for providing sequential periodic fluidic communication between said accumulator means and the engine cylinders through the corresponding fuel injection lines associated with the corresponding engine cylinders for causing periodic injection of fuel into the corresponding engine cylinder in timed synchronism with the movement of the pistons in the corresponding cylinders, said fuel distribution means including a distributor body cantilever mounted on said pump housing in parallel, generally spaced apart relationship with respect to said overhang of said accumulator housing.

73. A high pressure fuel pump assembly as defined in claim 72, wherein said distributor means includes an injection control means for controlling the timing and quantity of fuel injected into each engine cylinder in response to engine operating conditions, said first control means including a first solenoid injection control valve mounted on said distributor housing and arranged to control the flow of fuel in said fuel injection lines, said first solenoid injection control valve being mounted on said distributor housing in the space between said distributor housing and said cantilevered overhang of said accumulator housing.

74. A high pressure fuel pump assembly as defined in claim 73, wherein said injection control means includes a second solenoid injection control valve for controlling the flow of fuel from said accumulator to said respective engine cylinders, said second solenoid injection control valve being mounted on said distributor housing adjacent said first solenoid injection control valve in the space between said distributor housing and said cantilevered overhang of said accumulator housing.

75. A high pressure fuel pump assembly as defined in claim 74, wherein said first and second solenoid injection control valves are three way valves operable when energized to connect one of the fuel injection lines with said accumulator and operable when de-energized to connect one of the fuel injection lines with a low pressure fuel drain.

76. A high pressure fuel pump assembly as defined in claim 73, wherein said first solenoid injection control valve is a three way valve operable when energized to connect one of the fuel injection lines with said accumulator and operable when de-energized to connect one of the fuel injection lines with a low pressure fuel drain.

77. A fuel pump assembly for supplying fuel at pressures above a predetermined high pressure to an internal combustion engine having an irregular transverse profile, comprising a compact pump housing having minimal dimensions in mutually perpendicular lateral and radial directions, said pump housing containing at least one pump cavity having a first pump axis extending in the radial direction;

pumping means mounted within said pump cavity for pressurizing fuel above the predetermined high pressure;

an accumulator housing containing at least one accumulator chamber for accumulating and temporarily storing fuel at high pressure, said accumulator housing being mounted on said pump housing adjacent one end of said pump cavity, said lateral extent of said accumulator housing being greater than the lateral extent of said pump housing thereby a cantilevered lateral overhang of said accumulator housing relative to said pump housing to form an offset transverse profile which allows the fuel pump assembly to be mounted on the internal combustion engine at a location wherein the transverse profile of the fuel pump assembly complements the irregular transverse profile of the internal combustion engine.

78. The fuel pump assembly of claim 77, further including pump control valve means connected with said lateral overhang of said accumulator housing adjacent said pump housing for controlling the amount of fuel pumped into said accumulator chamber in response to a pump control signal.

79. The fuel pump assembly of claim 78, wherein said pump housing includes plural pump cavities, said pumping means includes plural pump units corresponding to the number of said pump cavities and located in said pump cavities, respectively, each said pump unit operating to pressurize fuel for delivery to said accumulator chamber.

80. The fuel pump assembly of claim 79, wherein said accumulator housing contains at least one common fuel feed passage for supplying fuel to all of said pump cavities and a plurality of fuel feed branches extending between said common fuel feed passage and said pump cavities, respectively, each said fuel feed branch communicating at one end with a corresponding said pump cavity and communicating at the other end with said common fuel feed passage.

81. The fuel pump assembly of claim 80, wherein said pump control valve means includes a plurality of pump control valves associated with said fuel feed branches, respectively, to control the flow of fuel through the corresponding fuel feed branches in response to a pump control signal to control the amount of fuel pumped into said accumulator chambers by said pump means, said pump control valves being mounted on said lateral overhang of said accumulator.

82. A fuel pump assembly, comprising a pump housing containing an outwardly opening pump cavity, a drive shaft rotatably mounted in the pump housing, a pump head mountable on the pump housing to close the outwardly opening pump cavity, said pump head containing a pump unit recess positioned to communicate with the pump cavity, and a replaceable pump unit including a pump barrel containing a pump chamber and a pump plunger adapted to be mounted for reciprocal movement within said pump chamber in response to rotation of said drive shaft, said replaceable pump unit including retaining means for mounting said pump unit within said pump unit recess of said pump head in a position to extend at least partially into said pump cavity in spaced apart non-contacting relationship with said pump housing.

83. The fuel pump assembly of claim 82, wherein said pump housing includes a plurality of said outwardly opening pump cavities, said pump head containing a plurality of said pump unit recesses positioned to communicate with said pump cavities, respectively, and further including a plurality of said replaceable pump units, each said pump unit including a pump barrel containing a pump chamber, a pump plunger mounted for reciprocation within said pump chamber when said drive shaft rotates and a retaining means for mounting said pump unit within a corresponding said pump unit recess of said pump head in a position to extend at least partially into said pump cavity in spaced apart non-contacting relationship with said pump housing.

84. The fuel pump assembly of claim 83, wherein said drive shaft includes a plurality of cams for causing said pump plungers to reciprocate, and further including a plurality of tappet assemblies associated with said pump units, respectively, each said tappet assembly being mounted for reciprocal movement within a corresponding pump cavity and being connected with a corresponding pump plunger, and a plurality of tappet bias springs for biasing said tappet assemblies into engagement with said cams, respectively, to cause said tappet assemblies and the connected pump plungers to reciprocate as said drive shaft is rotated.

85. The fuel pump assembly of claim 84, wherein said pump housing is an integral single piece structure including a head engaging surface for precisely positioning said pump head and tappet guiding surfaces within said pump cavities for guiding said tappets, respectively, said pump housing further including a radially enclosed drive shaft cavity having substantial radial openings only through said pump cavities, said pump housing including drive shaft support surfaces for precisely supporting said drive shaft, said pump housing requiring close tolerance machining of only said head engaging surface, said tappet guiding surfaces and said drive shaft support surfaces to provide suitable alignment of said pump chambers with respect to said tappets and said drive shaft.

86. The fuel pump assembly of claim 85, wherein said pump housing is formed by metal casting procedures.

87. An accumulator for use in a high pressure fuel system for temporarily storing fuel at a predetermined operating pressure to supply fuel for periodic injection into the corresponding engine cylinder of a plural cylinder internal combustion engine having a predetermined operating range and a plurality of engine pistons mounted for reciprocal movement within the engine cylinders, comprising a high strength, compact accumulator housing containing a fluidically interconnected labyrinth of accumulator chambers whose aggregate volume is sufficient to allow a controlled quantity of fuel at the predetermined operating pressure to be delivered to each engine cylinder at appropriate times throughout the entire operating range of the engine, said accumulator housing being formed of an integral one piece block containing said labyrinth of accumulator chambers shaped and positioned to form surrounding walls sufficiently strong to withstand the forces generated when said accumulator chambers are filled with fuel at the predetermined operating pressure, said accumulator chambers being positioned to intersect a vertical plane through said accumulator housing in at least a two dimensional array.

88. The accumulator as defined in claim 87, wherein said accumulator chambers are formed by boring said one piece block, and wherein said accumulator includes a plurality of separate plugs for sealing said accumulator chambers respectively.

89. The accumulator as defined by claim 88, wherein the aggregate volume of said accumulator chambers is sufficient to limit the drop in fuel pressure within said accumulator throughout the entire operating range of the engine to no more than approximately 5%–10% of said predetermined operating pressure.

90. The accumulator of claim 87, wherein said accumulator block walls are sufficiently strong to allow said accumulator chambers to hold fuel at a predetermined pressure above 5,000 psi.

91. The accumulator of claim 90, wherein said accumulator block walls are sufficiently strong to allow said accumulator chambers to hold fuel at a predetermined pressure above 20,000 psi.

92. The accumulator of claim 90, wherein said accumulator chambers are elongated and cylindrical in shape and are connected by connecting passages.

93. The accumulator of claim 92, wherein said accumulator chambers are positioned adjacent, and oriented in generally parallel relationship, to each other.

94. The accumulator of claim 93, wherein said two dimensional array includes an upper row of a plurality of said accumulator chambers and a lower row of a plurality of said accumulator chambers.

95. The accumulator of claim 94, wherein said accumulator chambers are fluidically interconnected by a first cross passage which intersects an upper row of accumulator chambers and a second cross passage which intersects a lower row of accumulator chambers.

96. The accumulator of claim 95, wherein said upper row includes four accumulator chambers and said lower row includes three accumulator chambers.

97. The accumulator of claim 96, wherein accumulator means includes a plurality of plugs located at the ends of respective accumulator chambers to seal fluidically the ends of said accumulator chambers.

98. The accumulator of claim 104, adapted to be mounted on a pump housing of a fuel pump which is adapted to supply fuel above said predetermined operating pressure, wherein said accumulator housing includes plural pump recesses, said accumulator further including plural pump units received in said pump recesses, respectively, and supported by said accumulator housing, each said pump unit recess being fluidically connected with said accumulator chambers.

99. The accumulator of claim 98, wherein said accumulator housing contains at least one common fuel feed passage for supplying fuel to all of said pump units and a plurality of fuel feed branches extending between said common fuel feed passage and said pump unit recesses, respectively, each said fuel feed branch communicating at one end with said corresponding pump unit recess and communicating at the other end with said common fuel feed passage.

100. The accumulator of claim 99, further including a plurality of pump unit control valves associated with said fuel feed branches, respectively, to control the flow of fuel through the corresponding fuel feed branches in response to a pump unit control signal to control the amount of fuel pumped into said accumulator means by the corresponding pump unit.

101. The accumulator of claim 98, further including pressure sensing means for determining the pressure within said accumulator chambers and a pump unit valve control means for generating said pump unit control signal for each said pump unit control valve to maintain the pressure of fuel in said accumulator chambers at the predetermined operating pressure.

102. The accumulator of claim 100, wherein said accumulator housing contains an accumulator drain passage communicating with each said pump unit recess and with said common fuel feed passage, each said pump unit includes a pump unit drain means for directing fuel leaked from said pump unit into said accumulator drain passage, each said pump unit drain means further including a recess clearance formed between the corresponding said pump unit and the corresponding pump unit recess, each said recess clearance communicating with the corresponding accumulator drain passage.

103. The accumulator of claim 101, wherein each said pump unit includes a check valve to permit only one way flow of fuel from said pump unit into said accumulator chambers, each said pump unit check valve further including a check valve element adapted to be biased into a closed position by the pressure of fuel within said accumulator chambers until the pressure of fuel within the corresponding pump chamber exceeds the pressure within said accumulator chambers at which time said check valve element is caused to open to allow fuel to flow from the corresponding pump chamber into said accumulator chambers.

104. The accumulator of claim 98, wherein said accumulator housing further contains a plurality of check valve recesses associated with said pump unit recesses, respectively, for forming a fluidic passage between said pump unit recesses and said accumulator chambers, each said check valve recess being adapted to receive a check valve for permitting only one way flow of fuel from the corresponding pump unit into said accumulator chambers.

105. The accumulator of claim 100, wherein said accumulator housing further includes a plurality of control valve recesses within which the pump unit control valves are adapted to be mounted.

106. The accumulator of claim 105, wherein the central axis of said pump control valve recesses are parallel and are oriented to intersect an extension of the central axis of one of said accumulator chambers.

107. The accumulator of claim 105, wherein said upper row of accumulator chambers extend along substantially the entire length of said accumulator housing and said lower row of accumulator chambers are substantially shorter than the entire length of said accumulator, said pump unit recesses being positioned in alignment with an extension of the central axis of one of said accumulator chambers forming said lower row.

108. The accumulator of claim 107, further including pressure sensing means for determining the pressure within said accumulator chambers and a pump unit valve control means for generating said pump unit control signal for each said pump unit control valve to maintain the pressure of fuel in said accumulator chambers at the predetermined operating pressure.

109. The accumulator of claim 108, wherein said accumulator housing contains an accumulator drain passage communicating with each said pump unit recess and with said common fuel feed passage to receive fuel leaked from the pump unit into said pump unit recess for return back to said common fuel feed passage.

110. An accumulator for use in a high pressure fuel system for temporarily storing fuel at a predetermined operating pressure to supply fuel for periodic injection into the corresponding engine cylinder of a plural cylinder internal combustion engine having a predetermined operating range and a plurality of engine pistons mounted for reciprocal movement within the engine cylinders, comprising a high strength, compact accumulator housing containing a fluidically interconnected labyrinth of accumulator chambers whose aggregate volume is sufficient to allow a controlled quantity of fuel at the predetermined operating pressure to be delivered to each engine cylinder at appropriate times throughout the entire operating range of the engine, said accumulator housing being formed of an integral one piece block containing said labyrinth of accumulator chambers shaped and positioned to form surrounding walls sufficiently strong to withstand the forces generated when said accumulator chambers are filled with fuel at the predetermined operating pressure wherein said accumulator is formed from SAE 4340 or Aermet 100.

111. A unitized fuel pump assembly for sequential periodic injection of fuel through plural fuel injection lines into corresponding engine cylinders of a plural cylinder internal combustion engine having a predetermined operating range and a plurality of reciprocating pistons associated with the corresponding cylinders, comprising:

pump means for pressurizing fuel, said pump means including a pump housing and a drive shaft mounted within said housing for rotation about a rotational axis, said pump housing containing a plurality of pump cavities positioned along said rotational axis, said pump cavities being aligned along said rotational axis in a single radial direction;

accumulator means for accumulating and temporarily storing fuel under pressure received from said pump means, said accumulator means including an accumulator housing mounted on said pump housing in a position which is separated from said drive shaft cavity by said pump cavities;

a fuel distributor means for providing sequential periodic fluidic communication between said accumulator means and each of the engine cylinders through the corresponding fuel injection lines associated with the corresponding engine cylinders for causing periodic injection of fuel into the corresponding engine cylinder, said fuel distribution means including a distributor housing mounted on said pump housing adjacent one end of said drive shaft cavity, and injection control valve means for controlling the timing and quantity of fuel injected into each cylinder in response to engine operating conditions, said injection control valve means including a solenoid operator mounted on said distributor housing oriented generally in the same radial direction as said pump cavities relative to said rotational axis of said drive shaft.

112. The fuel pump assembly of claim 111, wherein said distributor housing includes a rotor bore and a set of receiving ports adapted to communicate with a corresponding set of fuel injection lines, respectively, said set of receiving ports opening into said rotor bore at circumferentially spaced apart locations within a distribution plane perpendicular to the central axis of said rotor bore, and wherein said distributor means includes a rotor adapted to be mounted for rotation within said rotor bore, said rotor containing an axial supply passage fluidically connected to receive fuel from said accumulator means, said rotor also containing a radial supply passage located within said distribution plane and rotor drive connection means for connecting said rotor to said pump drive shaft in a manner to cause said radial supply passage to align sequentially and successively with said receiving ports to supply fuel periodically to the corresponding engine cylinders as necessary for engine operation.

113. The fuel pump assembly of claim 112, further including a fuel feed line for fluidically connecting said axial supply passage to said accumulator means, said distributor housing containing a feed port for supplying fuel from said accumulator to said rotor bore, said feed port being located in a supply plane which is perpendicular to the rotational axis of said rotor and is axially spaced from said distributor plane, said rotor containing a radial receiving passage axially positioned within said supply plane and connected with said axial supply passage in said rotor.

114. The fuel pump assembly of claim 113, wherein said distributor housing contains a distributor housing drain port located at one end of said rotor bore for communication with a low pressure fuel drain, said rotor contains a first axial drain passage fluidically connected to said distributor housing drain port, said rotor further containing a first radial drain passage communicating with said axial drain passage.

115. The fuel pump assembly of claim 114, wherein said rotor is coupled to said drive shaft at the end of said rotor opposite said distributor housing drain port, said distributor housing having a seal recess surrounding the end of said rotor adjacent the drive shaft coupling, and wherein said distributor means further includes a fuel seal located within said seal recess.

116. The fuel pump assembly of claim 115, wherein said receiving ports are circumferentially spaced equal angularly around said rotor to maximize the space between said receiving ports.

117. The fuel pump assembly of claim 116, further including a supply groove contained in one of said rotor and said rotor bore, said supply groove being positioned in said supply plane to communicate at all times with said radial receiving passage of said rotor and said fuel feed line.

118. The fuel pump assembly of claim 113, wherein said injection control valve means is arranged to control the flow of fuel through said fuel feed line, said first solenoid injection control valve being a three way valve operable when energized to connect said axial supply passage of said rotor with said accumulator means and operable when de-energized to connect said axial supply passage of said rotor with a low pressure drain, wherein said distributor housing includes an elongated first valve cavity for receiving said first injection control valve.

119. The fuel pump assembly of claim 118, wherein said injection control valve means includes a second injection control valve mounted on said distributor housing and arranged to control the flow of fuel through the fuel feed line in parallel with said first injection control valve, said second solenoid injection control valve being a three way valve operable when energized to connect said axial supply passage of said rotor with said accumulator means and operable when de-energized to connect said axial supply passage of said rotor with a low pressure fuel drain, said distributor housing contains a second valve cavity having a central axis parallel to the central axis of said first valve cavity, said central axes residing within said supply plane containing said radial supply passage supplying fuel to said axial supply passage of said rotor, said first and second valve cavities being positioned on opposite sides of said rotor.

120. The fuel pump assembly of claim 119, wherein said first and second valve cavities are interconnected by a rotor feed bore having a central axis located in said supply plane, said feed port for said rotor cavity being fluidically connected with said rotor feed bore, said distributor means including a two way check valve located within said rotor feed bore to prevent fuel supplied from one said three way valve into said rotor feed bore to flow into the drain groove of the other three way valve.

121. A unitized, single piece fuel pump housing for a fuel pump assembly having a rotatable camshaft for causing a plurality of pump plungers to reciprocate in response to the reciprocating movement of a plurality of camshaft engaging tappets, comprising a pump housing containing a plurality of outwardly opening pump cavities and a radially enclosed cam shaft cavity communicating with said pump cavities, said cam shaft cavity adapted to receive a rotatable cam shaft, a pump head engaging surface formed on said pump body for precisely positioning a pump head to allow the outwardly opening pump cavities to be closed when a pump head is mounted on said pump body, and a plurality of tappet guiding surfaces within said pump cavities for guiding the tappets, said head engaging surface and said tappet guiding surfaces being machined to closer tolerances than the remainder of said pump cavities.

122. The fuel pump housing of claim 121, wherein said pump body is formed by metal casting procedures.

123. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a pump means for pressurizing fuel above the predetermined pressure;

an accumulator means for accumulating and temporarily storing fuel at high pressure received from said pump means;

a fuel distributor means fluidically connected with said accumulator means through said fuel transfer circuit for enabling sequential periodic fluidic communication with the engine cylinders through the corresponding fuel injection lines;

a solenoid operated injection control valve positioned within said fuel transfer circuit between said accumulator means and said fuel distributor means for controlling the fuel injected into each engine cylinder during each of the sequential periods of communication enabled by said fuel distributor means to thereby define sequential injection events, said solenoid operated injection control valve movable between an open position permitting fuel flow from said accumulator means to said fuel distributor means and a closed position blocking fuel flow from said accumulator means to said fuel distributor means; and a rate shaping control means positioned within said fuel transfer circuit between said accumulator means and said fuel distributor means for producing a predetermined time varying change in the pressure of fuel during each injection event occurring sequentially at each engine cylinder to effect injection.

124. The high pressure fuel system of claim 123, wherein said rate shaping control means includes a flow limiting means positioned within said fuel transfer circuit between said accumulator means and said fuel distributor means for limiting the flow of fuel from said accumulator to said fuel distributor means during only a portion of each of said sequential injection events.

125. The high pressure fuel system of claim 124, wherein said rate shaping control means further includes a by-pass passage for directing fuel flow around said flow limiting means and a rate shaping by-pass valve positioned within said by-pass passage, said rate shaping by-pass valve movable into a closed position blocking fuel flow through said by-pass passage and an open position permitting flow through said by-pass passage.

126. The high pressure fuel system of claim 125, wherein said flow limiting means includes a fixed orifice having a constant cross-sectional flow area for restricting fuel flow through said fuel transfer circuit.

127. The high pressure fuel system of claim 125, wherein said flow limiting means includes a variable flow control valve movable between a first position permitting fuel to flow through said fuel transfer circuit at a first flow rate and a second position permitting fuel to flow through said fuel transfer circuit at a second flow rate.

128. The high pressure fuel system of claim 127, wherein said first flow rate occurs during a first portion of each said injection event and said second flow rate occurs during a second portion of each said injection event following said first portion, said first flow rate being greater than said second flow rate.

129. The high pressure fuel system of claim 128, wherein movement of said rate shaping by-pass valve to said open position permits fuel to flow through said fuel transfer circuit at a third flow rate, said third flow rate being greater than said second flow rate, said third flow rate occurring during a third portion of each injection event following said second portion.

130. The high pressure fuel system of claim 128, wherein said variable flow control valve includes a slidable piston having first and second ends, a central bore having an inner end and an outer end, said outer end opening to said first end of said slidable piston, said slidable piston including a plurality of orifices extending from said inner end of said central bore through said second end.

131. The high pressure fuel system of claim 130, wherein said variable flow control valve includes a biasing spring operatively connected to said slidable piston for biasing said slidable piston towards said first position.

132. The high pressure fuel system of claim 131, wherein said slidable piston is mounted within a cavity arranged to cause said slidable piston to move towards said second position whenever the upstream pressure exceeds the downstream pressure by a predetermined amount.

133. The high pressure fuel system of claim 123, wherein said rate shaping control means permits fuel pressure in a respective fuel injection line adjacent the respective engine cylinder to increase prior and during each said injection event at a first high rate followed by a low rate less than said first high rate followed by a second high rate.

134. The high pressure fuel system of claim 123, wherein said rate shaping control means includes a variable flow control valve movable between a first position effecting said first high pressure rate and a second position effecting said low pressure rate.

135. The high pressure fuel system of claim 123, wherein fuel from said accumulator means is capable of reaching a maximum unrestricted flow rate corresponding to a maximum pressure in each of said fuel injection lines adjacent the respective engine cylinder during said injection event, said fuel transfer circuit including a first passage extending between said accumulator means and said injection control valve, said injection rate control means including said first passage, said first passage having a predetermined length sufficient to cause a predetermined time delay between the movement of said solenoid operated injection control valve to the open position and the attainment of said maximum pressure.

136. The high pressure fuel system of claim 135, wherein movement of said solenoid operated injection control valve to said open position creates a pressure wave in said fuel transfer circuit, the pressure wave traveling from said solenoid operated injection control valve to an engine cylinder to define a wave traveling time period, wherein said predetermined length of said first passage is selected to provide a desired wave traveling time period.

137. The high pressure fuel system of claim 135, wherein said injection rate control means further includes a second passage positioned in parallel to said first passage for directing flow from said accumulator means to said injection control valve, and an orifice positioned in said second passage.

138. The high pressure fuel system of claim 137, wherein said rate shaping control means permits fuel pressure in one of said fuel injection lines adjacent a respective engine cylinder to increase during each said injection event at a first high rate followed by a low rate less than said first high rate followed by a second high rate, said orifice having an effective cross sectional flow area for slowing said first high rate and said low rate to desired levels.

139. The high pressure fuel system of claim 123, wherein said rate shaping control means is positioned with said fuel transfer circuit between said accumulator means and said solenoid operated injection control valve, further including a cavitation control means for minimizing cavitation in said fuel transfer circuit between said cavitation control means and the cylinders, said cavitation control means including a reverse flow restrictor valve positioned within said fuel transfer circuit between said injection control valve and said fuel distributor means for allowing for at least a predetermined time period substantially unimpeded forward flow of fuel toward each engine cylinder while substantially restricting reverse flow.

140. The high pressure fuel system of claim 123, further including a cavitation control means for minimizing cavitation in said fuel transfer circuit and the fuel injection lines between said injection control valve and the engine cylinders, said cavitation control means operable to maintain fuel in said fuel transfer circuit downstream of said fuel distributor means, said cavitation control means including an auxiliary fuel supply connected to said drain passage for supplying pressurized fuel at an auxiliary supply pressure to said fuel transfer circuit downstream of said injection control valve when said injection control valve is in said closed position, wherein said auxiliary supply pressure is high enough to minimize the effects of cavitation while low enough to cause no fuel injection.

141. The high pressure fuel system of claim 123, further including a drain passage for connection to said fuel transfer circuit, said injection control valve being operable to connect said fuel transfer circuit to said drain passage to define a draining event, further including a cavitation control means for minimizing cavitation in said fuel transfer circuit and the fuel injection lines between said injection control valve and the engine cylinders, said cavitation control means including a pressure regulating means positioned in said drain passage for maintaining fuel in said fuel transfer circuit downstream of said injection control valve and in the fuel injection lines at a regulated pressure during said draining event.

142. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a pump means for pressurizing fuel above the predetermined pressure, said pump means including plural pump chambers and plural pump plungers mounted for reciprocal movement in said pump chambers;

a constant volume high pressure accumulator means for accumulating and temporarily storing fuel at high pressure received from said pump means;

a fuel distributor means fluidically connected with said constant volume high pressure accumulator means through said fuel transfer circuit for enabling sequential periodic fluidic communication with the engine cylinders through the corresponding fuel injection lines;

an injection control valve means for controlling the fuel injected into each engine cylinder during each of the sequential periods of communication enabled by said fuel distributor means to thereby define sequential injection events; and a rate shaping control means positioned within said fuel transfer circuit between said constant volume high pressure accumulator means and said fuel distributor means for producing a predetermined time varying change in the rate of fuel injected into each engine cylinder during said sequential injection events.

143. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a pump means for pressurizing fuel from said fuel supply means above the predetermined pressure;

a fuel distributor means fluidically connected with said pump means through said fuel transfer circuit for enabling sequential periodic fluidic communication with the engine cylinders through the corresponding fuel injection lines;

an injection control means for controlling the fuel injected into each engine cylinder during each of the sequential periods of communication enabled by said fuel distributor means to thereby define sequential injection events; and a rate shaping control means positioned within said fuel transfer circuit between said pump means and said fuel distributor means for producing a predetermined time varying change in the rate of fuel injected into each engine cylinder during said sequential injection events, wherein said rate shaping control means includes a flow limiting means positioned within said fuel transfer circuit between said pump means and said fuel distributor means for limiting the flow of fuel from said pump means to said fuel distributor means during each of said sequential injection events, a by-pass passage for directing fuel flow around said flow limiting means and a rate shaping by-pass valve positioned within said by-pass passage.

144. The high pressure fuel system of claim 143, wherein said rate shaping by-pass valve is movable into a closed position blocking fuel flow through said by-pass passage and an open position permitting flow through said by-pass passage.

145. The high pressure fuel system of claim 144, wherein said flow limiting means includes a fixed orifice having a constant cross-sectional flow area for restricting fuel flow through said fuel transfer circuit.

146. The high pressure fuel system of claim 144, wherein said flow limiting means includes a variable flow control valve movable between a first position permitting fuel to flow through said fuel transfer circuit at a first flow rate and a second position permitting fuel to flow through said fuel transfer circuit at a second flow rate.

147. The high pressure fuel system of claim 144, further including an accumulator means positioned along said fuel transfer circuit between said pump means and said injection control means for accumulating and temporarily storing fuel at high pressure received from said pump means.

148. The high pressure fuel system of claim 144, wherein said injection control means includes a three-way solenoid operated valve positioned along said fuel transfer circuit between said pump means and said distributor means, said rate shaping control means being positioned within said fuel transfer circuit between said three-way solenoid operated valve and said fuel distributor means.

149. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a pump means for pressurizing fuel above the predetermined pressure;

an accumulator means for accumulating and temporarily storing fuel at high pressure received from said pump means;

a fuel distributor means fluidically connected with said accumulator means through said fuel transfer circuit for enabling sequential periodic fluidic communication with the engine cylinders through the corresponding fuel injection lines;

an solenoid operated injection control valve positioned within said fuel transfer circuit between said accumulator means and said fuel distributor means for controlling the fuel injected into each engine cylinder during each sequential periods of communication enabled by said fuel distributor means;

a cavitation control means for minimizing cavitation in said fuel transfer circuit between said cavitation control means and the cylinders, said cavitation control means including a reverse flow restrictor valve positioned within said fuel transfer circuit between said injection control valve and said fuel distributor means for allowing substantially unimpeded forward flow of fuel toward each engine cylinder while substantially restricting reverse flow.

150. The high pressure fuel system of claim 149, further including a drain passage for connection to said fuel transfer circuit, wherein said solenoid operated injection control valve is movable between an open position allowing fuel flow from said accumulator means to said fuel distributor means and a closed position blocking flow from said accumulator means while fluidically connecting said drain passage to said fuel transfer circuit downstream of said solenoid operated injection control valve, said reverse flow restrictor valve being operable to permit substantially unrestricted fuel flow from said solenoid operated injection control valve to said fuel distributor when said solenoid operated injection control valve is in said open position and to restrict fuel flowing from said fuel distributor toward said solenoid operated injection control valve when said solenoid operated injection control valve is in said closed position.

151. The high pressure fuel system of claim 150, wherein said fuel distributor means includes a distributor housing and further including a injection control valve housing for housing said solenoid operated injection control valve, said injection control valve housing mounted in abutment with said distributor housing to form a cavity for receiving said reverse flow restrictor valve.

152. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a drain passage for connection to said fuel transfer circuit;

a high pressure pump means for pressurizing fuel above the predetermined pressure;

a fuel distributor means fluidically connected with said high pressure pump means through said fuel transfer circuit for enabling sequential periodic fluidic communication with the engine cylinders through the corresponding fuel injection lines;

an injection control valve positioned within said fuel transfer circuit between said high pressure pump means and said fuel distributor means for controlling the fuel injected into each engine cylinder during each of the sequential periods of communication enabled by said fuel distributor means to thereby define sequential injection events, said injection control valve is movable between an open position allowing fuel flow from said high pressure pump means to said fuel distributor means and a closed position blocking flow from said high pressure pump means while fluidically connecting said drain passage to said fuel transfer circuit downstream of said injection control valve;

a cavitation control means for minimizing cavitation in said fuel transfer circuit and the fuel injection lines between said injection control valve and the engine cylinders, said cavitation control means operable to maintain fuel in said fuel transfer circuit downstream of said fuel distributor means, said cavitation control means including an auxiliary fuel supply connected to said drain passage for supplying pressurized fuel at an auxiliary supply pressure to said fuel transfer circuit downstream of said injection control valve when said injection control valve is in said closed position, wherein said auxiliary supply pressure is high enough to minimize the effects of cavitation while low enough to cause no fuel injection.

153. The high pressure fuel system of claim 152, further including an accumulator means positioned along said fuel transfer circuit between said high pressure pump means and said injection control valve for accumulating and temporarily storing fuel at high pressure received from said high pressure pump means.

154. The high pressure fuel system of claim 149, wherein said fuel distributor means includes a distributor housing containing a rotor bore and a distributor rotor mounted for rotation in said rotor bore, said cavitation control means including a refill means for refilling the plural injection lines, said refill means including a boost pump means for supplying fuel at a boost pressure to said pump means, a boost pump outlet passage fluidically connecting said boost pump means to said pump means, and a refill port formed in said distributor rotor and continuously fluidically connected to said boost pump outlet passage, rotation of said distributor rotor causing said refill port to periodically fluidically connect said boost pump outlet passage to each of the plural injection lines so as to maintain fuel in the plural injection lines at boost pressure.

155. A high pressure fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a drain passage for connection to said fuel transfer circuit;

a high pressure pump means for pressurizing fuel above the predetermined pressure;

a fuel distributor means fluidically connected with said high pressure pump means through said fuel transfer circuit for enabling sequential periodic fluidic communication with the engine cylinders through the corresponding fuel injection lines;

an injection control valve positioned within said fuel transfer circuit between said high pressure pump means and said fuel distributor means for controlling the fuel injected into each engine cylinder during each of the sequential periods of communication enabled by said fuel distributor means, wherein said injection control valve is movable between an open position allowing fuel flow to said fuel distributor means and a closed position blocking flow from said accumulator means while fluidically connecting said drain passage to said fuel transfer circuit downstream of said injection control valve, wherein movement of said injection control valve from said open position to said closed position and from said closed position to said open position defines a draining event and movement of said injection control valve from said closed position to said open position and from said open position to said closed position defines an injection event;

a cavitation control means for minimizing cavitation in said fuel transfer circuit and the fuel injection lines between said injection control valve and the engine cylinders, said cavitation control means including a pressure regulating means positioned in said drain passage for maintaining fuel in said fuel transfer circuit downstream of said injection control valve and in the fuel injection lines at a regulated pressure during said draining event.

156. The high pressure fuel system of claim 155, further including an accumulator means positioned along said fuel transfer circuit between said high pressure pump means and said injection control valve for accumulating and temporarily storing fuel at high pressure received from said high pressure pump means.

157. The high pressure fuel system of claim 156, further including a refill passage fluidically connected at one end to said drain passage between said injection control valve and said pressure regulating means and at an opposite end to said fuel distributor means, wherein said fuel distributor means further functions to periodically fluidically connect said refill passage to the plural injection lines so as to maintain fuel in the plural injection lines at said regulated pressure.

158. The high pressure fuel system of claim 157, wherein said pressure regulating means includes a cylinder including a first end and a second end, a piston slidably mounted in said cylinder and a biasing means for biasing said piston toward said first end to force fuel into said refill passage.

159. The high pressure fuel system of claim 158, wherein said biasing means includes a coil spring positioned in abutment with said piston adjacent said second end of said cylinder.

160. The high pressure fuel system of claim 158, wherein said biasing means includes a supply of pressurized biasing fluid.

161. The high pressure fuel system of claim 160, wherein said supply of pressurized biasing fluid is accumulator fuel.

162. The high pressure fuel pump assembly of claim 1, wherein said fuel distributor means includes a plurality of injection line valves for controlling the flow of fuel to corresponding cylinders through corresponding fuel injection lines, each of said injection line valves including a slide valve element reciprocally mounted in said distributor housing.

163. The high pressure fuel pump assembly of claim 162, wherein said fuel distributor means further includes a distributor camshaft rotationally mounted in said distributor housing, said distributor camshaft including at least one cam for causing said distributor slide valve elements to reciprocate as said distributor camshaft is rotated, wherein said slide valves are mounted for reciprocal movement along axial lines, respectively, that are parallel to the rotational axis of said distributor camshaft.

164. The high pressure fuel pump assembly of claim 163, wherein each of said plurality of slide valve elements is movable into an open position to define a respective fuel injection period during which high pressure fuel may flow to the respective engine cylinder via the respective fuel injection line and a closed position blocking fuel flow through said respective fuel injection line, each of said plurality of injection line valves being of the spool-type including a land formed on said slide valve element for blocking fuel flow when said respective injection line valve is in said closed position.

165. The high pressure fuel pump assembly of claim 164, wherein said slide valve element includes a cylindrical portion having a first end and a second end, an annular groove formed in said cylindrical portion adjacent said land for permitting fuel to flow to the engine cylinders when said respective injection line valve is in said open position, further including a biasing means positioned adjacent said first end for biasing said second end into abutment with said at least one cam.

166. The high pressure fuel pump assembly of claim 11, further including a distributor housing mounted on said pump housing, said fuel distributor means including a plurality of injection line valves for controlling the flow of fuel to corresponding cylinders through corresponding fuel injection lines, each of said injection line valves including a slide valve element reciprocally mounted in said distributor housing.

167. The high pressure fuel pump assembly of claim 166, wherein said fuel distributor means further includes a distributor camshaft rotationally mounted in said distributor housing, said distributor camshaft including at least one cam for causing said distributor slide valve elements to reciprocate as said distributor camshaft is rotated.

168. The high pressure fuel pump assembly of claim 167, wherein each of said plurality of slide valve elements is movable into an open position to define a respective fuel injection period during which high pressure fuel may flow to the respective engine cylinder via the respective fuel injection line and a closed position blocking fuel flow through said respective fuel injection line, each of said plurality of injection line valves being of the spool-type including a land formed on said slide valve element for blocking fuel flow when said respective injection line valve is in said closed position.

169. The high pressure fuel pump assembly of claim 168, wherein said slide valve element includes a cylindrical portion having a first end and a second end, an annular groove formed in said cylindrical portion adjacent said land for permitting fuel to flow to the engine cylinders when said respective injection line valve is in said open position, further including a biasing means positioned adjacent said first end for biasing said second end into abutment with said at least one cam.

170. The fuel pump assembly of claim 82, wherein said pump head forms at least a partial end wall for said pump chamber, said pump chamber being positioned immediately adjacent said pump head.

171. The fuel pump assembly of claim 82, wherein said pump barrel is a one piece structure including an inner end positioned in abutment with said pump head.

172. The fuel pump assembly of claim 171, wherein said pump barrel includes a pump inlet passage adapted to communicate with a source of fuel for feeding fuel into said pump chamber and a pump outlet passage through which fuel may be discharged from said pump chamber and wherein said pump unit includes a pump unit check valve mounted at least partially within said pump outlet passage for permitting only one way flow of fuel from said pump chamber through said pump outlet passage, said pump unit check valve including a check valve seat formed on said pump barrel.

173. The fuel pump assembly of claim 170, wherein said pump head includes a pump inlet passage adapted to communicate with a source of fuel for feeding fuel into said pump chamber and a pump outlet passage through which fuel may be discharged from said pump chamber and further including a pump unit check valve mounted within said pump outlet passage for permitting only one way flow of fuel from said pump chamber through said pump unit outlet passage, said pump unit check valve including a check valve seat formed on said pump head.

174. The fuel pump assembly of claim 82, wherein said pump head includes a delivery passage for receiving high pressure fuel from said pumping chamber, said pump barrel including an inner end positioned in abutment with said pump head to form a high pressure joint exposed to high pressure fuel delivered from said pump chamber to said delivery passage, said high pressure joint being the only joint positioned between said pumping chamber and said delivery passage exposed to high pressure fuel.

175. The fuel pump assembly of claim 83, further including a plurality of pump unit control valves associated with said pump chambers, respectively, for controlling the amount of high pressure fuel pumped out of the corresponding pump chamber by a corresponding pump plunger, and a valve cavity formed in each of said pump barrels, each of said plurality of pump unit control valves including a control valve element mounted for reciprocal movement in a respective valve cavity.

176. The fuel pump assembly of claim 175, wherein each of said plurality of pump unit control valves includes an annular valve seat formed on the corresponding pump barrel in said valve cavity.

177. The fuel pump assembly of claim 176, wherein each said pump chamber extends through the corresponding pump barrel along a radial pump axis and opens into the corresponding valve cavity, said valve cavity extending diametrically through said pump barrel substantially perpendicular to said radial pump axis.

178. The fuel pump assembly of claim 177, wherein each said replaceable pump unit includes a pump unit inlet communicating with a source of fuel for feeding fuel into said pump chamber and a pump unit outlet, wherein said pump unit includes a pump unit check valve for permitting only one way flow of fuel from the pump chamber through said pump unit outlet, said control valve element positioned along said radial pump axis between said pump chamber and said pump unit check valve.

179. The fuel pump assembly of claim 178, wherein said control valve element is movable between an open position permitting fuel flow from the corresponding pump chamber and a closed position blocking fuel flow from said pump chamber through said pump unit outlet, said control valve element being pressure balanced in the closed position.

180. The fuel pump assembly of claim 82, further including an accumulator means containing at least one accumulator chamber for accumulating and temporarily storing fuel at high pressure received from said pump chamber, wherein said accumulator means includes an accumulator housing and at least one accumulator chamber formed in said accumulator housing, said accumulator housing being positioned a spaced distance from said pump head.

181. A fuel pump assembly, comprising a pump housing containing an outwardly opening pump cavity, a pump head mountable on the pump housing to close the outwardly opening pump cavity, said pump head containing a pump unit recess positioned to communicate with the pump cavity, a pump unit mounted within said pump unit recess, said pump unit including a pump barrel containing a pump chamber and a pump plunger adapted to be mounted for reciprocal movement within said pump chamber, said pump barrel containing a valve cavity, and a variable displacement pump control valve means mounted in said valve cavity for varying the effective displacement of said pump unit in response to a variable displacement control signal.

182. The fuel pump assembly of claim 181, wherein said pump housing includes a plurality of said outwardly opening pump cavities, said pump head containing a plurality of said pump unit recesses positioned to communicate with said pump cavities, respectively, and further including a plurality of said pump units, each said pump unit including a pump barrel containing a pump chamber, a pump plunger mounted for reciprocation within said pump chamber when said drive shaft rotates and a retaining means for mounting said pump unit within a corresponding said pump unit recess of said pump head in a position to extend at least partially into said pump cavity in spaced apart non-contacting relationship with said pump housing.

183. The fuel pump assembly of claim 182, wherein said drive shaft includes a plurality of cams for causing said pump plungers to reciprocate, and further including a plurality of tappet assemblies associated with said pump units, respectively, each said tappet assembly being mounted for reciprocal movement within a corresponding pump cavity and being connected with a corresponding pump plunger, and a plurality of tappet bias springs for biasing said tappet assemblies into engagement with said cams, respectively, to cause said tappet assemblies and the connected pump plungers to reciprocate as said drive shaft is rotated.

184. The fuel pump assembly of claim 183, wherein said pump housing is an integral single piece structure including a head engaging surface for precisely positioning said pump head and tappet guiding surfaces within said pump cavities for guiding said tappets, respectively, said pump housing further including a radially enclosed drive shaft cavity having substantial radial openings only through said pump cavities, said pump housing including drive shaft support surfaces for precisely supporting said drive shaft, said pump housing requiring close tolerance machining of only said head engaging surface, said tappet guiding surfaces and said drive shaft support surfaces to provide suitable alignment of said pump chambers with respect to said tappets and said drive shaft.

185. A fuel pump assembly, comprising a pump housing containing an outwardly opening pump cavity, a pump head mountable on the pump housing to close the outwardly opening pump cavity, said pump head containing a pump unit recess positioned to communicate with the pump cavity and a valve cavity having a central axis aligned with a central axis of said pump unit recess, a pump unit mounted within said pump unit recess, said pump unit including a pump barrel containing a pump chamber and a pump plunger adapted to be mounted for reciprocal movement within said pump chamber, and a variable displacement control valve means mounted in said valve cavity for varying the effective displacement of said pump unit in response to a variable displacement control signal.

186. The fuel pump assembly of claim 83, further including a plurality of pump unit control valves associated with said pump chambers, respectively, for controlling the effective displacement of each said associated pump plunger, said pump head including a first side for engaging said pump housing and a second side formed opposite said first side, said plurality of pump unit control valves mounted on said second side of said pump head directly opposite corresponding pump unit recesses.

187. A fuel pump assembly for supplying fuel to a multi-cylinder engine above a predetermined high pressure, comprising:

a pump housing containing an outwardly opening pump cavity, a drive shaft rotatably mounted in the pump housing, a single piece, integral pump head mountable on said pump housing to close said outwardly opening pump cavity, said integral pump head containing a pump chamber and at least one accumulator chamber for temporarily storing fuel under pressure received from said pump chamber;

a pump plunger adapted to be mounted for reciprocal movement within said pump chamber in response to rotation of said drive shaft; and distributor means for sequentially distributing fuel to said engine cylinders from said at least one accumulator chamber.

188. The fuel pump assembly of claim 187, wherein said pump head includes an integral pump barrel surrounding said pump chamber and extending into said outwardly opening pump cavity.

189. The fuel pump assembly of claim 188, wherein said pump housing includes a plurality of said outwardly opening pump cavities, said pump head containing a plurality of said integrally formed pump barrels, each of said integrally formed pump barrels containing a pump chamber, and further including a plurality of pump plungers mounted for reciprocation within said pump chambers, respectively, when said drive shaft rotates.

190. The fuel pump assembly of claim 189, wherein said drive shaft includes a plurality of cams for causing said pump plungers to reciprocate.

191. The fuel pump assembly of claim 190, further including a plurality of tappet assemblies associated with said pump units, respectively, each said tappet assembly being mounted for reciprocal movement within a corresponding pump cavity and being connected with a corresponding pump plunger, and a plurality of tappet bias springs for biasing said tappet assemblies into engagement with said cams, respectively, to cause said tappet assemblies and the connected pump plungers to reciprocate as said drive shaft is rotated.

192. The fuel pump assembly of claim 191, wherein said pump head includes a plurality of annular spring recesses formed around said integrally formed pump barrels for receiving a corresponding tappet bias spring.

* * * * *